US005839382A

United States Patent [19]

Tice et al.

[11] Patent Number: 5,839,382

[45] **Date of Patent: *Nov. 24, 1998**

[54] ELECTRONICALLY GEARED SEWING MACHINE

[75] Inventors: William A. Tice; Moshe Shloush; Mark E. Stapel, all of Knoxville; Gregory A. Davis, Maynardville, all of Tenn.

[73] Assignee: Tice Engineering and Sales, Inc., Knoxville, Tenn.

[ * ] Notice: The term of this patent shall not extend beyond the expiration date of Pat. No. 5,458,075.

[21] Appl. No.: 656,037

[22] Filed: May 24, 1996

Related U.S. Application Data

[63] Continuation-in-part of Ser. No. 517,712, Aug. 21, 1995, abandoned, which is a continuation of Ser. No. 306,708, Sep. 15, 1994, Pat. No. 5,458,075.

[51] Int. Cl.[6] ..... D05B 21/00; D05B 25/00

[52] U.S. Cl. ..... 112/470.04; 112/470.06; 112/155; 112/475.19; 112/475.25; 112/220

[58] Field of Search ..... 112/470.04, 470.06, 112/475.05, 475.25, 155, 220, 221, 273, 275, 278, 102.5, 456, 458, 457, 65, 68, 70

[56] References Cited

U.S. PATENT DOCUMENTS

| | | |
|---|---|---|
| 3,450,076 | 6/1969 | Bender . |
| 3,515,080 | 6/1970 | Ramsey . |
| 3,799,089 | 3/1974 | Tolle . |
| 3,977,339 | 8/1976 | Tice . |
| 3,984,745 | 10/1976 | Minalga . |

(List continued on next page.)

FOREIGN PATENT DOCUMENTS 8794499 of 0000 Canada .

OTHER PUBLICATIONS

"High Performance PC Bus Motion Controller," by Galil, Rev (1–94),Galil Motion Control, Inc., 575 Maude Court, Sunnyvale, CA 94086–2028.

"Compax M—System Description," by Hauser, 08.06.94 16:32, 192–040011 N8, Jun. 1994 (Hauser Motin Control, 2311 Highway 292, P.O. Box 38, Inman, South Carolina 29349).

"Dependability Without a Doubt," by Hauser, SNA–2000 Brochure (2 pages).

Hauser Quilter SNA 2000, Apparel Industry Magazine, Sep. 1993, p. 156.

Hauser Automation Inc., Apparel Industry Magazine, Sep. 1992, p. 140.

The Fastest Quilter in Half the Space—The New Hauser SNA 2000, Apparel Industry Magazine, Sep. 1992, p. 144.

Kaybematic III, Bobbin Magazine, Jun. 1992, p. 103.

*Primary Examiner*—Peter Nerbun

*Attorney, Agent, or Firm*—Luedeka, Neely & Graham P.C.

[57] ABSTRACT

This invention relates to a method and apparatus for electronically gearing the sewing parts of a sewing machine, and more particularly it relates to electronically gearing the bobbin to the needle to eliminate the necessity of their physical coupling through mechanical linkages and drive shafts. Servo motors provide torque to the needle, bobbin, and various other sewing parts of the sewing machine which require concerted movement. A computer uses servo motor positional information to calculate motion commands that are sent to the needle and bobbin servo motors, thereby enabling electronic gearing of the bobbin to the needle so that each moves substantially in unison. Motion commands sent to servo motors attached to various other sewing parts of the sewing machine are based on servo motor positional information to enable the sewing parts to move in concert with the needle and bobbin. Servo motors move the sewing material in two dimensions during stitching, and each move of the sewing material is calculated to consume the maximum amount of time available between stitches in order to dampen acceleration and deceleration of sewing parts and eliminate problems associated with machine jerk.

46 Claims, 11 Drawing Sheets

U.S. PATENT DOCUMENTS 4,215,639 8/1980 Johnson .
4,369,722 1/1983 Nishida et al. .
4,389,951 6/1983 Von Hagen .
4,459,925 7/1984 Miyachi et al. .
4,459,926 7/1984 Ohniwa .
4,467,737 8/1984 Breck, Jr. .
4,490,656 12/1984 Arnold .
4,503,788 3/1985 Giannuzzi et al. .
4,627,369 12/1986 Conrad et al. .
4,658,741 4/1987 Jehle et al. .
4,690,081 9/1987 Castagna et al. .
4,754,721 7/1988 Skogward .
4,815,404 3/1989 Ellerman et al. .
4,834,007 5/1989 Miyazaki et al. .
4,843,986 7/1989 Kozuka et al. .
4,849,902 7/1989 Yokoe et al. .
4,860,678 8/1989 Skogward .
4,867,080 9/1989 Taylor et al. .
4,936,232 6/1990 Monma .
4,943,906 7/1990 Tajima et al. .
4,955,305 9/1990 Garnier et al. .
4,981,091 1/1991 Taylor et al. .
4,989,527 2/1991 Off .
5,005,498 4/1991 Taylor et al. .
5,005,501 4/1991 Kita .
5,009,176 4/1991 Shigeta et al. .
5,016,550 5/1991 Horie et al. .
5,069,151 12/1991 Bellio ..... 112/278
5,074,232 12/1991 Matsubara et al. .
5,088,429 2/1992 Kanegae .
5,105,750 4/1992 Horie .
5,144,902 9/1992 Hirabayashi .
5,179,520 1/1993 Hayakawa .
5,189,971 3/1993 Frankel et al. .
5,199,365 4/1993 Arnold ..... 112/273
5,211,119 5/1993 Tagawa et al. .
5,227,976 7/1993 Hayakawa .
5,255,620 10/1993 Sasano et al. .
5,283,747 2/1994 Komuro et al. .
5,299,519 4/1994 Hirabayashi .
5,322,027 6/1994 Hashiride et al. .
5,383,412 1/1995 Sakakibara et al. .
5,474,001 12/1995 Tajima et al. ..... 112/470.06 X

ELECTRONICALLY GEARED SEWING MACHINE

This is a continuation in part of pending application Ser. No. 08/517,712 filed Aug. 21, 1995, now abandoned which is a continuation of application Ser. No. 08/306,708 filed Sep. 15, 1994, which issued as Pat. No. 5,458,075 on Oct. 17, 1995.

TECHNICAL FIELD

The present invention is directed to a sewing machine which utilizes positional information signals to electronically gear the motion of the needle with the motion of the bobbin and other sewing parts.

REFERENCE TO APPENDICES

Appendix A provides a 13 page computer program listing for the motion controller. The program is written in Basic.

Appendix B provides a 274 page listing of the user interface screens. The program is written in Visual Basic.

BACKGROUND OF THE INVENTION

Precision timing is required between the needle and bobbin movements of a sewing machine. In order to link the motion of the needle to that of the bobbin, conventional sewing machines use mechanical linkages, gears, drive shafts, timing belts, and other mechanisms to mechanically connect and mechanically gear the bobbin to the needle. An arm is used to position the needle above the bobbin, with the linkages between the needle and bobbin being routed through the arm. A single motor is typically used to drive both needle and bobbin by way of the mechanical gearing connecting them to each other.

Several disadvantages result from mechanically linking the needle and bobbin. The speed of the sewing machine is limited by the inertia and friction caused by the mechanical linkages. These mechanical linkages require constant lubrication. Reliability suffers from a system that employs so many moving parts. Additional power is required to accelerate and decelerate the mass of linkages. As a result, greater heat dissipation is required to prevent overheating. Noise levels are increased as a result of these moving mechanical parts. Finally, the ergonomic disadvantages associated with mechanically linking the needle and bobbin diminishes the sewing machine's versatility by limiting the mobility and location of the sewing head (needle and bobbin).

Attempts have been made to physically separate the needle and bobbin and to use separate electric motors to synchronize the needle with the bobbin. In U.S. Pat. No. 3,515,080, Ramsey discloses a sewing machine having physically separate needle and bobbin drive units that are purportedly synchronized. Stepper motors are disclosed as the drive units, and each drive unit is "electrically connected and operated in synchronism and in unison". However, Ramsey does not disclose a system or mechanism for electronically linking (gearing) the needle to the bobbin. Ramsey discloses in some detail a control system for moving the needle and bobbin laterally in the X-Y plane and for rotating them about the Z-axis, but there is little or no disclosure of how the needle and bobbin are driven or controlled for sewing (i.e., how the up and down motion of the needle and the rotation of the bobbin is controlled so that the bobbin hook engages and hooks the thread carried by the needle).

The prior art provides an inflexible approach to coordinating the needle and bobbin movements during sewing.

Whenever a needle type is changed, or the material thickness varies, or the bobbin is switched to a looper, a sewing parameter has been varied. Prior art machines are unable to automatically adjust to these changed parameters. Instead, prior art machines employing physically separate needle and bobbin must be manually reset to function within the new parameters.

SUMMARY OF THE INVENTION

The present invention aims to overcome the difficulties presented by the prior art by electronically gearing the motion of the needle to that of the bobbin with the use of positional information. By so doing, the present invention aims to eliminate any mechanical connections between the needle and bobbin, thereby improving efficiency, reliability, and versatility. Another object of the present invention is to reduce or eliminate the need for user intervention whenever a sewing parameter is changed. Another object of the present invention is to computerize sewing operations so that the movement of sewing parts and the setting of sewing parameters is controlled through software, and further, to allow a machine operator to electronically store sewing parameters for later recall. Another object of the present invention is to provide the ability to electronically adjust the position of the bobbin relative to the position of the needle. Another object of the present invention is to provide a skipped stitch detector. Another object of the present invention is to improve safety by continuous motor torque monitoring, and to enable the machine operator to easily adjust motor torque safety criteria. A still further object of the present invention is to provide the ergonomic advantage of being able to mount the sewing head wherever it is needed so that the sewing head may be presented to the material, and to provide the capability for multiple head applications.

Regarding the foregoing and other objects of the invention, the present invention provides an apparatus for forming a pattern of continuous stitches in a material by coordinating the movements of a plurality of operating parts. Each of the operating parts is moveable through a range of positions to form continuous stitches in the material. The operating parts are driven through their ranges of positions by a plurality of closed loop drive systems. Positional feedback for the closed loop drive systems is provided by monitors which produce monitor signals substantially continuously corresponding to the positions of the operating parts. The operating parts, drive systems, and monitors collectively comprise a first operating head. A data acquisition and control system, connected to each of the drive systems, receives the monitor signals and electronically gears the movements of the operating parts so that the parts move in concert with each other to form the pattern of continuous stitches. The data acquisition and control system includes at least one motion controller having multiple control axes that receive monitor signals from a plurality of the monitors, and for responding to the monitor signals by producing motion commands for each closed loop drive system. Control of the apparatus is provided by a user interface connected to the data acquisition and control system.

Several optional features of the apparatus are provided to enhance its useability. The data acquisition and control system may be operable to allow a user to electronically adjust the position of an operating part relative to the position of another operating part. The data acquisition and control system may also include electronic memory for storage of at least one stitch pattern. If a desired stitch pattern is not currently stored within memory, the user may design and input the desired stitch pattern through the user interface. The data acquisition and control system may be further operable to electronically gear movements of the operating parts in accordance with a speed and acceleration profile that optimizes performance of the apparatus for particular applications. To further optimize sewing operations, the user can define various sewing parameter values and store them for later retrieval.

The present invention also provides a method for forming a pattern of continuous stitches in a material where the movements of a plurality of operating parts are coordinated to form the pattern of stitches. The method includes the steps of producing monitor signals that correspond to the positions of the operating parts. The monitor signals, which are directed to a multiple axis controller, are monitored to determine the positions of the operating parts. Motion commands are generated by the controller to coordinate movement of the operating parts during formation of the stitch pattern. The motion commands are directed to mechanisms associated with the operating parts so that the operating parts move in concert with each other to form the pattern of continuous stitches.

As an optional step in the method, an alarm condition, such as blockage of one of the operating parts, is identified when the position of an operating part meets defined alarm criteria. When an alarm condition is identified, corrective action may be taken, including terminating movement of all operating parts, or re-executing the movement of at least one of the operating parts.

As a further optional step in this method, unraveling of a continuous stitching pattern is prevented by employing the operating parts to create backtack stitches at or near the end of the stitch pattern.

In another preferred embodiment, the present invention provides a multi-head sewing apparatus for performing a plurality of sewing operations, preferably simultaneously. For example, one application of a multi-head sewing apparatus forms button holes in a textile sewing material where movement of a plurality of operating parts is coordinated to form stitches adjacent to each of the holes. This hole forming apparatus includes all of the basic elements of the stitch forming apparatus described above. Another multi-head sewing application sews buttons onto a sewing material. Spreaders can be included with each of the heads to spread the button holes in one sewing material so that the buttons can be sewn through the button holes and onto another sewing material.

Another method provided by the present invention is a method of substantially simultaneously forming a plurality of bound holes in a material. This method includes the steps of creating relative movement in a controlled fashion between the material and a plurality of heads where each head includes two or more cooperatively operating parts. The position of the operating parts in each head is monitored, and monitor signals corresponding to the position of the part are substantially continuously produced. The monitor signals are directed to a multiple axis controller where commands are generated for coordinated movement of the parts. The commands are then directed to mechanisms associated with each of the operating parts in each head to control the movement of the operating parts in concert with each other and thereby form the bound holes. Once the holes are formed, buttons can then be fed to the operating parts and sewn onto the sewing material.

To detect faults in a sewing machine, a method of the invention provides for the acquisition of data corresponding to the positions of two or more sewing parts. The acquired data is monitored to determine the position of the sewing parts relative to a predetermined position for each part. An alarm condition is identified when the position of a sewing part is not within a predetermined tolerance of the predetermined position of the sewing part. Alternatively, an alarm condition is identified when a sewing part does not arrive at its predetermined position at a predetermined time.

Finally, a method of detecting a skipped stitch during operation of a sewing machine is provided by the invention. Similar to the fault detection method described above, the positions of two or more sewing parts are monitored and their positions compared to one another to determine a positional difference between the parts. A skipped stitch is detected when the positional difference between the parts meets a predetermined threshold.

BRIEF DESCRIPTION OF THE DRAWINGS

Relative to the drawings wherein like reference characters designate like or similar elements throughout the several drawing figures.

DETAILED DESCRIPTION OF THE PREFERRED EMBODIMENT

Figure 1:
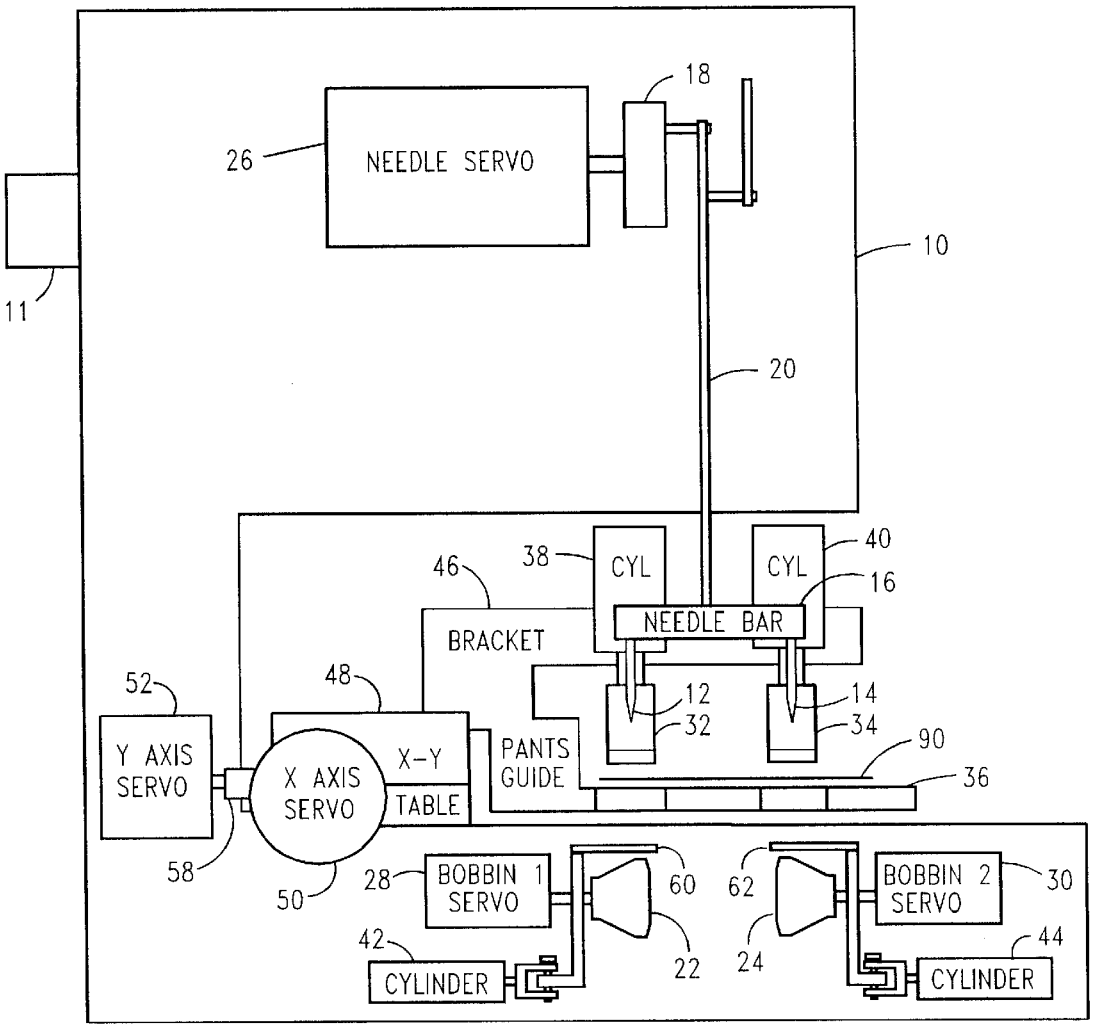
FIG. 1 is a schematic diagram of a two-needle, belt loop tacking, electronically geared sewing machine.
Figure 2:
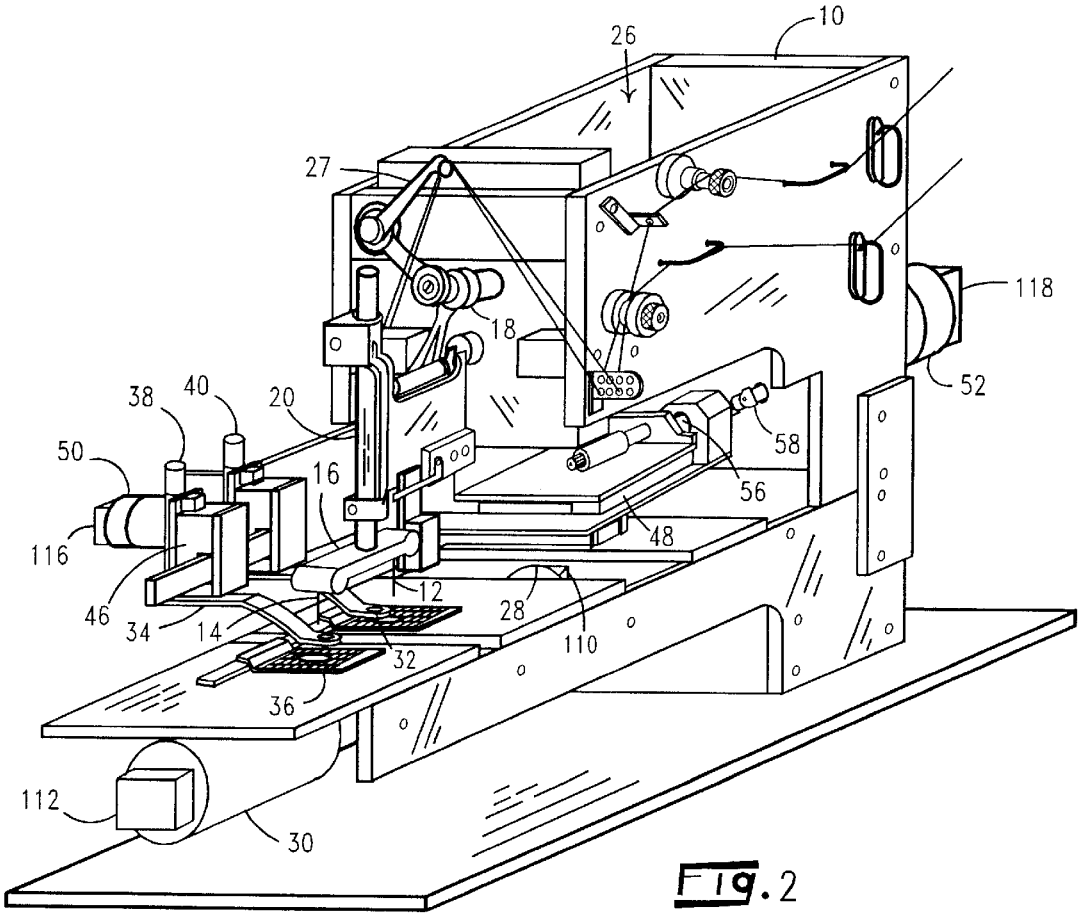
FIG. 2 is an overall illustration of the apparatus of this invention.

In accordance with a preferred embodiment of the present invention as shown in FIGS. 1 and 2, the hardware configuration for an electronically geared, two-needle, belt-loop tacking, sewing machine 10 is illustrated. Sewing is enabled by electronic gearing of the needles 12 and 14 to the bobbins 22 and 24. Each of the bobbins 22 and 24 have a hook for hooking the thread during sewing to create a lockstitch. Alternatively, a looper replaces the bobbin and hook to create a chainstitch. (For simplicity, a bobbin with a hook or a looper will hereinafter be referred to as a bobbin.) There are no mechanical synchronizing linkages or drive shafts connecting the needles 12 and 14 to the bobbins 22 and 24. Elimination of the mass associated with drive shafts and mechanical linkages enables the sewing machine 10 to reach top speed quickly due to lower inertia, thus eliminating many of the problems associated with acceleration and deceleration of the sewing machine 10. Advantages realized by the elimination of these moving parts includes improved reliability, reduced heat and noise levels, and lower energy consumption.

With continued reference to FIGS. 1 and 2, the two needles 12 and 14 are rigidly connected by a needle bar 16 so that each move in perfect unison. The needle bar 16 connects to a flywheel 18 via a shaft 20. The flywheel 18 is driven by a servo motor 26. By attaching the needle bar shaft 20 to the flywheel 18 at a point offset from the flywheel's center, vertical sewing motion of needles 12 and 14 is produced as the needle servo motor 26 turns the flywheel 18. Each of the bobbins 22 and 24 are driven by servo motors 28 and 30. Each of the bobbin servo motors 28 and 30 operate at twice the speed of the needle servo motor 26. Beneath each of the needles 12 and 14 is a pneumatically actuated foot 32 and 34 for holding the sewing material 90 in the pants guide 36 while sewing. Each foot 32 and 34 is moved vertically by a pneumatic cylinder 38 and 40 during sewing. When the feet 32 and 34 are actuated, the sewing material 90 is held firmly between the feet 32 and 34 and the pants guide 36 to provide uniform stitching and to enable two-dimensional movement of the sewing material 90 during sewing. When stitching is complete, trimmers 60 and 62 are actuated by pneumatic cylinders 42 and 44, thereby cutting the bobbin and needle threads.

With continued reference to FIGS. 1 and 2, the sewing material 90, when held in place by actuation of the foot cylinders 38 and 40, is moved in an X axis direction and a Y axis direction in relation to the needles 12 and 14 which remain stationary in the X-Y plane. This X-Y motion enables the sewing machine 10 to sew a variety of stitch patterns. The two foot cylinders 38 and 40, the two feet 12 and 14, and the pants guide 36 are rigidly connected to a bracket 46. The bracket 46 is rigidly connected to an X-Y table 48 so that movement of the X-Y table 48 induces equal movement in the feet 12 and 14, foot cylinders 38 and 40, and the pants guide 36.

Figure 3:
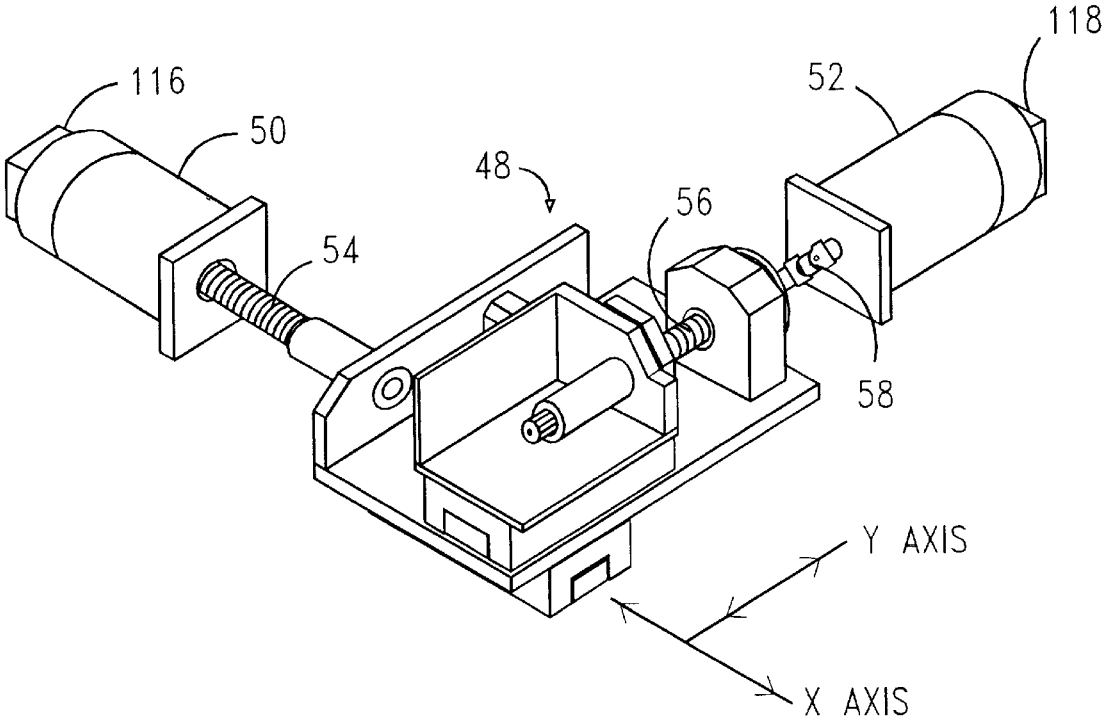
FIG. 3 is a somewhat isometric view of the X-Y table with servo motors attached.

As shown in FIGS. 1 and 3, the motion of the X-Y table 48 is controlled by two servo motors. An X axis servo motor 50 controls movement along the X axis by turning a translational screw 54 attached to the X-Y table 48. A Y axis servo motor 52 controls movement along the Y axis by turning a translational screw 56 attached to the X-Y table 48. A universal, telescoping coupling 58 interconnects the Y axis translational screw 56 with the Y axis servo motor 52, thereby enabling unobstructed movement of the Y axis translational screw 56 along the X axis.

Figure 4:
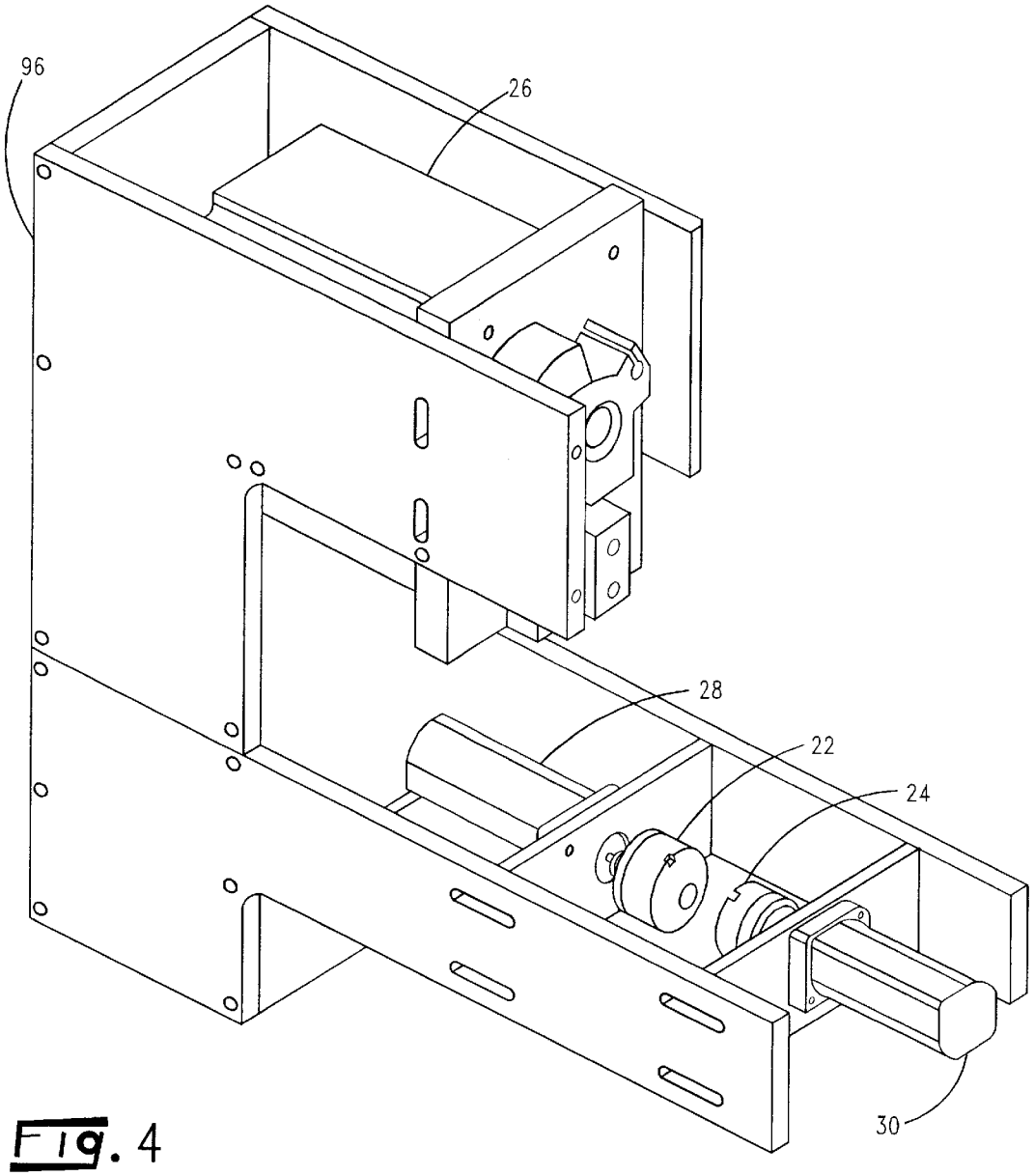
FIG. 4 is a somewhat isometric view of the sewing machine chassis with servo motors attached.

FIG. 4 is an illustration of the sewing machine chassis 96 with the needle servo motor 26 and bobbin servo motors 28 and 30 installed. The bobbins 22 and 24 are shown connected to their respective servo motors 28 and 30.

Position monitoring of the sewing parts enables electronic gearing of the movements of the sewing parts. Sewing parts are parts that are required to be rigorously moved during sewing operations, including the needles 12 and 14 and the bobbins 22 and 24. An example of a sewing part not shown in FIGS. 1 and 2 is an electronic thread take-up. A conventional thread tensioner 27 is used in the preferred embodiment in place of an electronic thread take-up. Although the preferred embodiment uses rotary servo motors for movement of the needles 12 and 14, bobbins 22 and 24, and X-Y table 48, it will be understood that other types of electric motors may be used instead, including linear servo motors and/or stepper motors.

Figure 5:
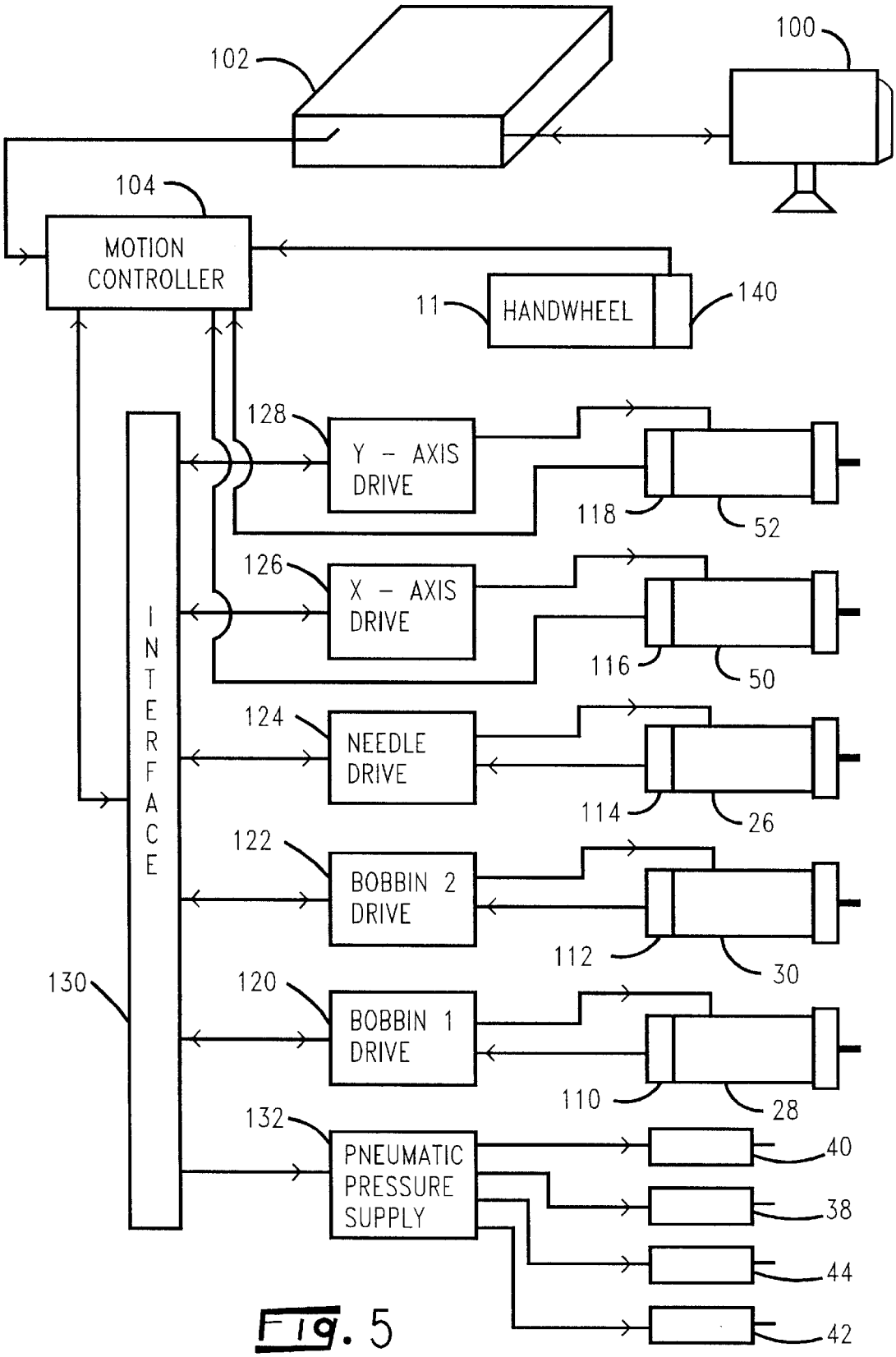
FIG. 5 is a functional block diagram of the feedback and command structure of an electronically geared, two-needle, belt loop tacking sewing machine.

Position monitoring can be by any effective method of position signaling. In a preferred embodiment as shown in FIG. 5, each of the servo motors is equipped with an encoder 110, 112, 114, 116, and 118 for monitoring the position of the servo motor load. Encoder position information is incremental. Incremental position information can be generally viewed as a series of pulses, or clicks wherein each pulse represents a specific amount of angular movement about the servo motor axis. For example, an encoder that has a resolution of one pulse per degree of movement about the servo motor axis would output 360 pulses for each complete revolution of the servo motor. Servo motor rotation equates to a specific position of the load so that 150 pulses from home position of the needle encoder 114 equates, for example, to the needles 12 and 14 being positioned one inch above the sewing material 90. In an alternative embodiment, absolute position information is provided in the form of angular position from reference about the servo motor axis so that instead of a series of pulses, the encoder outputs a signal corresponding to 100 degrees when the servo motor has moved 100 degrees from reference. Absolute position information can also be easily determined from incremental position information.

With continued reference to FIG. 5, each servo motor 26, 28, 30, 50, 52 is connected to a servo drive 120, 122, 124, 126, and 128 (as shown) for providing excitation to the servo motor. Motion commands for each of the servo motors 26, 28, 30, 50, and 52 are generated by a motion controller 104 and then passed to the servo drives 120–128 via an interface 130. The interface 130 is either a digital data bus or it is a direct, hardwired link between the motion controller 104 and the servo drives 120-128 and pneumatic pressure supply 132. Motion commands in the preferred embodiment are in the form of analog voltages, but it will be understood that digital motion commands may also be used. Each motion command utilizes S-curve profiling to eliminate machine jerk, and it instructs the corresponding servo drive to provide a specific amount of current to the servo motor. The motion controller 104 knows how far each servo motor 26, 28, 30, 50, and 52 must travel in a given time period, so it periodically adjusts the analog voltage level of each motion command to prevent overtravel or undertravel of the servo motor. For example, to move bobbin 22 an analog motion command corresponding to the desired motion of the bobbin 22 is generated by the motion controller 104 and sent out to the bobbin 1 drive 120. The analog motion command is received by the bobbin 1 drive 120 and used to provide an electrical current for excitation of the bobbin 1 servo motor 28. Encoder 110 monitors the position of servo motor 28 and outputs this positional information through the bobbin drive 120 for bobbin 1 to the motion controller 104. Motion controller 104 receives the digital positional information from the bobbin drive 120 for bobbin 1 and uses it for two purposes. First, the encoder 110 positional information is used by the controller 104 as feedback to determine whether the servo motor 28 has traveled to the point where it should be. If commanded motion differs from actual motion by a predetermined distance, then the motion controller 104 increases or decreases the voltage level of the analog motion command to increase or decrease servo motor 28 speed. Second, the encoder positional information is used by the controller 104 to limit the torque on the servo motor 28. This torque limiter function prevents the motion controller 104 from increasing the analog voltage motion command beyond a predetermined limit, thereby limiting the maximum amount of current to be supplied to the servo motor. In an alternate embodiment, encoder 110 positional information is used by the bobbin drive 120 for bobbin 1 as feedback to enable comparison of commanded motion with actual motion. In this alternate embodiment the bobbin 1 drive 120 itself adjusts the current to the servo motor 28 to correct any overtravel or undertravel (smart drive).

In a preferred embodiment, ac servo motors are used for the bobbin servo motors 28 and 30 and the needle servo motor 26, and dc servo motors are used for the X and Y axes. Servo drives 120, 122, and 124 such as YESKAWA servo drives are preferably used for each of the ac servo motors. Servo drives such as COMPUMOTOR OEM670X servo drives are preferably used for each of the dc servo motors. Encoders 110, 112, and 114 for each of the ac servo motors 26–30 are preferably magnetic encoders, such as SONY MAGNESCALE INC. Magnetic Rotary Encoder RE90B-2048C. Encoder 110–114 position signals are also routed through the servo drives 120–124 to the interface 130 for use by the motion controller 104 in calculating motion commands.

X axis servo motor 50 and Y axis servo motor 52 are preferably dc servo motors. Servo drives 126 and 128 for each of these dc servo motors are preferably COMPUMOTOR OEM670X servo drives. Encoders 116 and 118 for each of the dc servo motors 50 and 52 are preferably optical encoders, such as COMPUTER OPTICAL PRODUCTS, INC. CM350-1000-L. Encoder 116 and 118 position signals are routed directly to the motion controller 104. The encoder position information is used by the controller 104 as servo motor feedback control.

With continued reference to FIG. 5, the motion controller 104, which is part of a computer 102, and its associated software can conceptually be viewed as a plurality of motion command axes so that a command axis is established for each servo motor and its corresponding drive. For example, a command axis is established for the needle drive 124, the needle servo motor 26, and the needle servo motor encoder 114. A separate command axis is established for the bobbin 1 drive 120, the bobbin 1 servo motor 28, and the bobbin 1 servo motor encoder 110. Each motion command axis calculates motion commands as a function of encoder position information from all servo motors 28, 30, 32, 50, and 52. Motion commands provide the servo drives 120–128 with information relating to the desired motion of the servo motors 26, 28, 30, 50, and 52, and each motion command and resulting servo motor motion can generally be viewed as a pulse due to its relatively short duration. Faster stitching operations require shorter duration and higher frequency motion commands. The motion controller 104 is programmed to control the position of the servo motors 26, 28, 30, 50, and 52 by generating motion commands corresponding to the frequency and current of these pulses to be supplied to the servo motors. In a preferred embodiment, PC Bus Motion Controller cards, such as GALIL DMC-1000 cards having eight axes of motion control per card with multiple card synchronization, are used within the computer 102. Each axis of the motion controller 104 generates an appropriate motion command for its corresponding servo motor and drive.

Monitoring by the motion controller 104 of encoders 110–118 enables electronic gearing of the bobbins 22 and 24 and needles 12 and 14. Encoder 110–118 monitoring is used, for example, by designating one of the servo motors as the master with the other servo motors slaved to the master. For example, in the preferred embodiment, the bobbin servo motors 28 are slaved to the needle servo motor 26, which is the master, so that each slaved controller axis monitors the needle servo motor encoder 114 and generates the appropriate motion command for concerted movement of the slaved servo motors with the needle servo motor 26. In an alternate embodiment, any of the servo motors may be the master. If positional information provided via the encoders 110–114 indicates that one of the slave servo motors is unable to keep up with the master servo motor and lags the master servo motor by, for example, 50 encoder pulses or greater, the motion controller 104 will cause the master servo motor to slow. This effectively flipflops the identities of the servo motors and the slave servo motor suddenly becomes the master servo motor.

In a preferred embodiment, the X axis servo motor 50 and Y axis servo motor 52 are slaved to the needle servo motor 26 in such a way that the motion of the X-Y table 48 is as slow as possible. In other words, when the needles 12 and 14 move up and clear the sewing material 90, the X-Y table 48 will begin to move, and the speed of the X-Y table 48 is calculated to achieve the desired X-Y axis movement in the known time required for the needle to raise to the top of its travel and return to the point of entering the sewing material 90 again. Consuming the maximum length of time between stitches in order to move the X-Y table 48 dampens otherwise jerky machine motions and reduces or eliminates the problems associated with acceleration and deceleration, thereby enabling the sewing machine 10 to achieve the smoothest, tightest stitch possible. In a preferred embodiment, the X-Y table begins its motion when the needle encoder 114 has output 2800 pulses from home position with the needles 12 and 14 rising to a height approximately one fourth of an inch above the plane of the pant guide 36, and the X-Y table completes its motion when the needle encoder 114 has output 4000 pulses from home position and the needles 12 and 14 again lower to a height of approximately one fourth of an inch above the plane of the pants guide 36.

As an alternative to the master-slave arrangement of the preferred embodiment, electronic gearing is enabled by generating motion commands without reference to a master. Each controller axis receives encoder positional information from all other encoders and generates motion commands based on the positions of all sewing parts. If encoder positional information indicates that one of the servo motors is unable to keep up with the others and lags the other servo motors by, for example, 50 encoder pulses or greater, then that lagging servo motor is designated as master and all other controller axes are slaved to it to maintain electronic gearing. Therefore, an alternate embodiment is disclosed whereby a master-slave arrangement does not exist until there is a lag by one of the servo motors.

Each encoder 110–118 is equipped with a reference position indicator, enabling the motion controller 104 to command each servo motor 26, 28, 30, 50, and 52 to find the reference point and then move to a "home" position. This home position is used to initialize the sewing machine 10 for start of sewing operations. The encoders 110–118 sense movement from the home position and produce signals corresponding to such movements. Initialization (moving servo motors to the home position) and stitch pattern selection is enabled by use of a user interface 100 such as, for example, a touch screen monitor. A user menu software package, such as Visual Basic or Corel Flow, is used to generate user interface screens. Stitch patterns are stored in electronic storage, including computer 102 hard disk and other magnetic media, RAM, and ROM, and selected by the user through the touch screen monitor 100.

The user interface 100 enables a user to electronically adjust the position of either of the bobbins 22, 24 relative to the position of the needles 12, 14. Preferably, this is accomplished by changing the home position of one of the servo motors 26–30. In this manner, the timing of the bobbins 22, 24 can be easily adjusted on-screen to ensure the bobbin will catch the thread with the precision necessary to form stitches in the sewing material 90. This feature is particularly useful when a change in the thread or the material necessitates a change in the timing of the bobbins 22, 24 relative to the needles 12, 14. Thread size, thread type, material tightness, and even the dye used to color the thread can affect the timing and size of the thread loop. The timing of bobbin 22, 24 and needle 12, 14 must therefore be adjusted as necessary to accommodate such changes. After appropriate adjustments have been made for a particular sewing application, the positional settings can be electronically stored and retrieved at a later time, thus saving the user the time, expense, and effort otherwise required to re-establish those settings for that particular sewing application. Adjusting the rotational positions of the needle and bobbin in a conventional sewing machine requires that one part be mechanically adjusted and fixed in relation to the other. Electronic adjustment of these sewing parts, made possible by electronically geared sewing, is much easier and less time consuming than the conventional method of mechanical adjustment. An additional advantage is that no tools are required to effect the adjustment electronically.

Shown in FIG. 1 is a handwheel 11 which is similar in function to a conventional sewing machine handwheel. The handwheel 11 becomes operable after selecting it from the touch screen monitor 100. As FIG. 5 illustrates, an encoder 140 is connected to the handwheel 11 for providing the motion controller 104 with handwheel motion signals. Alternatively, a servo motor or similar device may be connected to the handwheel 11 for providing force reflective movement of the handwheel 11. Once the handwheel 11 is selected, all or certain selected sewing parts become slaved to the handwheel 11 so that the handwheel motion signals dictate all motion commands being sent out by the motion controller 104. Therefore, the handwheel 11 provides a capability for manual mode, electronically geared movement of electronically geared sewing parts. In addition, the sensitivity of the force reflective feel of the handwheel motion can be adjusted by the user through the user interface 100 to suit the needs of the particular sewing application.

By electronically gearing and controlling the motion of the various sewing parts within the machine 10, the computer 102 can be programmed to enable a variety of other automated functions that can be selected, activated, adjusted, stored, and recalled on-screen. One such function enabled by the computer 102 is torque limiting for machine error detection (such as detection of skipped stitches) and for improved safety. The torque limiting feature enables the computer 102 to recognize when an abnormal amount of resistance is encountered and to adjust required operating torque accordingly or to shut down at a predetermined level. The computer 102 calculates and monitors the normal operating current that is required per pulse to drive each servo motor. When, for example, the needles 12 and 14 are going through heavy sewing material 90, more current per pulse to the needle servo motor 26 (more torque) is required to maintain the desired speed of operation; i.e., the servo motor 26 torque requirement goes up. Likewise, if the needle tries to go through a finger or other obstruction, the resulting increase in resistance to the needle servo motor 26 causes an increase in the current required to maintain the selected speed of operation. By manual input through the user interface 100 or by default program setting, the computer 102 maintains, for selected servo motors, an established torque limit. This torque limit is continuously compared to the servo motor torque requirement. When an obstruction such as a finger is hit by a needle 12 and/or 14, or when some other obstruction causes an excessive amount of required torque, the computer 102 turns off the sewing machine 10, thereby preventing further damage to the finger or other obstruction instead of commanding the servo motor 26 to provide torque above the torque limit. It also prevents possible damage to the sewing machine 10 itself.

Preferably, the torque limit for an individual servo motor is adjustable on-screen through the user interface 100 so that the torque limit setting can be optimized for different sewing applications. For example, when sewing through heavy sewing material such as denim, canvass, or leather, the optimal torque limit will be greater than the optimal torque limit when sewing through lighter materials. If the torque limit is too low for a particular application, the computer 102 will cause nuisance shut downs of the machine 10. If the torque limit is set too high, the machine 10 may not shut down when needed and the torque limiting function will not effectively serve as a safety feature.

In one embodiment, torque limit shut down of the sewing machine 10 due to excessive resistance encountered by a servo motor is a two step procedure. First, a user defined current limit prevents the computer 102 from commanding a current level in excess of the defined limit. The selected current limit will vary depending on the thickness and resistive properties of the material being sewn. For thin materials, a low current limit is set. For thicker materials, a higher current limit is set. Once the current limit is reached, the computer will hold the current at that level until encoder positional information indicates that the restrained servo motor is lagging by, for example, 50 encoder pulses or greater. At this point, the master and slave servo motors flipflop identities if the restrained servo motor is a slave. If the restrained servo motor is the master, no flipflop occurs. If the blocked servo motor continues to lag by, for example, an additional 50 encoder pulses or greater, despite the fact that maximum current is being commanded, then the computer turns off the sewing machine 10. In an alternate embodiment, the machine 10 is shut down when a servo motor fails to reach a predetermined position within a predetermined amount of time.

Figure 7:
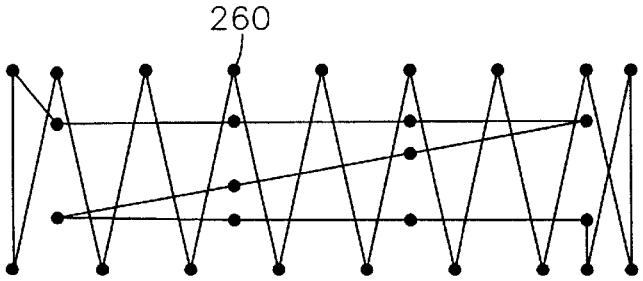
FIG. 7 is a plan view illustrating an exemplary 28-stitch, stitch pattern that can be programmed into an electronically geared sewing machine.

As previously described, the computer 102 includes electronic memory (not shown) for storage of various stitch patterns, such as the 28 stitch pattern shown in FIG. 7. Each stitch pattern, which typically includes a plurality of continuous stitches 260, is user selectable through the user interface 100. If the desired stitch pattern is not already stored in the computer 102, the user may design or program a desired stitch pattern into the computer 102 on-screen through the user interface 100. This procedure requires instructing the computer 102 through appropriate user commands as to the placement and sequence of each stitch 260 within the new pattern. When complete, the new stitch pattern may be stored in memory with the other stitch patterns and selected by a user at a later date.

Figure 8:
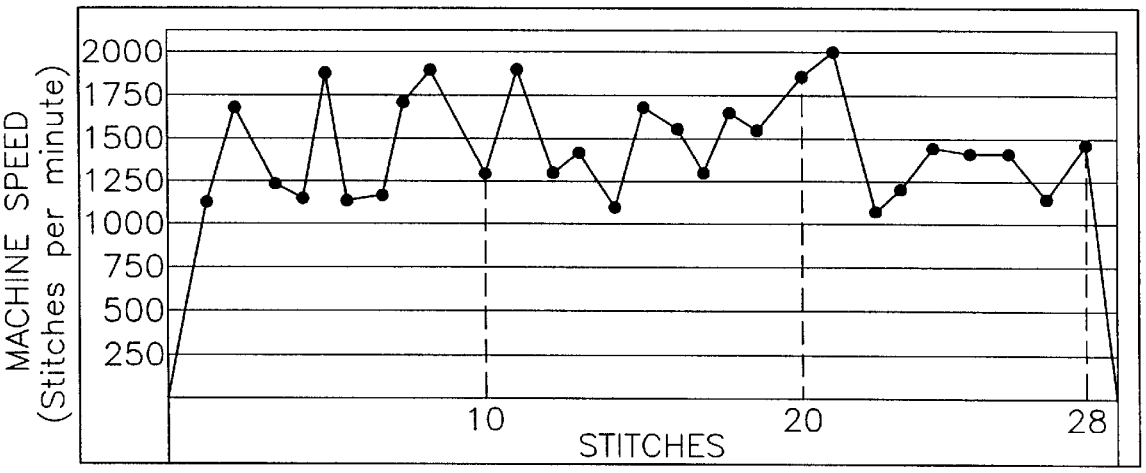
FIG. 8 is a graph showing machine speed, measured in stitches per minute (SPM), for an electronically geared sewing machine while sewing the 28 stitch pattern of FIG. 7.

Encoder positional information may be used by the computer 102 to produce a graphic representation of the speed profile of the machine 10 during sewing. The graph of FIG. 8 illustrates an actual profile of machine speed, measured in stitches per minute (SPM), for an electronically geared sewing machine 10 while sewing the 28 stitch pattern of FIG. 7. As can be seen, machine speed varies from stitch to stitch. These speed variances are largely dependent on the stitch pattern. There are many variables within the stitch pattern that can cause machine speed to vary, including the distance between successive stitches and whether the machine 10 must stop and change direction in order to form the next stitch. Generally, a greater distance between stitches equates to slower machine speed (i.e., less SPM). Likewise, machine speed will be slower when the stitch pattern requires dramatic changes in the direction of sewing. Within a typical stitch pattern, it is common to have a series of successive stitches with uniform spacing and that require modest changes in sewing direction between stitches. Such stitches can be sewn at greater average machine speeds than those having inconsistent spacing and substantial directional changes.

To optimize sewing speeds for particular stitch patterns, the present invention enables the user to program the machine 10 to execute the selected stitch pattern in accordance with a predetermined speed and acceleration profile. For example, in sewing the 28 stitch pattern of FIGS. 7 and 8, the user can define a first speed and acceleration for the first 10 stitches, a second speed and acceleration for stitches 11–20, and a third speed and deceleration for the final 8 stitches of the pattern. For each group of stitches in this example, the machine 10 will accelerate to the defined speed and acceleration will become zero when the first speed is reached. By selecting a high acceleration, the machine 10 can reach the defined speed as quickly as the second or third stitch. Alternatively, a low acceleration can be used to prevent the machine 10 from reaching the selected speed until the eighth, ninth, or even tenth stitch. In similar fashion, the second and third groups of stitches will be sewn by the machine 10 in accordance with the defined second and third speed and acceleration settings.

The computer 102 may be programmed to enable the bobbin servo motor encoders 110, 112 to recognize when a stitch has been skipped. As the machine 10 sews a continuous stitch pattern, a hook on each of the bobbins 22, 24 catches the thread loop produced by the needles 12, 14 as the needles 12, 14 penetrate the sewing material. The bobbins 22, 24 experience some amount of resistance due to the tensioning of the thread as it is carried by the bobbins 22, 24. The resistance of the thread as it is being pulled by the bobbins 22, 24 causes the bobbin servo motors 28, 30 to lag by several encoder counts. When a bobbin fails to catch the thread, resulting in a skipped stitch, there is no thread resistance to slow the servo motor and the servo motor should not lag appreciably from its commanded position. Thus, the computer 102 monitors the bobbin servo motor encoders 110, 112 and determines that a stitch has been skipped, or missed whenever one of the encoders 110, 112 fails to lag in a manner characteristic of a bobbin pulling a thread.

Preferably, the machine 10 automatically re-attempts to form the stitch when the computer 102 detects a skipped stitch. Alternatively, the computer 102 may be programmed to shut down the machine 10, or the computer 102 may continue operation of the machine 10 and alert the user that a stitch has been skipped.

As previously stated, the machine 10 may be used to create a chainstitch by making the bobbins 22, 24 loopers. Chainstitch patterns, particularly single or double thread chainstitch patterns, are inherently vulnerable to unraveling if the last several stitches of the pattern are not terminated, such as by "backtacking" or other means of locking the last several stitches. In conventional lockstitch sewing machines, the last several stitches may be terminated and locked in by resewing back over the last several stitches. This process of resewing is known as "backtacking" and is usually accomplished by reversing the direction of feed so that the material being sewn moves in the reverse direction or at least stops moving.

Reversing the direction of feed in this manner is not possible in a chainstitch machine because the method of forming the stitch is dependent on the direction of feed. In other words, if a conventional sewing machine is operated in a reverse direction, the necessary operating relationship between the needle and looper will not be present because the pull of the sewing material in the reverse direction reverses the motion of the thread with respect to the needle. A sewing machine 10 employing electronic gearing in accordance with the present invention enables the user to reverse the direction of feed and still maintain the necessary cooperative relationship between the needle and looper because the direction of the motion of the feed elements can be changed independent of the direction of motion of the other sewing elements. Thus, the last several stitches in a chainstitch can be locked, or backtacked, with an electronically geared sewing machine 10 by reversing the direction of feed or, alternatively, by sewing several stitches in the same general location. This capability of electronically geared sewing technology eliminates the need for a separate backtacking apparatus and method in order to lock the last several stitches of a chainstitch. Additionally, it should be noted that this backtacking feature is not limited to chainstitch patterns. Rather, backtacking can be performed on any continuous stitching pattern, including lockstitch patterns.

A particularly convenient aspect of the present invention is the ability to electronically store machine operating parameters, which are optimized for a particular sewing application, as a group for later retrieval. For example, when sewing beltloops onto a material such as denim, the user will typically set up the operation of the machine 10 by defining various sewing parameters as previously discussed, including selecting or programming a desired stitch pattern, a speed and acceleration profile, a torque limit, and adjusting the relative timing of the bobbins 22, 24 and needles 12, 14. Some amount of experimentation may be required to find the optimal settings for these and other sewing parameters. Once the optimal settings have been defined, the user can electronically store the settings as a group. When the machine 10 is later used to sew beltloops onto denim material, the stored settings may be recalled, thus saving the user the time and effort required to optimize the machine 10 again.

Another function enabled by the computer 102 is real time production and maintenance monitoring of the sewing machine 10. The computer 102 monitors the amount of time that the sewing machine 10 is being operated, the speed at which it operates, and the power required to operate it over a period of time. This feature enables automated maintenance scheduling of the sewing machine 10.

Components are modularized to enhance maintainability. For example, the bobbins 22 and 24 shown in FIG. 3 can be easily removed and replaced with loopers. The versatility of electronically gearing the needles 12 and 14 to the bobbins 22 and 24 enables the user to make such parametric changes without having to manually reset other sewing parameters. Electronic gearing enables automatic adjustment to new sewing parameters.

Countless variations exist for the application of electronic gearing to sewing operations due to the elimination of conventional linkages and drive shafts gearing the needle to the bobbin. Variations include single and multi-head embroidery machines for sewing embroidery patterns onto a sewing material, machines for sewing airbags used in the manufacture of automobiles and other vehicles, and machines for sewing composite materials used in the manufacture of aircraft.

A further variation is a felling machine for sewing, for example, the interior seams of blue jeans. This type of machine typically requires a short throat for maintaining high speeds. Electronic gearing enables the high speed operation of even long throated sewing machines since there are no mechanical linkages or drive shafts to slow down operation.

Figure 6A:
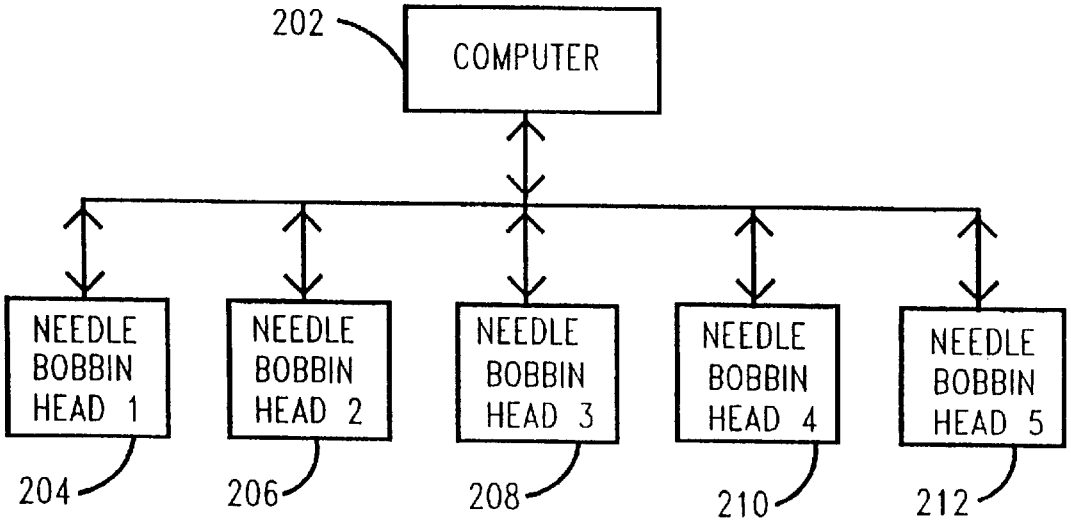
FIG. 6A is a functional block diagram of the feedback and command structure for a multi-head sewing machine.
Figure 6B:
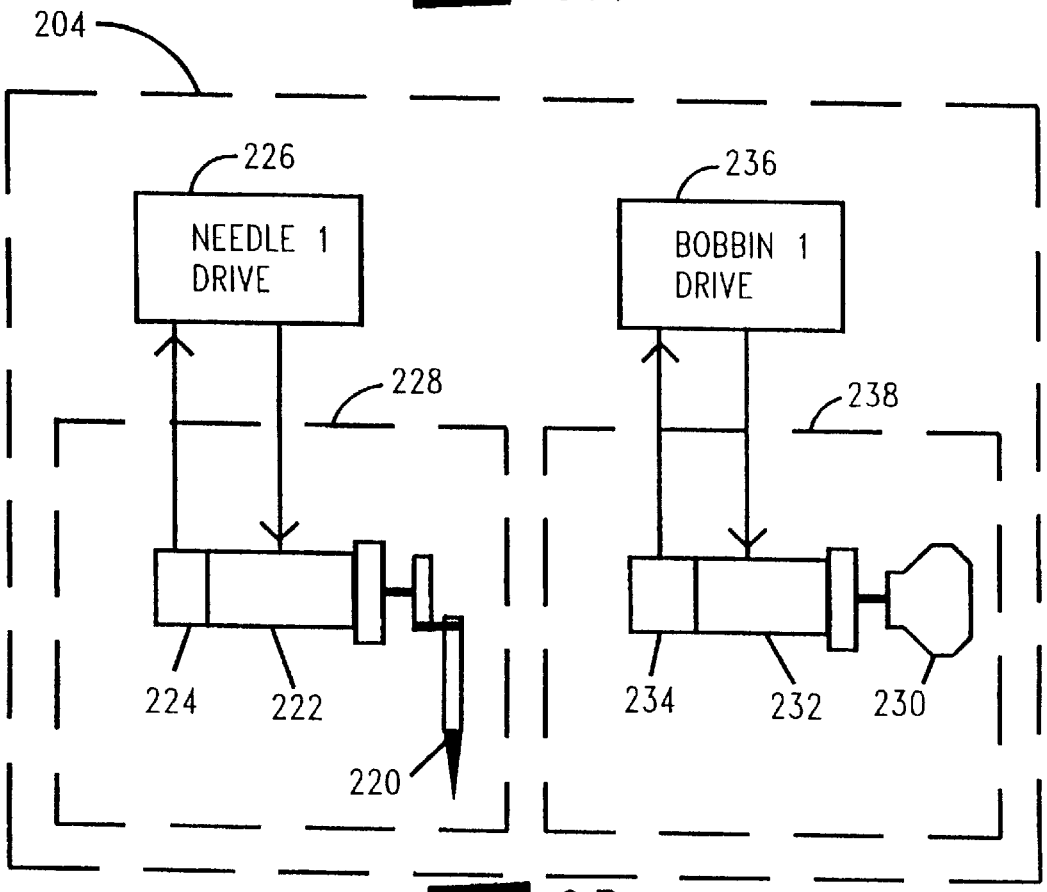
FIG. 6B is a block diagram of a needle/bobbin head for the multi-head sewing machine of FIG. 6A.
Figure 6C:
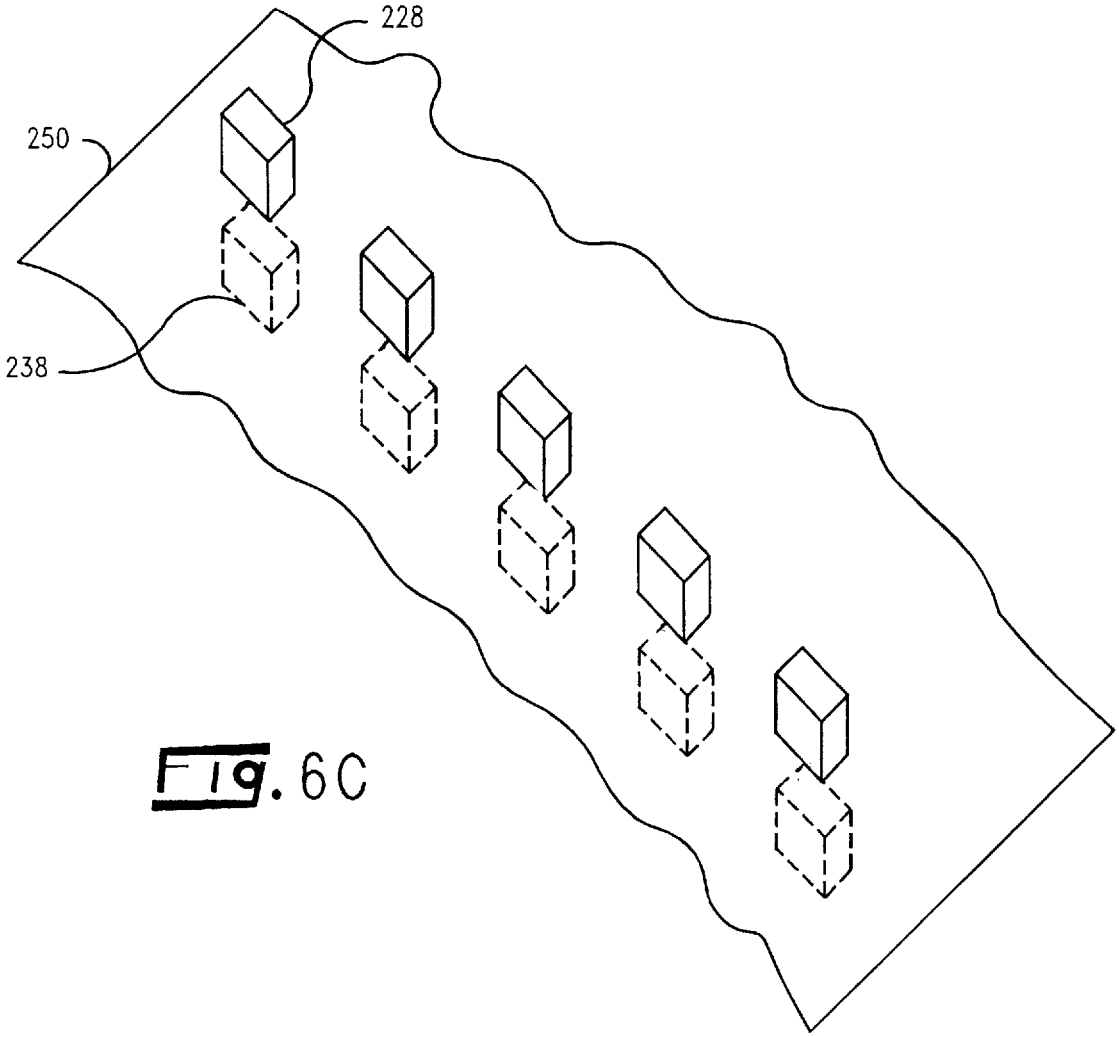
FIG. 6C is a somewhat isometric view of a multi-head sewing machine, illustrating the positions of the needle assembly and bobbin assembly relative to the sewing material.

The invention enables two or more sewing machines, or sewing heads, to be combined for applications where multiple sewing operations are performed. FIG. 6A shows a high-level block diagram for the configuration of a multi-head sewing application. A computer 202 coordinates the electronic gearing of five needle/bobbin heads 204, 206, 208, 210, and 212 that are spaced apart, center to center, by distances small enough to allow simultaneous sewing of button holes 252; e.g., about 2.5 to 4.0 inches. As shown in FIG. 6B, each needle/bobbin head 204–212 comprises at least a needle 220 with a corresponding servo motor 222, encoder 224, and drive 226, and a bobbin 230 with a servo motor 232, encoder 234, and drive 236. The needle servo motor 222, encoder 224, and the needle 220 form a needle assembly 228. The bobbin servo motor 232, encoder 234, and the bobbin 230 form a bobbin assembly 238. As FIG. 6C illustrates, the needle assembly 228 and bobbin assembly 238 of each sewing head 204–212 are structurally secured opposite to each other so that the needle assembly 228 of each head is positioned on the opposite side of the sewing material 250 than its corresponding bobbin assembly 238 while sewing. Electronic gearing of each of the needle/bobbin heads 204–212 is enabled by use of positional information provided by, for example, encoders attached to the servo motors as previously described. The needle of each head 204–212 is electronically geared to the bobbin of the same head. While it is not necessary, it is also preferred to electronically gear together the needles and bobbins of all of the heads 204–212.

Figure 9:
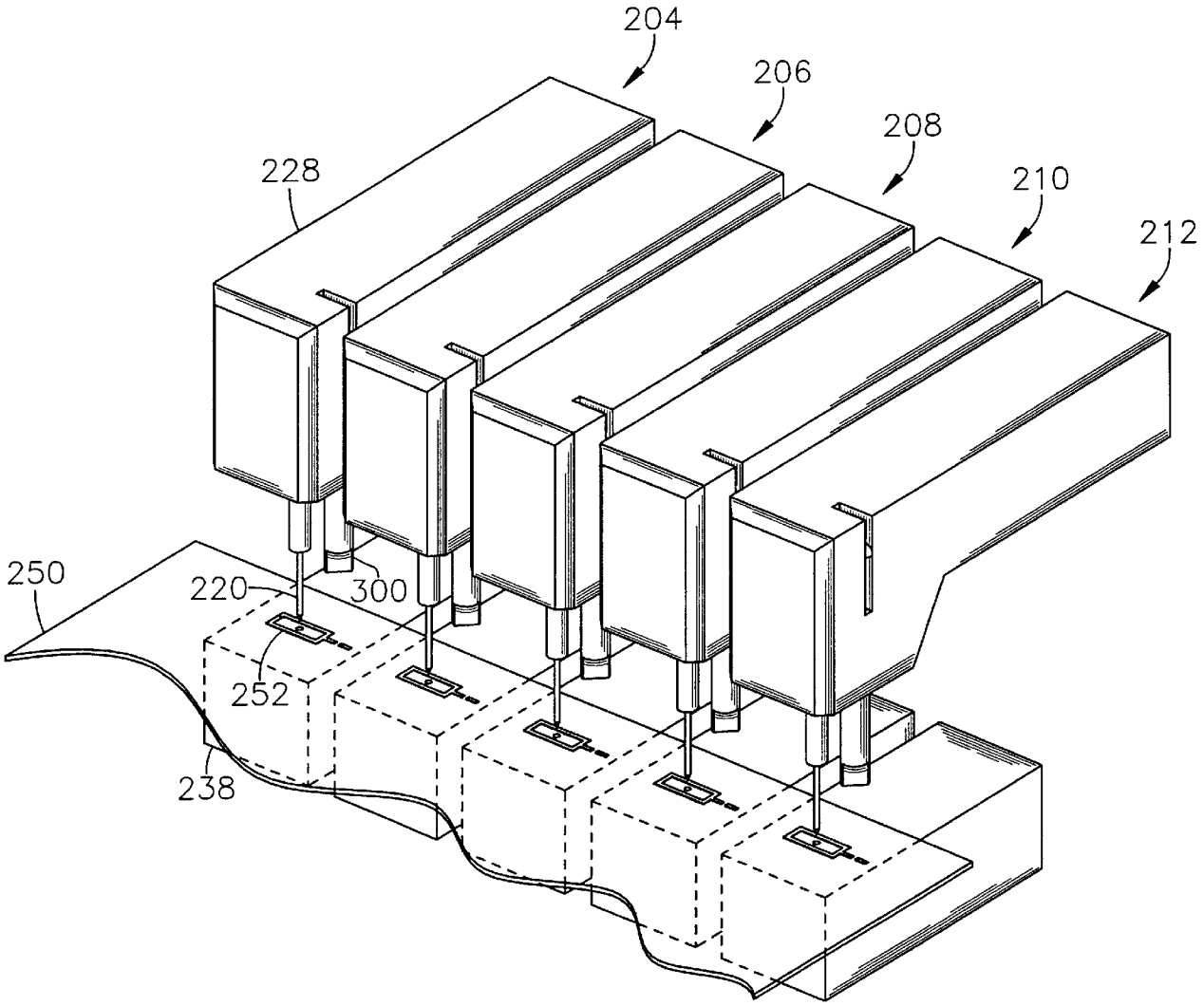
FIG. 9 is an isometric view of a multi-head sewing machine having five heads configured for sewing button holes in a sewing material.

In a specific application of a multi-head sewing machine, FIG. 9 illustrates a five-head embodiment for sewing button holes 252 in a sewing material 250, which sewing material 250 may be, for example, part of a shirt. For simplicity, the individual operation of one head 204 will be described, it being understood that all other heads 206–212 operate in similar fashion to create button holes. It will be further understood that, although each head 204–212 may be operated at a different time and a different speed, it is preferable to operate all heads, 204–212 at substantially the same time and at substantially the same speed to increase efficiency and reduce the amount of time required to complete all button holes.

Each head 204 includes a knife 300 which is actuated, for example, by a pneumatic pressure supply 132 like that shown in FIG. 5 in response to commands generated by a computer 202. When the knife 300 is actuated, the knife 300 cuts the sewing material 250 to create a hole in the sewing material 250 which is the opening for the button hole 252. After the sewing material 250 is cut, a needle 220 stitches that part of the sewing material 250 immediately adjacent the cut hole to provide structural integrity and prevent fraying of the sewing material 250, thus completing the button hole 252. Alternatively, stitching is performed prior to cutting the sewing material 250 with the knife 300.

Figure 10:
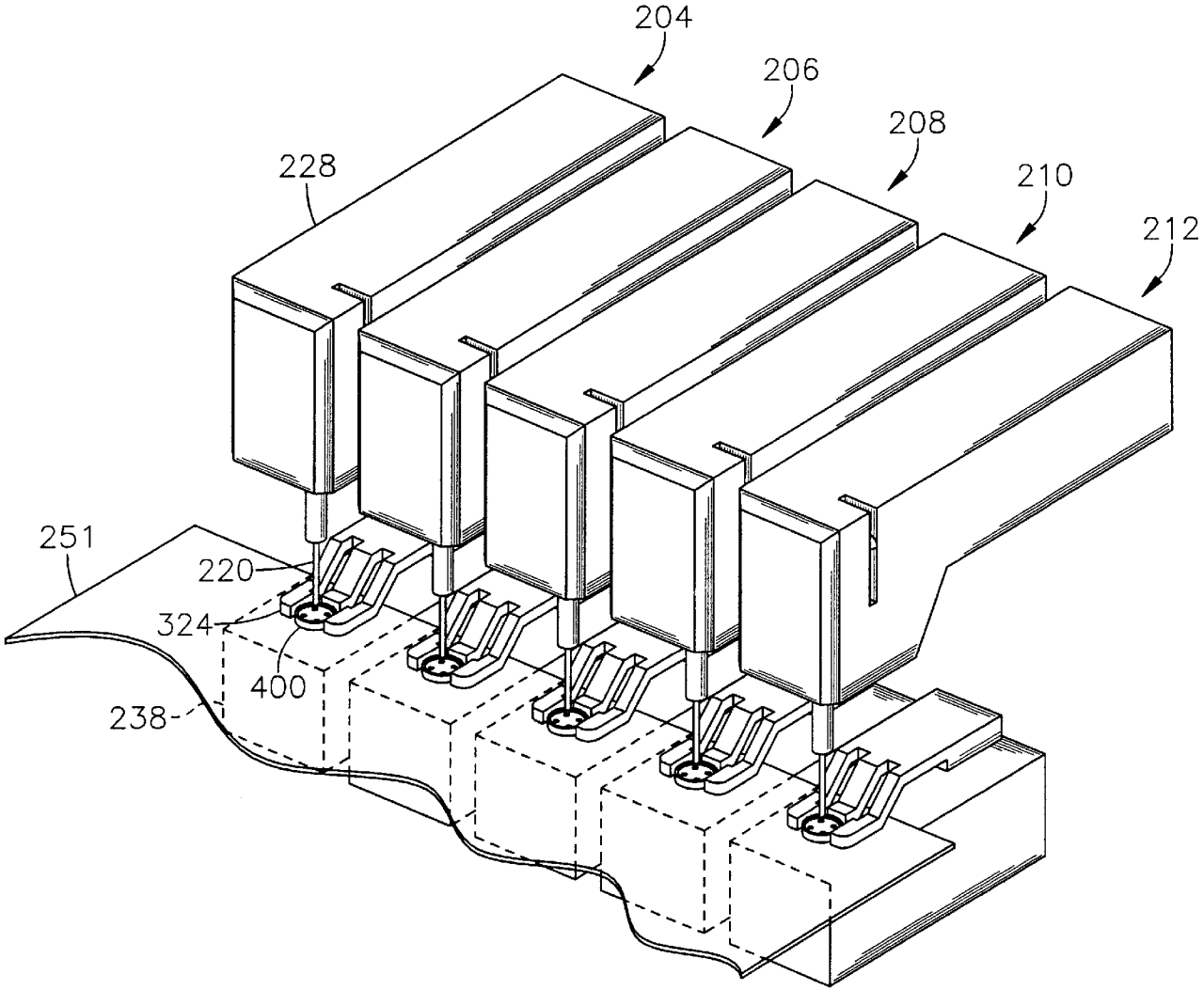
FIG. 10 is an isometric view of a multi-head sewing machine having five heads for sewing buttons onto a sewing material.

Multiple-head applications of the present invention are made possible because the needle and bobbin are physically freed from each other. In another multi-head application of the invention, FIG. 10 illustrates a five-head embodiment adapted for sewing buttons 400 onto a sewing material 251, preferably simultaneously. Head 204, like all other heads 206–212 includes a clamp 324 for securing the button 400 as it is sewn onto the sewing material 250 by the needle 220. Although not shown in FIG. 10, a button feed mechanism can be provided and controlled by the computer 202 to automatically feed buttons 400 to each clamp 324 during operation.

A particular advantage of multi-head sewing operations is a significant increase in the efficiency of sewing operations. For example, in the time required to create a single button hole 252 in the sewing material 250 (FIG. 9) with a single head machine, the five-head machine of FIG. 9 will have sewn five times as many button holes 252. Likewise, the five-head button sewing machine of FIG. 10 can sew at least five buttons 400 for every one button 400 sewn by a single-head machine.

Figure 11:
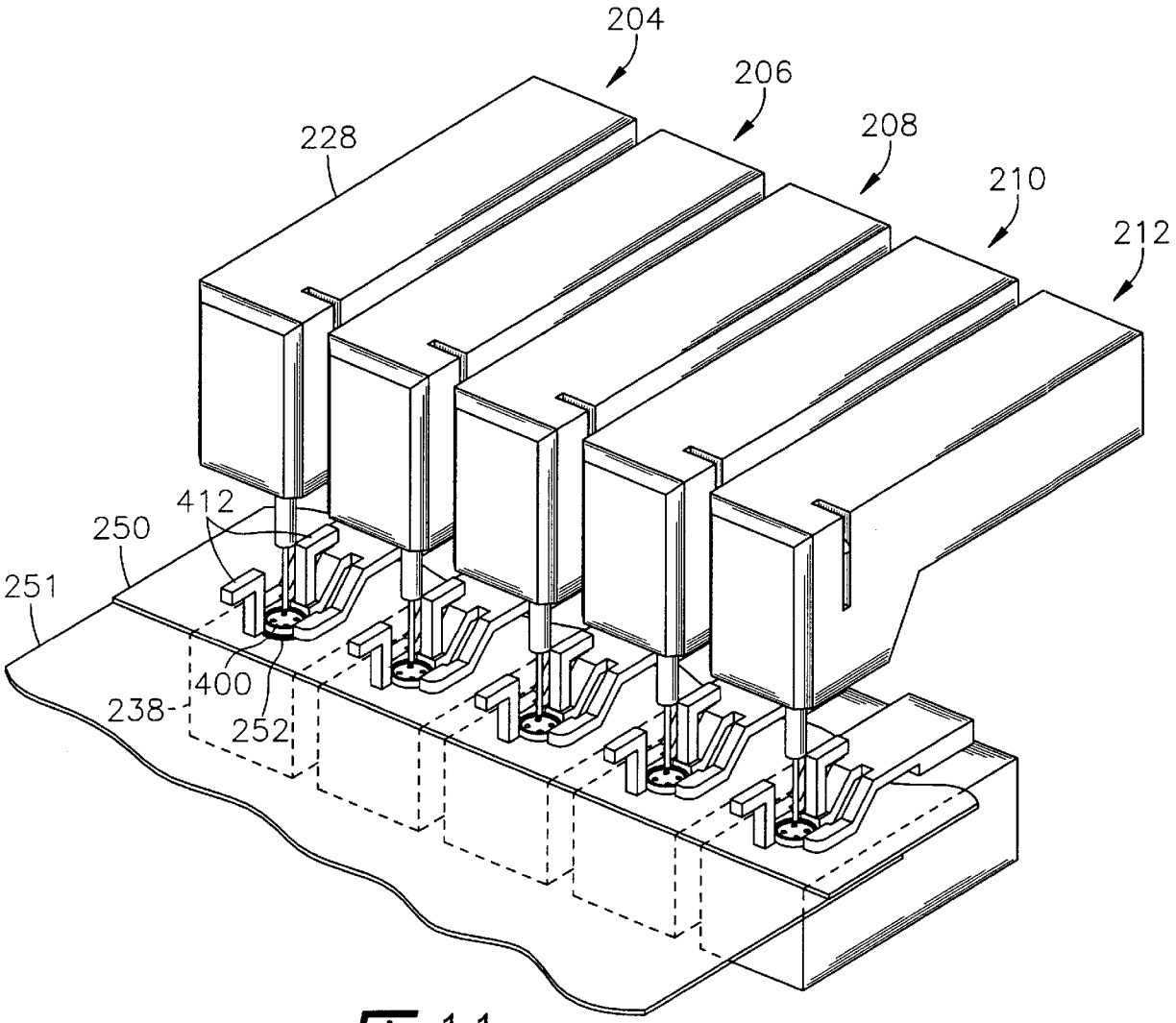
FIG. 11 is an isometric view of a multi-head sewing machine having five heads with spreaders for separating button holes in a top sewing material and sewing buttons into a bottom sewing material located below the top sewing material.

In a further multi-head, button sewing application, FIG. 11 illustrates how each button sewing head 204–212 is provided with a spreader 412 which spreads button holes 252 in one sewing material 250 so that buttons 400 can be stitched through the button holes 252 and onto another sewing material 251. Each spreader 412 is actuated, for example, by a pneumatic pressure supply 132 similar to that shown and described in FIG. 5 in response to commands generated by a computer 202. A particular advantage of this embodiment is that the steps of attaching the buttons 400 and connecting the two pieces of sewing material 250, 251 are accomplished at the same time with the same machine.

It will be appreciated that the physical separation of the needle and bobbin enables the sewing heads 204–212, either individually or in groups, to be moved in three dimensions while sewing, thereby enabling three-dimensional sewing operations. Instead of bringing the sewing material to the sewing machine in a single plane, the present invention enables the sewing heads 204–212 to be brought in multiple planes to the sewing material.

It is contemplated, and will be apparent to those skilled in the art from the preceding description and accompanying drawings, that modifications and/or changes may be made to the described embodiments of the invention. Accordingly, it is expressly intended that the foregoing description and accompanying drawings are illustrative of preferred embodiments only, not limiting thereto, and that the true spirit and scope of the present invention be determined by reference to the appended claims.

ATTY DOCKET: 49140.C1

APPENDIX A

Computer Program Listing of the Motion

Controller For Electronically

Geared Sewing Machine

Tice Engineering and Sales, Inc.
6711 Maynardville Highway
Knoxville, Tennessee 37918

Michael E. Sellers, Esq.
LUEDEKA, NEELY & GRAHAM, P.C.
Suite 1871, Riverview Tower
900 South Gay Street
Knoxville, Tennessee 37902
Telephone: (423) 546-4305

Express Mailing Label Number: EM 531 349 381 US

08/656037

Suffix.dl

```
#POSERR
CB1
CB16
AB1
ST
JP#MGX,_TEX>300
JP#MGY,_TEY>300
JP#MGZ,_TEZ>200
JP#MGW,_TEW>1000
JP#MGE,_TEE>200
RE
EN
#MGX
MG"5"
EN
#MGY
MG"6"
EN
#MGZ
MG"7"
EN
#MGW
MG"8"
EN
#MGE
MG"9"
EN
#HANDS
JP#TOUT,@IN[11]=0
GA F
GR,,-2,1,-2
EN
#A
A=@IN[7]
A=
SB1
SB16
JP#HOME
EN
#B
A1=@IN[7]
A1=
EN
#THRIM
MG"12"
WT20
ST
EN
#AIR
MG"13"
WT20
CB2
CB3
CB4
CB5
CB6
CB7
CB8
CB9
CB10
CB11
CB12
CB15
EN
#THRIMB
MG"11"
WT20
ST
EN
#START
```

```
XQ#SS,1
XQ#STEP,2
EN
#STEP
JP#AIR,@IN[12]=1
AI-2
SB15
WT30
CB15
AI13
SB5
WT20
SB6
WT70
CB6
AI-6
CB10
WT150
SB7
AI-5
WT30
SB8
WT100
CB5
WT100
SB9
JP#STEP
EN
#NEW
JP#AIR,@IN[12]=1
CB11
CB8
CB9
CB7
AI-6
CB10
SB15
WT30
CB15
AI13
SB5
WT20
SB6
WT100
CB6
WT100
SB7
AI-5
WT70
SB8
WT100
CB5
WT100
SB9
EN
#JOGA
JP#AIR,@IN[12]=1
CB5
CB7
CB8
CB9
CB11
AI-6
CB10
SB15
WT50
CB15
EN
#JOGB
SB5
WT100
SB6
```

```
WT100
CB6
EN
#JOGC
AI-6
SB7
EN
#JOGBC
CB7
EN
#JOGD
AI-5
SB8
EN
#JOGBD
CB8
EN
#JOGE
CB5
WT100
SB9
EN
#JOGBE
CB9
AI-5
SB5
EN
#JOGF
AI-14
SB10
EN
#JOGBF
CB10
EN
#JOGG
AI-2
SB11
EN
#JOGBG
CB11
EN
#JOGH
AI-3
SB2
EN
#JOGBH
CB2
EN
#JOGI
CB11
EN
#JOGJ
CB5
CB9
CB7
CB8
AI-6
CB10
CB2
EN
#TOUT
MG"10"
JP#SS
EN
#JOGR
CB5
CB9
CB7
CB8
AI-6
CB10
EN
```

08/656037

Michal.dl

```
#SS
AI-14
AI-8
JP#AIR,@IN[12]=1
JP#TOUT,@IN[11]=1
JP#THRIM,@IN[9]=1
JP#THRIMB,@IN[10]=1
SB10
AI-2
SB11
AI-3
SB2
WT150
CB7
CB9
CB11
AI-14
CB8
T1=TIME
GA W
GR,,-2,,-2
ER315,315,400,4000,400
OX=_TPX
OY=_TPY
PR,,,116000
SP,,,V4=
SP V2=
SP ,V3=
AC10000000, 10000000,700000,350000,700000
DC10000000, 10000000,10000000,900000,10000000
BGW
AD,,,2800
T3=TIME
PR-360
BGX
AD,,,6800
T4=TIME
Z1=T4-T3
T3=TIME
PR-360
BGX
AD,,,10800
T4=TIME
Z2=T4-T3
T3=TIME
PR-360
BGX
AD,,,14800
T4=TIME
Z3=T4-T3
T3=TIME
PR360,-70
BGXY
AD,,,18800
T4=TIME
Z4=T4-T3
T3=TIME
PR360,-70
BGXY
AD,,,22800
T4=TIME
Z5=T4-T3
T3=TIME
PR360,-70
BGXY
AD,,,26800
T4=TIME
Z6=T4-T3
T3=TIME
PR-360
```

```
BGX
AD,,,30800
T4=TIME
Z7=T4-T3
T3=TIME
PR-360
BGX
AD,,,34800
T4=TIME
Z8=T4-T3
T3=TIME
PR-360
BGX
AD,,,38800
T4=TIME
Z9=T4-T3
T3=TIME
PR-90,-140
BGXY
AD,,,42800
T4=TIME
Z10=T4-T3
T3=TIME
PR,490
BGY
AD,,,46800
T4=TIME
Z11=T4-T3
T3=TIME
PR90,-490
BGXY
AD,,,50800
T4=TIME
Z12=T4-T3
T3=TIME
PR90,490
BGXY
AD,,,54800
T4=TIME
Z13=T4-T3
T3=TIME
PR90,-490
BGXY
AD,,,58800
T4=TIME
Z14=T4-T3
T3=TIME
PR90,490
BGXY
AD,,,62800
T4=TIME
Z15=T4-T3
T3=TIME
PR90,-490
BGXY
AD,,,66800
T4=TIME
Z16=T4-T3
T3=TIME
PR90,490
BGXY
AD,,,70800
T4=TIME
Z17=T4-T3
T3=TIME
PR90,-490
BGXY
AD,,,74800
T4=TIME
Z18=T4-T3
T3=TIME
PR90,490
```

08/656037

```
BGXY
AD,,,78800
T4=TIME
Z19=T4-T3
T3=TIME
PR90,-490
BGXY
AD,,,82800
T4=TIME
Z20=T4-T3
T3=TIME
PR90,490
BGXY
AD,,,86800
T4=TIME
Z21=T4-T3
T3=TIME
PR90,-490
BGXY
AD,,,90800
T4=TIME
Z22=T4-T3
T3=TIME
PR90,490
BGXY
AD,,,94800
T4=TIME
Z23=T4-T3
T3=TIME
PR90,-490
BGXY
AD,,,98800
T4=TIME
Z24=T4-T3
T3=TIME
PR90,490
BGXY
AD,,,102800
T4=TIME
Z25=T4-T3
T3=TIME
PR,-490
BGY
AD,,,106800
T4=TIME
Z26=T4-T3
T3=TIME
PR-90,490
BGXY
AD,,,110800
T4=TIME
Z27=T4-T3
T3=TIME
AD,,,111356
SB4
SB12
WT30
SB3
AD,,,114800
T4=TIME
Z28=T4-T3
WT50
CB4
CB12
WT100
CB3
WT20
AI-9
AI-10
SB13
WT50
CB13
```

08/656037

```
WT50
CB2
PA OX,OY
BGXY
T2=TIME
D1=T2-T1
MG"CYCLE"
JP#SS
EN
#SS2
JP#AIR,@IN[12]=1
JP#THRIM,@IN[9]=1
JP#THRIMB,@IN[10]=1
GA W
GR,,-2,,-2
ER315,315,400,4000,400
OX=_TPX
OY=_TPY
PR,,,116000
SP,,,V4=
SP V2=
SP ,V3=
AC10000000, 10000000,700000,350000,700000
DC10000000, 10000000,10000000,900000,10000000
BGW
AD,,,2800
T3=TIME
PR-360
BGX
AD,,,6800
T4=TIME
Z1=T4-T3
T3=TIME
PR-360
BGX
AD,,,10800
T4=TIME
Z2=T4-T3
T3=TIME
PR-360
BGX
AD,,,14800
T4=TIME
Z3=T4-T3
T3=TIME
PR360,-70
BGXY
AD,,,18800
T4=TIME
Z4=T4-T3
T3=TIME
PR360,-70
BGXY
AD,,,22800
T4=TIME
Z5=T4-T3
T3=TIME
PR360,-70
BGXY
AD,,,26800
T4=TIME
Z6=T4-T3
T3=TIME
PR-360
BGX
AD,,,30800
T4=TIME
Z7=T4-T3
T3=TIME
PR-360
BGX
AD,,,34800
```

```
T4=TIME
Z8=T4-T3
T3=TIME
PR-360
BGX
AD,,,38800
T4=TIME
Z9=T4-T3
T3=TIME
PR~90,-140
BGXY
AD,,,42800
T4=TIME
Z10=T4-T3
T3=TIME
PR,490
BGY
AD,,,46800
T4=TIME
Z11=T4-T3
T3=TIME
PR90,-490
BGXY
AD,,,50800
T4=TIME
Z12=T4-T3
T3=TIME
PR90,490
BGXY
AD,,,54800
T4=TIME
Z13=T4-T3
T3=TIME
PR90,-490
BGXY
AD,,,58800
T4=TIME
Z14=T4-T3
T3=TIME
PR90,490
BGXY
AD,,,62800
T4=TIME
Z15=T4-T3
T3=TIME
PR90,-490
BGXY
AD,,,66800
T4=TIME
Z16=T4-T3
T3=TIME
PR90,490
BGXY
AD,,,70800
T4=TIME
Z17=T4-T3
T3=TIME
PR90,-490
BGXY
AD,,,74800
T4=TIME
Z18=T4-T3
T3=TIME
PR90,490
BGXY
AD,,,78800
T4=TIME
Z19=T4-T3
T3=TIME
PR90,-490
BGXY
AD,,,82800
```

```
T4=TIME
Z20=T4-T3
T3=TIME
PR90,490
BGXY
AD,,,86800
T4=TIME
Z21=T4-T3
T3=TIME
PR90,-490
BGXY
AD,,,90800
T4=TIME
Z22=T4-T3
T3=TIME
PR90,490
BGXY
AD,,,94800
T4=TIME
Z23=T4-T3
T3=TIME
PR90,-490
BGXY
AD,,,98800
T4=TIME
Z24=T4-T3
T3=TIME
PR90,490
BGXY
AD,,,102800
T4=TIME
Z25=T4-T3
T3=TIME
PR,-490
BGY
AD,,,106800
T4=TIME
Z26=T4-T3
T3=TIME
PR-90,490
BGXY
AD,,,110800
T4=TIME
Z27=T4-T3
T3=TIME
AD,,,111356
SB4
SB12
WT30
SB3
AD,,,114800
T4=TIME
Z28=T4-T3
WT50
CB4
CB12
WT100
CB3
WT20
AI-9
AI-10
SB13
WT50
CB13
WT50
CB2
PA OX,OY
BGXY
EN
#HOME
HomeDone=0
VH2=0
```

08/656037

```
VH3=0
VH4=0
JP#AIR,@IN[12]=1
JP#TOUT,@IN[11]=1
SB2
WT300
JG-5000,5000,5000,,5000
ER315,315,400,4000,400
FIZE;FEXY
BGXYZE
AMXYZE
WT10
DP0,0
PR1670,1225,1605,,1610
SP5000,5000,5000,,5000
BGXYZE
AMZE
MG "2"
VH2=1
AMXY
MG "3"
VH3=1
AC,,,20000
DC,,,20000
JGW=-5000
FIW
BGW
AMW
WT50
AC,,,20000
DC,,,20000
SP,,,20000
PR,,,1230
BGW
AMW
CB2
MG "4"
VH4=1
HomeDone=1
EN
#POSERR
AB1
CB1
CB16
CB14
WAPos=_TPW
WEPos=_TEW
MG"PE"
AB
RE
#HANDS
ER315,315,400,4000,400
JP#TOUT,@IN[11]=1
GA F
GR,,-2,1,-2
EN
#WHANDS
JP#TOUT,@IN[11]=1
GA F
GR,,,1
EN
#A
A=@IN[7]
A=
SB1
SB16
SB14
JP#HOME
EN
#B
A1=@IN[7]
A1=
```

```
EN
#THRIM
MG"12"
WT20
ST
EN
#AIR
MG"13"
WT20
CB2
CB3
CB4
CB12
CB5
CB6
CB7
CB8
CB9
CB10
CB11
CB12
CB15
EN
#THRIMB
MG"11"
WT20
ST
EN
#START
XQ#SS,1
XQ#STEP,2
EN
#STEP
JP#AIR,@IN[12]=1
AI-2
SB15
WT30
CB15
AI13
SB5
WT20
SB6
WT150
CB6
AI-6
CB10
WT150
SB7
AI-5
WT30
SB8
WT100
CB5
WT100
SB9
JP#STEP
EN
#NEW
JP#AIR,@IN[12]=1
CB11
CB8
CB9
CB7
AI-6
CB10
SB15
WT30
CB15
AI13
SB5
WT20
SB6
```

```
WT150
CB6
WT100
SB7
AI-5
WT70
SB8
WT100
CB5
WT100
SB9
EN
#JOGA
JP#AIR,@IN[12]=1
CB5
CB7
CB8
CB9
CB11
AI-6
CB10
SB15
WT50
CB15
EN
#JOGB
SB5
WT100
SB6
WT150
CB6
EN
#JOGC
AI-6
SB7
EN
#JOGBC
CB7
EN
#JOGD
AI-5
SB8
EN
#JOGBD
CB8
EN
#JOGE
CB5
WT100
SB9
EN
#JOGBE
CB9
AI-5
SB5
EN
#JOGF
AI-14
SB10
EN
#JOGBF
CB10
EN
#JOGG
AI-2
SB11
EN
#JOGBG
CB11
EN
#JOGH
AI-3
```

```
SB2
EN
#JOGBH
CB2
EN
#JOGI
CB11
EN
#JOGJ
CB5
CB9
CB7
CB8
AI-6
CB10
CB2
EN
#TOUT
MG"10"
JP#SS
EN
#JOGR
CB5
CB9
CB7
CB8
AI-6
CB10
EN
```

ATTY DOCKET: 49140.C1

APPENDIX B

Computer Program Listing of the User

Interface Screens for Electronically

Geared Sewing Machine

Tice Engineering and Sales, Inc.
6711 Maynardville Highway
Knoxville, Tennessee 37918

Michael E. Sellers, Esq.
LUEDEKA, NEELY & GRAHAM, P.C.
Suite 1871, Riverview Tower
900 South Gay Street
Knoxville, Tennessee 37902
Telephone: (423) 546-4305

Express Mailing Label Number: EM 531 349 381 US

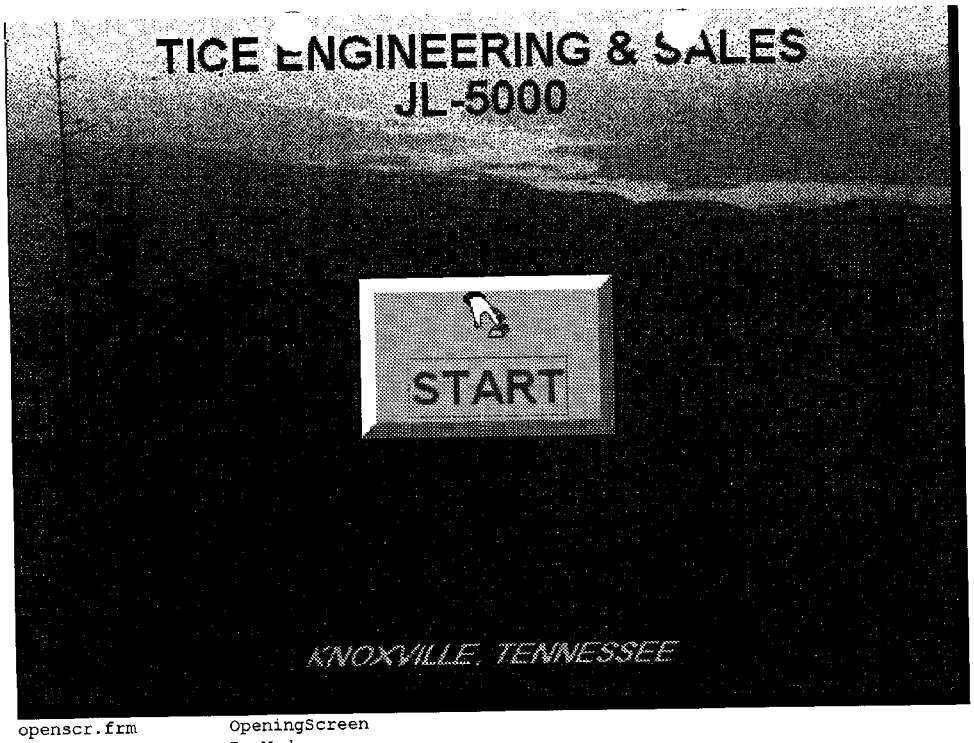
A
openscr.frm OpeningScreen
runmode.frm RunMode
B
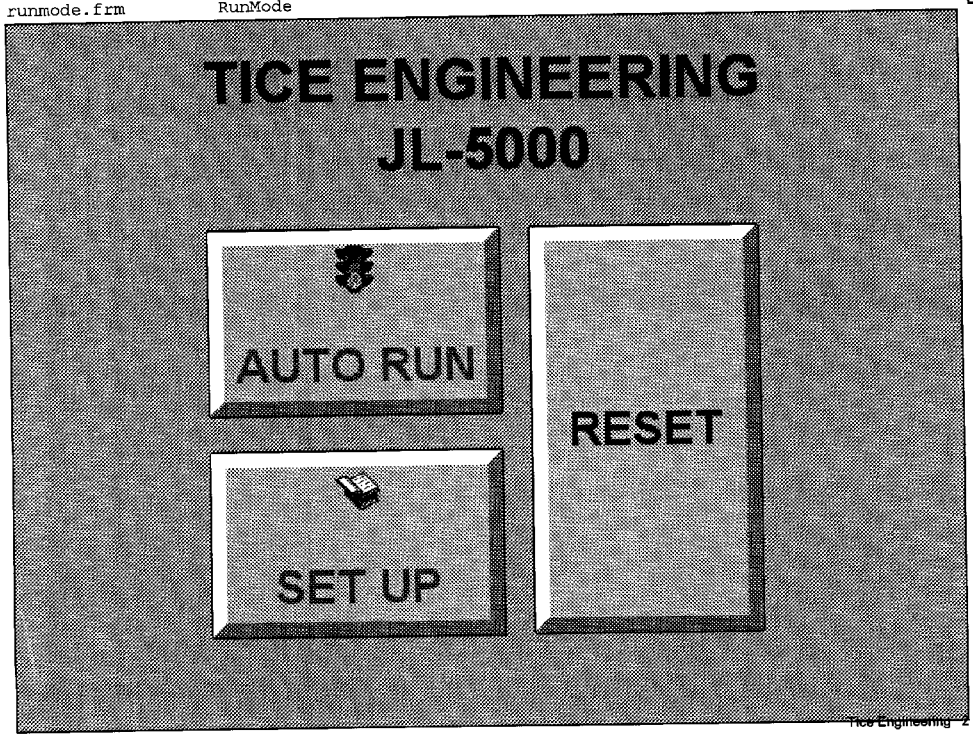

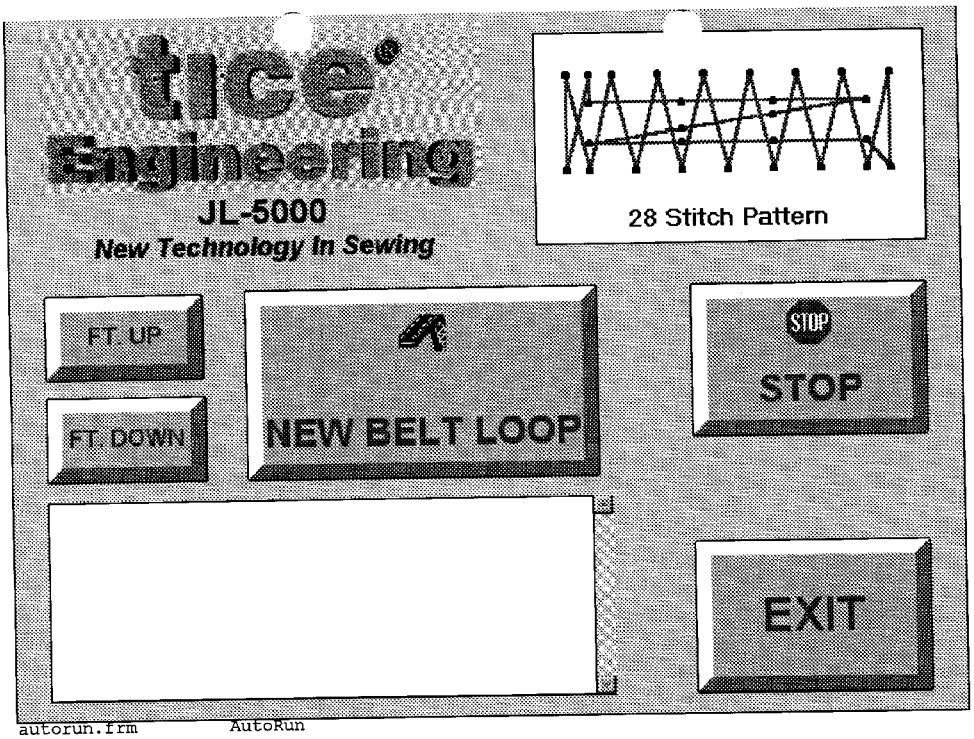
A
autorun.frm AutoRun
autorun.frm AutoRun
B
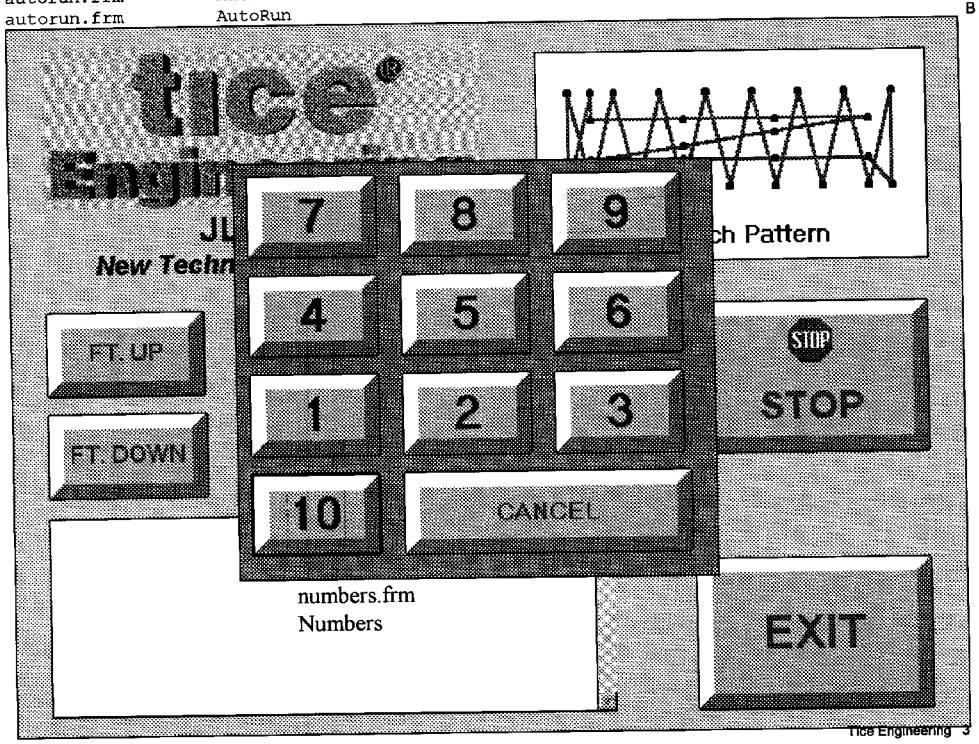
numbers.frm
Numbers
Tice Engineering 3

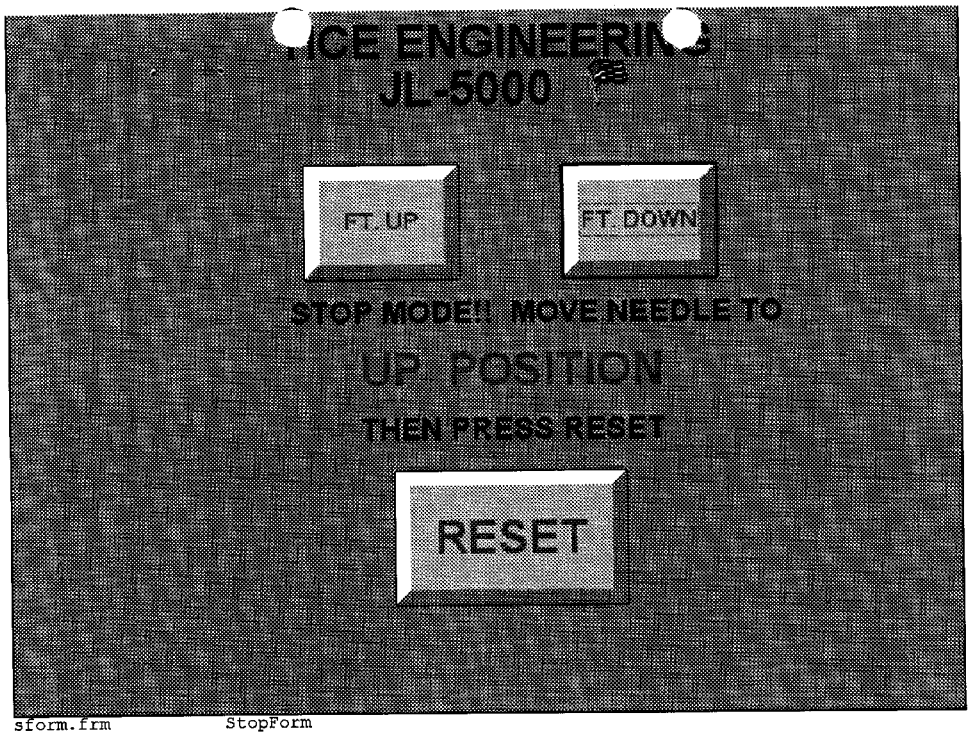
A
sform.frm StopForm
graph.frm Grapher
B
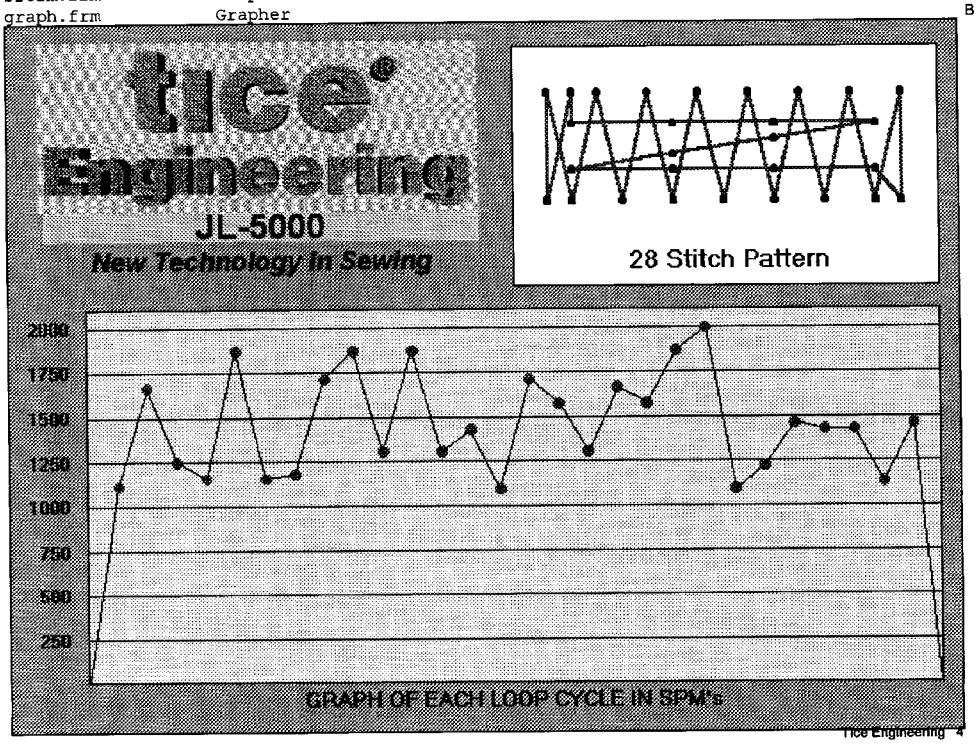

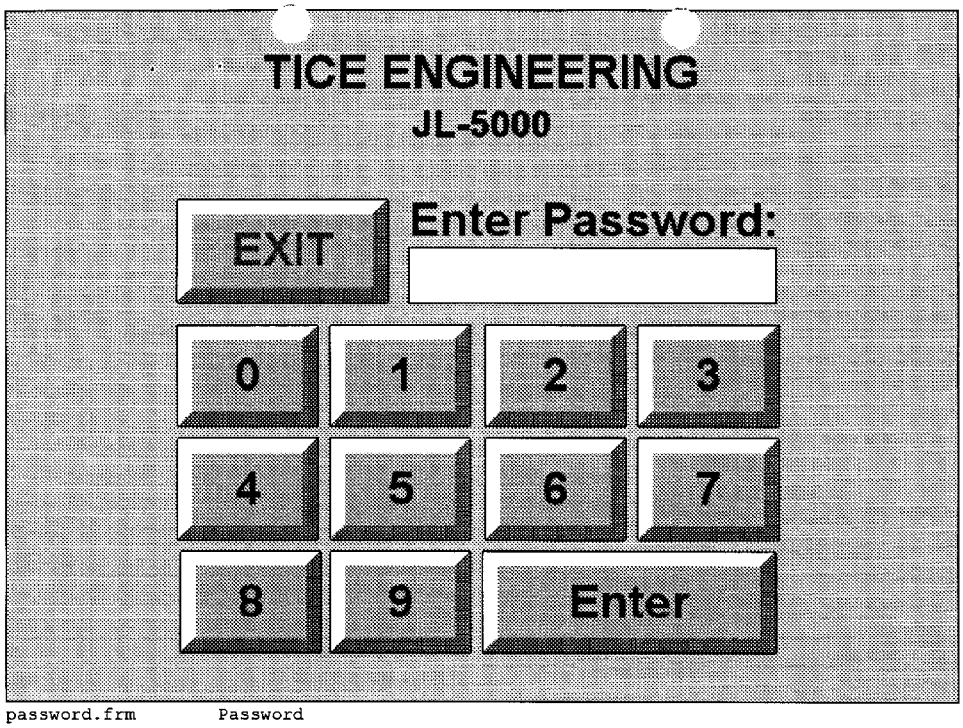
password.frm Password A
setup.frm SetupForm B
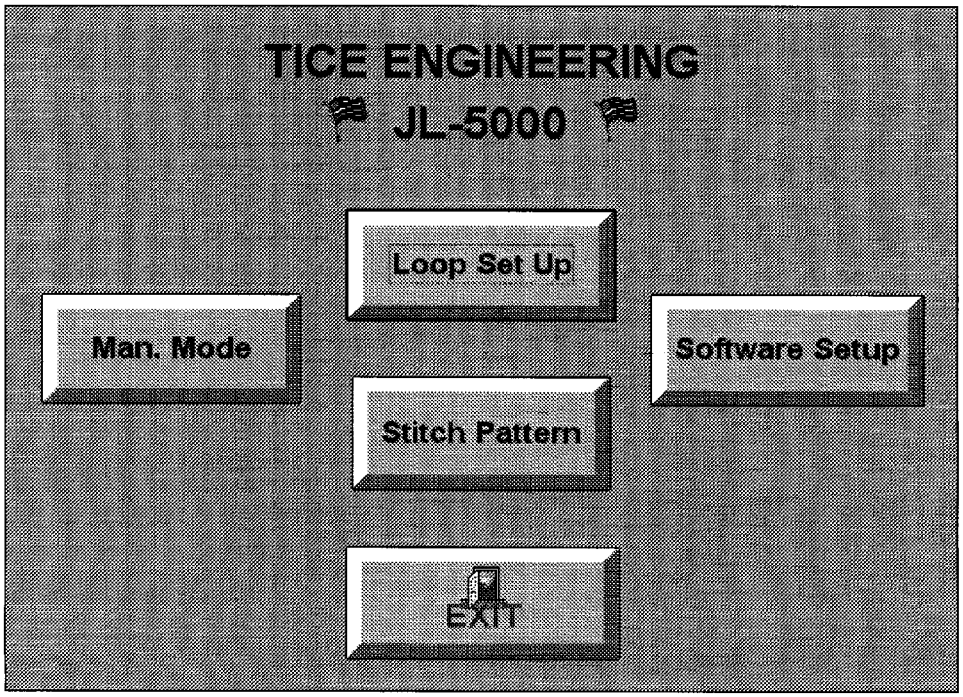
Tice Engineering 5

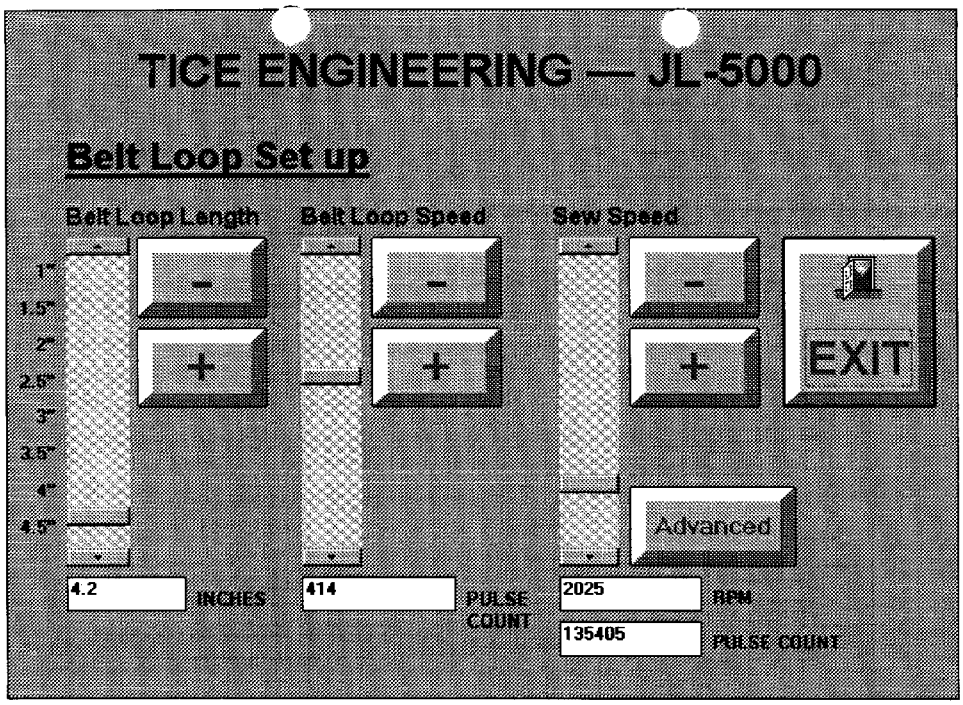
beltloop.frm BeltLoopSetup A
sspeed.frm SSpeed B
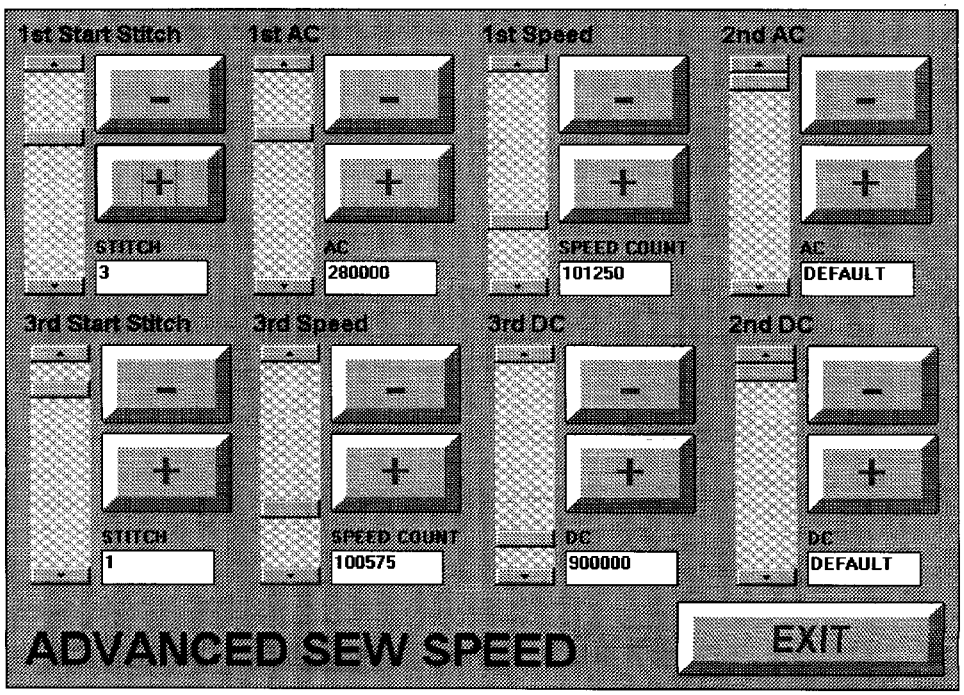
Tice Engineering 6

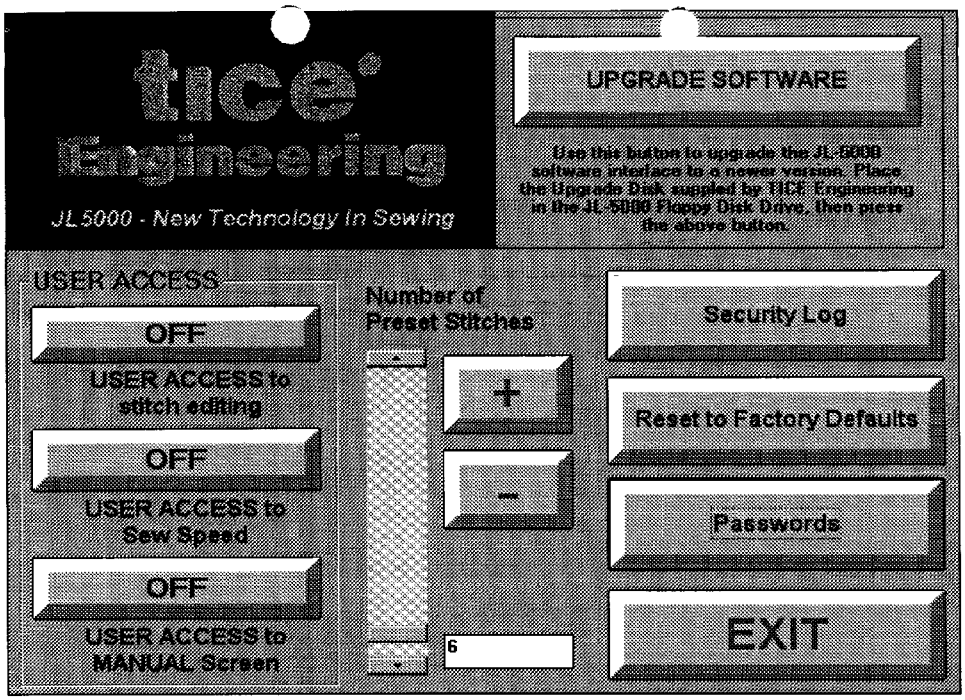
```
softwar3.frm        Software3        A
softwar2.frm        Software2        B
```
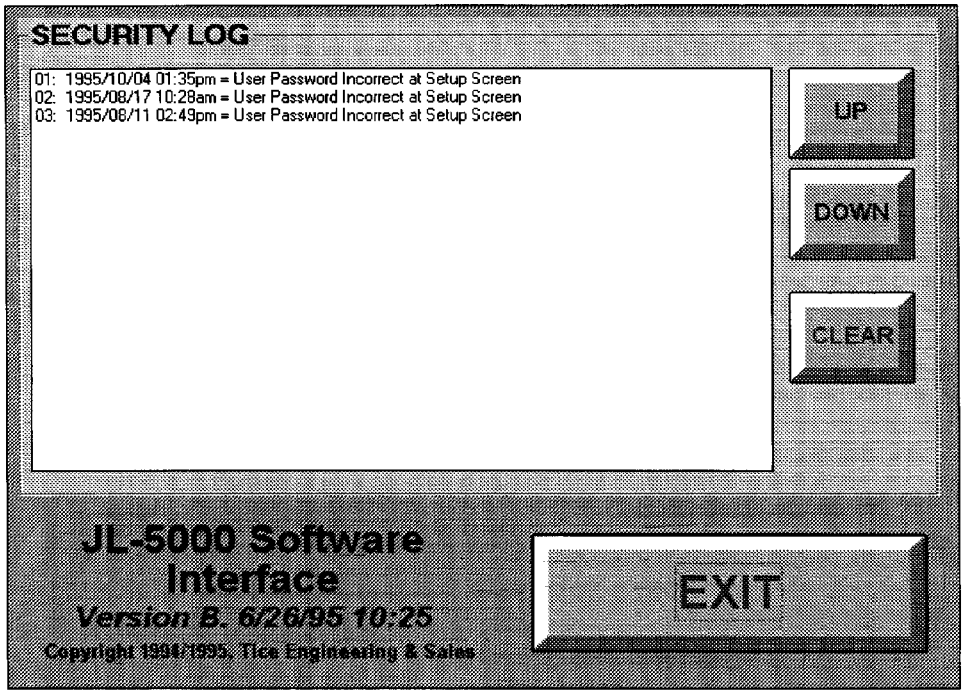
Tice Engineering 7

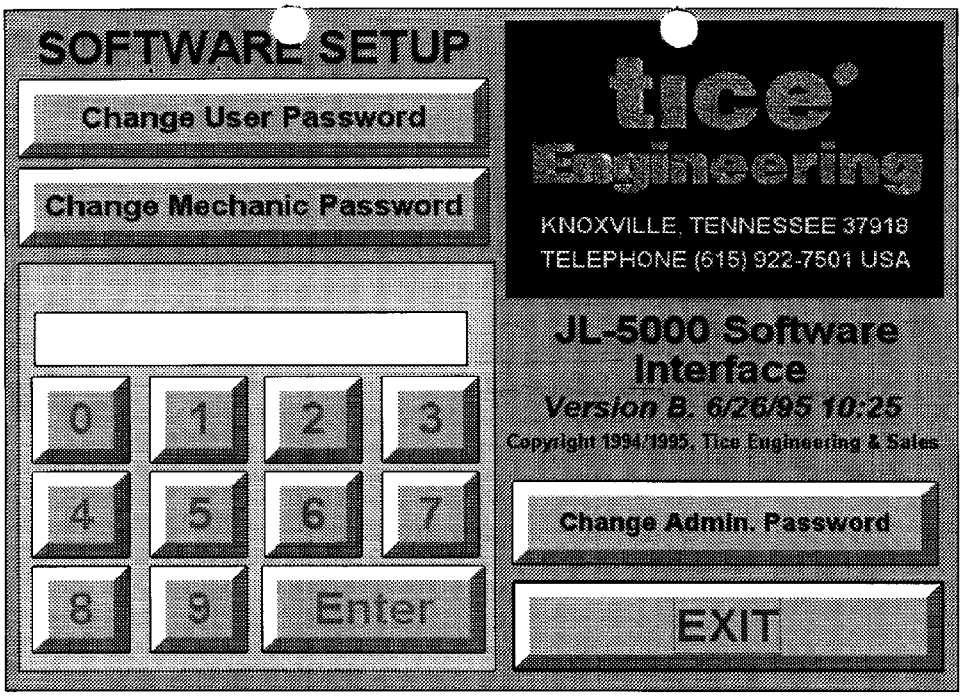
software.frm SoftwareSetup A
spattern.frm SPattern B
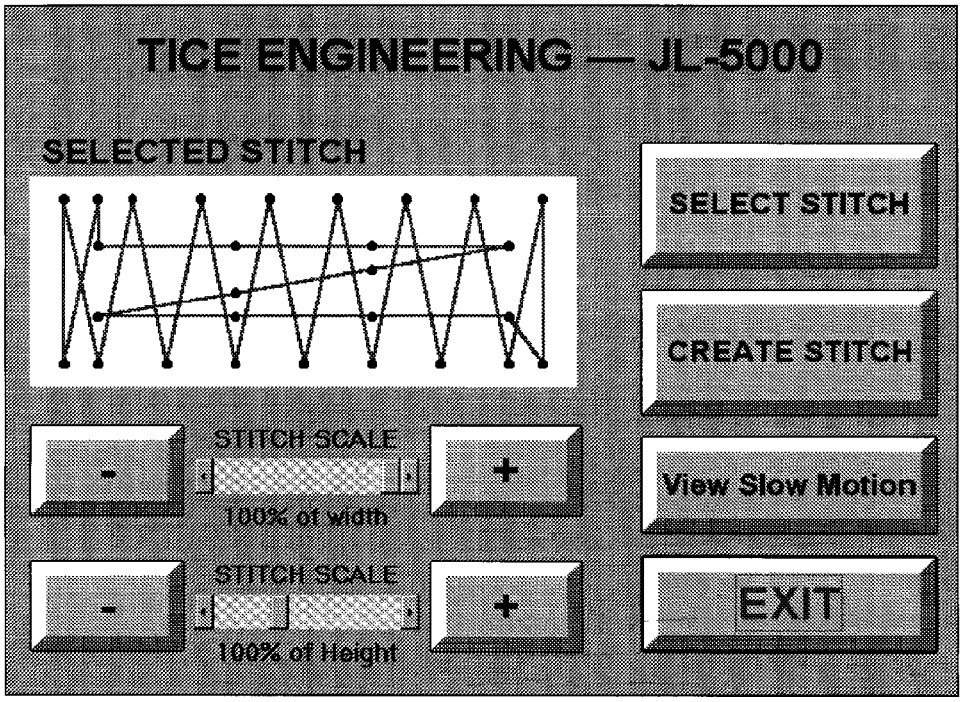
Tice Engineering 8

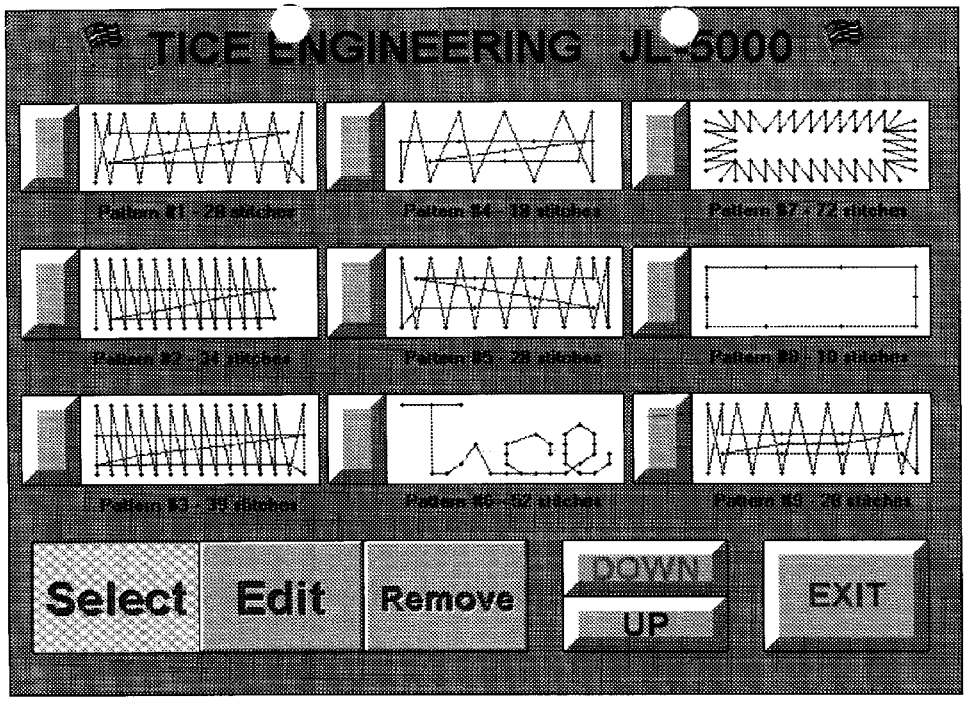
pstitch.frm PickStitch A
smaker.frm StitchMaker B
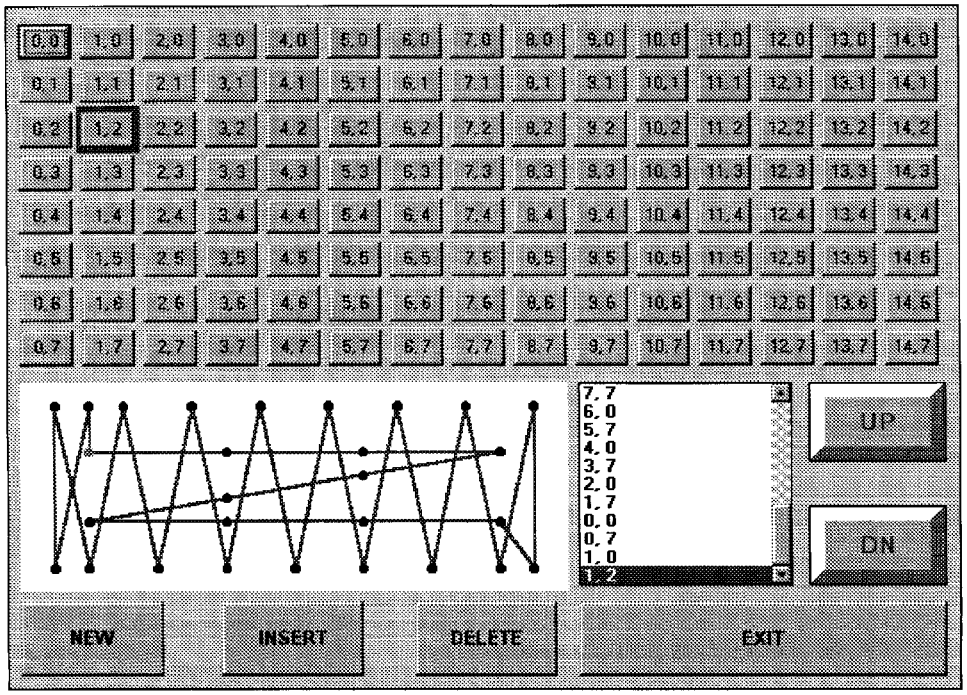
Tice Engineering 9

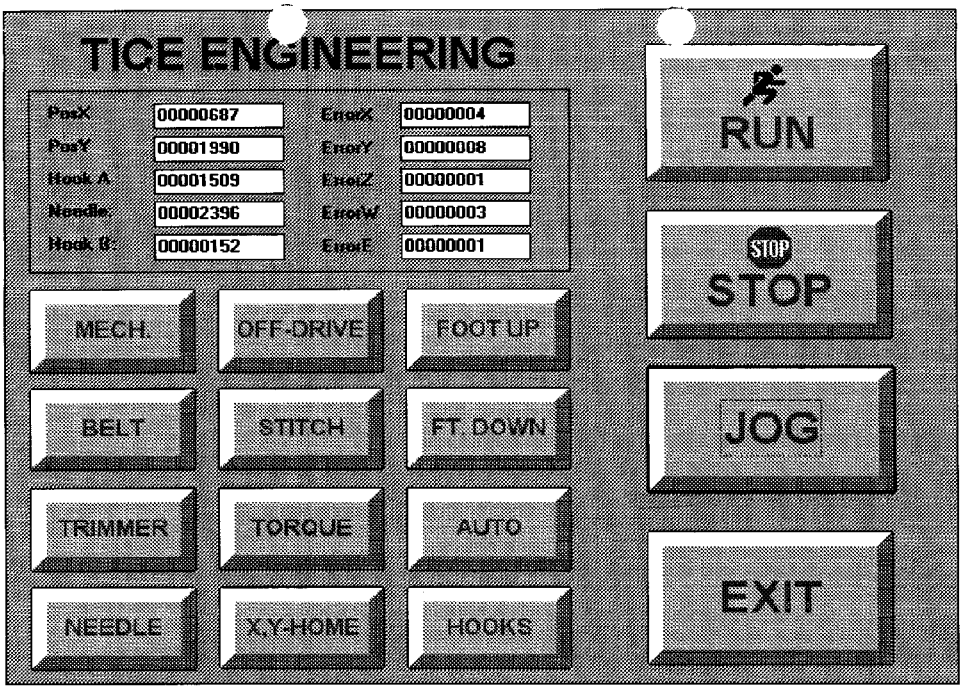
manual.frm Manual A
mech.frm Mech B
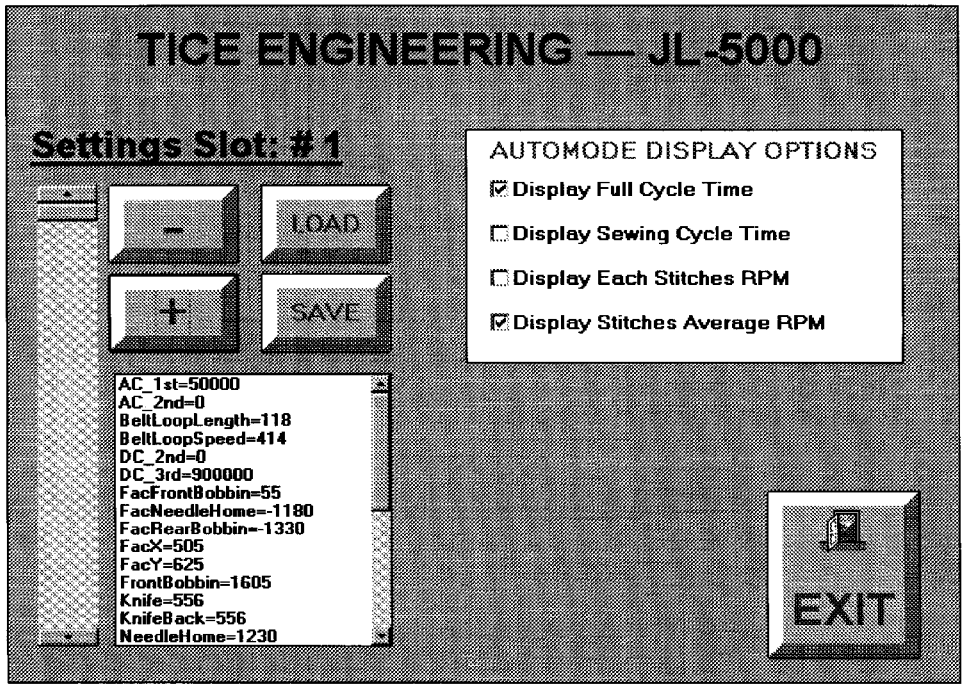
Tice Engineering 10

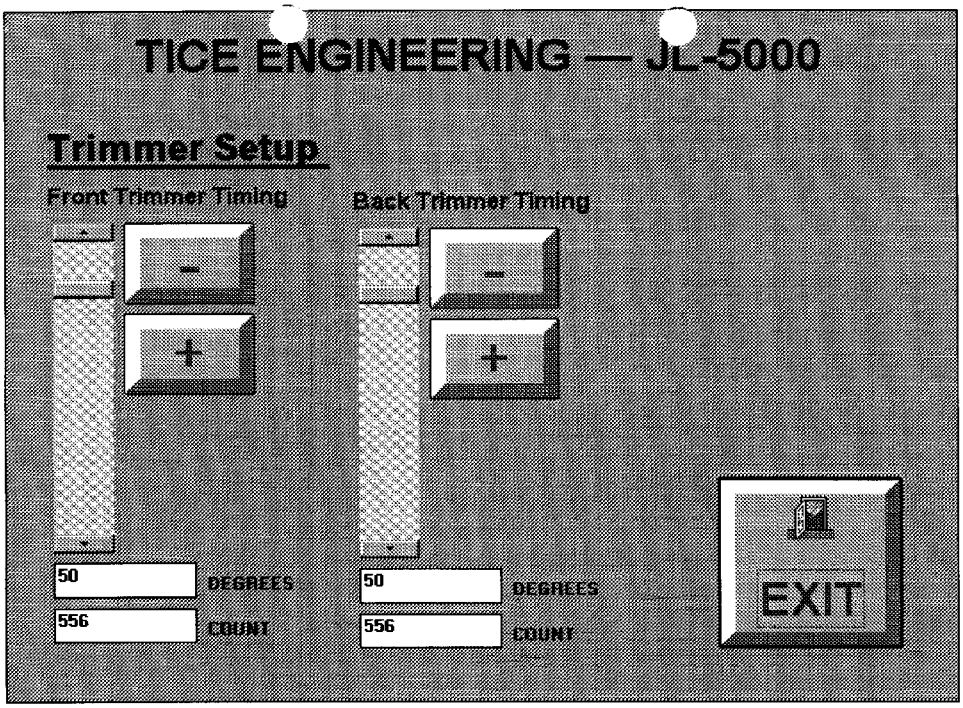
trimmer.frm Trimmer A
torque.frm Torque B
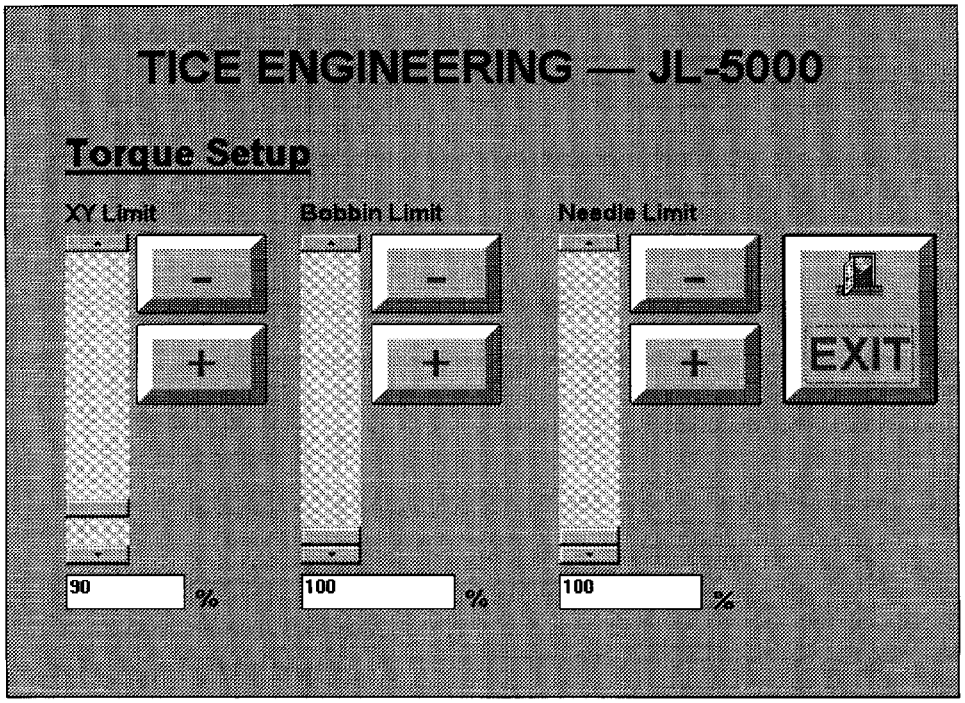

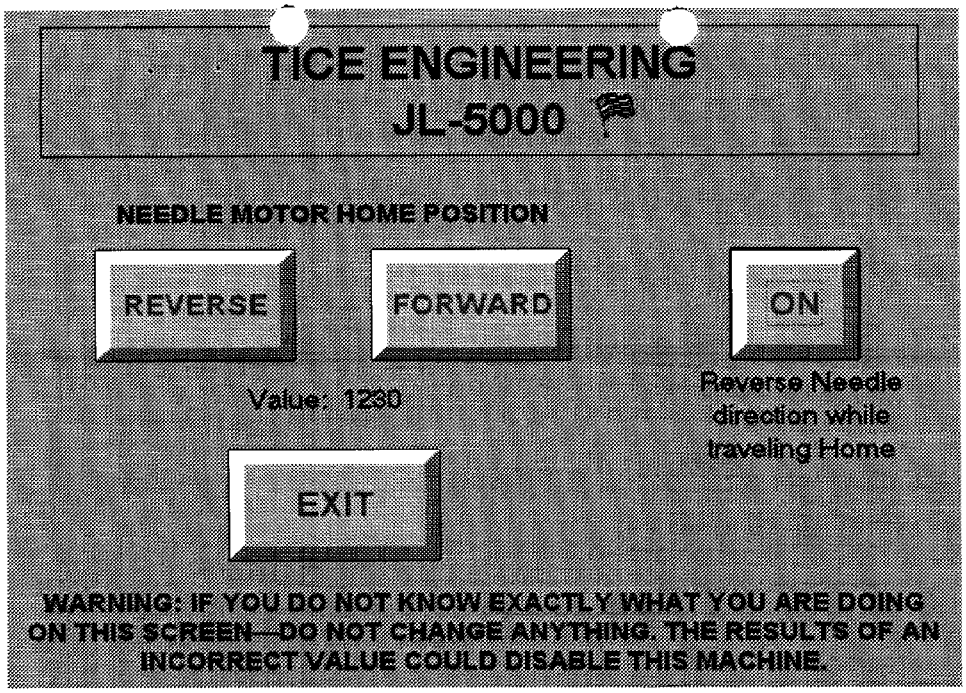
nm_home.frm NeedleMotorHome A
xyadjust.frm XYAdjust B
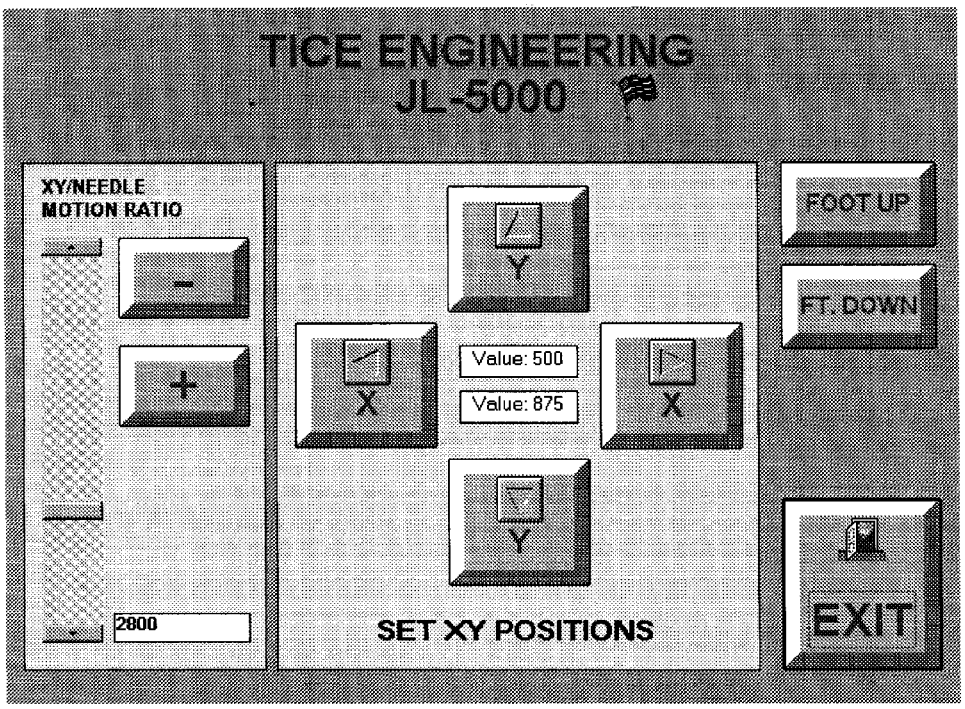
Tice Engineering 12

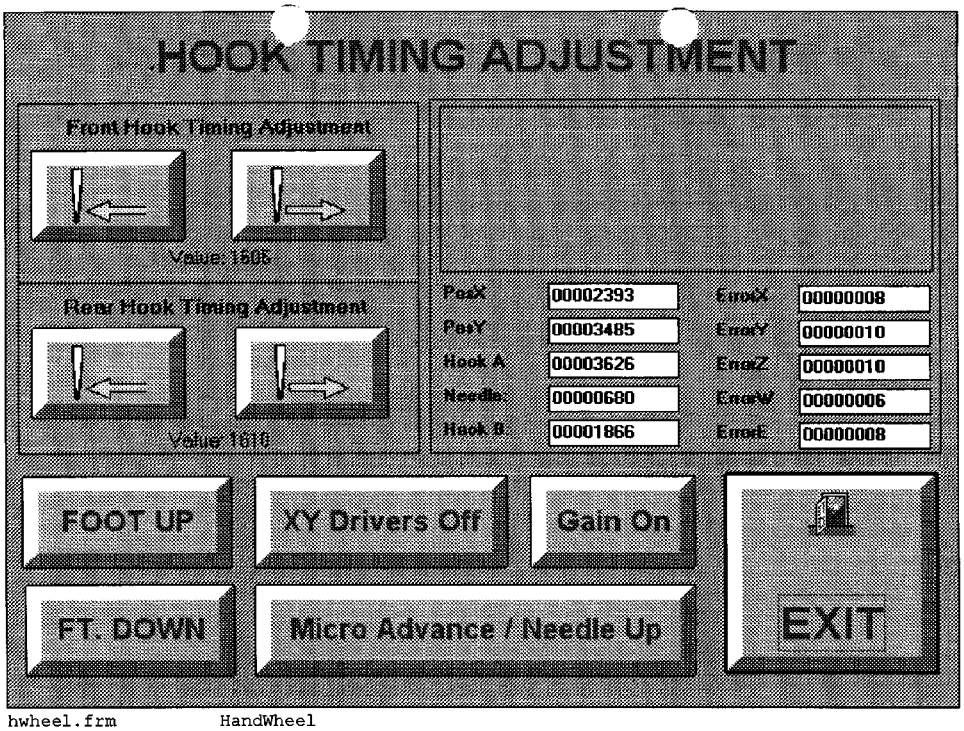
A
hwheel.frm HandWheel
stopform2.frm StopForm2
B
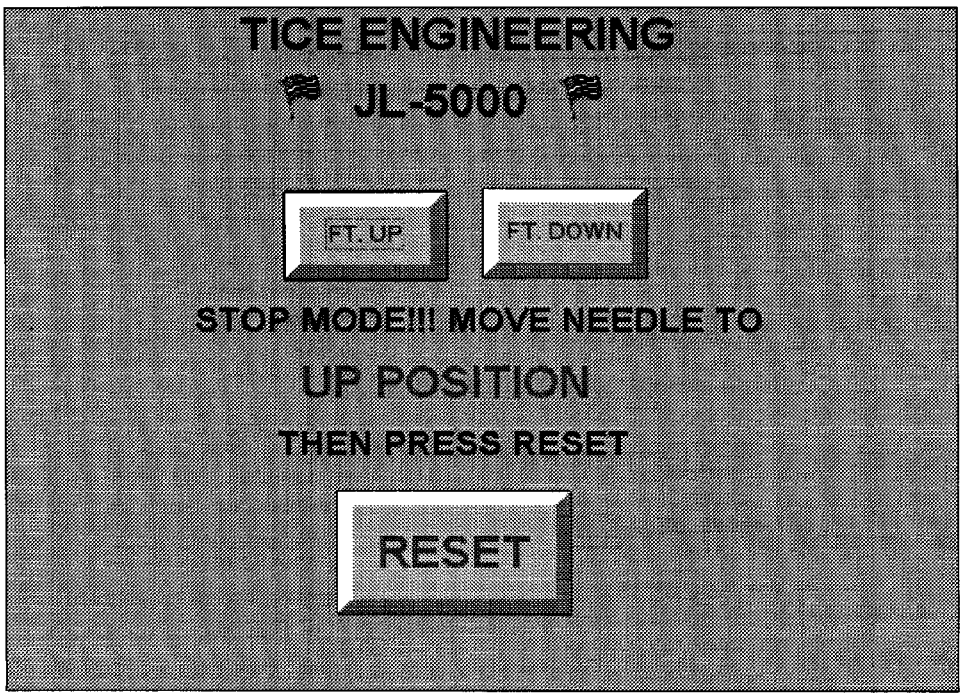
Tice Engineering 13

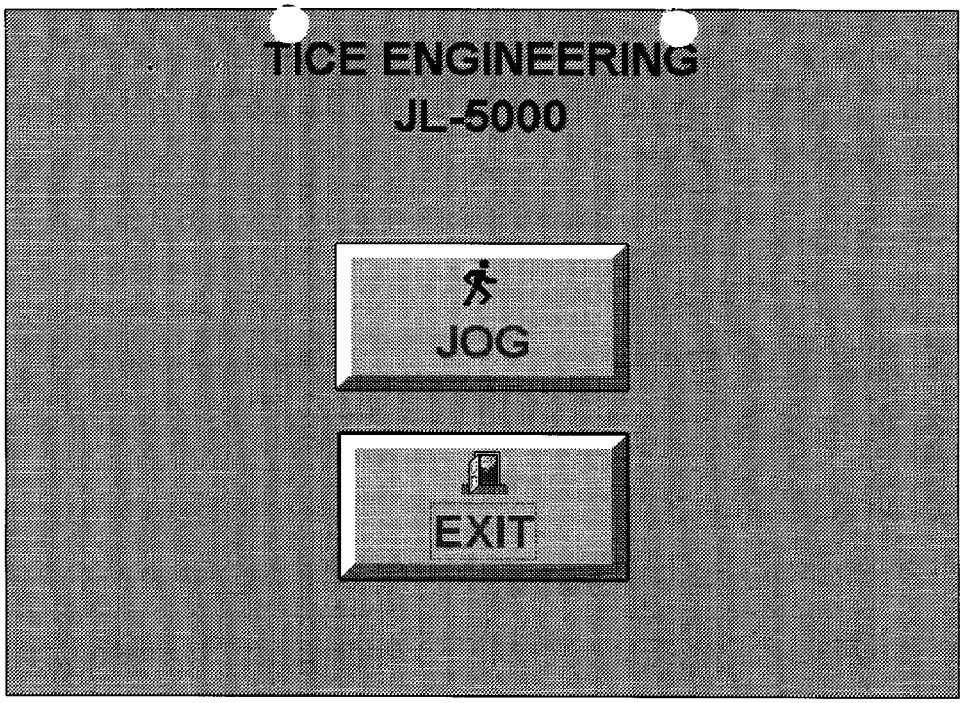
jog.frm JogForm A
jog.frm JogForm B
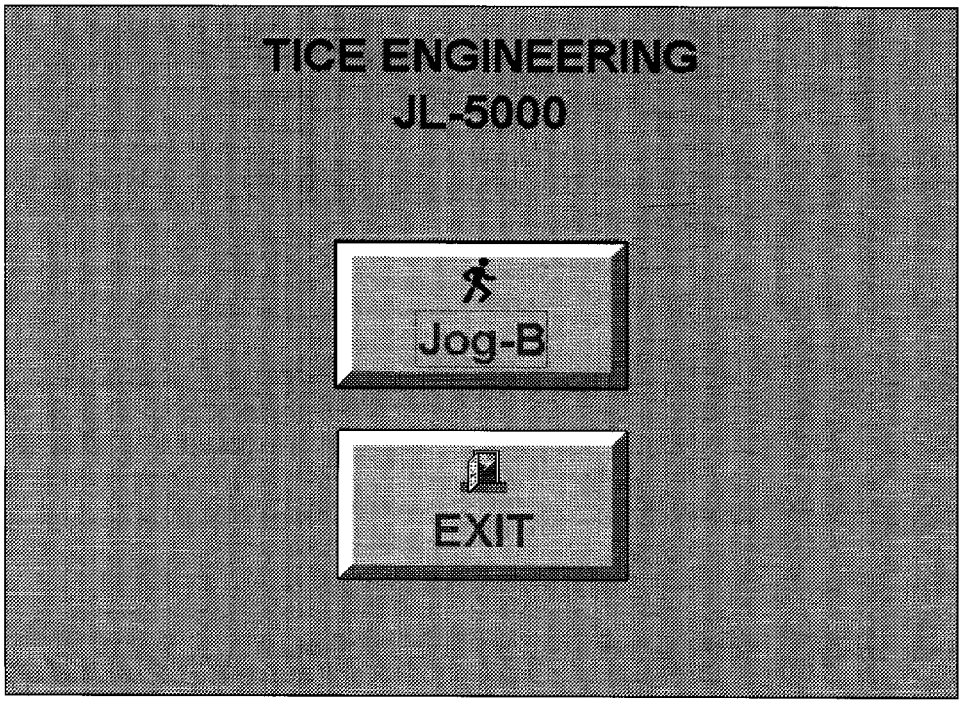
Tice Engineering 14

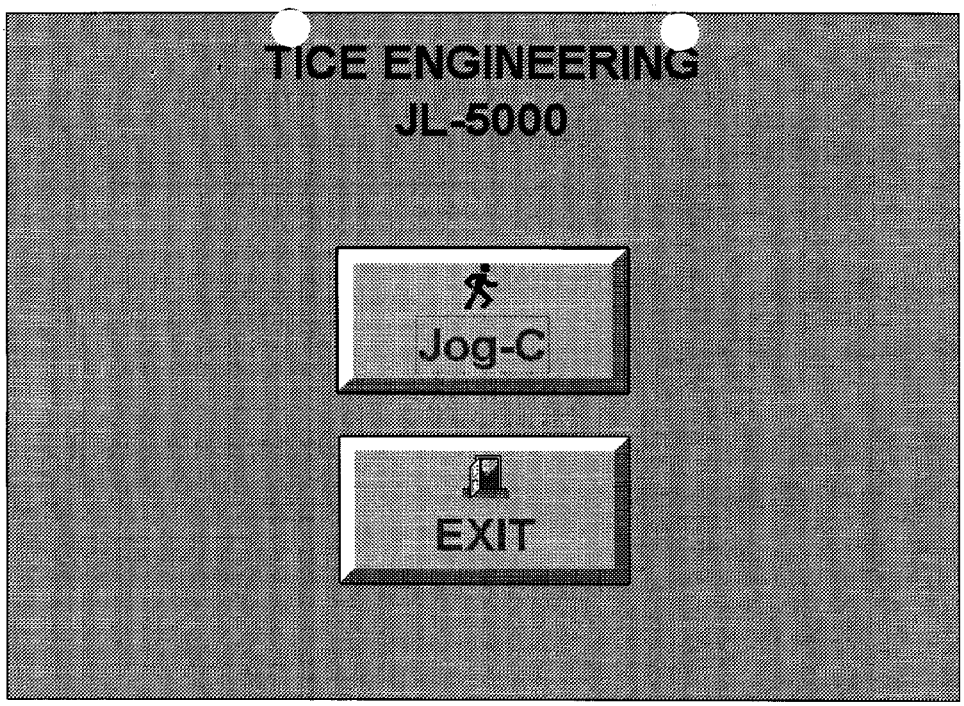
jog.frm JogForm A
jog.frm JogForm B
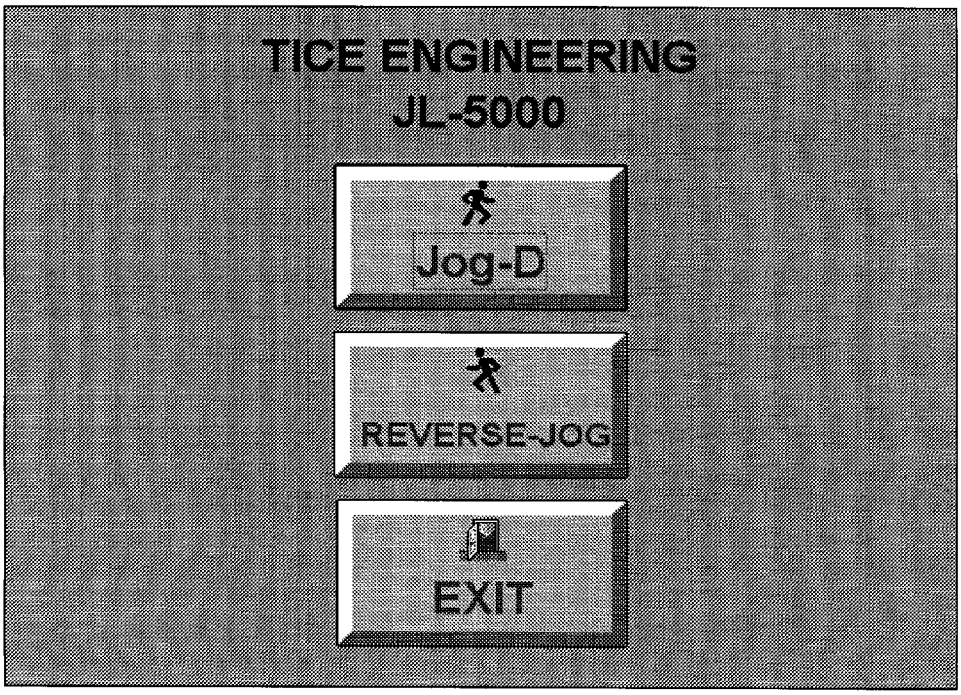
Tice Engineering 15

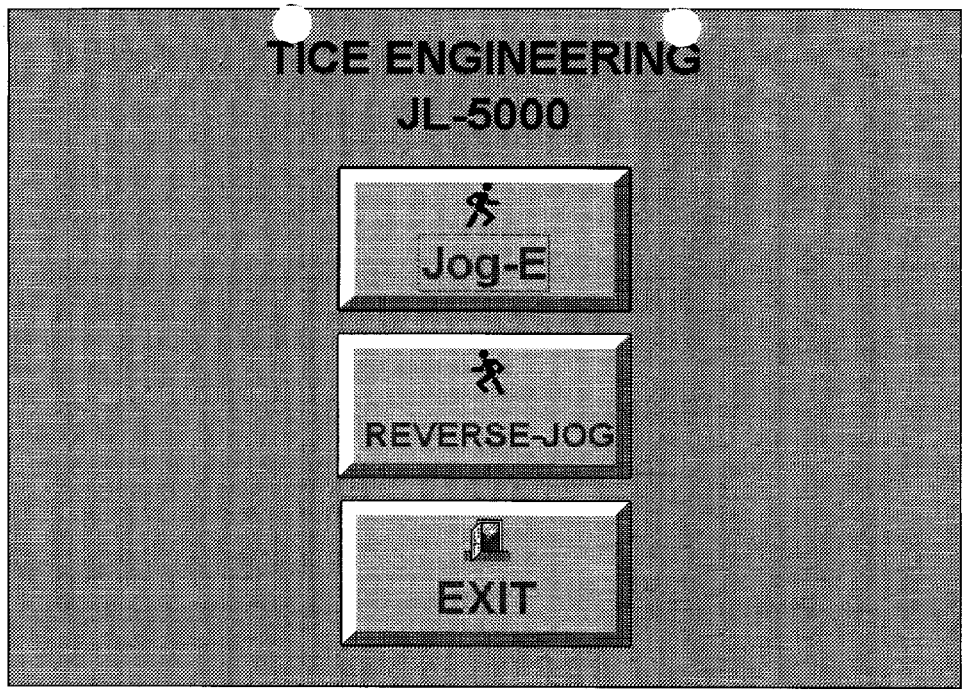
```
jog.frm      JogForm                                    A
jog.frm      JogForm                                    B
```
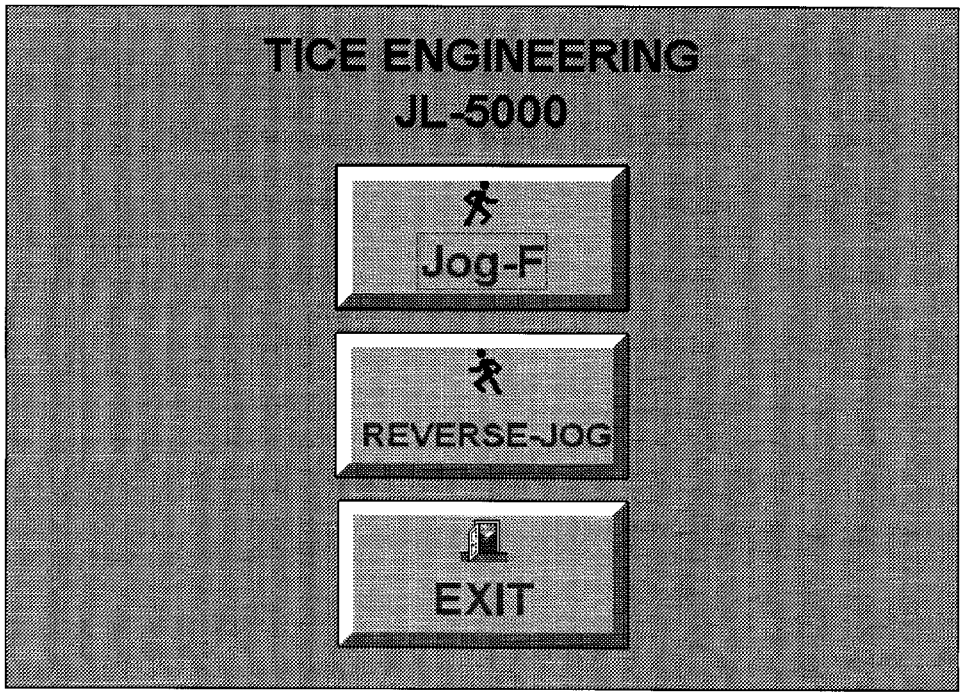
Tice Engineering 16

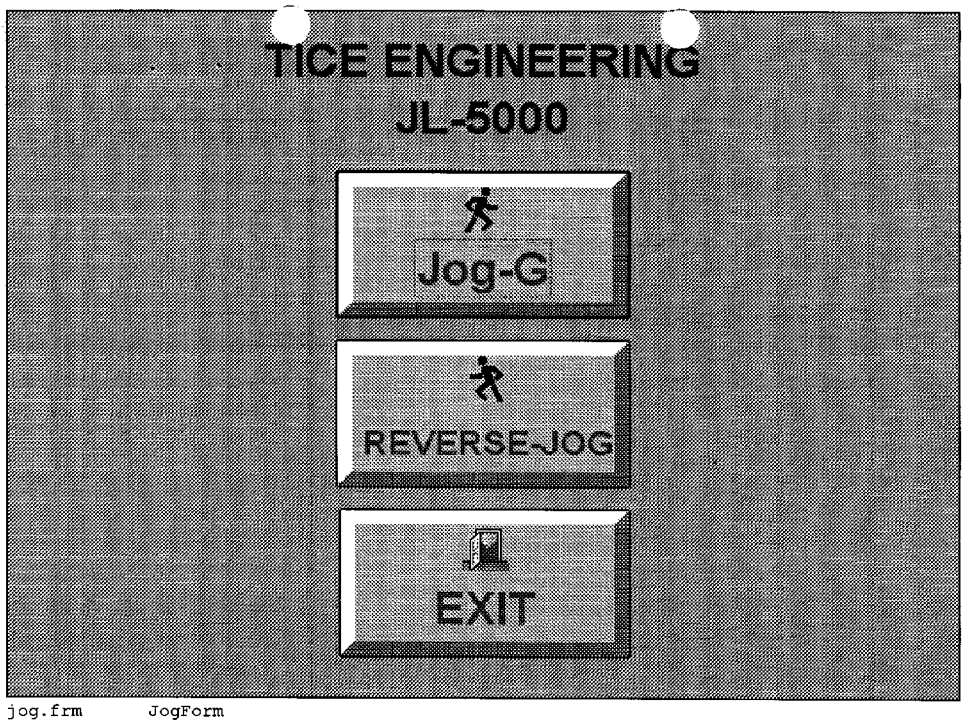
jog.frm JogForm A
jog.frm JogForm B
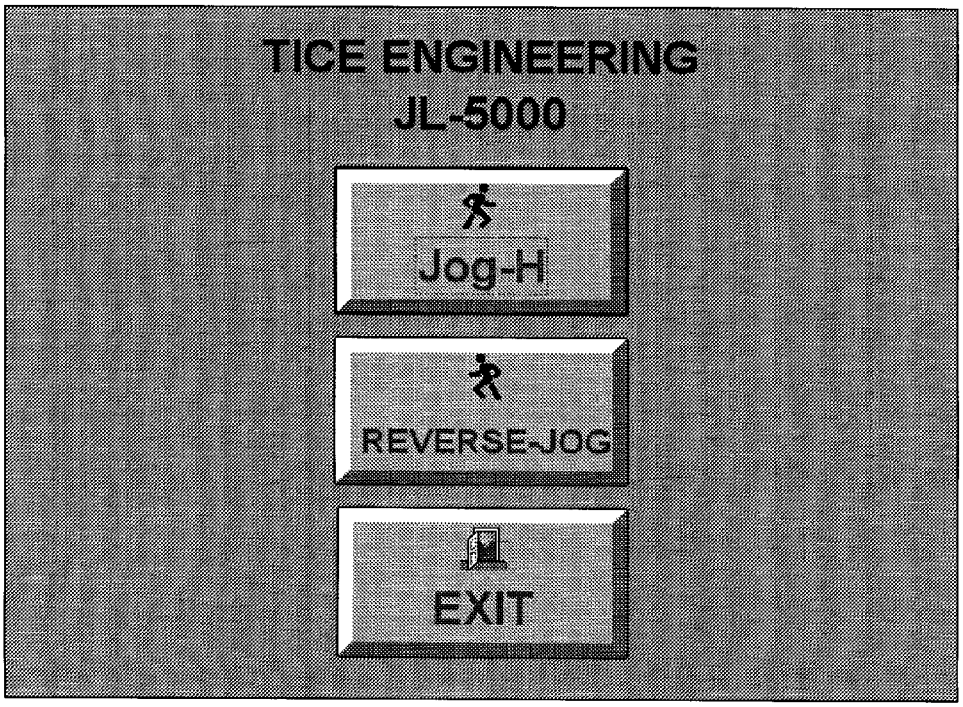
Tice Engineering 17

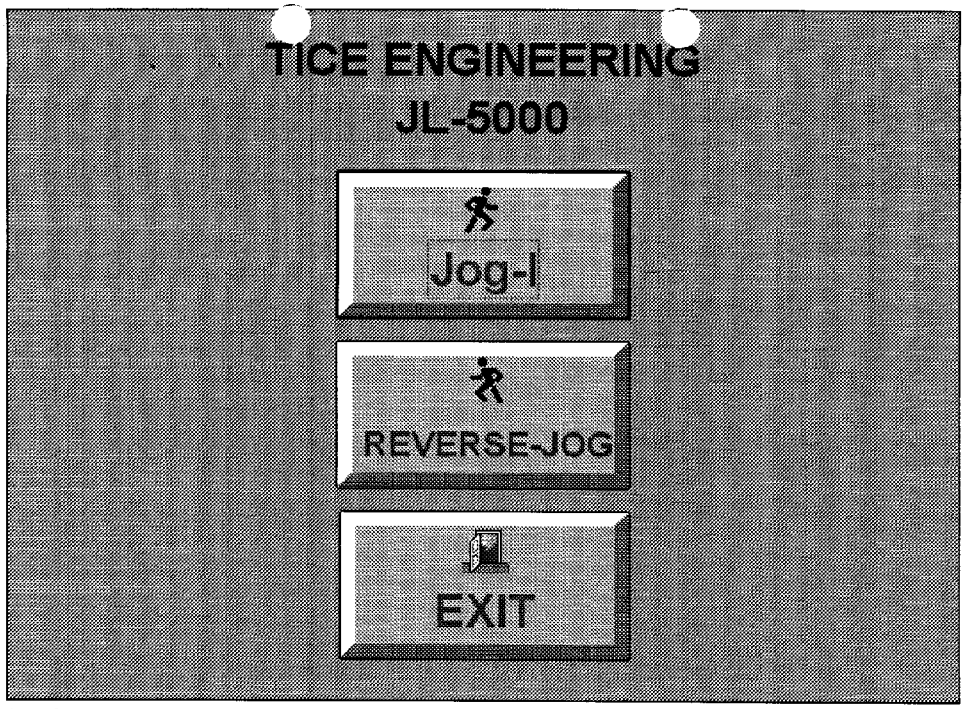
jog.frm JogForm A
jog10.frm JogForm10 B
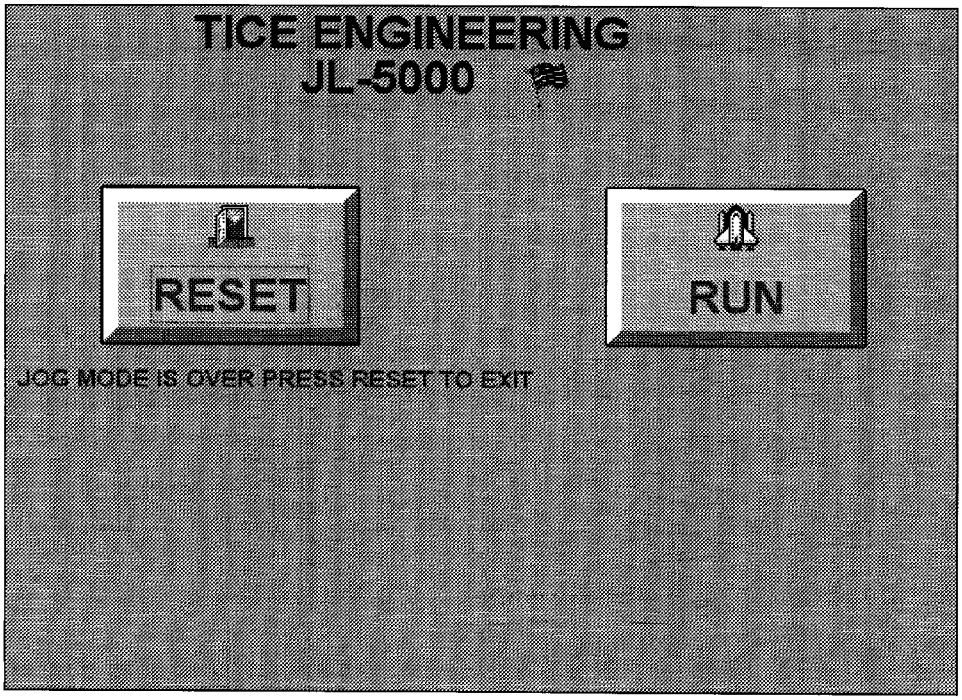
Tice Engineering 18

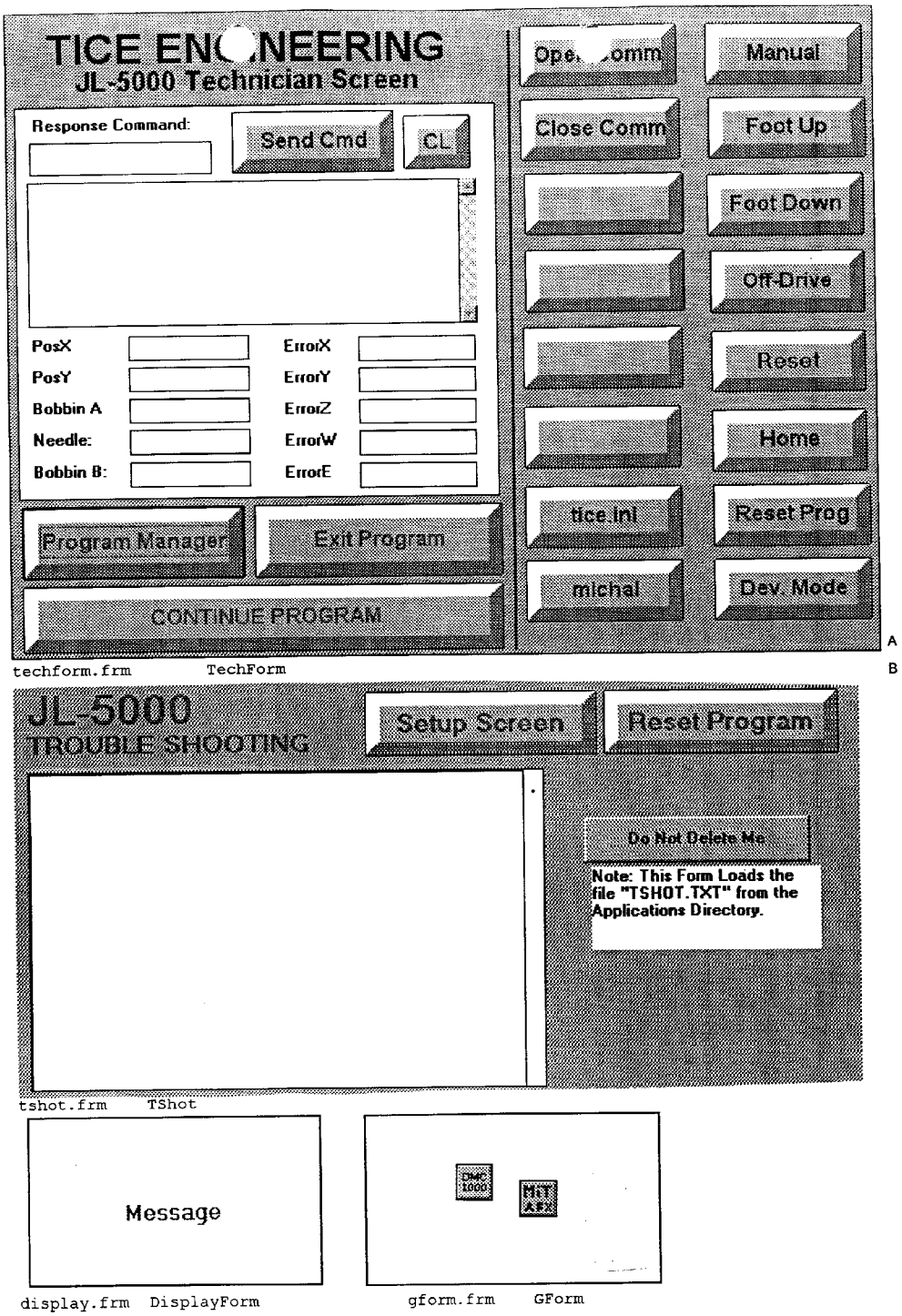
TICE ENGINEERING
JL-5000 Technician Screen
Response Command:
Send Cmd
CL
PosX
PosY
Bobbin A
Needle:
Bobbin B:
ErrorX
ErrorY
ErrorZ
ErrorW
ErrorE
Program Manager
Exit Program
CONTINUE PROGRAM
Manual
Close Comm
Foot Up
Foot Down
Off-Drive
Reset
Home
tice.ini
Reset Prog
michal
Dev. Mode
A
B
techform.frm TechForm
JL-5000
TROUBLE SHOOTING
Setup Screen
Reset Program
Do Not Delete Me
Note: This Form Loads the file "TSHOT.TXT" from the Applications Directory.
tshot.frm TShot
Message
display.frm DisplayForm
gform.frm GForm
Tice Engineering 19

Tice_ini.bas

```
Function LoadTVFile (ByVal slot%) As Integer
'Get File Name
    FN$ = Path$ & Format$(slot%, "00") & ".TV"
    If Dir$(FN$) = "" And FN$ <> "" Then
        MsgBox "Cannot Load. There is nothing saved in slot #" & Format$(slot%), 0,
"Load Saved Slot"
        Exit Function
        End If
'Erase Old Values
    success% = Writeini("JL5000", "", "", Path$ & "TICE.ini")

'Get JL5000 Section
    Ret$ = Getini(FN$, "JL5000", "", "")

'Delimit Values
    If Ret$ <> "" Then
        If Right$(Ret$, 1) <> Chr$(0) Then Ret$ = Ret$ & Chr$(0)
        Do Until Ret$ = ""
            X% = InStr(Ret$, Chr$(0))
            tmp$ = Left$(Ret$, X% - 1)
            Ret$ = Mid$(Ret$, X% + 1)
            Ret2$ = Getini(FN$, "JL5000", tmp$, "")
            success% = Writeini("JL5000", tmp$, Ret2$, Path$ & "TICE.ini")
        Loop
        End If

CurrentStitch$ = ReadCurrentStitch()
LoadTVFile = True


End Function

Function Read_AverageCycle () As Integer

Read_AverageCycle = Val(Getini(Path$ & "TICE.ini", "Options", "AverageCycle", "0"))

End Function



Function Read_EachCycle () As Integer

Read_EachCycle = Val(Getini(Path$ & "TICE.ini", "Options", "EachCycle", "0"))

End Function

Function Read_FullCycle () As Integer

Read_FullCycle = Val(Getini(Path$ & "TICE.ini", "Options", "FullCycle", "1"))

End Function

Function Read_SewingCycle () As Integer

Read_SewingCycle = Val(Getini(Path$ & "TICE.ini", "Options", "SewingCycle", "0"))

End Function

Function Read_W_Limit () As Integer

Read_W_Limit = Val(Getini(Path$ & "TICE.ini", "JL5000", "W_Limit",
Format$(DefaultWLimit)))

End Function

Function Read_XY_Limit () As Integer
```

```
Read_XY_Limit = Val(Getini(Path$ & "TICE.ini", "JL5000", "XY_Limit",
Format$(DefaultXYLimit)))

End Function

Function Read_XYW_Ratio () As Integer

Read_XYW_Ratio = Val(Getini(Path$ & "TICE.ini", "JL5000", "XYW_Ratio",
Format$(DefaultXYWRatio)))

End Function

Function Read_ZE_Limit () As Integer

Read_ZE_Limit = Val(Getini(Path$ & "TICE.ini", "JL5000", "ZE_Limit",
Format$(DefaultZELimit)))

End Function

Function ReadAdminPassword () As String
ReadAdminPassword = Trim$(Getini(Path$ & "tice.ini", "Info", "AdminPassword", ""))

End Function

Function ReadBeltLoopLength () As Integer
ReadBeltLoopLength = Val(Getini(Path$ & "TICE.ini", "JL5000", "BeltLoopLength",
Format$(DefaultBeltLoopLength)))

End Function

Function ReadBeltLoopSpeed () As Integer

ReadBeltLoopSpeed = Val(Getini(Path$ & "TICE.ini", "JL5000", "BeltLoopSpeed",
Format$(DefaultBeltLoopSpeed)))
End Function

Function ReadCurrentStitch () As String
On Error Resume Next

tmp$ = Trim$(Getini(Path$ & "tice.ini", "JL5000", "Stitch", ""))
If tmp$ = "" Or Dir$(tmp$) = "" Then tmp$ = Path$ & "00000001.sti"

ReadCurrentStitch = tmp$

End Function

Function ReadFacFrontBobbin () As String

ReadFacFrontBobbin = Getini(Path$ & "TICE.ini", "Fac", "FacFrontBobbin", "")

End Function

Function ReadFacHomeX () As String

ReadFacHomeX = Getini(Path$ & "TICE.ini", "Fac", "FacX", "")

End Function

Function ReadFacHomeXYW () As String

ReadFacHomeXYW = Getini(Path$ & "TICE.ini", "Fac", "XYW_Ratio", "")

End Function

Function ReadFacHomeY () As String

ReadFacHomeY = Getini(Path$ & "TICE.ini", "Fac", "FacY", "")

End Function
```

```
Function ReadFacKnife () As Integer

ReadFacKnife = Int(Val(Getini(Path$ & "TICE.ini", "Fac", "FacKnife",
Format$(DefaultKnife))))

End Function

Function ReadFacKnifeBack () As Integer

ReadFacKnifeBack = Int(Val(Getini(Path$ & "TICE.ini", "Fac", "FacKnifeBack",
Format$(DefaultKnife))))

End Function


Function ReadFacNeedleHome () As String

ReadFacNeedleHome = Getini(Path$ & "TICE.ini", "Fac", "FacNeedleHome", "")

End Function

Function ReadFacNeedleHomeJog () As String

ReadFacNeedleHomeJog = Getini(Path$ & "TICE.ini", "Fac", "FacNeedleHomeJog", "")

End Function

Function ReadFacRearBobbin () As String

ReadFacRearBobbin = Getini(Path$ & "TICE.ini", "Fac", "FacRearBobbin", "")

End Function

Function ReadFrontBobbin () As Double

ReadFrontBobbin = Val(Getini(Path$ & "TICE.ini", "JL5000", "FrontBobbin",
ReadFacFrontBobbin()))

End Function

Function ReadHomeX () As Integer

ReadHomeX = Val(Getini(Path$ & "TICE.ini", "JL5000", "X", ReadFacHomeX()))

End Function

Function ReadHomeY () As Integer

ReadHomeY = Val(Getini(Path$ & "TICE.ini", "JL5000", "Y", ReadFacHomeY()))

End Function

Function ReadIntializationError () As String

ReadIntializationError = Getini(Path$ & "tice.ini", "Error", "Opening", "")

End Function

Function ReadKnife () As String

ReadKnife = Format$(Int(Val(Getini(Path$ & "TICE.ini", "JL5000", "Knife",
Format$(DefaultKnife)))))

End Function

Function ReadKnifeBack () As String
```

```
ReadKnifeBack = Format$(Int(Val(Getini(Path$ & "TICE.ini", "JL5000", "KnifeBack",
Format$(ReadKnife()))))))

End Function

Function ReadMechPassword () As String
ReadMechPassword = Trim$(Getini(Path$ & "tice.ini", "Info", "MechPassword", ""))

End Function

Function ReadNeedleHome () As Integer

ReadNeedleHome = Val(Getini(Path$ & "TICE.ini", "JL5000", "NeedleHome",
ReadFacNeedleHome()))

End Function

Function ReadNeedleHomeJog () As Integer

ReadNeedleHomeJog = Val(Getini(Path$ & "TICE.ini", "JL5000", "NeedleHomeJog",
ReadFacNeedleHomeJog()))

End Function



Function ReadNumberOfPresetStitches ()

r% = Val(Getini(Path$ & "tice.ini", "JL5000", "Options", Format$(DefaultPresets)))

If r% < 1 Then r% = DefaultPresets

ReadNumberOfPresetStitches = r%

End Function

Function ReadRearBobbin () As Double

ReadRearBobbin = Val(Getini(Path$ & "TICE.ini", "JL5000", "RearBobbin",
ReadFacRearBobbin()))

End Function

Function ReadSewSpeed () As Double
r# = Int(Val(Getini(Path$ & "TICE.ini", "JL5000", "SewSpeed",
Format$(DefaultSewSpeed))))
ReadSewSpeed = r#
End Function

Function ReadStitchScaleX () As Single

ReadStitchScaleX = Val(Getini(Path$ & "tice.ini", "JL5000", "StitchScaleX",
Format$(DefaultStitchScaleX)))

End Function

Function ReadStitchScaleY () As Single

ReadStitchScaleY = Val(Getini(Path$ & "tice.ini", "JL5000", "StitchScaleY",
Format$(DefaultStitchScaleY)))

End Function

Function ReadUser1 () As Integer
ReadUser1 = Val(Trim$(Getini(Path$ & "tice.ini", "Info", "User1", "0")))

End Function

Function ReadUser2 () As Integer
ReadUser2 = Val(Trim$(Getini(Path$ & "tice.ini", "Info", "User2", "0")))
```

```
End Function

Function ReadUser3 () As Integer
ReadUser3 = Val(Trim$(Getini(Path$ & "tice.ini", "Info", "User3", "0")))

End Function

Function ReadUserPassword () As String

ReadUserPassword = Trim$(Getini(Path$ & "tice.ini", "Info", "Password", ""))



End Function

Sub Write_AverageCycle (ByVal Value As Integer)

success% = Writeini("Options", "AverageCycle", Format$(Value), Path$ & "TICE.ini")

End Sub

Sub Write_EachCycle (ByVal Value As Integer)

success% = Writeini("Options", "EachCycle", Format$(Value), Path$ & "TICE.ini")

End Sub

Sub Write_FullCycle (ByVal Value As Integer)

success% = Writeini("Options", "FullCycle", Format$(Value), Path$ & "TICE.ini")

End Sub

Sub Write_SewingCycle (ByVal Value As Integer)

success% = Writeini("Options", "SewingCycle", Format$(Value), Path$ & "TICE.ini")

End Sub


Sub Write_W_Limit (ByVal Value As Integer)

success% = Writeini("JL5000", "W_Limit", Format$(Value), Path$ & "TICE.ini")

End Sub

Sub Write_XY_Limit (ByVal Value As Integer)

success% = Writeini("JL5000", "XY_Limit", Format$(Value), Path$ & "TICE.ini")


End Sub

Sub Write_XYW_Ratio (ByVal Value As Integer)

success% = Writeini("JL5000", "XYW_Ratio", Format$(Value), Path$ & "TICE.ini")


End Sub

Sub Write_ZE_Limit (ByVal Value As Integer)

success% = Writeini("JL5000", "ZE_Limit", Format$(Value), Path$ & "TICE.ini")


End Sub
```

```
Function WriteAdminPassword (ByVal NP$) As Integer

WriteAdminPassword = Writeini("Info", "AdminPassword", NP$, Path$ & "tice.ini")
End Function

Sub WriteBeltLoopLength (ByVal NewBeltLoopLength As Integer)

tmp$ = Format$(NewBeltLoopLength)
success% = Writeini("JL5000", "BeltLoopLength", tmp$, Path$ & "TICE.ini")

End Sub

Sub WriteBeltLoopSpeed (ByVal NewBeltLoopSpeed As Integer)

tmp$ = Format$(NewBeltLoopSpeed)
success% = Writeini("JL5000", "BeltLoopSpeed", tmp$, Path$ & "TICE.ini")

End Sub

Function WriteCurrentStitch (ByVal NewStitch$) As Integer

WriteCurrentStitch = Writeini("JL5000", "Stitch", NewStitch$, Path$ & "tice.ini")

End Function

Function WriteFacFrontBobbin (ByVal V#) As Double

WriteFacFrontBobbin = Writeini("Fac", "FacFrontBobbin", Format$(V#), Path$ &
"TICE.ini")

End Function

Function WriteFacHomeX (ByVal V%) As Integer

WriteFacHomeX = Writeini("Fac", "FacX", Format$(V%), Path$ & "TICE.ini")

End Function

Function WriteFacHomeXYW (ByVal V%) As Integer

WriteFacHomeXYW = Writeini("Fac", "XYW_Ratio", Format$(V%), Path$ & "TICE.ini")

End Function

Function WriteFacHomeY (ByVal V%) As Integer

WriteFacHomeY = Writeini("Fac", "FacY", Format$(V%), Path$ & "TICE.ini")

End Function

Function WriteFacKnife (ByVal V%) As Integer

WriteFacKnife = Writeini("Fac", "FacKnife", Format$(V%), Path$ & "TICE.ini")

End Function

Function WriteFacKnifeBack (ByVal V%) As Integer

WriteFacKnifeBack = Writeini("Fac", "FacKnifeBack", Format$(V%), Path$ & "TICE.ini")

End Function

Function WriteFacNeedleHome (ByVal V#) As Double

WriteFacNeedleHome = Writeini("Fac", "FacNeedleHome", Format$(V#), Path$ &
"TICE.ini")

End Function

Function WriteFacNeedleHomeJog (ByVal V#) As Double
```

```
WriteFacNeedleHomeJog = Writeini("Fac", "FacNeedleHomeJog", Format$(V#), Path$ &
"TICE.ini")

End Function

Function WriteFacRearBobbin (ByVal V#) As Double

WriteFacRearBobbin = Writeini("Fac", "FacRearBobbin", Format$(V#), Path$ &
"TICE.ini")

End Function

Function WriteFrontBobbin (ByVal V#) As Double

WriteFrontBobbin = Writeini("JL5000", "FrontBobbin", Format$(V#), Path$ &
"TICE.ini")

End Function

Function WriteHomeX (ByVal V%) As Integer

WriteHomeX = Writeini("JL5000", "X", Format$(V%), Path$ & "TICE.ini")

End Function

Function WriteHomeY (ByVal V%) As Integer

WriteHomeY = Writeini("JL5000", "Y", Format$(V%), Path$ & "TICE.ini")

End Function

Sub WriteIntializationError (ByVal V$)

X% = Writeini("Error", "Opening", V$, Path$ & "tice.ini")

End Sub

Sub WriteKnife (ByVal Value As Integer)

success% = Writeini("JL5000", "Knife", Format$(Value), Path$ & "TICE.ini")

End Sub

Sub WriteKnifeBack (ByVal Value As Integer)

success% = Writeini("JL5000", "KnifeBack", Format$(Value), Path$ & "TICE.ini")

End Sub

Function WriteMechPassword (ByVal NP$) As Integer

WriteMechPassword = Writeini("Info", "MechPassword", NP$, Path$ & "tice.ini")

End Function

Function WriteNeedleHome (ByVal V#) As Double

WriteNeedleHome = Writeini("JL5000", "NeedleHome", Format$(V#), Path$ & "TICE.ini")

End Function

Function WriteNeedleHomeJog (ByVal V#) As Double

WriteNeedleHomeJog = Writeini("JL5000", "NeedleHomeJog", Format$(V#), Path$ &
"TICE.ini")

End Function
```

```
Function WriteNumberOfPresetStitches (ByVal V%) As Integer

WriteNumberOfPresetStitches = Writeini("JL5000", "Options", Format$(V%), Path$ &
"TICE.ini")

End Function

Function WriteRearBobbin (ByVal V#) As Double

WriteRearBobbin = Writeini("JL5000", "RearBobbin", Format$(V#), Path$ & "TICE.ini")

End Function

Sub WriteSewSpeed (ByVal NewSewSpeed As Double)

'Speed is in EncoderCount (Pulse Count)
    tmp$ = Trim$(Str$(NewSewSpeed))
    success% = Writeini("JL5000", "SewSpeed", tmp$, Path$ & "TICE.ini")
    G_SetSewSpeed NewSewSpeed



End Sub

Function WriteStitchScaleX (ByVal V As Single) As Integer

WriteStitchScaleX = Writeini("JL5000", "StitchScaleX", Format$(V), Path$ &
"TICE.ini")

End Function

Function WriteStitchScaleY (ByVal V As Single) As Integer

WriteStitchScaleY = Writeini("JL5000", "StitchScaleY", Format$(V), Path$ &
"TICE.ini")

End Function

Function WriteUser1 (ByVal V%) As Integer

WriteUser1 = Writeini("Info", "User1", Format$(V%), Path$ & "tice.ini")
End Function

Function WriteUser2 (ByVal V%) As Integer

WriteUser2 = Writeini("Info", "User2", Format$(V%), Path$ & "tice.ini")
End Function

Function WriteUser3 (ByVal V%) As Integer

WriteUser3 = Writeini("Info", "User3", Format$(V%), Path$ & "tice.ini")
End Function

Function WriteUserPassword (ByVal NP$) As Integer

WriteUserPassword = Writeini("Info", "Password", NP$, Path$ & "tice.ini")

End Function
```

Tice_dll.bas

```
Declare Function command_1000 Lib "tice123.dll" (ByVal cmd_str As String) As Integer
Declare Function get_from_1000 Lib "tice123.dll" (ByVal cmd_str As String, ByVal
resp_str As String) As Integer
Declare Function download_file Lib "tice123.dll" (ByVal filename As String) As
Integer
```

Stitch.bas

```
Global CurrentStitch$      'Current Stitch Filename
Global StitchScaleX As Single, StitchScaleY As Single
Global DefaultScaleX As Single, DefaultScaleY As Single

Global CameFromSPattern%

Global VirtualHomeX%, VirtualHomeY%

Global DrawTime As Single 'How fast stich is drawn

'Number of Factory Stitches
    Global Presets As Integer

'Which machine
    'if this is for the 1st Prototype, set following variable to true
    ' all other machines set it to false (the Default)
    Global Const Proto1 = False


'Cycel Displays
    Global Cycle1 As Integer, Cycle2 As Integer
    Global Cycle3 As Integer, Cycle4 As Integer
    Global GTotalNumberOfStitches%



Sub ChangeStitchScaleInFile (File$, SX As Single, SY As Single)
On Error Resume Next

'Get Backup File$
    FileTmp$ = Left$(File$, InStr(File$, ".")) & "TMP"

'Open Files
    FF% = FreeFile
    Open File$ For Input As FF%

    FF2% = FreeFile
    Open FileTmp$ For Output As FF2%

'Get # of Stitches
    Line Input #FF%, a$
    Print #FF2%, a$

'Place new Scale
    Line Input #FF%, a$
    Print #FF2%, Format$(SX) & "," & Format$(SY)

'Get Coordinates
    Do Until EOF(FF%)
        Line Input #FF%, a$
        Print #FF2%, a$
    Loop

'Close Files
    Close #FF%
    Close FF2%

'Rename Files
    Kill Left$(File$, InStr(File$, ".")) & "BAK"
    Name File$ As Left$(File$, InStr(File$, ".")) & "BAK"
    Err = 0
    Name FileTmp$ As File$
    If Err = 0 Then
        Kill Left$(File$, InStr(File$, ".")) & "BAK"
        End If


End Sub
```

```
Sub downloadstitch ()
On Error Resume Next

'Local Variables
    Dim ScaleX As Single, ScaleY As Single
    Const RealX = 90
    Const RealY = 70 '74 - was original value
    Const OneEncoderCountRevolution = 4000

'Get Cycel time display messages
    If Read_FullCycle() Then Cycle1 = True Else Cycle1 = False
    If Read_SewingCycle() Then Cycle2 = True Else Cycle2 = False
    If Read_EachCycle() Then Cycle3 = True Else Cycle3 = False
    If Read_AverageCycle() Then Cycle4 = True Else Cycle4 = False

'Get Real home Position
    HomeX% = ReadHomeX()
    HomeY% = ReadHomeY()

'Load Stich into List1
    TotalNumberOfStitches% = 0

'CurrentStitch$
    a$ = LoadStitchIntoString()

'Get Total number of stitches
    TotalNumberOfStitches% = Val(Left$(a$, InStr(a$, Chr$(0)) - 1))
    GTotalNumberOfStitches% = TotalNumberOfStitches%
    a$ = Mid$(a$, InStr(a$, Chr$(0)) + 1)

'Get Default Scales
    tmpScaleXY$ = Left$(a$, InStr(a$, Chr$(0)) - 1)
    a$ = Mid$(a$, InStr(a$, Chr$(0)) + 1)
    'the next two lines are not used at this time
        DefaultScaleX = Val(Left$(tmpScaleXY$, InStr(tmpScaleXY$, ",") - 1))
        DefaultScaleY = Val(Mid$(tmpScaleXY$, InStr(tmpScaleXY$, ",") + 1))
    ScaleX = RealX * (StitchScaleX / 100)
    ScaleY = RealY * (StitchScaleY / 100)

'Creater Prefix of DownLoad File
    FF% = FreeFile
    Open Path$ & "Prefix.dl" For Output As FF%

    'Base Start
        Print #FF%, "#SS"
        Print #FF%, "AI-14" '3rd pos. slide sensor
        Print #FF%, "AI-8" 'Start sew sw.
        DS_Sub1 FF%, 1  'SS1# and SS2# Common Statements
        Print #FF%, "SB10" 'Slide down pos.
        Print #FF%, "AI-2" 'Slide down pos. sensor
        Print #FF%, "SB11" 'Slide move to 3rd pos.
        Print #FF%, "AI-3" '4rt pos. slide sensor
        Print #FF%, "SB2"  'Foot down
        Print #FF%, "WT150"
        Print #FF%, "CB7"  'Reset 1st pos. slide
        Print #FF%, "CB9"  'Reset 2nd pos. slide
        Print #FF%, "CB11" 'Reset 3rd pos. slide
        Print #FF%, "AI-14"'3rd pis. slide sensor
        Print #FF%, "CB8"  'Reset folder
        If Cycle1 Then Print #FF%, "T1=TIME"
        'SS1# and SS2# Common Statements
            DS_Sub2 FF%, TotalNumberOfStitches%, a$, ScaleX, ScaleY, CX_Start%,
CY_Start%
        If Cycle1 Then Print #FF%, "T2=TIME"
        If Cycle1 Then Print #FF%, "D1=T2-T1"
        If Cycle1 = True Or Cycle2 = True Or Cycle3 = True Or Cycle4 = True Then
Print #FF%, "MG" & Chr$(34) & "CYCLE" & Chr$(34)
        Print #FF%, "JP#SS"
        Print #FF%, "EN"

        'Create SS#2 - RUN MODE (Same as #SS except without overhead commands)
            Print #FF%, "#SS2"
```

```
            DS_Sub1 FF%, 2 'SS1# and SS2# Common Statements
            DS_Sub2 FF%, TotalNumberOfStitches%, a$, ScaleX, ScaleY, CX_Start%,
CY_Start%
            Print #FF%, "EN"

'Create Home Procedure
    Print #FF%, "#HOME"
    Print #FF%, "HomeDone=0"
    Print #FF%, "VH2=0"
    Print #FF%, "VH3=0"
    Print #FF%, "VH4=0"
    Print #FF%, "JP#AIR,@IN[12]=1"
    If Proto1 = True Then
        'First Prototype machine only
        Print #FF%, "JP#TOUT,@IN[11]=0"
        Else
        Print #FF%, "JP#TOUT,@IN[11]=1"
        End If
    Print #FF%, "SB2"
    Print #FF%, "WT300"
    Print #FF%, "JG-5000,5000,5000,,5000"
    Print #FF%, ER_Common() 'ER Limits
    Print #FF%, "FIZE;FEXY"
    Print #FF%, "BGXYZE"
    Print #FF%, "AMXYZE"
    Print #FF%, "WT10"
    Print #FF%, "DP0,0"
    'Set New Home Position
        'Print #FF%, "PR"; Format$((CX_Start% * 80) + 600); ","; Format$((CY_Start%
* 50) + 1550); "," & Format$(FrontBobbin#) & ",," & Format$(BackBobbin#)
        FrontBobbin# = ReadFrontBobbin()
        BackBobbin# = ReadRearBobbin()
        'Create Virtual Home Positions including Scale
            VirtualHomeX% = CX_Start% * ScaleX
            VirtualHomeY% = CY_Start% * ScaleY
        'Center Stitch
            VirtualHomeX% = VirtualHomeX% + Int((((RealX * 14) - ((RealX * 14) *
(StitchScaleX / 100))) / 2))
            VirtualHomeY% = VirtualHomeY% + Int((((RealY * 7) - ((RealY * 7) *
(StitchScaleY / 100))) / 2))
        Print #FF%, "PR"; Format$(VirtualHomeX% + HomeX%); ",";
        Print #FF%, Format$(VirtualHomeY% + HomeY%);
        Print #FF%, "," & Format$(FrontBobbin#) & ",," & Format$(BackBobbin#)
    Print #FF%, "SP5000,5000,5000,,5000"
    Print #FF%, "BGXYZE"
    Print #FF%, "AMZE"
    Print #FF%, "MG "; Chr$(34); "2"; Chr$(34)
    Print #FF%, "VH2=1"
    Print #FF%, "AMXY"
    Print #FF%, "MG "; Chr$(34); "3"; Chr$(34)
    Print #FF%, "VH3=1"
    Print #FF%, "AC,,,20000"
    Print #FF%, "DC,,,20000"
    'Reverse W?
        If ReadNeedleHomeJog() = True Then
            Print #FF%, "JGW=-5000"
            Else
            Print #FF%, "JGW=5000"
            'Print #FF%, "SP,,,5000"
            End If
    Print #FF%, "FIW"
    Print #FF%, "BGW"
    Print #FF%, "AMW"
    Print #FF%, "WT50"
    Print #FF%, "AC,,,20000"
    Print #FF%, "DC,,,20000"
    Print #FF%, "SP,,,20000"
    Print #FF%, "PR,,,"; Format$(ReadNeedleHome())
    Print #FF%, "BGW"
    Print #FF%, "AMW"
    Print #FF%, "CB2"
    Print #FF%, "MG "; Chr$(34); "4"; Chr$(34)
```

```
    Print #FF%, "VH4=1"
    Print #FF%, "HomeDone=1"
    Print #FF%, "EN"

'Print Suffix Portion
    Suffix_DL FF%

'Close Prefix File
    Close FF%

Kill Path$ & "Michal.dl"
Name Path$ & "Prefix.dl" As Path$ & "Michal..dl"


End Sub

Sub DrawStitch (P As PictureBox, LB As ListBox, DefaultScale%, ByVal RedDot%)
'DefaultScale%=False --use StitchScale Variable
'DefaultScale%=True -- use stitches default scale

On Error Resume Next

'If no Stitch Exit sub
    If CurrentStitch$ = "" Then Exit Sub

'Setup drawing surface
    P.ScaleHeight = 9 ' 0 to 7
    P.ScaleWidth = 16 ' 0 to 14
    P.ScaleLeft = -1
    P.ScaleTop = -1

'Dim Variables
    Dim x1 As Single, x2 As Single, y1 As Single, y2 As Single, XScale As Single,
YScale As Single
    Dim x11 As Single, y11 As Single
    Dim CircleSize!
    CircleSize! = .1

'Draw Stitch
    'Set Scale Variables
        If DefaultScale% Then
            If DefaultScale% = 100 Then
                XScale = 1
                YScale = 1
                Else
                XScale = DefaultScaleX / 100
                YScale = DefaultScaleY / 100
                End If
            Else
            XScale = StitchScaleX / 100
            YScale = StitchScaleY / 100
            End If

    'Get Width from 0 to 7 so if drawing is scaled it can be centered
        PLeft! = (15 - (15 * XScale)) / 2
        PTop! = (8 - (8 * YScale)) / 2

    'Clear drawing area
        P.Cls

    'Draw Lines
        If DrawTime > 0 Then
            'Draw First Dot
                x2 = Val(Left$(LB.List(0), InStr(LB.List(0), ",") - 1))
                y2 = Val(Mid$(LB.List(0), InStr(LB.List(0), ",") + 1))
                P.Circle ((x2 * XScale) + PLeft!, (y2 * YScale) + PTop!),
CircleSize!, RGB(0, 0, 255)
            sleep DrawTime
            End If
        For z = 1 To LB.ListCount - 1
            x1 = Val(Left$(LB.List(z - 1), InStr(LB.List(z - 1), ",") - 1))
            y1 = Val(Mid$(LB.List(z - 1), InStr(LB.List(z - 1), ",") + 1))
```

```
            x2 = Val(Left$(LB.List(z), InStr(LB.List(z), ",") - 1))
            y2 = Val(Mid$(LB.List(z), InStr(LB.List(z), ",") + 1))
            P.Line ((x1 * XScale) + PLeft!, (y1 * YScale) + PTop!)-((x2 * XScale) +
PLeft!, (y2 * YScale) + PTop!)
            If DrawTime > 0 Then
                'Draw First Dot
                    x2 = Val(Left$(LB.List(0), InStr(LB.List(0), ",") - 1))
                    y2 = Val(Mid$(LB.List(0), InStr(LB.List(0), ",") + 1))
                    P.Circle ((x2 * XScale) + PLeft!, (y2 * YScale) + PTop!),
CircleSize!, RGB(0, 0, 255)
                'Draw dots up to current dot
                    For zz = 1 To z - 1
                        x2 = Val(Left$(LB.List(zz), InStr(LB.List(zz), ",") - 1))
                        y2 = Val(Mid$(LB.List(zz), InStr(LB.List(zz), ",") + 1))
                        P.Circle ((x2 * XScale) + PLeft!, (y2 * YScale) + PTop!),
CircleSize!, RGB(0, 0, 0)
                    Next zz
                tmpFillColor# = P.FillColor
                'Draw Last Dot
                    x2 = Val(Left$(LB.List(z), InStr(LB.List(z), ",") - 1))
                    y2 = Val(Mid$(LB.List(z), InStr(LB.List(z), ",") + 1))
                    P.FillColor = RGB(255, 0, 0)
                    P.Circle ((x2 * XScale) + PLeft!, (y2 * YScale) + PTop!),
CircleSize!, RGB(255, 0, 0)
                'Draw First Dot
                    x2 = Val(Left$(LB.List(0), InStr(LB.List(0), ",") - 1))
                    y2 = Val(Mid$(LB.List(0), InStr(LB.List(0), ",") + 1))
                    P.FillColor = RGB(0, 0, 255)
                    P.Circle ((x2 * XScale) + PLeft!, (y2 * YScale) + PTop!),
CircleSize!, RGB(0, 0, 255)
                P.FillColor = tmpFillColor#
                sleep DrawTime
                End If
        Next z

    'Draw Circles/Dots
        tmpFillColor# = P.FillColor
        P.FillColor = RGB(0, 0, 255)
        x2 = Val(Left$(LB.List(0), InStr(LB.List(0), ",") - 1))
        y2 = Val(Mid$(LB.List(0), InStr(LB.List(0), ",") + 1))
        x11 = x2
        y11 = y2
        P.Circle ((x2 * XScale) + PLeft!, (y2 * YScale) + PTop!), CircleSize!,
RGB(0, 0, 255)
        P.FillColor = tmpFillColor#

        For z = 1 To LB.ListCount - 1
            x2 = Val(Left$(LB.List(z), InStr(LB.List(z), ",") - 1))
            y2 = Val(Mid$(LB.List(z), InStr(LB.List(z), ",") + 1))
            If z = LB.ListCount - 1 And RedDot% = -1 Then
                If x2 = x11 And y2 = y11 Then
                    D# = RGB(0, 0, 255)
                    Else
                    D# = RGB(255, 0, 0)
                    End If
                P.FillColor = D#
                P.Circle ((x2 * XScale) + PLeft!, (y2 * YScale) + PTop!),
CircleSize!, D#
                Else
                P.Circle ((x2 * XScale) + PLeft!, (y2 * YScale) + PTop!),
CircleSize!, RGB(0, 0, 0)
                End If
        Next z


        'first stitch
        P.FillColor = RGB(0, 0, 255)
        x2 = Val(Left$(LB.List(0), InStr(LB.List(0), ",") - 1))
        y2 = Val(Mid$(LB.List(0), InStr(LB.List(0), ",") + 1))
        P.Circle ((x2 * XScale) + PLeft!, (y2 * YScale) + PTop!), CircleSize!,
RGB(0, 0, 255)
```

```
        'Red Dot
            If RedDot% > 0 Then
                x3 = Val(Left$(LB.List(RedDot%), InStr(LB.List(RedDot%), ",") - 1))
                y3 = Val(Mid$(LB.List(RedDot%), InStr(LB.List(RedDot%), ",") + 1))
                If x3 = x2 And y3 = y2 Then
                    P.FillColor = RGB(0, 255, 0)
                    P.Circle ((x3 * XScale) + PLeft!, (y3 * YScale) + PTop!),
CircleSize!, RGB(0, 255, 0)
                    Else
                    P.FillColor = RGB(255, 0, 0)
                    P.Circle ((x3 * XScale) + PLeft!, (y3 * YScale) + PTop!),
CircleSize!, RGB(255, 0, 0)
                    End If
                End If

        P.FillColor = tmpFillColor#



End Sub

Sub DS_Sub1 (ByVal FF%, Index%)
        Print #FF%, "JP#AIR,@IN[12]=1"

        If Proto1 = True Then
            'First Prototype machine only
            Print #FF%, "JP#TOUT,@IN[11]=0" 'first Prototype machine only
            End If

        If Index% = 1 Then
            'SS1 only
            If Proto1 = True Then
                Print #FF%, "JP#TOUT,@IN[16]=1" 'first Prototype machine only
                Else
                Print #FF%, "JP#TOUT,@IN[11]=1"
                End If
            End If

        Print #FF%, "JP#THRIM,@IN[9]=1"
        Print #FF%, "JP#THRIMB,@IN[10]=1"
End Sub

Sub DS_Sub2 (ByVal FF%, ByVal TotalNumberOfStitches%, ByVal a$, ByVal ScaleX As
Single, ByVal ScaleY As Single, CX_Start%, CY_Start%)
On Error Resume Next

'Local Variables
    Const OneEncoderCountRevolution = 4000
    KnifeFiringAdjustment% = Val(ReadKnife())
    KnifeFiringAdjustmentBack% = Val(ReadKnifeBack())

'Start Common Statements
        'Print #FF%, "GA WC"
        Print #FF%, "GA W"
        Print #FF%, "GR,,-2,,-2"
        Print #FF%, ER_Common() 'ER Limits

        dTMP# = TotalNumberOfStitches%
        dTMP# = dTMP# * OneEncoderCountRevolution

        'Get Current XY Position
            Print #FF%, "OX=_TPX" 'XO means Origin of X
            Print #FF%, "OY=_TPY"

        Print #FF%, "PR,,," & Format$(dTMP#)

        'See if 1st Speed is to be used
            If Read_Start_1st() <> 0 Then
```

```
                'Use 1st Speed
                    Print #FF%, "SP,,," & Format$(Read_Speed_1st(), "0")
                    Print #FF%, "SP" & Format$(Read_Speed_1st(), "0")
                    Print #FF%, "SP," & Format$(Read_Speed_1st(), "0")
                'Check to see of default AC is to be used
                    RAC# = Read_AC_1st()
                    If RAC# = 0 Then
                        'use default
                            Print #FF%, "AC10000000, 10000000,600000,300000,600000"
                        Else
                        'Use Custom Value
                            Print #FF%, "AC10000000, 10000000," & Format$(RAC# * 2,
"0") & "," & Format$(RAC#, "0") & "," & Format$(RAC# * 2, "0")
                        End If

                Else
                'Start with 2nd Speed
                    Print #FF%, "SP,,,V4="
                    Print #FF%, "SP V2="
                    Print #FF%, "SP ,V3="
                'Check to see of default AC is to be used
                    RAC# = Read_AC_2nd()
                    If RAC# = 0 Then
                        'use default
                            Print #FF%, "AC10000000, 10000000,600000,300000,600000"
                        Else
                        'Use Custom Value
                            Print #FF%, "AC10000000, 10000000," & Format$(RAC# * 2,
"0") & "," & Format$(RAC#, "0") & "," & Format$(RAC# * 2, "0")
                        End If
                End If
            RDC# = Read_DC_2nd()
            If RDC# = 0 Then
                'use default
                    Print #FF%, "DC10000000, 10000000,10000000,900000,10000000"
                Else
                'Use Custom Value
                    Print #FF%, "DC10000000, 10000000," & Format$(RDC# * 2, "0") &
"," & Format$(RDC#, "0") & "," & Format$(RDC# * 2, "0")
                End If


        If Cycle2 Then Print #FF%, "T5=TIME"
        Print #FF%, "BGW"

        'AD& = 2800
        AD& = Read_XYW_Ratio()

        Print #FF%, "AD,,," & Format$(AD&)

    'Get Starting Coordinates
        tmp$ = Left$(a$, InStr(a$, Chr$(0)) - 1)  'First Coordinate
        a$ = Mid$(a$, InStr(a$, Chr$(0)) + 1)

        x1% = Val(Left$(tmp$, InStr(tmp$, ",") - 1))
        y1% = Val(Mid$(tmp$, InStr(tmp$, ",") + 1))
        CX% = x1%   'Current Coordinate
        CY% = y1%
        CX_Start% = CX%
        CY_Start% = CY%


    'Cycle through Cooridinates
    RS1# = Read_Start_1st()
    RS3# = Read_Start_3rd()
    For z = 1 To TotalNumberOfStitches% - 2
        'Cycle Times for each stitch
            If Cycle3 Or Cycle4 Then Print #FF%, "T3=TIME"

        '2nd SPEED
        If z = RS1# + 1 And RS1# > 0 Then
            Print #FF%, "SP,,,V4="
```

```
            Print #FF%, "SP V2="
            Print #FF%, "SP ,V3="
            'Check to see of default AC/DC is to be used
                RAC# = Read_AC_2nd()
                If RAC# = 0 Then
                    'use default
                        Print #FF%, "AC10000000, 10000000,600000,300000,600000"
                    Else
                    'Use Custom Value
                        Print #FF%, "AC10000000, 10000000," & Format$(RAC# * 2, "0")
& "," & Format$(RAC#, "0") & "," & Format$(RAC# * 2, "0")
                    End If
            End If

        '3rd SPEED
        If z = (TotalNumberOfStitches% - 2) - (RS3# - 2) And RS3# > 0 Then
            'Use 1st Speed
                Print #FF%, "SP,,," & Format$(Read_Speed_3rd(), "0")
                Print #FF%, "SP" & Format$(Read_Speed_3rd(), "0")
                Print #FF%, "SP," & Format$(Read_Speed_3rd(), "0")
            'Check to see of default AC is to be used
                RDC# = Read_DC_3rd()
                If RDC# = 0 Then
                    'use default
                        Print #FF%, "DC10000000, 10000000,10000000,900000,10000000"
                    Else
                    'Use Custom Value
                        Print #FF%, "DC10000000, 10000000," & Format$(RDC# * 2, "0")
& "," & Format$(RDC#, "0") & "," & Format$(RDC# * 2, "0")
                    End If
            End If


        tmp$ = Left$(a$, InStr(a$, Chr$(0)) - 1)   'Coordinate
        a$ = Mid$(a$, InStr(a$, Chr$(0)) + 1)

    'Get Coordinates
        x1% = Val(Left$(tmp$, InStr(tmp$, ",") - 1))
        y1% = Val(Mid$(tmp$, InStr(tmp$, ",") + 1))
     'Get Realtive Movement
        xd% = (x1% - CX%) * ScaleX 'Coordinate in actual grid system
        yd% = (y1% - CY%) * ScaleY
        CX% = CX% + (x1% - CX%) 'Current Absolute Coordinate - used next time in
loop
        CY% = CY% + (y1% - CY%)


    'Create Line
        Select Case True
            Case xd% = 0 And yd% = 0
                AD& = AD& + OneEncoderCountRevolution
                Print #FF%, "AD,,," & Format$(AD&)
            Case xd% <> 0 And yd% = 0
                Print #FF%, "PR" & Format$(xd%)
                Print #FF%, "BGX"
                AD& = AD& + OneEncoderCountRevolution
                Print #FF%, "AD,,," & Format$(AD&)
            Case xd% = 0 And yd% <> 0
                Print #FF%, "PR," & Format$(yd%)
                Print #FF%, "BGY"
                AD& = AD& + OneEncoderCountRevolution
                Print #FF%, "AD,,," & Format$(AD&)
            Case xd% <> 0 And yd% <> 0
                Print #FF%, "PR" & Format$(xd%) & "," & Format$(yd%)
                Print #FF%, "BGXY"
                AD& = AD& + OneEncoderCountRevolution
                Print #FF%, "AD,,," & Format$(AD&)
         End Select

    If Cycle3 Or Cycle4 Then Print #FF%, "T4=TIME"
    If Cycle3 Or Cycle4 Then Print #FF%, "Z" & Format$(z) & "=T4-T3"
    Next z
```

```
    If Cycle3 Or Cycle4 Then Print #FF%, "T3=TIME"

'Get Last Stitch
    '3rd SPEED
    If RS3# = 1 Then
        'Use 1st Speed
            Print #FF%, "SP,,," & Format$(Read_Speed_3rd(), "0")
            Print #FF%, "SP" & Format$(Read_Speed_3rd(), "0")
            Print #FF%, "SP," & Format$(Read_Speed_3rd(), "0")
        'Check to see of default AC is to be used
            RDC# = Read_DC_3rd()
            If RDC# = 0 Then
                'use default
                    Print #FF%, "DC10000000, 10000000,10000000,900000,10000000"
                Else
                'Use Custom Value
                    Print #FF%, "DC10000000, 10000000," & Format$(RDC# * 2, "0") &
"," & Format$(RDC#, "0") & "," & Format$(RDC# * 2, "0")
                End If
        End If

    'Get Coordinates
        tmp$ = Left$(a$, InStr(a$, Chr$(0)) - 1)   'Coordinate
        a$ = Mid$(a$, InStr(a$, Chr$(0)) + 1)

        x1% = Val(Left$(tmp$, InStr(tmp$, ",") - 1))
        y1% = Val(Mid$(tmp$, InStr(tmp$, ",") + 1))

     'Get last Movement-moved to end of procedure
        'Print #FF%, "PA OX,OY"
        'Print #FF%, "BGXY"

     'Pick which knife fires first
        If KnifeFiringAdjustment% <= KnifeFiringAdjustmentBack% Then
            KFA% = KnifeFiringAdjustment%
            tmpSB$ = "SB4"
            Else
            KFA% = KnifeFiringAdjustmentBack%
            tmpSB$ = "SB12"
            End If

     'Fire First knife
            AD& = AD& + KFA%
            Print #FF%, "AD,,," & Format$(AD&)
            Print #FF%, tmpSB$   'Set trimmer

    'Reverse Adjustment on second knife
        If KnifeFiringAdjustment% <= KnifeFiringAdjustmentBack% Then
            KFA2% = KnifeFiringAdjustmentBack%
            tmpSB$ = "SB12"
            Else
            KFA2% = KnifeFiringAdjustment%
            tmpSB$ = "SB4"
            End If

     'Fire Second knife
            AD& = AD& + (KFA2% - KFA%)
            If KFA2% - KFA% > 0 Then Print #FF%, "AD,,," & Format$(AD&)
            Print #FF%, tmpSB$   'Set trimmer

    'Finish Knife
         Print #FF%, "WT30"
         Print #FF%, "SB3"   'Set thred tension
         Print #FF%, "AD,,," & Format$(AD& + (OneEncoderCountRevolution - KFA2%))

         If Cycle3 Or Cycle4 Then Print #FF%, "T4=TIME"
         If Cycle3 Or Cycle4 Then Print #FF%, "Z" & Format$(TotalNumberOfStitches% -
1) & "=T4-T3"

         If Cycle2 Then Print #FF%, "T6=TIME"
         If Cycle2 Then Print #FF%, "D2=T6-T5"
```

```
'Finish up Stitch
    Print #FF%, "WT50"
    Print #FF%, "CB4" 'Reset trimmer
    Print #FF%, "CB12" 'Reset trimmer
    Print #FF%, "WT100"
    Print #FF%, "CB3" 'Reset thred tension
    Print #FF%, "WT20"
    Print #FF%, "AI-9" 'trimmer sensor-1
    Print #FF%, "AI-10" 'trimmer sensor-2
    Print #FF%, "SB13"  'Thred wiper
    Print #FF%, "WT50"
    Print #FF%, "CB13"  'reset thred wiper
    Print #FF%, "WT50"
    Print #FF%, "CB2"   'foot up

'Get last Movement
    Print #FF%, "PA OX,OY"
    Print #FF%, "BGXY"

End Sub

Function ER_Common () As String
'ER Limits
    ER_Tmp$ = Format$((Read_XY_Limit() / 100) * XY_MaxCount) & "," ' X Limit
    ER_Tmp$ = ER_Tmp$ & Format$((Read_XY_Limit() / 100) * XY_MaxCount) & "," ' Y
Limit
    ER_Tmp$ = ER_Tmp$ & Format$((Read_ZE_Limit() / 100) * ZE_MaxCount) & "," ' Z
Limit
    ER_Tmp$ = ER_Tmp$ & Format$((Read_W_Limit() / 100) * W_MaxCount) & "," ' W Limit
    ER_Tmp$ = ER_Tmp$ & Format$((Read_ZE_Limit() / 100) * ZE_MaxCount)      ' E
Limit
    ER_Common = "ER" & ER_Tmp$

End Function

Function GetStitchNumber (ByVal File$) As Integer

On Error Resume Next

'Check that file exists
    If Dir$(File$) = "" Or Trim$(File$) = "" Then
        Exit Function 'returns 0
        End If

'Get only file name -- remove path portion
    Do Until InStr(File$, "\") = 0
        File$ = Mid$(File$, InStr(File$, "\") + 1)
    Loop

'Remove Extention
    If InStr(File$, ".") > 0 Then
        File$ = Left$(File$, InStr(File$, ".") - 1)
        End If

'Return Value
    GetStitchNumber = Val(File$)


End Function

Sub LoadStitchIntoListBox (LB As ListBox, Stitch$)
On Error Resume Next

'If no Stitch Exit sub
    If Dir$(Stitch$) = "" Then Exit Sub

'Get Stitch
    FF% = FreeFile
    Open Stitch$ For Input As FF%
    Line Input #FF%, a$
    If Val(a$) <= 0 Then Exit Sub
```

```
'Get Default Scales
    Line Input #FF%, tmpScaleXY$
    DefaultScaleX = Val(Left$(tmpScaleXY$, InStr(tmpScaleXY$, ",") - 1))
    DefaultScaleY = Val(Mid$(tmpScaleXY$, InStr(tmpScaleXY$, ",") + 1))

    LB.Clear
    Do Until EOF(FF%)
        Line Input #FF%, b$
        LB.AddItem b$
    Loop
    Close FF%

End Sub

Function LoadStitchIntoString () As String
'Use only to create DL File
FF% = FreeFile

Open CurrentStitch$ For Input As #FF%
    Line Input #FF%, a$

    If Val(a$) <= 0 Then Close #FF%: Exit Function

    Ret$ = Ret$ & a$ & Chr$(0)

    'Get Default Scale
        Line Input #FF%, a$
        Ret$ = Ret$ & a$ & Chr$(0)

    Do Until EOF(FF%)
        Line Input #FF%, b$
        'Convert Values
            X% = Val(Left$(b$, InStr(b$, ",") - 1))
            y% = Val(Mid$(b$, InStr(b$, ",") + 1))
            b$ = Format$(Abs(X% - 14)) & "," & Format$(Abs(y% - 7))
        Ret$ = Ret$ & b$ & Chr$(0)
    Loop

Close #FF%

LoadStitchIntoString = Ret$


End Function

Sub ResetFacStitches ()
On Error Resume Next

For z = 1 To DefaultPresets
F$ = Format$(z, "00000000")
If Dir$(Path$ & F$ & ".FAC") <> "" Then
    Kill Path$ & F$
    FileCopy Path$ & F$ & ".FAC", Path$ & F$ & ".STI"
    End If
Next

End Sub

Sub Suffix_DL (ByVal FF%)
'Suffix Statements
    Print #FF%, "#POSERR"
    Print #FF%, "AB1"
    Print #FF%, "CB1"
    Print #FF%, "CB16"
    Print #FF%, "CB14"
    Print #FF%, "WAPos=_TPW"
    Print #FF%, "WEPos=_TEW"
    Print #FF%, "MG" & Chr$(34) & "PE" & Chr$(34)
    Print #FF%, "AB"
    Print #FF%, "RE"

    Print #FF%, "#HANDS"
```

```
Print #FF%, ER_Common() 'ER Limits
If Proto1 = True Then
    'First Prototype machine only
    Print #FF%, "JP#TOUT,@IN[11]=0"
    Else
    Print #FF%, "JP#TOUT,@IN[11]=1"
    End If
Print #FF%, "GA F"
Print #FF%, "GR,,-2,1,-2"
Print #FF%, "EN"

Print #FF%, "#WHANDS"
If Proto1 = True Then
    'First Prototype machine only
    Print #FF%, "JP#TOUT,@IN[11]=0"
    Else
    Print #FF%, "JP#TOUT,@IN[11]=1"
    End If
Print #FF%, "GA F"
Print #FF%, "GR,,,1"
Print #FF%, "EN"

Print #FF%, "#A"
Print #FF%, "A=@IN[7]"
Print #FF%, "A="
Print #FF%, "SB1"
Print #FF%, "SB16"
Print #FF%, "SB14"
Print #FF%, "JP#HOME"
Print #FF%, "EN"

Print #FF%, "#B"
Print #FF%, "A1=@IN[7]"
Print #FF%, "A1="
Print #FF%, "EN"

Print #FF%, "#THRIM"
Print #FF%, "MG" & Chr$(34) & "12" & Chr$(34) & ""
Print #FF%, "WT20"
Print #FF%, "ST"
Print #FF%, "EN"

Print #FF%, "#AIR"
Print #FF%, "MG" & Chr$(34) & "13" & Chr$(34) & ""
Print #FF%, "WT20"
Print #FF%, "CB2"
Print #FF%, "CB3"
Print #FF%, "CB4"
Print #FF%, "CB12"
Print #FF%, "CB5"
Print #FF%, "CB6"
Print #FF%, "CB7"
Print #FF%, "CB8"
Print #FF%, "CB9"
Print #FF%, "CB10"
Print #FF%, "CB11"
Print #FF%, "CB12"
Print #FF%, "CB15"
Print #FF%, "EN"

Print #FF%, "#THRIMB"
Print #FF%, "MG" & Chr$(34) & "11" & Chr$(34) & ""
Print #FF%, "WT20"
Print #FF%, "ST"
Print #FF%, "EN"

Print #FF%, "#START"
Print #FF%, "XQ#SS,1"
Print #FF%, "XQ#STEP,2"
Print #FF%, "EN"

Print #FF%, "#STEP"
```

```
Print #FF%, "JP#AIR,@IN[12]=1"
Print #FF%, "AI-2"
'Roll Beltloop to length
    Print #FF%, "SB15"
    Print #FF%, "WT30" 'Normal WT30, XCut =
    Print #FF%, "CB15"
    Print #FF%, "AI13"
'Beltloop foot clamp
    Print #FF%, "SB5"
    Print #FF%, "WT20"
'Cut Beltloop
    Print #FF%, "SB6"
    Print #FF%, "WT150" 'WT70 is normal 120 for xcut
    Print #FF%, "CB6"

Print #FF%, "AI-6"
Print #FF%, "CB10"
Print #FF%, "WT150"
Print #FF%, "SB7"
Print #FF%, "AI-5"
Print #FF%, "WT30"
Print #FF%, "SB8"
Print #FF%, "WT100"
Print #FF%, "CB5"
Print #FF%, "WT100"
Print #FF%, "SB9"
Print #FF%, "JP#STEP"
Print #FF%, "EN"

Print #FF%, "#NEW"
Print #FF%, "JP#AIR,@IN[12]=1"
Print #FF%, "CB11"
Print #FF%, "CB8"
Print #FF%, "CB9"
Print #FF%, "CB7"
Print #FF%, "AI-6"
Print #FF%, "CB10"
Print #FF%, "SB15"
Print #FF%, "WT30"
Print #FF%, "CB15"
Print #FF%, "AI13"
Print #FF%, "SB5"
Print #FF%, "WT20"
Print #FF%, "SB6"
Print #FF%, "WT150"
Print #FF%, "CB6"
Print #FF%, "WT100"
Print #FF%, "SB7"
Print #FF%, "AI-5"
Print #FF%, "WT70"
Print #FF%, "SB8"
Print #FF%, "WT100"
Print #FF%, "CB5"
Print #FF%, "WT100"
Print #FF%, "SB9"
Print #FF%, "EN"

Print #FF%, "#JOGA"
Print #FF%, "JP#AIR,@IN[12]=1"
Print #FF%, "CB5"
Print #FF%, "CB7"
Print #FF%, "CB8"
Print #FF%, "CB9"
Print #FF%, "CB11"
Print #FF%, "AI-6"
Print #FF%, "CB10"
Print #FF%, "SB15"
Print #FF%, "WT50"
Print #FF%, "CB15"
Print #FF%, "EN"

Print #FF%, "#JOGB"
```

```
Print #FF%, "SB5"
Print #FF%, "WT100"
Print #FF%, "SB6"
Print #FF%, "WT150"
Print #FF%, "CB6"
Print #FF%, "EN"

Print #FF%, "#JOGC"
Print #FF%, "AI-6"
Print #FF%, "SB7"
Print #FF%, "EN"

Print #FF%, "#JOGBC"
Print #FF%, "CB7"
Print #FF%, "EN"

Print #FF%, "#JOGD"
Print #FF%, "AI-5"
Print #FF%, "SB8"
Print #FF%, "EN"

Print #FF%, "#JOGBD"
Print #FF%, "CB8"
Print #FF%, "EN"

Print #FF%, "#JOGE"
Print #FF%, "CB5"
Print #FF%, "WT100"
Print #FF%, "SB9"
Print #FF%, "EN"

Print #FF%, "#JOGBE"
Print #FF%, "CB9"
Print #FF%, "AI-5"
Print #FF%, "SB5"
Print #FF%, "EN"

Print #FF%, "#JOGF"
Print #FF%, "AI-14"
Print #FF%, "SB10"
Print #FF%, "EN"

Print #FF%, "#JOGBF"
Print #FF%, "CB10"
Print #FF%, "EN"

Print #FF%, "#JOGG"
Print #FF%, "AI-2"
Print #FF%, "SB11"
Print #FF%, "EN"

Print #FF%, "#JOGBG"
Print #FF%, "CB11"
Print #FF%, "EN"

Print #FF%, "#JOGH"
Print #FF%, "AI-3"
Print #FF%, "SB2"
Print #FF%, "EN"

Print #FF%, "#JOGBH"
Print #FF%, "CB2"
Print #FF%, "EN"

Print #FF%, "#JOGI"
Print #FF%, "CB11"
Print #FF%, "EN"

Print #FF%, "#JOGJ"
Print #FF%, "CB5"
Print #FF%, "CB9"
Print #FF%, "CB7"
```

```
    Print #FF%, "CB8"
    Print #FF%, "AI-6"
    Print #FF%, "CB10"
    Print #FF%, "CB2"
    Print #FF%, "EN"

    Print #FF%, "#TOUT"
    Print #FF%, "MG" & Chr$(34) & "10" & Chr$(34) & ""
    Print #FF%, "JP#SS"
    Print #FF%, "EN"

    Print #FF%, "#JOGR"
    Print #FF%, "CB5"
    Print #FF%, "CB9"
    Print #FF%, "CB7"
    Print #FF%, "CB8"
    Print #FF%, "AI-6"
    Print #FF%, "CB10"
    Print #FF%, "EN"

End Sub
```

J15000.bas

```
Global LastMsg$            'Last Message From Galia
Global FactoryFlag%

'Defaults and constants
    Global Const BInch = 692     'Belt Loop Inch
    Global Const EncoderCount = 135

    Global Const DefaultSewSpeed = 100000
    Global Const DefaultBeltLoopSpeed = 500
    Global Const DefaultBeltLoopLength = 98
    Global Const DefaultRearBobbin = -900
    Global Const DefaultFrontBobbin = 925
    Global Const DefaultHomeX = 600
    Global Const DefaultHomeY = 1550
    Global Const DefaultXYWRatio = 2800
    Global Const DefaultStitchScaleX = 100
    Global Const DefaultStitchScaleY = 100
    Global Const DefaultPresets = 6
    Global Const DefaultUserPassword = "0123"
    Global Const DefaultMechPassword = "4567"
    Global Const DefaultAdminPassword = "8901"

    Global Const DefaultXYLimit = 86   '%
    Global Const DefaultZELimit = 75   '%
    Global Const DefaultWLimit = 40    '%

    Global Const XY_MaxCount = 350
    Global Const ZE_MaxCount = 400
    Global Const W_MaxCount = 4000 '1500

    Global Const DefaultKnife = 900


'Flags
    Global UserIsHere%



Sub CloseCommWithVBX ()
'Developer mode with Galia in machine
    If DMode Then Exit Sub

    GForm.DMCShell1.DMCPollController = False
    GForm.DMCShell1.DMCInterrogate(0) = ""
    GForm.DMCShell1.DMCInterrogate(1) = ""
    GForm.DMCShell1.DMCInterrogate(2) = ""
    GForm.DMCShell1.DMCInterrogate(3) = ""
    GForm.DMCShell1.DMCConnect = False

End Sub

Function FixMessage (ResponseOrg$) As Integer
'Developer mode with Galia in machine
    If DMode Then Exit Function

If Trim$(ResponseOrg$) = "" Then Exit Function

On Error Resume Next

Response$ = ResponseOrg$
ResponseOrg$ = ""

'Get rid of Null characters
    Response$ = Replace(Response$, Chr$(0), "", False)

'Make sure string ends with nl$
    If Right$(Response$, 2) <> nl$ Then Response$ = Response$ & nl$
```

```
'Cycle through each message
    Do Until Response$ = ""
        X% = InStr(Response$, nl$)
        tmp$ = Left$(Response$, X% - 1)
        Response$ = Mid$(Response$, X% + 2)
        Select Case True
            Case tmp$ = "1": M$ = "Message 1"
            Case tmp$ = "2": M$ = "FRONT & REAR BOBBIN ARE HOME"
            Case tmp$ = "3": M$ = "X & Y TABLE ARE HOME"
            Case tmp$ = "4": M$ = "THE NEEDLE IS HOME"
            Case tmp$ = "10": M$ = "MACHINE IN RUN MODE"
            Case tmp$ = "11": M$ = "ERROR WITH FRONT TRIMMER"
            Case tmp$ = "12": M$ = "ERROR WITH REAR TRIMMER"
            Case tmp$ = "13": M$ = "AIR IS OFF"
            Case tmp$ = "PE"
                M$ = "Position Error:" & nl
                Select Case True
                    Case GetErrValue("X") > (Read_XY_Limit() / 100) * XY_MaxCount
                        M$ = M$ & " ERROR WITH X AXIS: " & Format$(GetErrValue("X"))
& nl$
                    Case GetErrValue("Y") > (Read_XY_Limit() / 100) * XY_MaxCount
                        M$ = M$ & " ERROR WITH Y AXIS: " & Format$(GetErrValue("Y"))
& nl$
                    Case GetErrValue("Z") > (Read_ZE_Limit() / 100) * ZE_MaxCount
                        M$ = M$ & " ERROR WITH THE REAR HOOK ASSEMBLY: " &
Format$(GetErrValue("Z")) & nl$
                    Case GetErrValue("W") > (Read_W_Limit() / 100) * W_MaxCount
                        'm$ = m$ & " ERROR WITH THE NEEDLE ASSEMBLY: " &
Format$(GetErrValue("W")) & nl$
                        Ret1$ = Space$(255)
                        R% = get_from_1000("WAPos=?", Ret1$)
                        ret2$ = Space$(255)
                        R% = get_from_1000("WEPos=?", ret2$)
                        M$ = M$ & " ERROR WITH THE NEEDLE ASSEMBLY: " &
Format$(GetErrValue("W")) & nl$ & "WAP=" & Format$(Val(Ret1$), "0") & nl$ & " WEP="
& Format$(Val(ret2$), "0")
                    Case GetErrValue("E") > (Read_ZE_Limit() / 100) * ZE_MaxCount
                        M$ = M$ & " ERROR WITH THE FRONT HOOK ASSEMBLY: " &
Format$(GetErrValue("E"))
                End Select
            Case tmp$ = "CYCLE"
                FixMessage = True
                M$ = ""
                If Cycle1 = True Then
                    'Full Cycle
                    ret2$ = Space$(255)
                    R% = get_from_1000("D1=?", ret2$)
                    M$ = "Delivery/Sew Time:  " & Format$(Val(ret2$) / 1000, "0.0#")
& " seconds" & Chr$(13) & Chr$(10)
                    End If
                If Cycle2 = True Then
                    'Sew Cycle
                    ret2$ = Space$(255)
                    R% = get_from_1000("D2=?", ret2$)
                    M$ = M$ & "Sewing Time:  " & Format$(Val(ret2$) / 1000, "0.0#")
& " seconds" & Chr$(13) & Chr$(10)
                    End If
                If Cycle3 = True Then
                    'Sew Cycle
                    For z = 1 To GTotalNumberOfStitches% - 1
                        ret2$ = Space$(255)
                        R% = get_from_1000("Z" & Format$(z) & "=?", ret2$)
                        If Cycle3 = True Then M$ = M$ & Format$(60 / (Val(ret2$) /
1000), "0") & ", "
                        Average# = Average# + (60 / (Val(ret2$) / 1000))
                    Next z
                    If Cycle3 = True Then M$ = Left$(M$, Len(M$) - 2) & Chr$(13) &
Chr$(10)
                    If Cycle4 = True Then M$ = M$ & "Ave RPM: " & Format$(Average# /
GTotalNumberOfStitches%, "0.0##")
                    End If
```

```
            Case Else
                If Left$(Trim$(tmp$), 1) <> "?" Then
                    M$ = "Unknown Message: " & tmp$
                    Else
                    M$ = "Unknown Message: ?"
                    End If
        End Select
        If M$ <> "" Then ResponseOrg$ = ResponseOrg$ & M$ & nl$
    Loop

ResponseOrg$ = ResponseOrg$ & nl$

End Function

Function G_Command (ByVal S$)
'Developer mode with Galia in machine
    If DMode Then Exit Function


Status% = command_1000(S$)

End Function

Sub G_FootDown ()
'Developer mode with Galia in machine
    If DMode Then Exit Sub

Status = command_1000("SB2")
End Sub

Sub G_FootUp ()
'Developer mode with Galia in machine
    If DMode Then Exit Sub

Status = command_1000("CB2")
End Sub

Function G_Get (ByVal C$) As String
On Error Resume Next

'Developer mode with Galia in machine
    If DMode Then
        C$ = UCase$(C$)
        Select Case True
            Case Left$(C$, 2) = "TE"
                G_Get = Format$(Int((10 - 1 + 1) * Rnd + 1), "00000000")
            Case Left$(C$, 2) = "TP"
                G_Get = Format$(Int((4000 - 10 + 1) * Rnd + 10), "00000000")
        End Select
        Exit Function
        End If

'Get from 1000
    Ret$ = Space$(255)
    R% = get_from_1000(UCase$(C$), Ret$)
    G_Get = Trim$(Ret$)

End Function

Function G_GetSewSpeed () As Double
G_GetSewSpeed = ReadSewSpeed()
End Function

Sub G_HandWheel ()
'Developer mode with Galia in machine
    If DMode Then Exit Sub

'Status = command_1000("GNZ=70")
'Status = command_1000("GNE=70")
'Status = command_1000("KIZ=0")
'Status = command_1000("KIE=0")
```

```
Status = command_1000("XQ#HANDS")

End Sub

Sub G_Home ()
'Developer mode with Galia in machine
    If DMode Then Exit Sub

'Set Galia To Home Position
    Status = command_1000("DP0,0,0,0,0")
    Status = command_1000("SB1")
    Status = command_1000("SB16")
    Status = command_1000("SB14")

    Status = command_1000("XQ#HOME")

End Sub

Sub G_NeedleMicroAdvance (C As Control)
'Developer mode with Galia in machine
    If DMode Then Exit Sub

Status = command_1000("SP,,10000,10000,10000")
Status = command_1000("PR,,-450,225,-450") '"PR,,-576,288,-576"
Status = command_1000("BGZWE")


C.Enabled = False

End Sub

Sub G_OffDrive ()
'Developer mode with Galia in machine
    If DMode Then Exit Sub

'Turn off Drivers?
Status = command_1000("CB1")
Status = command_1000("CB16")
Status = command_1000("CB14")


End Sub

Sub G_Run ()
'Developer mode with Galia in machine
    If DMode Then Exit Sub

 G_FootDown
 G_Wait 100
 Status = command_1000("XQ#SS2")

End Sub

Sub G_SetSewSpeed (ByVal NewSewSpeed#)
On Error Resume Next

'Developer mode with Galia in machine
    If DMode Then Exit Sub


'Set Speed Now
    'NewSewSpeed# is in Pulse Count
    Ret$ = Format$(NewSewSpeed#)
    Status = command_1000("V4=" & Ret$)
    Status = command_1000("V3=" & Format$(NewSewSpeed# * 1.3))
    Status = command_1000("V2=" & Format$(NewSewSpeed# * 1.3))


End Sub

Sub G_Stop ()
'Developer mode with Galia in machine
```

```
    If DMode Then Exit Sub

Status = command_1000("ST")
End Sub

Sub G_Wait (D#)
'Developer mode with Galia in machine
    If DMode Then Exit Sub

Status = command_1000("WT" & Format$(D#))
End Sub

Sub G_WHandWheel ()
'Developer mode with Galia in machine
    If DMode Then Exit Sub

Status = command_1000("XQ#WHANDS")
End Sub

Function GetErrValue (ByVal C$) As Double

    C$ = UCase$(C$)
    Ret$ = Space$(255)
    R% = get_from_1000("TE" & C$, Ret$)
    GetErrValue = Val(Ret$)

End Function

Function GetInputByte (ByVal ByteNum%) As Integer
'Developer mode with Galia in machine
    If DMode Then Exit Function

'Get Byte
    Ret$ = Space$(255)
    R% = get_from_1000("TI" & Format$(ByteNum%, "0"), Ret$)
    GetInputByte = Val(Ret$)


End Function

Sub OpenCommWithVBX ()
On Error Resume Next

'Check that Michal File Exists
    'If Dir$(Path$ & "Michal.dl") = "" Then
        If Dir$(CurrentStitch$) = "" Then
            CurrentStitch$ = ReadCurrentStitch()
            End If
        'downloadstitch
        'End If

'Developer mode with Galia in machine
    If DMode Then Exit Sub

'Make Connection with Galia
    GForm.DMCShell1.DMCAddress = 1000

    GForm.DMCShell1.DMCConnect = True

    If GForm.DMCShell1.DMCConnect = True Then
        GForm.DMCShell1.DMCPollController = True
        GForm.DMCShell1.DMCInterrogate(0) = "TEX;"
        GForm.DMCShell1.DMCInterrogate(1) = "TEY;"
        GForm.DMCShell1.DMCInterrogate(2) = "TPX;"
        GForm.DMCShell1.DMCInterrogate(3) = "TPY;"
        GForm.DMCShell1.DMCInterrogate(7) = "TEZ;"
        GForm.DMCShell1.DMCInterrogate(8) = "TEW;"
        GForm.DMCShell1.DMCInterrogate(9) = "TEE;"
        GForm.DMCShell1.DMCInterrogate(4) = "TPZ;"
        GForm.DMCShell1.DMCInterrogate(5) = "TPW;"
        GForm.DMCShell1.DMCInterrogate(6) = "TPE;"
```

```
        downloadstitch
        Status = download_file(Path$ & "Michal.dl")
        Kill Path$ & "Michal.dl"
    End If

'Set intial Sew Speed, BeltLoop Speed, BeltLoop Length from saved values
    'Sew Speed
        G_SetSewSpeed G_GetSewSpeed()

    'GetBeltLoopSpeed
         Ret$ = Format$(ReadBeltLoopSpeed())
         Status = command_1000("V5=" & Ret$)

    'GetBeltLoopLength
         Ret$ = Format$(ReadBeltLoopLength())
         Status = command_1000("V6=" & Ret$)

End Sub

Sub ResetGalia ()


ResetGaliaWithoutHome

'Developer mode with Galia in machine
    If DMode Then Exit Sub


'Home
    G_Home

End Sub

Sub ResetGaliaWithoutHome ()

'Create New Stitch File
    downloadstitch
    'This was once remmed out, but I forgot why
    'so I un-remmed it.

'Developer mode with Galia in machine
    If DMode Then
        Exit Sub
        End If


'Reset Galia
    G_Stop
    Status = command_1000("CB1")
    Status = command_1000("CB16")
    Status = command_1000("CB14")
    G_Wait 100
    Status = command_1000("RS")
    G_Wait 100
'Close COMM with VBX
    Unload GForm
'Open Communication
    Load GForm
    OpenCommWithVBX

End Sub

Sub ResetProgram (F As Form)
    Display "Resetting program...please wait"
    'TechMode = False //Placed in OpenScreen:Load_Form
    Unload F
    Unload GForm
    Techmode = False
    OpeningScreen.Show
    Display ""
```

```
End Sub

Sub ResetToFactoryDefaults (F As Form)

    Display "Resetting to Factory Defaults...please wait"
    sleep 2
    Display ""

'Reset Home Position
    R% = YN("Reset XY Home positions to factory default?", "Reset To Factory
Defaults")
    If R% Then
        X% = WriteHomeX(Val(ReadFacHomeX()))
        X% = WriteHomeY(Val(ReadFacHomeY()))
        End If

'Reset W Home Position
    R% = YN("Reset Needle Home Position to factory default?", "Reset To Factory
Defaults")
    If R% Then
        R% = WriteNeedleHome(Val(ReadFacNeedleHome()))
        R% = WriteNeedleHomeJog(Val(ReadFacNeedleHomeJog()))
        End If

'Reset Front And Rear Bobbin
    R% = YN("Reset Front and Rear Bobbin adjustments?", "Reset To Factory Defaults")
    If R% Then
        X% = WriteFrontBobbin(Val(ReadFacFrontBobbin()))
        X% = WriteRearBobbin(Val(ReadFacRearBobbin()))
        End If

'Reset XY_Limits Position
    R% = YN("Reset XY Torque Limit to factory default?", "Reset To Factory
Defaults")
    If R% Then
        Write_XY_Limit DefaultXYLimit
        End If

'Reset ZE_Limits Position
    R% = YN("Reset Bobbin Torque Limits to factory default?", "Reset To Factory
Defaults")
    If R% Then
        Write_ZE_Limit DefaultZELimit
        End If

'Reset W_Limits Position
    R% = YN("Reset Needle Torque Limit to factory default?", "Reset To Factory
Defaults")
    If R% Then
        Write_W_Limit DefaultWLimit
        End If

'Reset Knife Position
    R% = YN("Reset Trimmer Value?", "Reset To Factory Defaults")
    If R% Then
        WriteKnife ReadFacKnife()
        End If


'Reset Stitch Files
    R% = YN("Reset Preset Stitch Files to factory defaults?", "Reset To Factory
Defaults")
    If R% Then
        r2% = YN("The Factory Stitch Patterns may overwrite customized patterns. Are
you sure you wish to continue?", "Reset Factory Stitch Patterns")
        If r2% Then
            Display "Reinstalling Preset Stitches...please wait"
            r3% = WriteNumberOfPresetStitches(DefaultPresets)
            ResetFacStitches
            End If
        End If
```

```
'Reset Stitch Size
    Display "Resetting Stitch Scale to default values."
    sleep .5
    R% = WriteStitchScaleX(DefaultStitchScaleX)
    R% = WriteStitchScaleY(DefaultStitchScaleY)

'Reset Belt Loop Speed Setting
    Display "Resetting Belt Loop Speed"
    sleep .5
    WriteBeltLoopSpeed DefaultBeltLoopSpeed

'Reset Belt Loop Length Setting
    Display "Resetting Belt Loop Length"
    sleep .5
    WriteBeltLoopLength DefaultBeltLoopLength

'Reset Speed Setting
    Display "Resetting Sew Speed"
    sleep .5
    WriteSewSpeed DefaultSewSpeed

'Reset Default Stitch pattern
    Display "Resetting Default Stitch"
    sleep .5
    X% = WriteCurrentStitch(Path$ & "00000001.sti")

'Create and Download new DL File
    Display "Resetting Program..."
    sleep .5
    'downloadstitch

'Reset Error
    WriteIntializationError ""

'Reset Program
    ResetProgram F
    Display ""
End Sub

Sub SoftwareVersion (W$, V As Single, D$)

W$ = "B. 8/11/96 10:25"
V = 3
D$ = "08/11/96"

End Sub

Sub VBX_DisplayMessage (ByVal Response$)

R% = FixMessage(Response$)

LastMsg$ = Response$

Select Case UCase$(CurrentWindow$)
    Case UCase$("TechForm")
        If Len(TechForm.ResponseOutput) > 20000 Then
            TechForm.ResponseOutput = ""
            End If
        TechForm.ResponseOutput = TechForm.ResponseOutput & Response$
        TechForm.ResponseOutput.SelStart = Len(TechForm.ResponseOutput)
        TechForm.ResponseOutput.SelLength = Len(TechForm.ResponseOutput)

    Case UCase$("AutoRun")
        If Len(AutoRun.ResponseOutput) > 20000 Or R% = True Then
            AutoRun.ResponseOutput.Text = ""
            End If
        AutoRun.ResponseOutput = AutoRun.ResponseOutput & Response$

    Case UCase$("GRAPH")
        Grapher.Check1.Value = Abs(Grapher.Check1.Value - 1)

    Case UCase$("Manual")
```

```
        If Len(Manual.ResponseOutput) > 20000 Then
            Manual.ResponseOutput = ""
            End If
        Manual.ResponseOutput = Response$

    Case UCase$("HandWheel")
        If Len(HandWheel.ResponseOutput) > 20000 Then
            HandWheel.ResponseOutput = ""
            End If
        HandWheel.ResponseOutput = Response$
End Select

End Sub

Sub VBX_DMCInterrogate (ByVal Index As Integer, ByVal Response As String)

Select Case UCase$(CurrentWindow$)
    Case UCase$("TechForm")
        VBX_Interrogate_TechForm Index, Response

    Case UCase$("Manual")
        VBX_Interrogate_Manual Index, Response

    Case UCase$("HandWheel")
        VBX_Interrogate_HandWheel Index, Response

    Case UCase$("NeedleMotorHome")
        VBX_Interrogate_NeedleMotorHome Index, Response

End Select


End Sub

Sub VBX_Interrogate_HandWheel (ByVal Index As Integer, ByVal Response As String)
    If Index = 0 Then
        HandWheel.ErrX.Text = Response
    ElseIf Index = 1 Then
        HandWheel.ErrY.Text = Response
    ElseIf Index = 2 Then
        HandWheel.PosX.Text = Response
    ElseIf Index = 3 Then
        HandWheel.PosY.Text = Response
    ElseIf Index = 4 Then
        HandWheel.PosZ.Text = Response
    ElseIf Index = 5 Then
        HandWheel.PosW.Text = Response
    ElseIf Index = 6 Then
        HandWheel.PosE.Text = Response
    ElseIf Index = 7 Then
        HandWheel.ErrZ.Text = Response
    ElseIf Index = 8 Then
        HandWheel.ErrW.Text = Response
    ElseIf Index = 9 Then
        HandWheel.ErrE.Text = Response
    End If

End Sub

Sub VBX_Interrogate_Manual (ByVal Index As Integer, ByVal Response As String)
    If Index = 0 Then
        Manual.ErrX.Text = Response
    ElseIf Index = 1 Then
        Manual.ErrY.Text = Response
    ElseIf Index = 2 Then
        Manual.PosX.Text = Response
    ElseIf Index = 3 Then
        Manual.PosY.Text = Response
    ElseIf Index = 4 Then
        Manual.PosZ.Text = Response
    ElseIf Index = 5 Then
        Manual.PosW.Text = Response
```

```
    ElseIf Index = 6 Then
        Manual.PosE.Text = Response
    ElseIf Index = 7 Then
        Manual.ErrZ.Text = Response
    ElseIf Index = 8 Then
        Manual.ErrW.Text = Response
    ElseIf Index = 9 Then
        Manual.ErrE.Text = Response
    End If

End Sub

Sub VBX_Interrogate_NeedleMotorHome (ByVal Index As Integer, ByVal Response As
String)
    If Index = 0 Then
        'HandWheel.ErrX.Text = Response
    ElseIf Index = 1 Then
        'HandWheel.ErrY.Text = Response
    ElseIf Index = 2 Then
        'HandWheel.PosX.Text = Response
    ElseIf Index = 3 Then
        'HandWheel.PosY.Text = Response
    ElseIf Index = 4 Then
        'HandWheel.PosZ.Text = Response
    ElseIf Index = 5 Then
        'Get Index under 4000
            V# = Val(Response)
            V# = V# - (Fix(V# / 4000) * 4000)
        'Make to nearest 10
            V# = Fix(V# / 10) * 10
        'Write Position
            NeedleMotorHome.FValue = Format$(V#, "0")

    ElseIf Index = 6 Then
        'HandWheel.PosE.Text = Response
    ElseIf Index = 7 Then
        'HandWheel.ErrZ.Text = Response
    ElseIf Index = 8 Then
        'HandWheel.ErrW.Text = Response
    ElseIf Index = 9 Then
        'HandWheel.ErrE.Text = Response
    End If

End Sub

Sub VBX_Interrogate_TechForm (ByVal Index As Integer, ByVal Response As String)
    If Index = 0 Then
        TechForm.ErrX.Text = Response
    ElseIf Index = 1 Then
        TechForm.ErrY.Text = Response
    ElseIf Index = 2 Then
        TechForm.PosX.Text = Response
    ElseIf Index = 3 Then
        TechForm.PosY.Text = Response
    ElseIf Index = 4 Then
        TechForm.PosZ.Text = Response
    ElseIf Index = 5 Then
        TechForm.PosW.Text = Response
    ElseIf Index = 6 Then
        TechForm.PosE.Text = Response
    ElseIf Index = 7 Then
        TechForm.ErrZ.Text = Response
    ElseIf Index = 8 Then
        TechForm.ErrW.Text = Response
    ElseIf Index = 9 Then
        TechForm.ErrE.Text = Response
    End If

End Sub

Sub XYMove (ByVal X%, Y%)
'Developer mode with Galia in machine
```

```
    If DMode Then Exit Sub

Select Case True
    Case X% <> 0, Y% <> 0
        Status = command_1000("SP,1000")
        Status = command_1000("PR" & Format$(X%) & "," & Format$(Y%))
        Status = command_1000("BGX")
        Status = command_1000("BGY")
    Case X% <> 0, Y% = 0
        Status = command_1000("SP,1000")
        Status = command_1000("PR" & Format$(X%))
        Status = command_1000("BGX")
    Case X% = 0, Y% <> 0
        Status = command_1000("SP,1000")
        Status = command_1000("PR," & Format$(Y%))
        Status = command_1000("BGY")

End Select
End Sub
```

Global2.bas

```
Declare Function WritePrivateProfileString% Lib "Kernel" (ByVal lpAppName$, ByVal
lpKeyName As Any, ByVal lpString As Any, ByVal lpFileName$)
Declare Function GetPrivateProfileString% Lib "kernel" (ByVal lpAppName$, ByVal
lpKeyName As Any, ByVal lpDefault$, ByVal lpReturnString$, ByVal nSize%, ByVal
lpFileName$)
Declare Function ShowCursor Lib "User" (ByVal bShow As Integer) As Integer

Global CurrentWindow$
Global NumbersRet$

'=====================================================
Global Path$, nl$

'Flag that shows program has started -- needed for reset procedures
    Global ProgramHasAlreadyStarted As Integer

'Developer Flag
    'Set to True if Galia is not in this computer
    'else set to false
    'Set this variable in OpeningScreen
    Global DMode As Integer

'Technician Mode
    'Global Const TechMode = True
    Global Techmode As Integer


Declare Function SendMessage Lib "user" (ByVal hWnd As Integer, ByVal wMsg As
Integer, ByVal wp As Integer, lp As Any) As Long

Sub CenterControl (C As Control, ByVal W As Integer, ByVal H As Integer)
'C is Control to be centered
'W is width in twips of what control is to be centered to
'H is height in twips of what control is to be centered to

C.Left = (W / 2) - (C.Width / 2)

C.Top = (H / 2) - (C.Height / 2)


End Sub

Sub CenterControlH (C As Control, ByVal H As Integer)
'C is Control to be centered
'H is height in twips of what control is to be centered to

C.Top = (H / 2) - (C.Height / 2)

End Sub

Sub CenterControlW (C As Control, ByVal W As Integer)
'C is Control to be centered
'W is width in twips of what control is to be centered to

C.Left = (W / 2) - (C.Width / 2)

End Sub

Sub CenterForm (Frm As Form)
     Frm.Left = (Screen.Width - Frm.Width) / 2
     Frm.Top = (Screen.Height - Frm.Height) / 2
End Sub

Sub CheckSecurityLog ()
On Error Resume Next

'Check Size of File
    SFile$ = Path$ & "Security.log"
    Const MaxFileSize = 25000
    NewMaxFileSize& = (Int(MaxFileSize / 1000) - 1) * 1000
```

```
    If FileLen(SFile$) <= MaxFileSize Then Exit Sub

'Cycle Through file and elimate old entries
    Display "Updating Log File...please wait"

    'Get First Date
        FF% = FreeFile
        Open SFile$ For Input As FF%
        Do Until Flag% = True
            Line Input #FF%, a$
            x% = InStr(a$, "=")
            If x% > 0 Then
                B$ = Trim$(Left$(a$, x% - 1))
                B$ = Left$(B$, InStr(B$, " ") - 1)
                Err = 0
                D# = DateValue(B$)
                If Not Err Then Flag% = True
                End If
        Loop
        Close FF%
        B$ = Mid$(B$, InStr(B$, "/") + 1) & "/" & Left$(B$, InStr(B$, "/") - 1)
        z1% = Abs(DateValue(B$) - Now)

    'Cycle through file
        Err = 0
        For z = z1% To 1 Step -1
            Display "Updating Log File..." & Format$(z)
            FF% = FreeFile
            Open SFile$ For Input As FF%
            FF2% = FreeFile
            Open Path$ & "security.tmp" For Output As FF2%
            Do Until EOF(FF%)
                Line Input #FF%, a$
                x% = InStr(a$, "=")
                If x% > 0 Then
                    B$ = Trim$(Left$(a$, x% - 1))
                    B$ = Left$(B$, InStr(B$, " ") - 1)
                    B$ = Mid$(B$, InStr(B$, "/") + 1) & "/" & Left$(B$, InStr(B$,
"/") - 1)
                    Err = 0
                    D# = DateValue(B$)
                    If Not Err And D# > Now - z Then
                        Print #FF2%, a$
                        End If
                    End If
            Loop
            Close FF2%
            Close FF%

            If Dir$(Path$ & "security.tmp") <> "" Then
                Kill SFile$
                Name Path$ & "security.tmp" As SFile$
                End If
            If FileLen(SFile$) <= NewMaxFileSize& Then Exit For
        Next z

    If FileLen(SFile$) > MaxFileSize Then Kill SFile$
    Display ""

End Sub

Sub Display (Msg$)

If Trim$(Msg$) = "" Then
    Unload DisplayForm 'Close Form
    Exit Sub
    End If


Load DisplayForm
DisplayForm.Caption = ""
```

```
'Get Number OF Lines In Message
    NumOfLines% = 1
    LongestLine% = 0
    If InStr(Msg$, nl$) > 0 Then
        If Right$(Msg$, Len(nl$)) <> nl$ Then Msg$ = Msg$ & nl$
        Start% = InStr(Msg$, nl$) + Len(nl$)
        NumOfLines% = 1
        StartOfLine% = Start%
        LongestLine% = DisplayForm.TextWidth(Left$(Msg$, Start% - Len(nl$)))
        Do Until InStr(Start%, Msg$, nl$) = 0
            Start% = InStr(Start% + Len(nl$), Msg$, nl$)
            NumOfLines% = NumOfLines% + 1
            tmp$ = Mid$(Msg$, StartOfLine%, (Start%) - StartOfLine%)
            StartOfLine% = Start%
            Start% = Start% + Len(nl$)
            If DisplayForm.TextWidth(tmp$) > LongestLine% Then LongestLine% =
DisplayForm.TextWidth(tmp$)
        Loop
        Else
        LongestLine% = DisplayForm.TextWidth(Msg$)
        End If

'Set Message Label to Correct Height and Center
    DisplayForm.Height = DisplayForm.TextHeight("Xg") * (NumOfLines% + 2)
    DisplayForm.Width = LongestLine% + DisplayForm.TextWidth(Space$(10))

    DisplayForm.Message.Height = DisplayForm.TextHeight("Xg") * NumOfLines%
    DisplayForm.Message.Top = (DisplayForm.Height / 2) - (DisplayForm.Message.Height
/ 2)

    DisplayForm.Message.Width = LongestLine%
    DisplayForm.Message.Left = (DisplayForm.Width / 2) - (DisplayForm.Message.Width
/ 2)


DisplayForm.Message = Msg$

CenterForm DisplayForm

DisplayForm.Show

DisplayForm.Message.Refresh


End Sub

Function Getini (ByVal Path As String, ByVal Section As String, ByVal Key As String,
ByVal Default As String) As String

'EXAMPLE: Ret$=Getini(Path$, Section$, Key$, Default$)

'Return String
Ret$ = String$(10000, Chr$(0))
Size% = Len(Ret$)

If Key$ = "" Then
    x% = GetPrivateProfileString(Section$, ByVal 0&, Default$, Ret$, Size%, Path)
    Else
    x% = GetPrivateProfileString(Section$, Key$, Default$, Ret$, Size%, Path)
    End If

If x% = False Then
    Getini = ""
    Else
    Getini = Left$(Ret$, x%)
    End If


End Function

Sub GlobalKeyDown (KeyCode As Integer, Shift As Integer)
'Example in KeyDown Section Of Form:
```

```
'GlobalKeyDown KeyCode, Shift

If Techmode = False Then Exit Sub

'CTRL-Q = End Program
    If KeyCode = 81 And Shift = 2 Then
        quit
        End If

'CTRL-T = Show Tech Form
    If KeyCode = 84 And Shift = 2 Then
        TechForm.Show
        End If

'CNTRL-w = Current Window Name
    If KeyCode = 87 And Shift = 2 Then
        MsgBox CurrentWindow$
        End If

End Sub

Sub HideMouse ()
If DMode = True Then Exit Sub
    While ShowCursor(False) >= 0
    Wend
End Sub

Function ListFindExact (aList As ListBox, ByVal Target As String) As Integer
'Returns listindex of first matching string in a ListBox

Const WM_USER = &H400
Const LB_FINDSTRINGEXACT = (WM_USER + 35)
Const LB_ERR = (-1)

ListFindExact = SendMessage(aList.hWnd, LB_FINDSTRINGEXACT, -1, ByVal Target)

End Function

Sub quit ()
ShowMouse
End
End Sub

Function Replace (ByVal Target$, ByVal Search$, ByVal Rep$, ByVal CaseSensitive%) As
String
'CaseSensitive% = True then "M" <> "m"
'CaseSensitive% = False then "M" = "m"

'Example: Ret$ = Replace(Ret$, Search$, Replace$, false)

'Reverse values for INSTR Compare
If CaseSensitive% <> 0 Then
    CaseSensitive% = 0
    Else
    CaseSensitive% = 1
    End If

Start% = InStr(1, Target$, Search$, CaseSensitive%)

Do Until Start% = 0
    Target$ = Left$(Target$, Start% - 1) & Rep$ & Mid$(Target$, Start% +
Len(Search$))
    Start% = InStr(Start% + Len(Rep$), Target$, Search$, CaseSensitive%)
    Loop

Replace = Target$
End Function

Sub SetUpWindow (F As Form, FormName$)
'ex: SetUpWindow Me, "FormName"

'F.WindowState = 2 'maximized
```

```
F.WindowState = 0 'normal

F.Caption = ""

F.Height = 7320
F.Width = 9720
CenterForm F

CurrentWindow$ = FormName$



End Sub

Sub ShowMouse ()
    While ShowCursor(True) < 0
    Wend
End Sub

Sub sleep (N As Single)
On Error Resume Next

'Pauses computer for N seconds

Dim T2 As Double, T3 As Double
T2 = Now
T3 = T2 + (TimeSerial(0, 0, 1) * N)


Do Until T2 > T3
    T2 = Now
    DoEvents  'optional
    Loop

End Sub

Function Writeini (ByVal Section$, ByVal Key$, ByVal WS$, ByVal Path$) As Integer

'x%=Writeini(Section$, Key$, WS$, Path$)

Select Case True
    Case Key$ = "" And WS$ <> ""
        valid% = WritePrivateProfileString(Section$, ByVal 0&, WS$, Path$)
    Case WS$ = "" And Key$ <> ""
        valid% = WritePrivateProfileString(Section$, Key$, ByVal 0&, Path$)
    Case Key$ = "" And WS$ = ""
        valid% = WritePrivateProfileString(Section$, ByVal 0&, ByVal 0&, Path$)
    Case Else
        valid% = WritePrivateProfileString(Section$, Key$, WS$, Path$)
    End Select
Writeini = valid%
End Function

Function YN (ByVal M$, ByVal T$) As Integer
If M$ = "" Then M$ = "Save Current Changes?"
If T$ = "" Then T$ = "Save?"

x% = MsgBox(M$, 4, T$)

Select Case x%
    Case 6 'yes
        YN = True
    Case 7 'no
        YN = False
    End Select

End Function
```

Fxcomm.bas

```
'FX Com port
    Global Const FXCOMM_COMPORT = 1


Sub ClosePLC ()
'Developer mode with Galia in machine
    If DMode Then Exit Sub

On Error Resume Next
GForm.FX.PortOpen = False


End Sub

Function GetBeltLoopLength () As Integer
On Error Resume Next

'Developer mode with Galia in machine
    If DMode Then
        GetBeltLoopLength = ReadBeltLoopLength()
        Exit Function
        End If

On Error Resume Next

'REMEMBER: Communications with PLC must be opeded before this procedure is called.
    r% = GForm.FX.ValueD(212)
    GetBeltLoopLength = r%

End Function

Function GetBeltLoopSpeed () As Integer
On Error Resume Next

'Developer mode with Galia in machine
    If DMode Then
        GetBeltLoopSpeed = ReadBeltLoopSpeed()
        Exit Function
        End If

On Error Resume Next

'REMEMBER: Communications with PLC must be opeded before_this procedure is called.
    r% = GForm.FX.ValueD(210)
    GetBeltLoopSpeed = r%

End Function

Sub OpenPLC ()
'Developer mode with Galia in machine
    If DMode Then Exit Sub

On Error Resume Next

ClosePLC
Err = 0
GForm.FX.CommPort = FXCOMM_COMPORT
If Err Then MsgBox Error$, 0, "PLC COM Port"
Err = 0
GForm.FX.Simulate = False
GForm.FX.PortOpen = True
If Err Then MsgBox "Could not connect to PLC", 0, "Open PLC"

End Sub

Sub SetBeltLoopLength (ByVal NewBeltLoopLength As Integer)
On Error Resume Next

'REMEMBER: Communications with PLC must be opeded before this procedure is called.
    WriteBeltLoopLength NewBeltLoopLength
```

```
'Developer mode with Galia in machine
    If DMode Then Exit Sub

    GForm.FX.ValueD(212) = NewBeltLoopLength

End Sub

Sub SetBeltLoopSpeed (ByVal NewBeltLoopSpeed As Integer)
On Error Resume Next

'REMEMBER: Communications with PLC must be opeded before this procedure is called.
    WriteBeltLoopSpeed NewBeltLoopSpeed

'Developer mode with Galia in machine
    If DMode Then Exit Sub

    GForm.FX.ValueD(210) = NewBeltLoopSpeed


End Sub
```

Developr.bas

```
Sub MakeSampleSecurityLog ()
On Error Resume Next

'Update Security Log
    Path$ = app.Path: If Right$(Path$, 1) <> "\" Then Path$ = Path$ & "\"
    FF% = FreeFile
    Open Path$ & "Security.log" For Output As FF%
    For z = 700 To 0 Step -1
    a$ = Format$(Now - z, "yyyy") & Chr$(9) & Format$(Now - z, "mm/dd/yyyy
hh:mmam/pm") & " = " & "Message " & Format$(z)
    'MsgBox Format$(Now - z, "mm/dd/yyyy hh:mmam/pm")
    Print #FF%, a$
    Next
    Close FF%
    MsgBox Format$(FileLen(Path$ & "Security.log"))

End Sub

Function Read_AC_1st () As Double

Read_AC_1st = Val(Getini(Path$ & "TICE.ini", "JL5000", "AC_1st", "0"))

End Function

Function Read_AC_2nd () As Double

Read_AC_2nd = Val(Getini(Path$ & "TICE.ini", "JL5000", "AC_2nd", "0"))

End Function

Function Read_DC_2nd () As Double

Read_DC_2nd = Val(Getini(Path$ & "TICE.ini", "JL5000", "DC_2nd", "0"))

End Function

Function Read_DC_3rd () As Double

Read_DC_3rd = Val(Getini(Path$ & "TICE.ini", "JL5000", "DC_3rd", "0"))

End Function

Function Read_Speed_1st () As Double

Read_Speed_1st = Val(Getini(Path$ & "TICE.ini", "JL5000", "Speed_1st", "20000"))

End Function

Function Read_Speed_3rd () As Double

Read_Speed_3rd = Val(Getini(Path$ & "TICE.ini", "JL5000", "Speed_3rd", "50000"))

End Function

Function Read_Start_1st () As Double

Read_Start_1st = Val(Getini(Path$ & "TICE.ini", "JL5000", "Start_1st", "0"))

End Function

Function Read_Start_3rd () As Double

Read_Start_3rd = Val(Getini(Path$ & "TICE.ini", "JL5000", "Start_3rd", "0"))

End Function

Sub Write_AC_1st (ByVal Value As Double)

success% = Writeini("JL5000", "AC_1st", Format$(Value), Path$ & "TICE.ini")
```

```
End Sub
Sub Write_AC_2nd (ByVal Value As Double)
success% = Writeini("JL5000", "AC_2nd", Format$(Value), Path$ & "TICE.ini")
End Sub
Sub Write_DC_2nd (ByVal Value As Double)
success% = Writeini("JL5000", "DC_2nd", Format$(Value), Path$ & "TICE.ini")
End Sub
Sub Write_DC_3rd (ByVal Value As Double)
success% = Writeini("JL5000", "DC_3rd", Format$(Value), Path$ & "TICE.ini")
End Sub
Sub Write_Speed_1st (ByVal Value As Double)
success% = Writeini("JL5000", "Speed_1st", Format$(Value), Path$ & "TICE.ini")
End Sub
Sub Write_Speed_3rd (ByVal Value As Double)
success% = Writeini("JL5000", "Speed_3rd", Format$(Value), Path$ & "TICE.ini")
End Sub

Sub Write_Start_1st (ByVal Value As Double)
success% = Writeini("JL5000", "Start_1st", Format$(Value), Path$ & "TICE.ini")
End Sub
Sub Write_Start_3rd (ByVal Value As Double)
success% = Writeini("JL5000", "Start_3rd", Format$(Value), Path$ & "TICE.ini")
End Sub
```

```
VERSION 2.00
Begin Form OpeningScreen
   BackColor        =   &H00000000&
   BorderStyle      =   1  'Fixed Single
   Caption          =   " "
   ClientHeight     =   6915
   ClientLeft       =   825
   ClientTop        =   1920
   ClientWidth      =   9555
   ControlBox       =   0   'False
   FillColor        =   &H00FFC0FF&
   Height           =   7320
   Icon             =   OPENSCN.FRX:0000
   KeyPreview       =   -1  'True
   Left             =   765
   LinkTopic        =   "Form2"
   MaxButton        =   0   'False
   MinButton        =   0   'False
   Picture          =   OPENSCN.FRX:0302
   ScaleHeight      =   6915
   ScaleWidth       =   9555
   Top              =   1575
   Width            =   9675
   Begin SSCommand Command3D1
      BevelWidth       =   10
      Caption          =   "START"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   1695
      Left             =   3600
      Picture          =   OPENSCN.FRX:25B7E
      TabIndex         =   2
      Top              =   2640
      Width            =   2655
   End
   Begin Label Label1
      Alignment        =   2  'Center
      BackStyle        =   0  'Transparent
      Caption          =   "JL-5000"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00FF0000&
      Height           =   615
      Left             =   0
      TabIndex         =   3
      Top              =   720
      Width            =   9615
   End
   Begin Label Label3
      Alignment        =   2  'Center
      BackStyle        =   0  'Transparent
      Caption          =   "KNOXVILLE, TENNESSEE"
      FontBold         =   -1  'True
      FontItalic       =   -1  'True
      FontName         =   "MS Sans Serif"
      FontSize         =   13.5
      FontStrikethru   =   0   'False
      FontUnderline    =   0   'False
      ForeColor        =   &H00C0C0C0&
      Height           =   495
      Left             =   30
      TabIndex         =   0
      Top              =   6540
```

```
      Width            =   9585
   End
   Begin Label Label2
      Alignment        =   2   'Center
      BackStyle        =   0   'Transparent
      Caption          =   "TICE ENGINEERING && SALES"
      FontBold         =   -1   'True
      FontItalic       =   0   'False
      FontName         =   "Arial"
      FontSize         =   24
      FontStrikethru   =   0   'False
      FontUnderline    =   0   'False
      ForeColor        =   &H00FF0000&
      Height           =   615
      Left             =   0
      TabIndex         =   1
      Top              =   240
      Width            =   9615
   End
End
Sub Command3D1_Click ()
'Reset Galil
    Shared_1

'GoTo tempory_bypass -- Del this and the following line when back on-line
    'Developer mode with Galia in machine
        If DMode Then GoTo TempByPass

'Check Machine Inputs
    If Shared_2() <> True Then Exit Sub

'Check Needle Home Position
    If ReadFacNeedleHome() = "" Then
        ResetGalia
        FactoryFlag% = True
        Password.Show
        Unload Me
        Exit Sub
        End If

'Send Positions Home, then check for success
    G_Home

    'Enter Loop and wait for 10 seconds or until Galia sends OK message
        LastMsg$ = ""
        counter% = 0
        Dim T2 As Double, T3 As Double
        T2 = Now

        T3 = T2 + (TimeSerial(0, 0, 1) * 10) '10 seconds

        Do
        'Get variable value
            Ret$ = Space$(255)
            r% = get_from_1000("VH2=?", Ret$)
            If Val(Ret$) <> 0 Then
                'FRONT & REAR BOBBIN ARE HOME
                counter% = counter% Or (2 ^ 0)
                End If
        'Get variable value
            Ret$ = Space$(255)
            r% = get_from_1000("VH3=?", Ret$)
            If Val(Ret$) <> 0 Then
                'X & Y TABLE ARE HOME
                counter% = counter% Or (2 ^ 1)
                End If
        'Get variable value
            Ret$ = Space$(255)
            r% = get_from_1000("VH4=?", Ret$)
            If Val(Ret$) <> 0 Then
                'THE NEEDLE IS HOME
                counter% = counter% Or (2 ^ 2)
```

```
                End If

        'DoEvents
        T2 = Now
        Loop Until counter% = 7 Or T2 > T3

        If counter% <> 7 Then LastMsg$ = "1" 'Timeout Error

    'Check for Error
    If InStr(LastMsg$, "1") Then
        'See if this is first or second Error
        Ret$ = ReadIntializationError()

        Display ""
        Msg$ = "An intialization error has occured." & nl$
        Msg$ = Msg$ & "The machine did not return to the 'home' position correctly."
& nl$
        Msg$ = Msg$ & nl$
        If (counter% And (2 ^ 0)) = 0 Then Msg$ = Msg$ & "FRONT & REAR HOOK ARE NOT
HOME." & nl$
        If (counter% And (2 ^ 1)) = 0 Then Msg$ = Msg$ & "X & Y TABLE ARE NOT HOME."
& nl$
        If (counter% And (2 ^ 2)) = 0 Then Msg$ = Msg$ & "THE NEEDLE IS NOT HOME." &
nl$

        If Ret$ = "" Then Msg$ = Msg$ & nl$ & "Turn the machine off, and try again."
& nl$
        WriteIntializationError "1"
        MsgBox Msg$, 0, "Intialization Error"

        If Ret$ = "" Then
            Command3D1.Enabled = True
            Exit Sub
            Else
            'Second Error
            Display ""
            TShot.Show
            End If
        Else
        'No Error
        WriteIntializationError ""
        RunMode.Show
        Display ""
        End If

Unload Me


'Development Mode ByPass=====================================
Exit Sub
TempByPass:
        WriteIntializationError ""
        RunMode.Show
        Display ""
        Unload Me
'==========================================================

End Sub

Sub Form_KeyDown (KeyCode As Integer, Shift As Integer)
GlobalKeyDown KeyCode, Shift

End Sub

Sub Form_Load ()
On Error Resume Next

'Check if Program is supposed to be in Developer Mode
    If InStr(UCase$(Command$), "DMODE") > 0 And ProgramHasAlreadyStarted = False
Then
        DMode = True
        End If
```

```
    'If DMode = True Then Techmode = True
    'DMode = True

'Setup This Form
    CurrentWindow$ = ""
    SetUpWindow Me, "OpeningScreen"

'Center controls
    CenterControl Command3D1, Me.Width, Me.Height
    CenterControlW Label1, Me.Width
    CenterControlW Label2, Me.Width
    CenterControlW Label3, Me.Width
    Command3D1.Enabled = False
    Me.Show
    Me.Refresh

'Hide or ShowMouse
    If DMode = True Then
        ShowMouse
        Else
        HideMouse
        End If

'SETUP PROGRAM STARTUP
VALUES==========================================================
    'SetUp Global Variables
        Path$ = app.Path: If Right$(Path$, 1) <> "\" Then Path$ = Path$ & "\"
        nl$ = Chr$(13) & Chr$(10)
        CurrentStitch$ = ReadCurrentStitch()
        LastMsg$ = ""
        StitchScaleX = ReadStitchScaleX()
        StitchScaleY = ReadStitchScaleY()
        Presets = ReadNumberOfPresetStitches()

    'Start Startup Form
        Load GForm     'Form with VBX on it - Form always remains invisible
        OpenCommWithVBX


'Check Security Log Size
        CheckSecurityLog
        Command3D1.Enabled = True
        ProgramHasAlreadyStarted = True

'Check for factory defaults
    Me.Show
    If ReadFacNeedleHome() = "" And DMode = False Then
        Shared_1
        If Shared_2() <> True Then Exit Sub
        ResetGalia
        FactoryFlag% = True
        Password.Show
        Unload Me
        End If

End Sub

Sub Shared_1 ()
'Reset Galil
    Command3D1.Enabled = False
    Display "Intializing JL-5000...Please Wait."
    ResetGaliaWithoutHome
End Sub

Function Shared_2 () As Integer
'Check Inputs
    Byte% = 255 - GetInputByte(0)
    Byte1% = 255 - GetInputByte(1)

    'Check Air
        If (Byte1% And (2 ^ (12 - 9))) = 0 Then
            'Air is off
```

```
            MError$ = MError$ & "The Air is off." & nl
            End If
    'Check Front Trimmer
        If (Byte1% And (2 ^ (10 - 9))) = 0 Then
            MError$ = MError$ & "There is an error with the Front Trimmer." & nl
            End If
    'Check Back Trimmer
        If (Byte1% And (2 ^ (9 - 9))) = 0 Then
            MError$ = MError$ & "There is an error with the Rear Trimmer." & nl
            End If
    'Check Slide Home Position
        If (Byte% And (2 ^ (6 - 1))) = 0 Then
            MError$ = MError$ & "There is an error with the Slide Home Position." &
nl
            End If
    'Check Start Switch
        If (Byte% And (2 ^ (8 - 1))) <> 0 Then
            MError$ = MError$ & "The Start Switch is in the on position." & nl
            End If

    'Check Error Messages
        If MError$ <> "" Then
            Display ""
            MsgBox MError$ & nl & "Correct problem(s) and try again.", 0,
"Intialization Error"
            Command3D1.Enabled = True
            Exit Function
            Else
            Shared_2 = True
            End If

End Function
```

```
VERSION 2.00
Begin Form RunMode
   BackColor        =   &H00FFFF00&
   BorderStyle      =   1   'Fixed Single
   Caption          =   "RUN MODE"
   ClientHeight     =   6915
   ClientLeft       =   1050
   ClientTop        =   2100
   ClientWidth      =   9600
   ControlBox       =   0    'False
   Height           =   7320
   KeyPreview       =   -1   'True
   Left             =   990
   LinkTopic        =   "Form1"
   MaxButton        =   0    'False
   MinButton        =   0    'False
   ScaleHeight      =   6915
   ScaleWidth       =   9600
   Top              =   1755
   Width            =   9720
   Begin PictureBox P
      BackColor        =   &H00FFFF00&
      BorderStyle      =   0   'None
      Height           =   4215
      Left             =   2520
      ScaleHeight      =   4215
      ScaleWidth       =   5715
      TabIndex         =   2
      Top              =   2160
      Width            =   5715
      Begin SSCommand Command3D1
         BevelWidth       =   10
         Caption          =   "AUTO RUN"
         FontBold         =   -1   'True
         FontItalic       =   0    'False
         FontName         =   "Arial"
         FontSize         =   24
         FontStrikethru   =   0    'False
         FontUnderline    =   0    'False
         ForeColor        =   &H000000FF&
         Height           =   1935
         Left             =   0
         Picture          =   RUNMODE.FRX:0000
         TabIndex         =   5
         Top              =   0
         Width            =   3015
      End
      Begin SSCommand SETUP
         BevelWidth       =   10
         Caption          =   "SET UP"
         FontBold         =   -1   'True
         FontItalic       =   0    'False
         FontName         =   "Arial"
         FontSize         =   24
         FontStrikethru   =   0    'False
         FontUnderline    =   0    'False
         ForeColor        =   &H000000FF&
         Height           =   1935
         Left             =   0
         Picture          =   RUNMODE.FRX:0302
         TabIndex         =   4
         Top              =   2280
         Width            =   3015
      End
      Begin SSCommand TechButton
         BevelWidth       =   10
         Caption          =   "RESET"
         FontBold         =   -1   'True
         FontItalic       =   0    'False
         FontName         =   "Arial"
         FontSize         =   24
         FontStrikethru   =   0    'False
```

```
        FontUnderline   =   0   'False
        ForeColor       =   &H00FF0000&
        Height          =   4200
        Left            =   3300
        TabIndex        =   3
        Top             =   0
        Width           =   2355
      End
    End
    Begin Label Label2
      Alignment       =   2  'Center
      BackStyle       =   0  'Transparent
      Caption         =   "JL-5000"
      FontBold        =   -1  'True
      FontItalic      =   0   'False
      FontName        =   "Arial"
      FontSize        =   30
      FontStrikethru  =   0   'False
      FontUnderline   =   0   'False
      ForeColor       =   &H00800000&
      Height          =   615
      Left            =   3780
      TabIndex        =   1
      Top             =   1020
      Width           =   3015
    End
    Begin Label Label1
      Alignment       =   2  'Center
      BackStyle       =   0  'Transparent
      Caption         =   "TICE ENGINEERING"
      FontBold        =   -1  'True
      FontItalic      =   0   'False
      FontName        =   "Arial"
      FontSize        =   30
      FontStrikethru  =   0   'False
      FontUnderline   =   0   'False
      ForeColor       =   &H00800000&
      Height          =   705
      Left            =   2640
      TabIndex        =   0
      Top             =   300
      Width           =   6075
    End
End
Sub Command3D1_Click ()
G_Stop
Status = G_Command("XQ#START")
AutoRun.Show
Unload Me
End Sub

Sub Form_Activate ()
    If TechMode = True Then
        P.Width = TechButton.Left + TechButton.Width
        TechButton.Caption = "TECH"
        Else
        'P.Width = Setup.Left + Setup.Width
        TechButton.Caption = "RESET"
        End If
    CenterControlW P, Me.Width

End Sub

Sub Form_KeyDown (KeyCode As Integer, Shift As Integer)
GlobalKeyDown KeyCode, Shift
End Sub

Sub Form_Load ()
'Setup This Form
    SetUpWindow Me, "RunMode"

'Center Controls
```

```
    CenterControlW Label1, Me.Width
    CenterControlW Label2, Me.Width

End Sub

Sub SETUP_Click ()
G_Stop

'Check if Password is null and take action
    If TechMode <> True Then
        UserIsHere% = True
        Password.Show
        Else
        UserIsHere% = 1
        SetupForm.Show
        End If

Unload Me

End Sub

Sub TechButton_Click ()
If TechMode = True Or DMode = True  Then
    TechForm.Show
    Else
    G_Stop
    Status = command_1000("CB1")
    Status = command_1000("CB16")
    Status = command_1000("CB14")
    ResetProgram Me
    End If

End Sub
```

```
VERSION 2.00
Begin Form AutoRun
   BackColor        =   &H00FFFF80&
   BorderStyle      =   1  'Fixed Single
   Caption          =   "AutoRun"
   ClientHeight     =   7515
   ClientLeft       =   990
   ClientTop        =   1635
   ClientWidth      =   9570
   ControlBox       =   0   'False
   Height           =   7920
   KeyPreview       =   -1  'True
   Left             =   930
   LinkTopic        =   "Form1"
   MaxButton        =   0   'False
   MinButton        =   0   'False
   ScaleHeight      =   7515
   ScaleWidth       =   9570
   Top              =   1290
   Width            =   9690
   Begin PictureBox Picture2
      Height           =   2175
      Left             =   5280
      ScaleHeight      =   2145
      ScaleWidth       =   3945
      TabIndex         =   10
      Top              =   300
      Width            =   3975
      Begin PictureBox P
         BorderStyle      =   0  'None
         DrawWidth        =   2
         FillStyle        =   0  'Solid
         ForeColor        =   &H000000FF&
         Height           =   1635
         Left             =   60
         ScaleHeight      =   6.866
         ScaleMode        =   0  'User
         ScaleWidth       =   7.775
         TabIndex         =   11
         Top              =   60
         Width            =   3795
      End
      Begin Label Label3
         Alignment        =   2  'Center
         BackStyle        =   0  'Transparent
         Caption          =   "Current Stitch Pattern"
         FontBold         =   -1  'True
         FontItalic       =   0   'False
         FontName         =   "MS Sans Serif"
         FontSize         =   12
         FontStrikethru   =   0   'False
         FontUnderline    =   0   'False
         Height           =   315
         Left             =   60
         TabIndex         =   1
         Top              =   1740
         Width            =   3795
      End
   End
   Begin ListBox List1
      Height           =   225
      Left             =   9300
      TabIndex         =   9
      Top              =   2040
      Visible          =   0   'False
      Width            =   555
   End
   Begin PictureBox Picture1
      BackColor        =   &H00FFFF80&
      BorderStyle      =   0  'None
      Height           =   4335
      Left             =   180
```

```
ScaleHeight      =   4335
ScaleWidth       =   9015
TabIndex         =   2
Top              =   2880
Width            =   9015
Begin TextBox ResponseOutput
   BackColor        =   &H00FFFFFF&
   FontBold         =   -1   'True
   FontItalic       =   0    'False
   FontName         =   "Arial"
   FontSize         =   9.75
   FontStrikethru   =   0    'False
   FontUnderline    =   0    'False
   ForeColor        =   &H000000FF&
   Height           =   2055
   Left             =   0
   MultiLine        =   -1   'True
   ScrollBars       =   2   'Vertical
   TabIndex         =   8
   TabStop          =   0    'False
   Top              =   2160
   Width            =   5775
End
Begin SSCommand Command3D1
   BevelWidth       =   10
   Caption          =   "NEW BELT LOOP"
   FontBold         =   -1   'True
   FontItalic       =   0    'False
   FontName         =   "Arial"
   FontSize         =   19.5
   FontStrikethru   =   0    'False
   FontUnderline    =   0    'False
   ForeColor        =   &H000000FF&
   Height           =   1965
   Left             =   2040
   Picture          =   AUTORUN.FRX:0000
   TabIndex         =   7
   Top              =   0
   Width            =   3615
End
Begin SSCommand Command3D3
   BevelWidth       =   10
   Caption          =   "STOP"
   FontBold         =   -1   'True
   FontItalic       =   0    'False
   FontName         =   "Arial"
   FontSize         =   19.5
   FontStrikethru   =   0    'False
   FontUnderline    =   0    'False
   ForeColor        =   &H000000FF&
   Height           =   1575
   Left             =   6600
   Picture          =   AUTORUN.FRX:0302
   TabIndex         =   6
   Top              =   0
   Width            =   2400
End
Begin SSCommand Command3D4
   BevelWidth       =   10
   Caption          =   "FT. DOWN"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H000000FF&
   Height           =   885
   Left             =   0
   TabIndex         =   5
   Top              =   1080
   Width            =   1635
```

```
   End
   Begin SSCommand Command3D5
      BevelWidth       =   10
      Caption          =   "FT. UP"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H000000FF&
      Height           =   885
      Left             =   0
      TabIndex         =   4
      Top              =   30
      Width            =   1620
   End
   Begin SSCommand Command3D6
      BevelWidth       =   10
      Caption          =   "EXIT"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H000000FF&
      Height           =   1575
      Left             =   6600
      TabIndex         =   3
      Top              =   2640
      Width            =   2400
   End
End
Begin Label Slot
   Alignment        =   1   'Right Justify
   BackStyle        =   0   'Transparent
   FontBold         =   0    'False
   FontItalic       =   -1   'True
   FontName         =   "Arial"
   FontSize         =   8.25
   FontStrikethru   =   0    'False
   FontUnderline    =   0    'False
   Height           =   255
   Left             =   5280
   TabIndex         =   13
   Top              =   2520
   Width            =   3975
End
Begin Label Title
   Alignment        =   2   'Center
   BackColor        =   &H00FFFF80&
   Caption          =   "JL-5000"
   FontBold         =   -1   'True
   FontItalic       =   0    'False
   FontName         =   "Arial"
   FontSize         =   18
   FontStrikethru   =   0    'False
   FontUnderline    =   0    'False
   ForeColor        =   &H00800000&
   Height           =   375
   Left             =   420
   TabIndex         =   0
   Top              =   1860
   Width            =   4455
End
Begin Label Label1
   Alignment        =   2   'Center
   BackStyle        =   0   'Transparent
   Caption          =   "New Technology In Sewing"
   FontBold         =   -1   'True
   FontItalic       =   -1   'True
```

```
      FontName          =   "Arial"
      FontSize          =   13.5
      FontStrikethru    =   0    'False
      FontUnderline     =   0    'False
      ForeColor         =   &H00800000&
      Height            =   375
      Left              =   360
      TabIndex          =   12
      Top               =   2280
      Width             =   4575
   End
   Begin Image Image2
      Height            =   1755
      Left              =   360
      Picture           =   AUTORUN.FRX:0604
      Top               =   180
      Width             =   4500
   End
End
Sub Command3D1_Click ()
ResponseOutput = ""
Status = G_Command("XQ#NEW,3")

End Sub

Sub Command3D3_Click ()
Status = G_Command("CB13")
Status = G_Command("WT100")
G_Stop
Status = G_Command("CB1")
Status = G_Command("CB16")
Status = G_Command("CB14")

StopForm2.Show 1

'Simulate button push in RunMode Form
    Status = G_Command("XQ#START")

'Simulate Form_Load in this form
    SetUpWindow Me, "AutoRun"
    DrawStitch P, List1, False, -1

'Get Cycel time display messages
    If Read_FullCycle() Then Cycle1 = True
    If Read_SewingCycle() Then Cycle2 = True
    If Read_EachCycle() Then Cycle3 = True
    If Read_AverageCycle() Then Cycle4 = True


End Sub

Sub Command3D4_Click ()
G_FootDown
Status = G_Command("WT100")
Status = G_Command("SB13")
End Sub

Sub Command3D5_Click ()
Status = G_Command("CB13")
Status = G_Command("WT100")
G_FootUp
End Sub

Sub Command3D6_Click ()

ExitForm

If AutoRun.Tag <> "Manual" Then RunMode.Show
Unload Me


End Sub
```

```
Sub ExitForm ()
Status = G_Command("ST")
Status = G_Command("CB13")
Status = G_Command("WT100")
Status = G_Command("XQ#JOGJ")

End Sub

Sub Form_Activate ()
SetUpWindow Me, "AutoRun"
End Sub

Sub Form_KeyDown (KeyCode As Integer, Shift As Integer)
GlobalKeyDown KeyCode, Shift
End Sub

Sub Form_Load ()
SetUpWindow Me, "AutoRun"

'Center Controls
    CenterControlW Picture1, Me.Width
    Picture2.Left = Picture1.Left + Picture1.Width - Picture2.Width
    Image2.Left = Picture1.Left
    Title.Left = Picture1.Left
    Label1.Left = Picture1.Left
    Title.Width = Image2.Width
    Label1.Width = Image2.Width


'Draw Stitch
    LoadStitchIntoListBox List1, CurrentStitch$
    Me.Show
    DrawStitch P, List1, False, -1
    Label3.Caption = Format$(List1.ListCount - 1) & " Stitch Pattern"

'Get Cycel time display messages
    If Read_FullCycle() Then Cycle1 = True Else Cycle1 = False
    If Read_SewingCycle() Then Cycle2 = True Else Cycle2 = False
    If Read_EachCycle() Then Cycle3 = True Else Cycle3 = False
    If Read_AverageCycle() Then Cycle4 = True Else Cycle4 = False


End Sub

Sub Form_Paint ()
DrawStitch P, List1, False, -1
End Sub

Sub Image2_Click ()
Load Numbers
Numbers.Command3D7(0).Caption = "10"
Numbers.Show 1

If NumbersRet$ = "" Then Exit Sub


N% = Val(NumbersRet$)

r% = LoadTVFile(N%)
If r% = False Then Exit Sub

SimulateExit

Slot = "Slot #" & Format$(N%)



End Sub
```

```
Sub P_Click ()
If Cycle3 = False And Cycle4 = False Then Exit Sub
Grapher.Show
End Sub

Sub ResponseOutput_DblClick ()
If YN("Clear Display?", "Clear Display") Then
    ResponseOutput.Text = ""
    End If
End Sub

Sub ResponseOutput_GotFocus ()
Command3D1.SetFocus
End Sub

Sub SimulateExit ()
'Simulate exit of form
    ResponseOutput = ""
    ExitForm
'Simulate button push in RunMode Form
    G_Stop
    ResetGalia

'Wait till reset is done
    If DMode = False Then
        Ret$ = "0"
        Dim T2 As Double, T3 As Double
        T2 = Now
        N! = 10
        T3 = T2 + (TimeSerial(0, 0, 1) * N!)

        Do Until Val(Ret$) <> 0 Or T2 > T3
            Ret$ = Space$(255)
            r% = get_from_1000("HomeDone=?", Ret$)
            T2 = Now
        Loop
        End If

'Simulate Form_Load in this form
    Status = G_Command("XQ#START")
    SetUpWindow Me, "AutoRun"
    LoadStitchIntoListBox List1, CurrentStitch$
    DrawStitch P, List1, False, -1
    Label3.Caption = Format$(List1.ListCount - 1) & " Stitch Pattern"

'Get Cycel time display messages
    If Read_FullCycle() Then Cycle1 = True
    If Read_SewingCycle() Then Cycle2 = True
    If Read_EachCycle() Then Cycle3 = True
    If Read_AverageCycle() Then Cycle4 = True

End Sub
```

```
VERSION 2.00
Begin Form Numbers
   BackColor        =   &H0000FF00&
   BorderStyle      =   1  'Fixed Single
   Caption          =   "Numbers"
   ClientHeight     =   4275
   ClientLeft       =   2295
   ClientTop        =   1935
   ClientWidth      =   4875
   ControlBox       =   0   'False
   Height           =   4680
   Left             =   2235
   LinkTopic        =   "Form1"
   MaxButton        =   0   'False
   MinButton        =   0   'False
   ScaleHeight      =   4275
   ScaleWidth       =   4875
   Top              =   1590
   Width            =   4995
   Begin SSCommand Command3D8
      BevelWidth       =   10
      Caption          =   "CANCEL"
      FontBold         =   -1  'True
      FontItalic       =   0   'False
      FontName         =   "MS Sans Serif"
      FontSize         =   12
      FontStrikethru   =   0   'False
      FontUnderline    =   0   'False
      ForeColor        =   &H000000FF&
      Height           =   855
      Left             =   1680
      TabIndex         =   10
      Top              =   3180
      Width            =   2955
   End
   Begin SSCommand Command3D7
      BevelWidth       =   10
      Caption          =   "9"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H00FF0000&
      Height           =   855
      Index            =   9
      Left             =   3240
      TabIndex         =   9
      Top              =   120
      Width            =   1335
   End
   Begin SSCommand Command3D7
      BevelWidth       =   10
      Caption          =   "8"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H00FF0000&
      Height           =   855
      Index            =   8
      Left             =   1680
      TabIndex         =   8
      Top              =   120
      Width            =   1335
   End
   Begin SSCommand Command3D7
      BevelWidth       =   10
      Caption          =   "7"
```

```
   FontBold          =   -1  'True
   FontItalic        =   0   'False
   FontName          =   "MS Sans Serif"
   FontSize          =   24
   FontStrikethru    =   0   'False
   FontUnderline     =   0   'False
   ForeColor         =   &H00FF0000&
   Height            =   855
   Index             =   7
   Left              =   120
   TabIndex          =   7
   Top               =   120
   Width             =   1335
End
Begin SSCommand Command3D7
   BevelWidth        =   10
   Caption           =   "6"
   FontBold          =   -1  'True
   FontItalic        =   0   'False
   FontName          =   "MS Sans Serif"
   FontSize          =   24
   FontStrikethru    =   0   'False
   FontUnderline     =   0   'False
   ForeColor         =   &H00FF0000&
   Height            =   855
   Index             =   6
   Left              =   3240
   TabIndex          =   6
   Top               =   1140
   Width             =   1335
End
Begin SSCommand Command3D7
   BevelWidth        =   10
   Caption           =   "5"
   FontBold          =   -1  'True
   FontItalic        =   0   'False
   FontName          =   "MS Sans Serif"
   FontSize          =   24
   FontStrikethru    =   0   'False
   FontUnderline     =   0   'False
   ForeColor         =   &H00FF0000&
   Height            =   855
   Index             =   5
   Left              =   1680
   TabIndex          =   5
   Top               =   1140
   Width             =   1335
End
Begin SSCommand Command3D7
   BevelWidth        =   10
   Caption           =   "4"
   FontBold          =   -1  'True
   FontItalic        =   0   'False
   FontName          =   "MS Sans Serif"
   FontSize          =   24
   FontStrikethru    =   0   'False
   FontUnderline     =   0   'False
   ForeColor         =   &H00FF0000&
   Height            =   855
   Index             =   4
   Left              =   120
   TabIndex          =   4
   Top               =   1140
   Width             =   1335
End
Begin SSCommand Command3D7
   BevelWidth        =   10
   Caption           =   "3"
   FontBold          =   -1  'True
   FontItalic        =   0   'False
   FontName          =   "MS Sans Serif"
   FontSize          =   24
```

```
      FontStrikethru  =   0    'False
      FontUnderline   =   0    'False
      ForeColor       =   &H00FF0000&
      Height          =   855
      Index           =   3
      Left            =   3240
      TabIndex        =   3
      Top             =   2160
      Width           =   1335
   End
   Begin SSCommand Command3D7
      BevelWidth      =   10
      Caption         =   "2"
      FontBold        =   -1   'True
      FontItalic      =   0    'False
      FontName        =   "MS Sans Serif"
      FontSize        =   24
      FontStrikethru  =   0    'False
      FontUnderline   =   0    'False
      ForeColor       =   &H00FF0000&
      Height          =   855
      Index           =   2
      Left            =   1680
      TabIndex        =   2
      Top             =   2160
      Width           =   1335
   End
   Begin SSCommand Command3D7
      BevelWidth      =   10
      Caption         =   "1"
      FontBold        =   -1   'True
      FontItalic      =   0    'False
      FontName        =   "MS Sans Serif"
      FontSize        =   24
      FontStrikethru  =   0    'False
      FontUnderline   =   0    'False
      ForeColor       =   &H00FF0000&
      Height          =   855
      Index           =   1
      Left            =   120
      TabIndex        =   1
      Top             =   2160
      Width           =   1335
   End
   Begin SSCommand Command3D7
      BevelWidth      =   10
      Caption         =   "0"
      FontBold        =   -1   'True
      FontItalic      =   0    'False
      FontName        =   "MS Sans Serif"
      FontSize        =   24
      FontStrikethru  =   0    'False
      FontUnderline   =   0    'False
      ForeColor       =   &H00FF0000&
      Height          =   855
      Index           =   0
      Left            =   120
      TabIndex        =   0
      Top             =   3180
      Width           =   1335
   End
End
Sub Command3D7_Click (Index As Integer)
NumbersRet$ = Command3D7(Index).Caption
Unload Me
End Sub

Sub Command3D8_Click ()
Unload Me
End Sub

Sub Form_Load ()
```

```
Me.Caption = ""
CenterForm Me
NumbersRet$ = ""
End Sub
```

```
VERSION 2.00
Begin Form StopForm
   BackColor        =   &H00FFFF00&
   BorderStyle      =   1   'Fixed Single
   Caption          =   "Stop Form"
   ClientHeight     =   8670
   ClientLeft       =   -270
   ClientTop        =   1770
   ClientWidth      =   11445
   ClipControls     =   0    'False
   ControlBox       =   0    'False
   Height           =   9075
   KeyPreview       =   -1   'True
   Left             =   -330
   LinkTopic        =   "PAGE14"
   MaxButton        =   0    'False
   MinButton        =   0    'False
   ScaleHeight      =   8670
   ScaleWidth       =   11445
   Top              =   1425
   Width            =   11565
   Begin SSCommand Command3D3
      BevelWidth       =   10
      Caption          =   "RESET"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H000000FF&
      Height           =   1335
      Left             =   3360
      TabIndex         =   2
      Top              =   5160
      Width            =   2415
   End
   Begin SSCommand Command3D2
      BevelWidth       =   10
      Caption          =   "FT. DOWN"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H000000FF&
      Height           =   975
      Left             =   4860
      TabIndex         =   1
      Top              =   1920
      Width            =   1695
   End
   Begin SSCommand Command3D1
      BevelWidth       =   10
      Caption          =   "FT. UP"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H000000FF&
      Height           =   975
      Left             =   2820
      TabIndex         =   0
      Top              =   1950
      Width            =   1695
   End
   Begin Label Label2
      Alignment        =   2   'Center
      BackStyle        =   0   'Transparent
```

```
   Caption          =   "JL-5000"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H00800000&
   Height           =   615
   Index            =   1
   Left             =   3000
   TabIndex         =   7
   Top              =   720
   Width            =   2895
End
Begin Label Label1
   Alignment        =   2  'Center
   BackStyle        =   0  'Transparent
   Caption          =   "TICE ENGINEERING"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H00800000&
   Height           =   615
   Index            =   1
   Left             =   2280
   TabIndex         =   6
   Top              =   0
   Width            =   4695
End
Begin Image Image1
   Height           =   480
   Index            =   0
   Left             =   5640
   Picture          =   SFORM.FRX:0000
   Top              =   720
   Width            =   480
End
Begin Image Image1
   Height           =   480
   Index            =   1
   Left             =   2760
   Picture          =   SFORM.FRX:0302
   Top              =   720
   Width            =   480
End
Begin Label Label3
   BackStyle        =   0  'Transparent
   Caption          =   "THEN PRESS RESET"
   FontBold         =   -1  'True
   FontItalic       =   0   'False
   FontName         =   "Arial"
   FontSize         =   18
   FontStrikethru   =   0   'False
   FontUnderline    =   0   'False
   Height           =   495
   Left             =   2760
   TabIndex         =   5
   Top              =   4440
   Width            =   3855
End
Begin Label Label2
   BackStyle        =   0  'Transparent
   Caption          =   "STOP MODE!!! MOVE NEEDLE TO"
   FontBold         =   -1  'True
   FontItalic       =   0   'False
   FontName         =   "Arial"
   FontSize         =   18
   FontStrikethru   =   0   'False
```

```
      FontUnderline   =   0   'False
      Height          =   615
      Index           =   0
      Left            =   1920
      TabIndex        =   4
      Top             =   3120
      Width           =   6015
   End
   Begin Label Label1
      BackStyle       =   0  'Transparent
      Caption         =   "UP POSITION"
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H000000FF&
      Height          =   615
      Index           =   0
      Left            =   3000
      TabIndex        =   3
      Top             =   3720
      Width           =   3495
   End
End
Sub Command3D1_Click ()
G_FootUp
End Sub

Sub Command3D2_Click ()
G_FootDown
End Sub

Sub Command3D3_Click ()
G_Stop
ResetGalia
G_Wait 50
Unload Me
End Sub

Sub Form_KeyDown (KeyCode As Integer, Shift As Integer)
GlobalKeyDown KeyCode, Shift
End Sub

Sub Form_Load ()
SetUpWindow Me, "StopForm"

If DMode = True Then Exit Sub
Status = command_1000("WT500")
Status = command_1000("CB1")
Status = command_1000("CB16")
Status = command_1000("CB14")

End Sub
```

```
VERSION 2.00
Begin Form Grapher
   BackColor        =   &H00FFFF00&
   BorderStyle      =   1  'Fixed Single
   Caption          =   "Mech. Screen"
   ClientHeight     =   7515
   ClientLeft       =   420
   ClientTop        =   1695
   ClientWidth      =   10275
   ControlBox       =   0   'False
   Height           =   7920
   KeyPreview       =   -1  'True
   Left             =   360
   LinkTopic        =   "Form1"
   MaxButton        =   0   'False
   MinButton        =   0   'False
   ScaleHeight      =   7515
   ScaleWidth       =   10275
   Top              =   1350
   Width            =   10395
   Begin VBMsg VBMsg1
      Height           =   420
      Left             =   9780
      MessageCount     =   GRAPH.FRX:0000
      MessageList      =   GRAPH.FRX:0002
      MessageTypes     =   0  'Selected Messages
      Top              =   4680
      Width            =   420
   End
   Begin CheckBox Check1
      Caption          =   "Check1"
      Height           =   195
      Left             =   9900
      TabIndex         =   9
      Top              =   3360
      Visible          =   0   'False
      Width            =   975
   End
   Begin PictureBox G2
      BackColor        =   &H00FFFF00&
      BorderStyle      =   0  'None
      FillStyle        =   0  'Solid
      Height           =   4095
      Left             =   0
      ScaleHeight      =   4095
      ScaleWidth       =   615
      TabIndex         =   7
      Top              =   2700
      Width            =   615
   End
   Begin ListBox List1
      Height           =   225
      Left             =   9780
      TabIndex         =   0
      Top              =   2760
      Visible          =   0   'False
      Width            =   555
   End
   Begin PictureBox G
      BackColor        =   &H00FFFFC0&
      FillStyle        =   0  'Solid
      Height           =   3855
      Left             =   780
      ScaleHeight      =   3825
      ScaleWidth       =   8685
      TabIndex         =   1
      Top              =   2940
      Width            =   8715
   End
   Begin PictureBox Picture2
      Height           =   2475
      Left             =   5160
```

```
   ScaleHeight      =   2445
   ScaleWidth       =   4305
   TabIndex         =   3
   Top              =   240
   Width            =   4335
   Begin PictureBox P
      BorderStyle      =   0   'None
      DrawWidth        =   2
      FillStyle        =   0   'Solid
      ForeColor        =   &H000000FF&
      Height           =   1875
      Left             =   60
      ScaleHeight      =   7.874
      ScaleMode        =   0   'User
      ScaleWidth       =   8.513
      TabIndex         =   4
      Top              =   60
      Width            =   4155
   End
   Begin Label Label3
      Alignment        =   2   'Center
      BackStyle        =   0   'Transparent
      Caption          =   "Current Stitch Pattern"
      FontBold         =   -1  'True
      FontItalic       =   0   'False
      FontName         =   "MS Sans Serif"
      FontSize         =   12
      FontStrikethru   =   0   'False
      FontUnderline    =   0   'False
      Height           =   315
      Left             =   180
      TabIndex         =   5
      Top              =   2040
      Width            =   4035
   End
End
Begin Label Label2
   Alignment        =   2   'Center
   BackStyle        =   0   'Transparent
   Caption          =   "GRAPH OF EACH LOOP CYCLE IN SPM's"
   FontBold         =   -1  'True
   FontItalic       =   0   'False
   FontName         =   "MS Sans Serif"
   FontSize         =   9.75
   FontStrikethru   =   0   'False
   FontUnderline    =   0   'False
   Height           =   495
   Left             =   780
   TabIndex         =   8
   Top              =   6840
   Width            =   8715
End
Begin Image Image2
   Height           =   1755
   Left             =   300
   Picture          =   GRAPH.FRX:03FE
   Top              =   180
   Width            =   4500
End
Begin Label Label1
   Alignment        =   2   'Center
   BackStyle        =   0   'Transparent
   Caption          =   "New Technology In Sewing"
   FontBold         =   -1  'True
   FontItalic       =   -1  'True
   FontName         =   "Arial"
   FontSize         =   13.5
   FontStrikethru   =   0   'False
   FontUnderline    =   0   'False
   ForeColor        =   &H00800000&
   Height           =   375
   Left             =   300
```

```
      TabIndex          =   2
      Top               =   2280
      Width             =   4575
   End
   Begin Label Title
      Alignment         =   2  'Center
      BackColor         =   &H00FFFF80&
      Caption           =   "JL-5000"
      FontBold          =   -1  'True
      FontItalic        =   0   'False
      FontName          =   "Arial"
      FontSize          =   18
      FontStrikethru    =   0   'False
      FontUnderline     =   0   'False
      ForeColor         =   &H00800000&
      Height            =   375
      Left              =   360
      TabIndex          =   6
      Top               =   1860
      Width             =   4455
   End
   Begin Line Line1
      Visible           =   0   'False
      X1                =   9660
      X2                =   9660
      Y1                =   0
      Y2                =   7260
   End
   Begin Line Line2
      Visible           =   0   'False
      X1                =   9660
      X2                =   0
      Y1                =   7260
      Y2                =   7260
   End
End
Declare Function mciSendString Lib "mmsystem" (ByVal lpstrCommand$, ByVal
lpstrReturnStr As Any, ByVal wReturnLen%, ByVal hCallBack%) As Long
Const WS_CHILD = &H40000000

'Top Most Window
Declare Function SetWindowPos Lib "user" (ByVal h%, ByVal hb%, ByVal x%, ByVal y%,
ByVal cx%, ByVal cy%, ByVal f%) As Integer
Const SWP_NOMOVE = 2
Const SWP_NOSIZE = 1
Const FLAGS = SWP_NOMOVE Or SWP_NOSIZE
Const HWND_TOPMOST = -1
Const HWND_NOTOPMOST = -2
Const HWND_TOP = 0
Const HWND_BOTTOM = 1

Dim PlayAviFlag%, counter%

Sub Check1_Click ()
G.Cls
sleep .5
G_Click
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "Graph"

End Sub

Sub Form_Paint ()
Me.Show
```

```
G_Click

If PlayAviFlag% = True Then Exit Sub

'Draw Stitch
    LoadStitchIntoListBox List1, CurrentStitch$
    Me.Show
    DrawStitch P, List1, False, -1
    Label3.Caption = Format$(List1.ListCount - 1) & " Stitch Pattern"

End Sub

Sub G_Click ()
On Error Resume Next

MaxX! = GTotalNumberOfStitches% - 1
XUnit! = (G.Width / (MaxX! + 1))

'Clear Graph
    G.Cls

'Get Largest Y Value
    MaxY! = 0
    If Dmode = True Then
       For Z = 4 To MaxX!
            'Get Value
                r% = Int((56 - 30 + 1) * Rnd + 30)
                D# = 60 / (r% / 1000)
                If D# > MaxY! Then MaxY! = D#
        Next Z
        Else
        For Z = 4 To MaxX!
            'Get Value
                Ret$ = Space$(255)
                r% = get_from_1000("Z" & Format$(Z) & "=?", Ret$)
                D# = 60 / (Val(Ret$) / 1000)
                If D# > MaxY! Then MaxY! = D#
        Next Z
        End If

'Set G Scale
    G.ScaleHeight = Int(MaxY!) + 100
    G.ScaleTop = -G.ScaleHeight

    G2.ScaleHeight = G.ScaleHeight * (G2.Height / G.Height)
    G2.ScaleTop = -G2.ScaleHeight

'Draw Horizonal Lines
    If MaxY! > 2500 Then
        LineUnit! = 500
        Else
        LineUnit! = 250
        End If
    G2.Cls
    Do Until h! > G.ScaleHeight
        h! = h! + LineUnit!
        G.Line (0, -h!)-(G.ScaleWidth, -h!), RGB(0, 0, 255)

        'G2.Line (0, -H!)-(G2.ScaleWidth, -H!), RGB(0, 0, 255)
        G2.CurrentX = G2.ScaleWidth - G2.TextWidth(Format$(h!))
        G2.CurrentY = -h! - (G2.TextHeight(Format$(h!)) / 2)
        If G2.CurrentY - (G2.TextHeight(Format$(h!)) / 2) > -G2.ScaleHeight Then
            G2.Print Format$(h!)
            End If

    Loop

'Sew Cycle
    x1! = 0
    Y1! = 0
    For Z = 1 To MaxX!
        'Get Value
```

```
            If Dmode Then
                r% = Int((56 - 30 + 1) * Rnd + 30)
                D# = 60 / (r% / 1000)
                Else
                Ret$ = Space$(255)
                r% = get_from_1000("Z" & Format$(Z) & "=?", Ret$)
                D# = 60 / (Val(Ret$) / 1000)
                End If

        'Get X,Y
            x2! = ((Z - 1) * XUnit!) + XUnit!
            Y2! = -D#

        'Graph Circles
            G.FillColor = RGB(255, 0, 0)
            G.Circle (x2!, Y2!), 50, RGB(255, 0, 0)

        'Graph Line
            G.Line (x1!, Y1!)-(x2!, Y2!)

        'Save Last Values
            x1! = x2!
            Y1! = Y2!
    Next Z

'Draw Line Back to Zero
    G.Line (x2!, Y2!)-(G.ScaleWidth, 0)


End Sub

Sub Image2_Click ()
Status = G_Command("XQ#NEW,3")
End Sub

Sub Label2_Click ()
On Error Resume Next

'Dim Variables
    Dim CmdStr As String, Ret As Integer

If PlayAviFlag% = True Then
        PlayAviFlag% = False
        Ret = mciSendString("close Animation", 0&, 0, 0)
        VBMsg1.SubClasshWnd = 0
        Form_Paint
        Exit Sub
        End If

'Set File Path
    file$ = Path$ & "Sew.avi"
    If Dir$(file$) = "" Then Exit Sub
    Label3 = "The JL5000 in actual production."

'Set window Position
    success% = SetWindowPos(P.hWnd, HWND_TOPMOST, 0, 0, 0, 0, FLAGS)

'Set VBX to accept correct messages
    VBMsg1.AddMessage = 953' MM_MCINOTIFY
    VBMsg1.SubClasshWnd = P.hWnd

'PLAY ANIMATION
    P.Cls
    P.hWnd.Refresh
    CmdStr = ("open " & file$ & " type AVIVideo alias Animation parent " +
LTrim$(Str$(P.hWnd)) + " style " + LTrim$(Str$(WS_CHILD)))
    Ret = mciSendString(CmdStr, 0&, 0, 0)
    VWidth = 160
    VHeight = 120
    VLeft = ((P.Width - (VWidth * screen.TwipsPerPixelX)) / 2) /
screen.TwipsPerPixelX
```

```
    VTop = ((P.Height - (VHeight * screen.TwipsPerPixelY)) / 2) /
screen.TwipsPerPixelY
    VS$ = "put Animation window at " & Format$(VLeft, "0") & " " & Format(VTop, "0")
& " " & Format$(VWidth, "0") & " " & Format$(VHeight, "0")
    Ret = mciSendString(VS$, 0&, 0, 0)
    Ret = mciSendString("play Animation from 0 notify", 0&, 0, P.hWnd)
    PlayAviFlag% = True


End Sub

Sub Option1_Click ()

End Sub

Sub P_Click ()
If PlayAviFlag% = True Then
    Label2_Click
    Exit Sub
    End If

Unload Me


End Sub

Sub VBMsg1_WindowMessage (hWindow As Integer, Msg As Integer, wParam As Integer,
lParam As Long, RetVal As Long, CallDefProc As Integer)
On Error Resume Next
If Msg <> 953 Or counter% = 10 Then Exit Sub

'counter% = counter% + 1
'If counter% = 2 Then
'     counter% = 10
'     Label2_Click
'     VBMsg1.SubClasshWnd = 0
'     counter% = 0
'     Else
    counter% = 10
    Ret = mciSendString("play Animation from 0 notify", 0&, 0, P.hWnd)
    counter% = 1
'     End If


End Sub
```

```
VERSION 2.00
Begin Form Password
   BackColor        =   &H00FFFF80&
   BorderStyle      =   1   'Fixed Single
   Caption          =   "PASS WORD"
   ClientHeight     =   7875
   ClientLeft       =   30
   ClientTop        =   2160
   ClientWidth      =   10470
   ControlBox       =   0    'False
   FillColor        =   &H0080FF80&
   FontBold         =   -1   'True
   FontItalic       =   0    'False
   FontName         =   "Arial"
   FontSize         =   18
   FontStrikethru   =   0    'False
   FontUnderline    =   0    'False
   Height           =   8280
   KeyPreview       =   -1   'True
   Left             =   -30
   LinkTopic        =   "Form2"
   MaxButton        =   0    'False
   MinButton        =   0    'False
   ScaleHeight      =   7875
   ScaleWidth       =   10470
   Top              =   1815
   Width            =   10590
   Begin PictureBox Picture1
      BackColor        =   &H00FFFF80&
      BorderStyle      =   0   'None
      Height           =   5055
      Left             =   1680
      ScaleHeight      =   5055
      ScaleWidth       =   6255
      TabIndex         =   4
      Top              =   1920
      Width            =   6255
      Begin SSCommand Command3D1
         BevelWidth       =   10
         Caption          =   "EXIT"
         FontBold         =   -1   'True
         FontItalic       =   0    'False
         FontName         =   "Arial"
         FontSize         =   24
         FontStrikethru   =   0    'False
         FontUnderline    =   0    'False
         ForeColor        =   &H000000FF&
         Height           =   1095
         Left             =   0
         TabIndex         =   16
         Top              =   60
         Width            =   2175
      End
      Begin SSCommand Command3D2
         BevelWidth       =   10
         Caption          =   "0"
         FontBold         =   -1   'True
         FontItalic       =   0    'False
         FontName         =   "Arial"
         FontSize         =   24
         FontStrikethru   =   0    'False
         FontUnderline    =   0    'False
         ForeColor        =   &H00C00000&
         Height           =   1095
         Index            =   0
         Left             =   0
         TabIndex         =   15
         Top              =   1380
         Width            =   1455
      End
      Begin SSCommand Command3D12
         BevelWidth       =   10
```

```
   Caption          =   "Enter"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   1095
   Left             =   3120
   TabIndex         =   14
   Top              =   3780
   Width            =   3015
End
Begin SSCommand Command3D2
   BevelWidth       =   10
   Caption          =   "1"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   1095
   Index            =   1
   Left             =   1560
   TabIndex         =   13
   Top              =   1380
   Width            =   1455
End
Begin SSCommand Command3D2
   BevelWidth       =   10
   Caption          =   "2"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   1095
   Index            =   2
   Left             =   3150
   TabIndex         =   12
   Top              =   1380
   Width            =   1455
End
Begin SSCommand Command3D2
   BevelWidth       =   10
   Caption          =   "3"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   1095
   Index            =   3
   Left             =   4710
   TabIndex         =   11
   Top              =   1380
   Width            =   1455
End
Begin SSCommand Command3D2
   BevelWidth       =   10
   Caption          =   "4"
   FontBold         =   -1   'True
   FontItalic       =   0    'False
   FontName         =   "Arial"
   FontSize         =   24
```

```
   FontStrikethru  =   0    'False
   FontUnderline   =   0    'False
   ForeColor       =   &H00C00000&
   Height          =   1095
   Index           =   4
   Left            =   0
   TabIndex        =   10
   Top             =   2580
   Width           =   1455
End
Begin SSCommand Command3D2
   BevelWidth      =   10
   Caption         =   "5"
   FontBold        =   -1   'True
   FontItalic      =   0    'False
   FontName        =   "Arial"
   FontSize        =   24
   FontStrikethru  =   0    'False
   FontUnderline   =   0    'False
   ForeColor       =   &H00C00000&
   Height          =   1095
   Index           =   5
   Left            =   1560
   TabIndex        =   9
   Top             =   2580
   Width           =   1455
End
Begin SSCommand Command3D2
   BevelWidth      =   10
   Caption         =   "6"
   FontBold        =   -1   'True
   FontItalic      =   0    'False
   FontName        =   "Arial"
   FontSize        =   24
   FontStrikethru  =   0    'False
   FontUnderline   =   0    'False
   ForeColor       =   &H00C00000&
   Height          =   1095
   Index           =   6
   Left            =   3150
   TabIndex        =   8
   Top             =   2580
   Width           =   1455
End
Begin SSCommand Command3D2
   BevelWidth      =   10
   Caption         =   "7"
   FontBold        =   -1   'True
   FontItalic      =   0    'False
   FontName        =   "Arial"
   FontSize        =   24
   FontStrikethru  =   0    'False
   FontUnderline   =   0    'False
   ForeColor       =   &H00C00000&
   Height          =   1095
   Index           =   7
   Left            =   4710
   TabIndex        =   7
   Top             =   2580
   Width           =   1455
End
Begin SSCommand Command3D2
   BevelWidth      =   10
   Caption         =   "8"
   FontBold        =   -1   'True
   FontItalic      =   0    'False
   FontName        =   "Arial"
   FontSize        =   24
   FontStrikethru  =   0    'False
   FontUnderline   =   0    'False
   ForeColor       =   &H00C00000&
   Height          =   1095
```

```
      Index            =   8
      Left             =   30
      TabIndex         =   6
      Top              =   3780
      Width            =   1455
   End
   Begin SSCommand Command3D2
      BevelWidth       =   10
      Caption          =   "9"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00C00000&
      Height           =   1095
      Index            =   9
      Left             =   1560
      TabIndex         =   5
      Top              =   3780
      Width            =   1455
   End
   Begin Label Label1
      Alignment        =   2  'Center
      BackStyle        =   0  'Transparent
      Caption          =   "Enter Password:"
      FontBold         =   -1  'True
      FontItalic       =   0   'False
      FontName         =   "Arial"
      FontSize         =   24
      FontStrikethru   =   0   'False
      FontUnderline    =   0   'False
      Height           =   495
      Left             =   2160
      TabIndex         =   0
      Top              =   0
      Width            =   4215
   End
   Begin Label PWord
      BorderStyle      =   1  'Fixed Single
      FontBold         =   -1  'True
      FontItalic       =   0   'False
      FontName         =   "MS Sans Serif"
      FontSize         =   18
      FontStrikethru   =   0   'False
      FontUnderline    =   0   'False
      Height           =   585
      Left             =   2370
      TabIndex         =   3
      Top              =   570
      Width            =   3765
   End
End
Begin Label Label3
   Alignment        =   2  'Center
   BackStyle        =   0  'Transparent
   Caption          =   "JL-5000"
   FontBold         =   -1  'True
   FontItalic       =   0   'False
   FontName         =   "Arial"
   FontSize         =   19.5
   FontStrikethru   =   0   'False
   FontUnderline    =   0   'False
   ForeColor        =   &H00800000&
   Height           =   495
   Left             =   2760
   TabIndex         =   2
   Top              =   960
   Width            =   3735
End
Begin Label Label2
```

```
      Alignment        =   2  'Center
      BackStyle        =   0  'Transparent
      Caption          =   "TICE ENGINEERING"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   495
      Left             =   2520
      TabIndex         =   1
      Top              =   360
      Width            =   4575
   End
End
Sub Command3D1_Click ()
If ReadIntializationError() <> "" And TechMode = False Then
    TShot.Show
    Else
    RunMode.Show
    End If
Unload Me

End Sub

Sub Command3D12_Click ()
If Dmode = True Then
    'UserIsHere% = 1
    'SetupForm.Show
    'Unload Me
    'Exit Sub
    End If

P$ = ReadUserPassword()
AP$ = ReadAdminPassword()
MP$ = ReadMechPassword()

If PWord.Tag = P$ Or PWord.Tag = AP$ Or PWord.Tag = MP$ Then
    UserIsHere% = True
    If PWord.Tag = MP$ Then UserIsHere% = False
    If PWord.Tag = AP$ Then UserIsHere% = 1
    SetupForm.Show
    Unload Me
    Else
    PWord = ""
    PWord.Tag = ""
    msg$ = "Incorrect Password." & Chr$(13)
    msg$ = msg$ & "This violation has been noted in the security log." & Chr$(13)
    'Update Security Log
        FF% = FreeFile
        Open Path$ & "Security.log" For Append As FF%
        Print #FF%, Format$(Now - z, "yyyy/mm/dd hh:mmam/pm") & " = " & "User
Password Incorrect at Setup Screen"
        Close FF%
    MsgBox msg$, 0, "Security Violation"
    End If

End Sub

Sub Command3D2_Click (Index As Integer)


PWord.Tag = PWord.Tag & Format$(Index)
PWord = String$(Len(PWord.Tag), "*")


End Sub

Sub Form_KeyDown (KeyCode As Integer, Shift As Integer)
GlobalKeyDown KeyCode, Shift
```

```
End Sub

Sub Form_Load ()
SetUpWindow Me, "Password"

'Center Controls
    CenterControlW Picture1, Me.Width
    CenterControlW Label2, Me.Width
    CenterControlW Label3, Me.Width
    UserIsHere% = True

End Sub

Sub Label2_Click ()
On Error Resume Next

'See if password is a technician wanting to enter TechMode
'Code=8410173996710569116
'which is "TeIcCiEt"; which is a combination of "TICE" and "ecit"
'of course the letters are converted to ASCII numbers
If PWord.Tag = "5" Then
    Display "Please Wait..."
    FF% = FreeFile
    Open "a:\ticetech.inf" For Input As FF%
    If Err Then
        Display ""
        'MsgBox Error$, 0, "Error #" & Format$(Err)
        PWord = ""
        PWord.Tag = ""
        Exit Sub
        End If
    Do Until EOF(FF%)
        Line Input #FF%, a$
        If Trim$(a$) = "8410173996710569116" Then
            TechMode = True
            UserIsHere% = 1
            Exit Do
            End If
    Loop
    Close FF%
    Display ""
    If TechMode = False Then
        Display ""
        MsgBox "Improper code.", 0, "Access Denied"
        Else
        Command3D1_Click
        End If
    End If

End Sub
```

```
VERSION 2.00
Begin Form SetupForm
   BackColor        =   &H00FFFF00&
   BorderStyle      =   1  'Fixed Single
   Caption          =   "Setup Form"
   ClientHeight     =   7350
   ClientLeft       =   795
   ClientTop        =   1890
   ClientWidth      =   9810
   ControlBox       =   0   'False
   Height           =   7755
   KeyPreview       =   -1  'True
   Left             =   735
   LinkTopic        =   "Form5"
   MaxButton        =   0   'False
   MinButton        =   0   'False
   ScaleHeight      =   7350
   ScaleWidth       =   9810
   Top              =   1545
   Width            =   9930
   Begin SSCommand Command3D1
      BevelWidth       =   10
      Caption          =   "Software Setup"
      FontBold         =   -1  'True
      FontItalic       =   0   'False
      FontName         =   "Arial"
      FontSize         =   15.75
      FontStrikethru   =   0   'False
      FontUnderline    =   0   'False
      ForeColor        =   &H00FF0000&
      Height           =   1200
      Left             =   6660
      TabIndex         =   6
      Top              =   3180
      Width            =   2775
   End
   Begin SSCommand Command3D5
      BevelWidth       =   10
      Caption          =   "Stitch Pattern"
      FontBold         =   -1  'True
      FontItalic       =   0   'False
      FontName         =   "Arial"
      FontSize         =   15.75
      FontStrikethru   =   0   'False
      FontUnderline    =   0   'False
      ForeColor        =   &H00FF0000&
      Height           =   1215
      Left             =   3540
      TabIndex         =   5
      Top              =   4260
      Width            =   2655
   End
   Begin SSCommand Command3D4
      BevelWidth       =   10
      Caption          =   "EXIT"
      FontBold         =   -1  'True
      FontItalic       =   0   'False
      FontName         =   "Arial"
      FontSize         =   18
      FontStrikethru   =   0   'False
      FontUnderline    =   0   'False
      ForeColor        =   &H000000FF&
      Height           =   1200
      Left             =   3480
      Picture          =   SETUPFRM.FRX:0000
      TabIndex         =   2
      Top              =   5760
      Width            =   2805
   End
   Begin SSCommand Command3D3
      BevelWidth       =   10
      Caption          =   "Man. Mode"
```

```
   FontBold        =   -1  'True
   FontItalic      =   0   'False
   FontName        =   "Arial"
   FontSize        =   15.75
   FontStrikethru  =   0   'False
   FontUnderline   =   0   'False
   ForeColor       =   &H00FF0000&
   Height          =   1185
   Left            =   360
   TabIndex        =   1
   Top             =   3120
   Width           =   2655
End
Begin SSCommand Command3D2
   BevelWidth      =   10
   Caption         =   "Loop Set Up"
   FontBold        =   -1  'True
   FontItalic      =   0   'False
   FontName        =   "Arial"
   FontSize        =   15.75
   FontStrikethru  =   0   'False
   FontUnderline   =   0   'False
   ForeColor       =   &H00FF0000&
   Height          =   1200
   Left            =   3480
   TabIndex        =   0
   Top             =   2160
   Width           =   2775
End
Begin Image Image1
   Height          =   480
   Index           =   1
   Left            =   6000
   Picture         =   SETUPFRM.FRX:0302
   Top             =   990
   Width           =   480
End
Begin Image Image1
   Height          =   480
   Index           =   0
   Left            =   3240
   Picture         =   SETUPFRM.FRX:0604
   Top             =   960
   Width           =   480
End
Begin Label Label1
   Alignment       =   2  'Center
   BackStyle       =   0  'Transparent
   Caption         =   "TICE ENGINEERING"
   FontBold        =   -1  'True
   FontItalic      =   0   'False
   FontName        =   "Arial"
   FontSize        =   24
   FontStrikethru  =   0   'False
   FontUnderline   =   0   'False
   ForeColor       =   &H00800000&
   Height          =   615
   Left            =   330
   TabIndex        =   4
   Top             =   300
   Width           =   9165
End
Begin Label Label2
   Alignment       =   2  'Center
   BackStyle       =   0  'Transparent
   Caption         =   "JL-5000"
   FontBold        =   -1  'True
   FontItalic      =   0   'False
   FontName        =   "Arial"
   FontSize        =   24
   FontStrikethru  =   0   'False
   FontUnderline   =   0   'False
```

```
        ForeColor        =   &H00800000&
        Height           =   615
        Left             =   3720
        TabIndex         =   3
        Top              =   960
        Width            =   2295
    End
End
Sub Command3D1_Click ()
Software3.Show
Unload Me
End Sub

Sub Command3D2_Click ()
Display "Please wait..."
BeltLoopSetup.Show
Unload Me
End Sub

Sub Command3D3_Click ()
Manual.Show
Unload Me
End Sub

Sub Command3D4_Click ()
RunMode.Show
Unload Me
End Sub

Sub Command3D5_Click ()
SPattern.Show
Unload Me
End Sub

Sub Form_KeyDown (KeyCode As Integer, Shift As Integer)
GlobalKeyDown KeyCode, Shift
End Sub

Sub Form_Load ()
SetUpWindow Me, "SetupForm"

'Center Controls
    CenterControlW Label1, Me.Width
    CenterControlW Label2, Me.Width
    Image1(1).Left = Label2.Left - Image1(0).Width
    Image1(0).Left = Label2.Left + Label2.Width
    Image1(1).Top = Label2.Top
    Image1(0).Top = Label2.Top

    CenterControlW Command3D2, Me.Width
    CenterControlW Command3D5, Me.Width
    CenterControlW Command3D4, Me.Width

    Command3D3.Top = Command3D2.Top + ((Command3D2.Height / 4) * 3)
    Command3D1.Top = Command3D3.Top
    Command3D5.Top = Command3D3.Top + ((Command3D3.Height / 4) * 3)
    Command3D4.Top = Command3D5.Top + Command3D5.Height + (Command3D5.Top -
(Command3D2.Top + Command3D2.Height))
    Command3D3.Left = 360
    Command3D1.Left = Me.Width - Command3D1.Width - 360

    If UserIsHere% = True Then
        If ReadUser2() = False Then
            Command3D3.Visible = False
            Else
            Command3D5.Left = Command3D1.Left
            Command3D5.Top = Command3D3.Top
            Command3D2.Top = Command3D3.Top
            End If
        Command3D1.Visible = False
        Else
        Command3D3.Visible = True
```

```
        Command3D1.Visible = True
        End If

End Sub
```

```
VERSION 2.00
Begin Form BeltLoopSetup
   AutoRedraw       =   -1  'True
   BackColor        =   &H00FFFF00&
   BorderStyle      =   1  'Fixed Single
   Caption          =   "BeltLoopSetup"
   ClientHeight     =   7530
   ClientLeft       =   315
   ClientTop        =   1965
   ClientWidth      =   10110
   ControlBox       =   0   'False
   DrawWidth        =   3
   Height           =   7935
   Icon             =   BELTLOOP.FRX:0000
   KeyPreview       =   -1  'True
   Left             =   255
   LinkTopic        =   "Form4"
   MaxButton        =   0   'False
   MinButton        =   0   'False
   ScaleHeight      =   7530
   ScaleWidth       =   10110
   Top              =   1620
   Width            =   10230
   Begin SSCommand Command3D8
      BevelWidth       =   10
      Caption          =   "Advanced"
      FontBold         =   -1  'True
      FontItalic       =   0   'False
      FontName         =   "MS Sans Serif"
      FontSize         =   12
      FontStrikethru   =   0   'False
      FontUnderline    =   0   'False
      ForeColor        =   &H000000FF&
      Height           =   855
      Left             =   6360
      TabIndex         =   23
      Top              =   5040
      Width            =   1695
   End
   Begin SSCommand Command3D7
      BevelWidth       =   10
      Caption          =   "+"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H000000FF&
      Height           =   855
      Left             =   6360
      TabIndex         =   1
      Top              =   3360
      Width            =   1335
   End
   Begin SSCommand Command3D6
      BevelWidth       =   10
      Caption          =   "-"
      FontBold         =   -1  'True
      FontItalic       =   0   'False
      FontName         =   "MS Sans Serif"
      FontSize         =   36
      FontStrikethru   =   0   'False
      FontUnderline    =   0   'False
      ForeColor        =   &H000000FF&
      Height           =   855
      Left             =   6360
      TabIndex         =   22
      Top              =   2400
      Width            =   1335
   End
   Begin SSCommand Command3D5
```

```
    BevelWidth       =   10
    Caption          =   "+"
    FontBold         =   -1   'True
    FontItalic       =   0    'False
    FontName         =   "MS Sans Serif"
    FontSize         =   24
    FontStrikethru   =   0    'False
    FontUnderline    =   0    'False
    ForeColor        =   &H000000FF&
    Height           =   855
    Left             =   3720
    TabIndex         =   21
    Top              =   3360
    Width            =   1335
End
Begin SSCommand Command3D4
    BevelWidth       =   10
    Caption          =   "-"
    FontBold         =   -1   'True
    FontItalic       =   0    'False
    FontName         =   "MS Sans Serif"
    FontSize         =   36
    FontStrikethru   =   0    'False
    FontUnderline    =   0    'False
    ForeColor        =   &H000000FF&
    Height           =   855
    Left             =   3720
    TabIndex         =   20
    Top              =   2400
    Width            =   1335
End
Begin SSCommand Command3D2
    BevelWidth       =   10
    Caption          =   "-"
    FontBold         =   -1   'True
    FontItalic       =   0    'False
    FontName         =   "MS Sans Serif"
    FontSize         =   36
    FontStrikethru   =   0    'False
    FontUnderline    =   0    'False
    ForeColor        =   &H000000FF&
    Height           =   855
    Left             =   1320
    TabIndex         =   19
    Top              =   2400
    Width            =   1335
End
Begin SSCommand Command3D1
    BevelWidth       =   10
    Caption          =   "+"
    FontBold         =   -1   'True
    FontItalic       =   0    'False
    FontName         =   "MS Sans Serif"
    FontSize         =   24
    FontStrikethru   =   0    'False
    FontUnderline    =   0    'False
    ForeColor        =   &H000000FF&
    Height           =   855
    Left             =   1320
    TabIndex         =   18
    Top              =   3360
    Width            =   1335
End
Begin VScrollBar VScroll2
    Height           =   3495
    LargeChange      =   100
    Left             =   5640
    Max              =   1250
    Min              =   25
    SmallChange      =   25
    TabIndex         =   14
    Top              =   2400
```

```
   Value            =   25
   Width            =   615
End
Begin TextBox SewSpeedPulse
   Height           =   375
   Left             =   5640
   TabIndex         =   13
   Top              =   6480
   Width            =   1455
End
Begin TextBox SewSpeedRPM
   Height           =   375
   Left             =   5640
   TabIndex         =   12
   Top              =   6000
   Width            =   1455
End
Begin TextBox BLENGTH
   Height           =   375
   Left             =   600
   TabIndex         =   8
   Top              =   6000
   Width            =   1215
End
Begin TextBox RPM
   Height           =   375
   Left             =   3000
   TabIndex         =   9
   Top              =   6000
   Width            =   1575
End
Begin VScrollBar VScroll1
   Height           =   3495
   LargeChange      =   10
   Left             =   600
   Max              =   126
   Min              =   28
   SmallChange      =   2
   TabIndex         =   6
   Top              =   2400
   Value            =   100
   Width            =   645
End
Begin VScrollBar VSCROLL
   DragIcon         =   BELTLOOP.FRX:0302
   Height           =   3495
   LargeChange      =   50
   Left             =   3000
   Max              =   1000
   Min              =   10
   SmallChange      =   50
   TabIndex         =   3
   Top              =   2400
   Value            =   10
   Width            =   615
End
Begin SSCommand Command3D3
   BevelWidth       =   10
   Caption          =   "EXIT"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H000000FF&
   Height           =   1815
   Left             =   7920
   Picture          =   BELTLOOP.FRX:0604
   TabIndex         =   0
   Top              =   2400
   Width            =   1560
```

```
End
Begin Label Label4
   BackStyle        =   0  'Transparent
   Caption          =   "Sew Speed"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
   Index            =   2
   Left             =   5580
   TabIndex         =   15
   Top              =   2040
   Width            =   2295
End
Begin Label Label13
   BackStyle        =   0  'Transparent
   Caption          =   "PULSE COUNT"
   Height           =   255
   Left             =   7200
   TabIndex         =   17
   Top              =   6600
   Width            =   1575
End
Begin Label Label6
   BackStyle        =   0  'Transparent
   Caption          =   "RPM"
   Height           =   255
   Left             =   7200
   TabIndex         =   16
   Top              =   6120
   Width            =   735
End
Begin Label Label3
   BackStyle        =   0  'Transparent
   Caption          =   "INCHES"
   FontBold         =   -1  'True
   FontItalic       =   0   'False
   FontName         =   "Arial"
   FontSize         =   9.75
   FontStrikethru   =   0   'False
   FontUnderline    =   0   'False
   Height           =   255
   Left             =   1920
   TabIndex         =   11
   Top              =   6120
   Width            =   735
End
Begin Label Label5
   BackStyle        =   0  'Transparent
   Caption          =   "Belt Loop Set up"
   FontBold         =   -1  'True
   FontItalic       =   0   'False
   FontName         =   "Arial"
   FontSize         =   19.5
   FontStrikethru   =   0   'False
   FontUnderline    =   -1  'True
   Height           =   615
   Left             =   600
   TabIndex         =   5
   Top              =   1320
   Width            =   3375
End
Begin Label Label4
   BackStyle        =   0  'Transparent
   Caption          =   "Belt Loop Speed"
   FontBold         =   -1  'True
   FontItalic       =   0   'False
   FontName         =   "Arial"
   FontSize         =   12
```

```
      FontStrikethru  =   0   'False
      FontUnderline   =   0   'False
      Height          =   255
      Index           =   1
      Left            =   3000
      TabIndex        =   7
      Top             =   2040
      Width           =   2055
   End
   Begin Label Label4
      BackStyle       =   0  'Transparent
      Caption         =   "Belt Loop Length"
      FontBold        =   -1  'True
      FontItalic      =   0   'False
      FontName        =   "Arial"
      FontSize        =   12
      FontStrikethru  =   0   'False
      FontUnderline   =   0   'False
      Height          =   315
      Index           =   0
      Left            =   600
      TabIndex        =   10
      Top             =   2040
      Width           =   2055
   End
   Begin Label Label14
      BackStyle       =   0  'Transparent
      Caption         =   "PULSE COUNT"
      FontBold        =   -1  'True
      FontItalic      =   0   'False
      FontName        =   "Arial"
      FontSize        =   9.75
      FontStrikethru  =   0   'False
      FontUnderline   =   0   'False
      Height          =   615
      Left            =   4680
      TabIndex        =   4
      Top             =   6120
      Width           =   855
   End
   Begin Label Label1
      Alignment       =   2  'Center
      BackStyle       =   0  'Transparent
      Caption         =   "TICE ENGINEERING - JL-5000"
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H00800000&
      Height          =   615
      Left            =   0
      TabIndex        =   2
      Top             =   360
      Width           =   7935
   End
End
Dim DownFlag%

Sub Command3D1_Click ()
'On Error Resume Next

'VScroll1.Value = VScroll1.Value + VScroll1.SmallChange
'If Err Then VScroll1.Value = VScroll1.Max


End Sub

Sub Command3D1_MouseDown (Button As Integer, Shift As Integer, X As Single, Y As
Single)
On Error Resume Next
```

```
'set downflag
    If DownFlag% = True Then Exit Sub
    DownFlag% = True

'change first value
    VScroll1.Value = VScroll1.Value + VScroll1.SmallChange
    VScroll1.Refresh

'allow time for mouseup
    rsleep .5

'enter loop for continous value change
    Do Until DownFlag% = False
        VScroll1.Value = VScroll1.Value + VScroll1.SmallChange
        VScroll1.Refresh
        DoEvents
    Loop

    DownFlag% = False

End Sub

Sub Command3D1_MouseUp (Button As Integer, Shift As Integer, X As Single, Y As
Single)
DownFlag% = False
End Sub

Sub Command3D2_Click ()
'On Error Resume Next

'VScroll1.Value = VScroll1.Value - VScroll1.SmallChange

 If Err Then VScroll1.Value = VScroll1.Min

End Sub

Sub Command3D2_MouseDown (Button As Integer, Shift As Integer, X As Single, Y As
Single)
On Error Resume Next

'set downflag
    If DownFlag% = True Then Exit Sub
    DownFlag% = True

'change first value
    VScroll1.Value = VScroll1.Value - VScroll1.SmallChange
    VScroll1.Refresh

'allow time for mouseup
    rsleep .5

'enter loop for continous value change
    Do Until DownFlag% = False
        VScroll1.Value = VScroll1.Value - VScroll1.SmallChange
        VScroll1.Refresh
        DoEvents
    Loop

    DownFlag% = False

End Sub

Sub Command3D2_MouseUp (Button As Integer, Shift As Integer, X As Single, Y As
Single)
DownFlag% = False
End Sub

Sub Command3D3_Click ()
'Open communication with PLC
    OpenPLC
```

```
'Save Belt Loop Speed Setting
    SetBeltLoopSpeed VScroll.Value

'Save Belt Loop Length Setting
    SetBeltLoopLength VScroll1.Value

'Close Communication with Plc
    ClosePLC

'Save Speed Setting
    WriteSewSpeed VScroll2.Value * EncoderCount

'Create New Stitch File
    ResetGalia

'Show new form
    If BeltLoopSetup.Tag <> "Manual" Then SetupForm.Show
    Unload Me
End Sub


Sub Command3D4_MouseDown (Button As Integer, Shift As Integer, X As Single, Y As
Single)
On Error Resume Next

'set downflag
    If DownFlag% = True Then Exit Sub
    DownFlag% = True

'change first value
    VScroll.Value = VScroll.Value - VScroll.SmallChange
    VScroll.Refresh

'allow time for mouseup
    rsleep .5

'enter loop for continous value change
    Do Until DownFlag% = False
        VScroll.Value = VScroll.Value - VScroll.SmallChange
        If Err Then DownFlag% = False: VScroll.Value = VScroll.Min
        VScroll.Refresh
        DoEvents
    Loop

    DownFlag% = False

End Sub

Sub Command3D4_MouseUp (Button As Integer, Shift As Integer, X As Single, Y As
Single)
DownFlag% = False
End Sub

Sub Command3D5_MouseDown (Button As Integer, Shift As Integer, X As Single, Y As
Single)
On Error Resume Next

'set downflag
    If DownFlag% = True Then Exit Sub
    DownFlag% = True

'change first value
    VScroll.Value = VScroll.Value + VScroll.SmallChange
    VScroll.Refresh

'allow time for mouseup
    rsleep .5

'enter loop for continous value change
    Do Until DownFlag% = False
```

```
        VScroll.Value = VScroll.Value + VScroll.SmallChange
        If Err Then DownFlag% = False: VScroll.Value = VScroll.Max
        VScroll.Refresh
        DoEvents
    Loop

    DownFlag% = False

End Sub

Sub Command3D5_MouseUp (Button As Integer, Shift As Integer, X As Single, Y As
Single)
DownFlag% = False
End Sub

Sub Command3D6_MouseDown (Button As Integer, Shift As Integer, X As Single, Y As
Single)
On Error Resume Next

'set downflag
    If DownFlag% = True Then Exit Sub
    DownFlag% = True

'change first value
    VScroll2.Value = VScroll2.Value - VScroll2.SmallChange
    VScroll2.Refresh

'allow time for mouseup
    rsleep .5

'enter loop for continous value change
    Do Until DownFlag% = False
        VScroll2.Value = VScroll2.Value - VScroll2.SmallChange
        If Err Then DownFlag% = False: VScroll2.Value = VScroll2.Min
        VScroll2.Refresh
        DoEvents
    Loop

    DownFlag% = False

End Sub

Sub Command3D6_MouseUp (Button As Integer, Shift As Integer, X As Single, Y As
Single)
DownFlag% = False
End Sub

Sub Command3D7_Click ()
On Error Resume Next
'VScroll2.Value = VScroll2.Value + VScroll2.SmallChange
'If Err Then VScroll2.Value = VScroll2.Max

End Sub

Sub Command3D7_MouseDown (Button As Integer, Shift As Integer, X As Single, Y As
Single)
On Error Resume Next

'set downflag
    If DownFlag% = True Then Exit Sub
    DownFlag% = True

'change first value
    VScroll2.Value = VScroll2.Value + VScroll2.SmallChange
    VScroll2.Refresh

'allow time for mouseup
    rsleep .5

'enter loop for continous value change
    Do Until DownFlag% = False
        VScroll2.Value = VScroll2.Value + VScroll2.SmallChange
```

```
        VScroll2.Refresh
        DoEvents
    Loop

    DownFlag% = False

End Sub

Sub Command3D7_MouseUp (Button As Integer, Shift As Integer, X As Single, Y As
Single)
DownFlag% = False
End Sub

Sub Command3D8_Click ()
SSPeed.Show
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "BeltLoopSetup"

'Set Scroll Bars
        VScroll2.Value = G_GetSewSpeed() / EncoderCount

'Get Lenght and Speed of BeltLoop
    'Open communication with PLC
        OpenPLC
        VScroll.Value = GetBeltLoopSpeed()
        VScroll1.Value = GetBeltLoopLength()
        ClosePLC


'Update Display Boxes
    If BLENGTH.Text = "" Then VScroll1_Change
    If RPM.Text = "" Then VScroll_Change
    If SewSpeedRPM.Text = "" Then VScroll2_Change

'Security
    If UserIsHere% = True And ReadUser3() = False Then
        VScroll2.Visible = False
        Command3D6.Visible = False
        Command3D7.Visible = False
        Command3D8.Visible = False
        Label4(2).Top = 5640
        Command3D3.Left = VScroll2.Left
        End If

'DRAW INCHES
    Display ""
    Me.Show
    L% = VScroll1.Left - 100 ' VScroll1.Width + 50
    VScrollHeadHeight% = 255
    VScrollHeight% = VScroll1.Height - (VScrollHeadHeight% * 2)
    HalfInch% = VScrollHeight% / 3.85

    For z = 1 To 4.5 Step .5
        Me.CurrentX = L% - Me.TextWidth(Format$(z) & Chr$(34))
        CY% = VScroll1.Top + VScrollHeadHeight%
        Me.CurrentY = CY% + (HalfInch% * z) - HalfInch%
        Me.Print Format$(z) & Chr$(34)
    Next z


'Center Controls
    CenterControlW Label1, Me.Width
```

```
End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub VScroll_Change ()
'STEPPER SPEED
'MAX FOR SPEED SHOULD BE NO MORE THAN 20000

RPM.Text = VScroll.Value
'GForm.FX.ValueD(210) = Format$(VScroll1)
    'X5$ = "V5=" & Format$(VSCROLL.Value)
    'Status = G_Command(X5$)

End Sub

Sub VScroll1_Change ()

'MAX ON LENGTH OF 500
If VScroll1.Value < 28 Then VScroll1.Value = 28
BLENGTH.Text = Format$(VScroll1.Value / 28, "0.0")
VScroll1.Value = Val(BLENGTH.Text) * 28


'GForm.FX.ValueD(212) = Format$(VScroll1)
'Status = G_Command("V6=" & Format$(Int((VSCROLL1.Value / 100) * BInch)))


End Sub

Sub VScroll2_Change ()
    'Display Sew Speed in Pulse Count
        SewSpeedPulse.Text = Format$(VScroll2.Value * EncoderCount)

    'Display Sew Speed in RPM (Round RMP to 25)
        tmp$ = Format$((VScroll2.Value * EncoderCount * 60) / 4000, "0")
        D# = 0
        Select Case Len(tmp$)
            Case 3: D# = Val(Left$(tmp$, 1)) * 100
            Case 4: D# = Val(Left$(tmp$, 2)) * 100
        End Select
        N2# = Val(tmp$) - D#
        Select Case N2#
            Case Is < 25: A% = 0
            Case 25 To 49: A% = 25
            Case 50 To 74: A% = 50
            Case Is >= 75: A% = 100
        End Select
        D# = D# + A%
        SewSpeedRPM.Text = Format$(D#)

'Set Speed Now
    G_SetSewSpeed VScroll2.Value * EncoderCount

End Sub
```

```
VERSION 2.00
Begin Form SSpeed
   BackColor        =   &H00FFFF00&
   BorderStyle      =   1  'Fixed Single
   Caption          =   "Advanced Sew Speed"
   ClientHeight     =   7500
   ClientLeft       =   345
   ClientTop        =   1590
   ClientWidth      =   9915
   ControlBox       =   0   'False
   Height           =   7905
   KeyPreview       =   -1  'True
   Left             =   285
   LinkTopic        =   "Form1"
   MaxButton        =   0   'False
   MinButton        =   0   'False
   ScaleHeight      =   7500
   ScaleWidth       =   9915
   Top              =   1245
   Width            =   10035
   Begin SSCommand Plus
      BevelWidth       =   10
      Caption          =   "+"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H000000FF&
      Height           =   855
      Index            =   7
      Left             =   8160
      TabIndex         =   7
      Top              =   4560
      Width            =   1335
   End
   Begin SSCommand Minus
      BevelWidth       =   10
      Caption          =   "-"
      FontBold         =   -1  'True
      FontItalic       =   0   'False
      FontName         =   "MS Sans Serif"
      FontSize         =   36
      FontStrikethru   =   0   'False
      FontUnderline    =   0   'False
      ForeColor        =   &H000000FF&
      Height           =   855
      Index            =   7
      Left             =   8160
      TabIndex         =   9
      Top              =   3600
      Width            =   1335
   End
   Begin VScrollBar VScroll
      Height           =   2595
      Index            =   7
      LargeChange      =   10
      Left             =   7440
      Max              =   100
      TabIndex         =   10
      Top              =   3600
      Width            =   615
   End
   Begin TextBox Unit
      Height           =   375
      Index            =   7
      Left             =   8160
      TabIndex         =   11
      Top              =   5820
      Width            =   1155
   End
```

```
Begin SSCommand Plus
   BevelWidth      =   10
   Caption         =   "+"
   FontBold        =   -1  'True
   FontItalic      =   0   'False
   FontName        =   "MS Sans Serif"
   FontSize        =   24
   FontStrikethru  =   0   'False
   FontUnderline   =   0   'False
   ForeColor       =   &H000000FF&
   Height          =   855
   Index           =   6
   Left            =   5700
   TabIndex        =   12
   Top             =   4560
   Width           =   1335
End
Begin SSCommand Minus
   BevelWidth      =   10
   Caption         =   "-"
   FontBold        =   -1  'True
   FontItalic      =   0   'False
   FontName        =   "MS Sans Serif"
   FontSize        =   36
   FontStrikethru  =   0   'False
   FontUnderline   =   0   'False
   ForeColor       =   &H000000FF&
   Height          =   855
   Index           =   6
   Left            =   5700
   TabIndex        =   13
   Top             =   3600
   Width           =   1335
End
Begin VScrollBar VScroll
   Height          =   2595
   Index           =   6
   LargeChange     =   10
   Left            =   4980
   Max             =   100
   Min             =   1
   TabIndex        =   14
   Top             =   3600
   Value           =   1
   Width           =   615
End
Begin TextBox Unit
   Height          =   375
   Index           =   6
   Left            =   5700
   TabIndex        =   15
   Top             =   5820
   Width           =   1155
End
Begin SSCommand Plus
   BevelWidth      =   10
   Caption         =   "+"
   FontBold        =   -1  'True
   FontItalic      =   0   'False
   FontName        =   "MS Sans Serif"
   FontSize        =   24
   FontStrikethru  =   0   'False
   FontUnderline   =   0   'False
   ForeColor       =   &H000000FF&
   Height          =   855
   Index           =   5
   Left            =   3300
   TabIndex        =   16
   Top             =   4560
   Width           =   1335
End
Begin SSCommand Minus
```

```
   BevelWidth       =   10
   Caption          =   "-"
   FontBold         =   -1  'True
   FontItalic       =   0   'False
   FontName         =   "MS Sans Serif"
   FontSize         =   36
   FontStrikethru   =   0   'False
   FontUnderline    =   0   'False
   ForeColor        =   &H000000FF&
   Height           =   855
   Index            =   5
   Left             =   3300
   TabIndex         =   17
   Top              =   3600
   Width            =   1335
End
Begin VScrollBar VScroll
   Height           =   2595
   Index            =   5
   LargeChange      =   10
   Left             =   2580
   Max              =   1000
   Min              =   25
   SmallChange      =   25
   TabIndex         =   49
   Top              =   3600
   Value            =   25
   Width            =   615
End
Begin TextBox Unit
   Height           =   375
   Index            =   5
   Left             =   3300
   TabIndex         =   48
   Top              =   5820
   Width            =   1155
End
Begin SSCommand Plus
   BevelWidth       =   10
   Caption          =   "+"
   FontBold         =   -1  'True
   FontItalic       =   0   'False
   FontName         =   "MS Sans Serif"
   FontSize         =   24
   FontStrikethru   =   0   'False
   FontUnderline    =   0   'False
   ForeColor        =   &H000000FF&
   Height           =   855
   Index            =   4
   Left             =   960
   TabIndex         =   45
   Top              =   4560
   Width            =   1335
End
Begin SSCommand Minus
   BevelWidth       =   10
   Caption          =   "-"
   FontBold         =   -1  'True
   FontItalic       =   0   'False
   FontName         =   "MS Sans Serif"
   FontSize         =   36
   FontStrikethru   =   0   'False
   FontUnderline    =   0   'False
   ForeColor        =   &H000000FF&
   Height           =   855
   Index            =   4
   Left             =   960
   TabIndex         =   44
   Top              =   3600
   Width            =   1335
End
Begin VScrollBar VScroll
```

```
   Height          =   2595
   Index           =   4
   LargeChange     =   10
   Left            =   240
   Max             =   10
   TabIndex        =   43
   Top             =   3600
   Width           =   615
End
Begin TextBox Unit
   Height          =   375
   Index           =   4
   Left            =   960
   TabIndex        =   42
   Top             =   5820
   Width           =   1155
End
Begin SSCommand Plus
   BevelWidth      =   10
   Caption         =   "+"
   FontBold        =   -1  'True
   FontItalic      =   0   'False
   FontName        =   "MS Sans Serif"
   FontSize        =   24
   FontStrikethru  =   0   'False
   FontUnderline   =   0   'False
   ForeColor       =   &H000000FF&
   Height          =   855
   Index           =   3
   Left            =   8100
   TabIndex        =   39
   Top             =   1440
   Width           =   1335
End
Begin SSCommand Minus
   BevelWidth      =   10
   Caption         =   "-"
   FontBold        =   -1  'True
   FontItalic      =   0   'False
   FontName        =   "MS Sans Serif"
   FontSize        =   36
   FontStrikethru  =   0   'False
   FontUnderline   =   0   'False
   ForeColor       =   &H000000FF&
   Height          =   855
   Index           =   3
   Left            =   8100
   TabIndex        =   38
   Top             =   480
   Width           =   1335
End
Begin VScrollBar VScroll
   Height          =   2595
   Index           =   3
   LargeChange     =   10
   Left            =   7380
   Max             =   100
   TabIndex        =   37
   Top             =   480
   Width           =   615
End
Begin TextBox Unit
   Height          =   375
   Index           =   3
   Left            =   8100
   TabIndex        =   36
   Top             =   2700
   Width           =   1155
End
Begin SSCommand Plus
   BevelWidth      =   10
   Caption         =   "+"
```

```
   FontBold          =   -1   'True
   FontItalic        =   0    'False
   FontName          =   "MS Sans Serif"
   FontSize          =   24
   FontStrikethru    =   0    'False
   FontUnderline     =   0    'False
   ForeColor         =   &H000000FF&
   Height            =   855
   Index             =   2
   Left              =   5640
   TabIndex          =   33
   Top               =   1440
   Width             =   1335
End
Begin SSCommand Minus
   BevelWidth        =   10
   Caption           =   "-"
   FontBold          =   -1   'True
   FontItalic        =   0    'False
   FontName          =   "MS Sans Serif"
   FontSize          =   36
   FontStrikethru    =   0    'False
   FontUnderline     =   0    'False
   ForeColor         =   &H000000FF&
   Height            =   855
   Index             =   2
   Left              =   5640
   TabIndex          =   32
   Top               =   480
   Width             =   1335
End
Begin VScrollBar VScroll
   Height            =   2595
   Index             =   2
   LargeChange       =   10
   Left              =   4920
   Max               =   1000
   Min               =   25
   SmallChange       =   25
   TabIndex          =   31
   Top               =   480
   Value             =   25
   Width             =   615
End
Begin TextBox Unit
   Height            =   375
   Index             =   2
   Left              =   5640
   TabIndex          =   30
   Top               =   2700
   Width             =   1155
End
Begin SSCommand Plus
   BevelWidth        =   10
   Caption           =   "+"
   FontBold          =   -1   'True
   FontItalic        =   0    'False
   FontName          =   "MS Sans Serif"
   FontSize          =   24
   FontStrikethru    =   0    'False
   FontUnderline     =   0    'False
   ForeColor         =   &H000000FF&
   Height            =   855
   Index             =   1
   Left              =   3240
   TabIndex          =   27
   Top               =   1440
   Width             =   1335
End
Begin SSCommand Minus
   BevelWidth        =   10
   Caption           =   "-"
```

```
   FontBold          =   -1   'True
   FontItalic        =   0    'False
   FontName          =   "MS Sans Serif"
   FontSize          =   36
   FontStrikethru    =   0    'False
   FontUnderline     =   0    'False
   ForeColor         =   &H000000FF&
   Height            =   855
   Index             =   1
   Left              =   3240
   TabIndex          =   26
   Top               =   480
   Width             =   1335
End
Begin VScrollBar VScroll
   Height            =   2595
   Index             =   1
   LargeChange       =   10
   Left              =   2520
   Max               =   100
   Min               =   1
   TabIndex          =   25
   Top               =   480
   Value             =   1
   Width             =   615
End
Begin TextBox Unit
   Height            =   375
   Index             =   1
   Left              =   3240
   TabIndex          =   24
   Top               =   2700
   Width             =   1155
End
Begin SSCommand Command3D3
   BevelWidth        =   10
   Caption           =   "EXIT"
   FontBold          =   -1   'True
   FontItalic        =   0    'False
   FontName          =   "Arial"
   FontSize          =   18
   FontStrikethru    =   0    'False
   FontUnderline     =   0    'False
   ForeColor         =   &H000000FF&
   Height            =   795
   Left              =   6840
   TabIndex          =   4
   Top               =   6360
   Width             =   2715
End
Begin TextBox Unit
   Height            =   375
   Index             =   0
   Left              =   900
   TabIndex          =   3
   Top               =   2700
   Width             =   1155
End
Begin VScrollBar VScroll
   Height            =   2595
   Index             =   0
   LargeChange       =   10
   Left              =   180
   Max               =   10
   TabIndex          =   2
   Top               =   480
   Width             =   615
End
Begin SSCommand Minus
   BevelWidth        =   10
   Caption           =   "-"
   FontBold          =   -1   'True
```

```
   FontItalic       =   0   'False
   FontName         =   "MS Sans Serif"
   FontSize         =   36
   FontStrikethru   =   0   'False
   FontUnderline    =   0   'False
   ForeColor        =   &H000000FF&
   Height           =   855
   Index            =   0
   Left             =   900
   TabIndex         =   1
   Top              =   480
   Width            =   1335
End
Begin SSCommand Plus
   BevelWidth       =   10
   Caption          =   "+"
   FontBold         =   -1  'True
   FontItalic       =   0   'False
   FontName         =   "MS Sans Serif"
   FontSize         =   24
   FontStrikethru   =   0   'False
   FontUnderline    =   0   'False
   ForeColor        =   &H000000FF&
   Height           =   855
   Index            =   0
   Left             =   900
   TabIndex         =   0
   Top              =   1440
   Width            =   1335
End
Begin Label Title
   BackStyle        =   0  'Transparent
   Caption          =   "2nd DC"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
   Index            =   7
   Left             =   7380
   TabIndex         =   18
   Top              =   3240
   Width            =   1875
End
Begin Label UnitLabel
   BackStyle        =   0  'Transparent
   Caption          =   "DC"
   Height           =   255
   Index            =   7
   Left             =   8160
   TabIndex         =   19
   Top              =   5580
   Width            =   1095
End
Begin Label Title
   BackStyle        =   0  'Transparent
   Caption          =   "3rd DC"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
   Index            =   6
   Left             =   4920
   TabIndex         =   20
   Top              =   3240
   Width            =   2295
End
```

```
Begin Label UnitLabel
   BackStyle        =   0   'Transparent
   Caption          =   "DC"
   Height           =   255
   Index            =   6
   Left             =   5700
   TabIndex         =   21
   Top              =   5580
   Width            =   1095
End
Begin Label Title
   BackStyle        =   0   'Transparent
   Caption          =   "3rd Speed"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
   Index            =   5
   Left             =   2520
   TabIndex         =   22
   Top              =   3240
   Width            =   2295
End
Begin Label UnitLabel
   BackStyle        =   0   'Transparent
   Caption          =   "SPEED COUNT"
   Height           =   255
   Index            =   5
   Left             =   3300
   TabIndex         =   23
   Top              =   5580
   Width            =   1515
End
Begin Label Title
   BackStyle        =   0   'Transparent
   Caption          =   "3rd Start Stitch"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
   Index            =   4
   Left             =   180
   TabIndex         =   47
   Top              =   3240
   Width            =   2295
End
Begin Label UnitLabel
   BackStyle        =   0   'Transparent
   Caption          =   "STITCH"
   Height           =   255
   Index            =   4
   Left             =   960
   TabIndex         =   46
   Top              =   5580
   Width            =   1095
End
Begin Label Title
   BackStyle        =   0   'Transparent
   Caption          =   "2nd AC"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   255
```

```
   Index          =   3
   Left           =   7320
   TabIndex       =   41
   Top            =   120
   Width          =   2295
End
Begin Label UnitLabel
   BackStyle      =   0  'Transparent
   Caption        =   "AC"
   Height         =   255
   Index          =   3
   Left           =   8100
   TabIndex       =   40
   Top            =   2460
   Width          =   1095
End
Begin Label Title
   BackStyle      =   0  'Transparent
   Caption        =   "1st Speed"
   FontBold       =   -1  'True
   FontItalic     =   0   'False
   FontName       =   "Arial"
   FontSize       =   12
   FontStrikethru =   0   'False
   FontUnderline  =   0   'False
   Height         =   255
   Index          =   2
   Left           =   4860
   TabIndex       =   35
   Top            =   120
   Width          =   2295
End
Begin Label UnitLabel
   BackStyle      =   0  'Transparent
   Caption        =   "SPEED COUNT"
   Height         =   255
   Index          =   2
   Left           =   5640
   TabIndex       =   34
   Top            =   2460
   Width          =   1635
End
Begin Label Title
   BackStyle      =   0  'Transparent
   Caption        =   "1st AC"
   FontBold       =   -1  'True
   FontItalic     =   0   'False
   FontName       =   "Arial"
   FontSize       =   12
   FontStrikethru =   0   'False
   FontUnderline  =   0   'False
   Height         =   255
   Index          =   1
   Left           =   2460
   TabIndex       =   29
   Top            =   120
   Width          =   2295
End
Begin Label UnitLabel
   BackStyle      =   0  'Transparent
   Caption        =   "AC"
   Height         =   255
   Index          =   1
   Left           =   3240
   TabIndex       =   28
   Top            =   2460
   Width          =   1095
End
Begin Line Line1
   Visible        =   0   'False
   X1             =   9660
   X2             =   9660
```

```
      Y1                =   0
      Y2                =   7260
   End
   Begin Line Line2
      Visible           =   0   'False
      X1                =   9660
      X2                =   0
      Y1                =   7260
      Y2                =   7260
   End
   Begin Label Label1
      BackStyle         =   0  'Transparent
      Caption           =   "ADVANCED SEW SPEED"
      FontBold          =   -1  'True
      FontItalic        =   0   'False
      FontName          =   "Arial"
      FontSize          =   24
      FontStrikethru    =   0   'False
      FontUnderline     =   0   'False
      ForeColor         =   &H00800000&
      Height            =   615
      Left              =   180
      TabIndex          =   8
      Top               =   6600
      Width             =   5835
   End
   Begin Label UnitLabel
      BackStyle         =   0  'Transparent
      Caption           =   "STITCH"
      Height            =   255
      Index             =   0
      Left              =   900
      TabIndex          =   6
      Top               =   2460
      Width             =   1095
   End
   Begin Label Title
      BackStyle         =   0  'Transparent
      Caption           =   "1st Start Stitch"
      FontBold          =   -1  'True
      FontItalic        =   0   'False
      FontName          =   "Arial"
      FontSize          =   12
      FontStrikethru    =   0   'False
      FontUnderline     =   0   'False
      Height            =   255
      Index             =   0
      Left              =   120
      TabIndex          =   5
      Top               =   120
      Width             =   2295
   End
End
Dim DownFlag%

Sub Command3D3_Click ()
'Write Value to INI
    Write_Start_1st Vscroll(0).value
    Write_AC_1st Vscroll(1).value * 10000
    Write_Speed_1st Vscroll(2).value * EncoderCount
    Write_AC_2nd Vscroll(3).value * 10000
    Write_Start_3rd Vscroll(4).value
    Write_Speed_3rd Vscroll(5).value * EncoderCount
    Write_DC_3rd Vscroll(6).value * 10000
    Write_DC_2nd Vscroll(7).value * 10000

'Check if this is a factory setting
    If TechMode = True Or FactoryFlag% = True Then
        End If

Unload Me
End Sub
```

```
Sub Form_KeyDown (KeyCode As Integer, Shift As Integer)
GlobalKeyDown KeyCode, Shift
End Sub

Sub Form_Load ()
On Error Resume Next

SetUpWindow Me, "SSpeed"

'Get Values
    Vscroll(0).value = Read_Start_1st()
    Vscroll(1).value = Read_AC_1st() / 10000
    Vscroll(2).value = Read_Speed_1st() / EncoderCount
    Vscroll(3).value = Read_AC_2nd() / 10000
    Vscroll(4).value = Read_Start_3rd()
    Vscroll(5).value = Read_Speed_3rd() / EncoderCount
    Vscroll(6).value = Read_DC_3rd() / 10000
    Vscroll(7).value = Read_DC_2nd() / 10000


'Display Unit Values
    For z% = 0 To 7
        VScroll_Change z%
    Next

End Sub

Sub Minus_MouseDown (Index As Integer, Button As Integer, Shift As Integer, X As
Single, Y As Single)
On Error Resume Next

'set downflag
    If DownFlag% = True Then Exit Sub
    DownFlag% = True

'change first value
    Vscroll(Index).value = Vscroll(Index).value - Vscroll(Index).SmallChange
    Vscroll(Index).Refresh

'allow time for mouseup
    rsleep .5

'enter loop for continous value change
    Do Until DownFlag% = False
        Vscroll(Index).value = Vscroll(Index).value - Vscroll(Index).SmallChange
        If Err Then DownFlag% = False: Vscroll(Index).value = Vscroll(Index).Min
        Vscroll(Index).Refresh
        DoEvents
    Loop

    DownFlag% = False

End Sub

Sub Minus_MouseUp (Index As Integer, Button As Integer, Shift As Integer, X As
Single, Y As Single)
DownFlag% = False
End Sub

Sub Plus_MouseDown (Index As Integer, Button As Integer, Shift As Integer, X As
Single, Y As Single)
On Error Resume Next

'set downflag
    If DownFlag% = True Then Exit Sub
    DownFlag% = True

'change first value
    Vscroll(Index).value = Vscroll(Index).value + Vscroll(Index).SmallChange
    Vscroll(Index).Refresh
```

```
'allow time for mouseup
    rsleep .5

'enter loop for continous value change
    Do Until DownFlag% = False
        Vscroll(Index).value = Vscroll(Index).value + Vscroll(Index).SmallChange
        If Err Then DownFlag% = False: Vscroll(Index).value = Vscroll(Index).Max
        Vscroll(Index).Refresh
        DoEvents
    Loop

    DownFlag% = False


End Sub

Sub Plus_MouseUp (Index As Integer, Button As Integer, Shift As Integer, X As
Single, Y As Single)
DownFlag% = False
End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub TurnOnOff (ByVal z As Integer, ByVal V%)
Title(z).Visible = V%
Vscroll(z).Visible = V%
Minus(z).Visible = V%
Plus(z).Visible = V%
UnitLabel(z).Visible = V%
Unit(z).Visible = V%

End Sub

Sub VScroll_Change (Index As Integer)

Select Case Index
    Case 1, 6 'AC/DC for 1 & 3 stitch
        Unit(Index).Text = Format$(Vscroll(Index).value * 10000)
    Case 3, 7 'AC/DC for 2nd stitch
         If Vscroll(Index).value = 0 Then
            Unit(Index).Text = "DEFAULT"
            Else
            Unit(Index).Text = Format$(Vscroll(Index).value * 10000)
            End If
    Case 2, 5 'Speed
        Unit(Index).Text = Format$(Vscroll(Index).value * EncoderCount)
    Case 0, 4 'Start Stitch
        If Vscroll(Index).value = 0 Then
            Unit(Index).Text = "N/A"
            Else
            Unit(Index).Text = Format$(Vscroll(Index).value)
            End If
        If Vscroll(Index).value = 0 Then V% = False Else V% = True
        If Index = 0 Then
            TurnOnOff 1, V%
            TurnOnOff 2, V%
            Else
```

```
            TurnOnOff 5, V%
            TurnOnOff 6, V%
            End If

End Select

End Sub
```

```
VERSION 2.00
Begin Form Software3
   BackColor        =   &H00FFFF00&
   BorderStyle      =   1  'Fixed Single
   Caption          =   "Software3"
   ClientHeight     =   7425
   ClientLeft       =   465
   ClientTop        =   1830
   ClientWidth      =   10935
   ControlBox       =   0   'False
   Height           =   7830
   KeyPreview       =   -1  'True
   Left             =   405
   LinkTopic        =   "Form1"
   MaxButton        =   0   'False
   MinButton        =   0   'False
   ScaleHeight      =   7425
   ScaleWidth       =   10935
   Top              =   1485
   Width            =   11055
   Begin PictureBox Picture2
      BackColor        =   &H00000000&
      Height           =   2535
      Left             =   0
      ScaleHeight      =   2505
      ScaleWidth       =   4965
      TabIndex         =   7
      Top              =   0
      Width            =   4995
      Begin Image Image1
         BorderStyle      =   1  'Fixed Single
         Height           =   2025
         Left             =   240
         Picture          =   SOFTWAR3.FRX:0000
         Top              =   0
         Width            =   4425
      End
      Begin Label Label5
         Alignment        =   2  'Center
         BackColor        =   &H00000000&
         Caption          =   "JL5000 - New Technology In Sewing"
         FontBold         =   -1  'True
         FontItalic       =   -1  'True
         FontName         =   "Arial"
         FontSize         =   12
         FontStrikethru   =   0   'False
         FontUnderline    =   0   'False
         ForeColor        =   &H0000FFFF&
         Height           =   315
         Left             =   60
         TabIndex         =   8
         Top              =   2040
         Width            =   4875
      End
   End
   Begin Frame Frame1
      BackColor        =   &H00FFFF00&
      Caption          =   "USER ACCESS"
      FontBold         =   -1  'True
      FontItalic       =   0   'False
      FontName         =   "MS Sans Serif"
      FontSize         =   12
      FontStrikethru   =   0   'False
      FontUnderline    =   0   'False
      Height           =   4515
      Left             =   120
      TabIndex         =   17
      Top              =   2700
      Width            =   3255
      Begin SSCommand User3
         BevelWidth       =   10
         Caption          =   "OFF"
```

```
   FontBold          =   -1   'True
   FontItalic        =   0    'False
   FontName          =   "MS Sans Serif"
   FontSize          =   13.5
   FontStrikethru    =   0    'False
   FontUnderline     =   0    'False
   ForeColor         =   &H00FF0000&
   Height            =   675
   Left              =   120
   TabIndex          =   19
   Top               =   1740
   Width             =   2955
End
Begin SSCommand User2
   BevelWidth        =   10
   Caption           =   "OFF"
   FontBold          =   -1   'True
   FontItalic        =   0    'False
   FontName          =   "MS Sans Serif"
   FontSize          =   13.5
   FontStrikethru    =   0    'False
   FontUnderline     =   0    'False
   ForeColor         =   &H00FF0000&
   Height            =   675
   Left              =   120
   TabIndex          =   9
   Top               =   3120
   Width             =   2955
End
Begin SSCommand User1
   BevelWidth        =   10
   Caption           =   "OFF"
   FontBold          =   -1   'True
   FontItalic        =   0    'False
   FontName          =   "MS Sans Serif"
   FontSize          =   13.5
   FontStrikethru    =   0    'False
   FontUnderline     =   0    'False
   ForeColor         =   &H00FF0000&
   Height            =   615
   Left              =   120
   TabIndex          =   18
   Top               =   420
   Width             =   2955
End
Begin Label Label2
   Alignment         =   2   'Center
   BackStyle         =   0   'Transparent
   Caption           =   "USER ACCESS to Sew Speed"
   FontBold          =   -1   'True
   FontItalic        =   0    'False
   FontName          =   "Arial"
   FontSize          =   12
   FontStrikethru    =   0    'False
   FontUnderline     =   0    'False
   Height            =   615
   Index             =   3
   Left              =   480
   TabIndex          =   20
   Top               =   2460
   Width             =   2415
End
Begin Label Label2
   Alignment         =   2   'Center
   BackStyle         =   0   'Transparent
   Caption           =   "USER ACCESS to MANUAL Screen"
   FontBold          =   -1   'True
   FontItalic        =   0    'False
   FontName          =   "Arial"
   FontSize          =   12
   FontStrikethru    =   0    'False
   FontUnderline     =   0    'False
```

```
      Height          =   615
      Index           =   2
      Left            =   480
      TabIndex        =   10
      Top             =   3840
      Width           =   2415
   End
   Begin Label Label2
      Alignment       =   2   'Center
      BackStyle       =   0   'Transparent
      Caption         =   "USER ACCESS to stitch editing"
      FontBold        =   -1  'True
      FontItalic      =   0   'False
      FontName        =   "Arial"
      FontSize        =   12
      FontStrikethru  =   0   'False
      FontUnderline   =   0   'False
      Height          =   615
      Index           =   0
      Left            =   540
      TabIndex        =   16
      Top             =   1080
      Width           =   2415
   End
End
Begin VScrollBar VSCROLL
   DragIcon        =   SOFTWAR3.FRX:4D60
   Height          =   3495
   LargeChange     =   10
   Left            =   3660
   Max             =   1
   Min             =   99
   TabIndex        =   14
   Top             =   3600
   Value           =   6
   Width           =   615
End
Begin TextBox RPM
   Height          =   375
   Left            =   4440
   TabIndex        =   13
   Top             =   6660
   Width           =   1335
End
Begin SSCommand Command3D4
   BevelWidth      =   10
   Caption         =   "-"
   FontBold        =   -1  'True
   FontItalic      =   0   'False
   FontName        =   "MS Sans Serif"
   FontSize        =   36
   FontStrikethru  =   0   'False
   FontUnderline   =   0   'False
   ForeColor       =   &H000000FF&
   Height          =   855
   Left            =   4440
   TabIndex        =   12
   Top             =   4680
   Width           =   1335
End
Begin SSCommand Command3D5
   BevelWidth      =   10
   Caption         =   "+"
   FontBold        =   -1  'True
   FontItalic      =   0   'False
   FontName        =   "MS Sans Serif"
   FontSize        =   24
   FontStrikethru  =   0   'False
   FontUnderline   =   0   'False
   ForeColor       =   &H000000FF&
   Height          =   855
   Left            =   4440
```

```
      TabIndex          =   11
      Top               =   3660
      Width             =   1335
   End
   Begin PictureBox Picture1
      BackColor         =   &H00FFFF00&
      Height            =   2475
      Left              =   4980
      ScaleHeight       =   2445
      ScaleWidth        =   4545
      TabIndex          =   4
      Top               =   60
      Width             =   4575
      Begin SSCommand Command3D1
         BevelWidth       =   10
         Caption          =   "UPGRADE SOFTWARE"
         FontBold         =   -1   'True
         FontItalic       =   0    'False
         FontName         =   "Arial"
         FontSize         =   12
         FontStrikethru   =   0    'False
         FontUnderline    =   0    'False
         ForeColor        =   &H00FF0000&
         Height           =   975
         Left             =   180
         TabIndex         =   5
         Top              =   180
         Width            =   4155
      End
      Begin Label Label1
         Alignment        =   2   'Center
         BackStyle        =   0   'Transparent
         Caption          =   "Use this button to upgrade the JL-5000 software
interface to a newer version. Place the Upgrade Disk supplied by TICE Engineering in
the JL-5000 Floppy Disk Drive, then press the above button."
         Height           =   1035
         Left             =   240
         TabIndex         =   6
         Top              =   1320
         Width            =   4035
      End
   End
   Begin SSCommand UpgradeButton
      BevelWidth       =   10
      Caption          =   "Security Log"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H00FF0000&
      Height           =   975
      Left             =   6120
      TabIndex         =   3
      Top              =   2760
      Width            =   3435
   End
   Begin SSCommand ExitButton
      BevelWidth       =   10
      Caption          =   "EXIT"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H000000FF&
      Height           =   975
      Left             =   6120
      TabIndex         =   2
      Top              =   6180
```

```
      Width            =   3435
   End
   Begin SSCommand Command3D18
      BevelWidth       =   10
      Caption          =   "Reset to Factory Defaults"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H00FF0000&
      Height           =   945
      Left             =   6120
      TabIndex         =   1
      Top              =   3900
      Width            =   3435
   End
   Begin SSCommand Command3D17
      BevelWidth       =   10
      Caption          =   "Passwords"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H00FF0000&
      Height           =   1005
      Left             =   6120
      TabIndex         =   0
      Top              =   4980
      Width            =   3435
   End
   Begin Label Label2
      BackStyle        =   0   'Transparent
      Caption          =   "Number of Preset Stitches"
      FontBold         =   -1   'True
      FontItalic       =   0    'False
      FontName         =   "Arial"
      FontSize         =   12
      FontStrikethru   =   0    'False
      FontUnderline    =   0    'False
      Height           =   735
      Index            =   1
      Left             =   3660
      TabIndex         =   15
      Top              =   2880
      Width            =   1875
   End
   Begin Line Line1
      Visible          =   0    'False
      X1               =   9660
      X2               =   9660
      Y1               =   0
      Y2               =   7260
   End
   Begin Line Line2
      Visible          =   0    'False
      X1               =   9660
      X2               =   0
      Y1               =   7260
      Y2               =   7260
   End
End
Dim DownFlag%

Sub Command3D1_Click ()
On Error Resume Next

'Check Floppy Disk for Upgrade.inf file
    Display "Please Wait..."
```

```
    'Ret$ = Trim$(Getini("a:\upgrade.inf", "upgrade", "run", ""))

    Ret$ = "upgrade.exe"
    If Dir$("a:\" & Ret$) = "" Or Ret$ = "" Then
        Display ""
        MsgBox "Could not preform upgrade." & Chr$(13) & "Insure that correct disk
is in the floppy drive.", 0, "UPGRADE"
        Exit Sub
        End If

'Get Version date
    SoftwareVersion W$, V!, D$

'Run Upgrade executable
    r% = Shell("a:\" & Ret$ & " " & Format$(V!) & " " & D$ & " " & Path$, 1)
    Display ""
    End

End Sub

Sub Command3D17_Click ()
SoftwareSetup.Show
Unload Me
End Sub

Sub Command3D18_Click ()
ResetToFactoryDefaults Me
End Sub

Sub Command3D4_MouseDown (Button As Integer, Shift As Integer, X As Single, Y As
Single)
On Error Resume Next

'set downflag
    If DownFlag% = True Then Exit Sub
    DownFlag% = True

'change first value
    VSCROLL.Value = VSCROLL.Value - VSCROLL.SmallChange
    VSCROLL.Refresh

'allow time for mouseup
    rsleep .5

'enter loop for continous value change
    Do Until DownFlag% = False
        VSCROLL.Value = VSCROLL.Value - VSCROLL.SmallChange
        If Err Then DownFlag% = False: VSCROLL.Value = VSCROLL.Max
        VSCROLL.Refresh
        DoEvents
    Loop

    DownFlag% = False

End Sub

Sub Command3D4_MouseUp (Button As Integer, Shift As Integer, X As Single, Y As
Single)
DownFlag% = False
End Sub

Sub Command3D5_MouseDown (Button As Integer, Shift As Integer, X As Single, Y As
Single)
On Error Resume Next

'set downflag
    If DownFlag% = True Then Exit Sub
    DownFlag% = True

'change first value
    VSCROLL.Value = VSCROLL.Value + VSCROLL.SmallChange
```

```
    VSCROLL.Refresh

'allow time for mouseup
    rsleep .5

'enter loop for continous value change
    Do Until DownFlag% = False
        VSCROLL.Value = VSCROLL.Value + VSCROLL.SmallChange
        If Err Then DownFlag% = False: VSCROLL.Value = VSCROLL.Min
        VSCROLL.Refresh
        DoEvents
    Loop

    DownFlag% = False

End Sub

Sub Command3D5_MouseUp (Button As Integer, Shift As Integer, X As Single, Y As
Single)
DownFlag% = False
End Sub

Sub ExitButton_Click ()
'Update INI
     'Presets
        r% = WriteNumberOfPresetStitches(VSCROLL.Value)
        Presets = VSCROLL.Value
    'User1
        If User1.Caption = "OFF" Then
            r% = WriteUser1(False)
            Else
            r% = WriteUser1(True)
            End If
    'User2
        If User2.Caption = "OFF" Then
            r% = WriteUser2(False)
            Else
            r% = WriteUser2(True)
            End If

    'User3
        If User3.Caption = "OFF" Then
            r% = WriteUser3(False)
            Else
            r% = WriteUser3(True)
            End If


SetupForm.Show
Unload Me

End Sub

Sub Form_KeyDown (KeyCode As Integer, Shift As Integer)
GlobalKeyDown KeyCode, Shift
End Sub

Sub Form_Load ()
'Setup This Form
    SetUpWindow Me, "Software3"

'Title
    SoftwareVersion W$, V!, D$
    Version = Trim$(Version) & " " & W$

'Presets
    VSCROLL.Value = ReadNumberOfPresetStitches()
    VScroll_Change

'Users
    If ReadUser1() <> False Then User1.Caption = "ON"
```

```
    If ReadUser2() <> False Then User2.Caption = "ON"
    If ReadUser3() <> False Then User3.Caption = "ON"

End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub UpgradeButton_Click ()
Software2.Show
Unload Me

End Sub

Sub User1_Click ()
If User1.Caption = "OFF" Then
    User1.Caption = "ON"
    Else
    User1.Caption = "OFF"
    End If


End Sub

Sub User2_Click ()
If User2.Caption = "OFF" Then
    User2.Caption = "ON"
    Else
    User2.Caption = "OFF"
    End If

End Sub

Sub User3_Click ()
If User3.Caption = "OFF" Then
    User3.Caption = "ON"
    Else
    User3.Caption = "OFF"
    End If

End Sub

Sub VScroll_Change ()
RPM = Format$(VSCROLL.Value, "0")
End Sub
```

```
VERSION 2.00
Begin Form Software2
   BackColor        =   &H00FFFF00&
   BorderStyle      =   1  'Fixed Single
   Caption          =   "Software Maintenace"
   ClientHeight     =   8400
   ClientLeft       =   165
   ClientTop        =   1515
   ClientWidth      =   10320
   ControlBox       =   0   'False
   Height           =   8805
   KeyPreview       =   -1  'True
   Left             =   105
   LinkTopic        =   "Form1"
   MaxButton        =   0   'False
   MinButton        =   0   'False
   ScaleHeight      =   8400
   ScaleWidth       =   10320
   Top              =   1170
   Width            =   10440
   Begin Frame Frame1
      BackColor        =   &H00FFFF80&
      Caption          =   "SECURITY LOG"
      FontBold         =   -1  'True
      FontItalic       =   0   'False
      FontName         =   "MS Sans Serif"
      FontSize         =   13.5
      FontStrikethru   =   0   'False
      FontUnderline    =   0   'False
      Height           =   5115
      Left             =   120
      TabIndex         =   2
      Top              =   120
      Width            =   9375
      Begin ListBox List1
         Height           =   225
         Left             =   8100
         Sorted           =   -1  'True
         TabIndex         =   6
         Top              =   4080
         Visible          =   0   'False
         Width            =   975
      End
      Begin SSCommand Command3D2
         BevelWidth       =   10
         Caption          =   "CLEAR"
         FontBold         =   -1  'True
         FontItalic       =   0   'False
         FontName         =   "Arial"
         FontSize         =   12
         FontStrikethru   =   0   'False
         FontUnderline    =   0   'False
         ForeColor        =   &H000000FF&
         Height           =   975
         Left             =   7860
         TabIndex         =   1
         Top              =   2940
         Width            =   1275
      End
      Begin SSCommand Command3D1
         BevelWidth       =   10
         Caption          =   "DOWN"
         FontBold         =   -1  'True
         FontItalic       =   0   'False
         FontName         =   "Arial"
         FontSize         =   12
         FontStrikethru   =   0   'False
         FontUnderline    =   0   'False
         ForeColor        =   &H00FF0000&
         Height           =   975
         Left             =   7860
         TabIndex         =   5
```

```
      Top              =   1620
      Width            =   1275
   End
   Begin SSCommand TechButton
      BevelWidth       =   10
      Caption          =   "UP"
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H00FF0000&
      Height           =   975
      Left             =   7860
      TabIndex         =   4
      Top              =   540
      Width            =   1275
   End
   Begin ListBox SList
      FontBold         =   0   'False
      FontItalic       =   0   'False
      FontName         =   "MS Sans Serif"
      FontSize         =   8.25
      FontStrikethru   =   0   'False
      FontUnderline    =   0   'False
      Height           =   4320
      Left             =   120
      TabIndex         =   3
      Top              =   540
      Width            =   7575
   End
End
Begin SSCommand ExitButton
   BevelWidth       =   10
   Caption          =   "EXIT"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H000000FF&
   Height           =   1275
   Left             =   5340
   TabIndex         =   0
   Top              =   5640
   Width            =   4035
End
Begin Label Title
   Alignment        =   2  'Center
   BackStyle        =   0  'Transparent
   Caption          =   "JL-5000 Software"
   FontBold         =   -1  'True
   FontItalic       =   0   'False
   FontName         =   "Arial"
   FontSize         =   21
   FontStrikethru   =   0   'False
   FontUnderline    =   0   'False
   ForeColor        =   &H00800000&
   Height           =   435
   Left             =   300
   TabIndex         =   10
   Top              =   5460
   Width            =   4395
End
Begin Label Label3
   Alignment        =   2  'Center
   BackStyle        =   0  'Transparent
   Caption          =   "Interface"
   FontBold         =   -1  'True
   FontItalic       =   0   'False
```

```
      FontName          =   "Arial"
      FontSize          =   21
      FontStrikethru    =   0   'False
      FontUnderline     =   0   'False
      ForeColor         =   &H00800000&
      Height            =   435
      Left              =   300
      TabIndex          =   9
      Top               =   5880
      Width             =   4395
   End
   Begin Label Version
      Alignment         =   2  'Center
      BackStyle         =   0  'Transparent
      Caption           =   "Version"
      FontBold          =   -1  'True
      FontItalic        =   -1  'True
      FontName          =   "Arial"
      FontSize          =   15.75
      FontStrikethru    =   0   'False
      FontUnderline     =   0   'False
      ForeColor         =   &H00800000&
      Height            =   435
      Left              =   300
      TabIndex          =   8
      Top               =   6360
      Width             =   4395
   End
   Begin Label Label4
      Alignment         =   2  'Center
      BackStyle         =   0  'Transparent
      Caption           =   "Copyright 1994/1995, Tice Engineering && Sales"
      FontBold          =   -1  'True
      FontItalic        =   0   'False
      FontName          =   "Arial"
      FontSize          =   9.75
      FontStrikethru    =   0   'False
      FontUnderline     =   0   'False
      ForeColor         =   &H00800000&
      Height            =   435
      Left              =   60
      TabIndex          =   7
      Top               =   6780
      Width             =   4995
   End
   Begin Line Line2
      Visible           =   0   'False
      X1                =   9660
      X2                =   0
      Y1                =   7260
      Y2                =   7260
   End
   Begin Line Line1
      Visible           =   0   'False
      X1                =   9660
      X2                =   9660
      Y1                =   0
      Y2                =   7260
   End
End
Sub Command3D1_Click ()
On Error Resume Next

Slist.TopIndex = Slist.TopIndex + 22
Slist.ListIndex = Slist.TopIndex
If Err Then
    Slist.TopIndex = Slist.ListCount - 1
    Slist.ListIndex = Slist.ListCount - 1
    End If
End Sub

Sub Command3D2_Click ()
```

```
On Error Resume Next
Kill Path$ & "Security.log"
LoadSecurityLog

End Sub

Sub ExitButton_Click ()
Software3.Show
Unload Me
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "Software2"

'CenterControl ExitButton, Me.Width, Me.Height
'Label1.Top = ExitButton.Top + ExitButton.Height + 200
'CenterControlW Label1, Me.Width

'Title
    SoftwareVersion W$, V!, D$
    Version = Trim$(Version) & " " & W$

'Load Security Log
    LoadSecurityLog

End Sub

Sub LoadSecurityLog ()
On Error Resume Next

'Load Security Log  into List1 (which is sorted)
    List1.Clear
    Slist.Clear
    FF% = FreeFile
    Err = 0
    Open Path$ & "Security.log" For Input As FF%
    Do Until EOF(FF%)
        If Err Then Exit Do
        Line Input #FF%, a$
        a$ = Trim$(a$)
        If a$ <> "" Then List1.AddItem a$
    Loop
    Close FF%

'Transfer to SList
    For z = List1.ListCount - 1 To 0 Step -1
        tmp$ = List1.List(z)
        tmp$ = Mid$(tmp$, InStr(tmp$, Chr$(9)) + 1)
        Slist.AddItem Format$(List1.ListCount - z, "00") & ":  " & tmp$
    Next z

End Sub

Sub TechButton_Click ()
On Error Resume Next

Slist.TopIndex = Slist.TopIndex - 22
Slist.ListIndex = Slist.TopIndex
If Err Then
    Slist.TopIndex = 0
    Slist.ListIndex = 0
    End If


End Sub
```

```
Sub UpgradeButton_Click ()
On Error Resume Next

'Check Floppy Disk for Upgrade.inf file
    Display "Please Wait..."
    Ret$ = Trim$(Getini("a:\upgrade.inf", "upgrade", "run", ""))
    If Dir$("a:\" & Ret$) = "" Or Ret$ = "" Then
        Display ""
        MsgBox "Could not preform upgrade." & Chr$(13) & "Insure that correct disk
is in the floppy drive.", 0, "UPGRADE"
        Exit Sub
        End If

'Get Version date
    SoftwareVersion W$, V!, D$

'Run Upgrade executable
    r% = Shell("a:\" & Ret$ & " " & Format$(V!) & " " & D$ & " " & Path$, 1)
    Display ""
    End


End Sub
```

```
VERSION 2.00
Begin Form SoftwareSetup
   BackColor        =   &H00FFFF00&
   BorderStyle      =   1  'Fixed Single
   Caption          =   "Software Setup"
   ClientHeight     =   8430
   ClientLeft       =   45
   ClientTop        =   1890
   ClientWidth      =   10710
   ControlBox       =   0   'False
   Height           =   8835
   KeyPreview       =   -1  'True
   Left             =   -15
   LinkTopic        =   "Form1"
   MaxButton        =   0   'False
   MinButton        =   0   'False
   ScaleHeight      =   8430
   ScaleWidth       =   10710
   Top              =   1545
   Width            =   10830
   Begin PictureBox Picture2
      BackColor        =   &H00000000&
      Height           =   2955
      Left             =   5100
      ScaleHeight      =   2925
      ScaleWidth       =   4425
      TabIndex         =   23
      Top              =   120
      Width            =   4455
      Begin Label Label6
         Alignment        =   2  'Center
         BackColor        =   &H00000000&
         Caption          =   "TELEPHONE (615) 922-7501 USA"
         FontBold         =   -1  'True
         FontItalic       =   0   'False
         FontName         =   "Arial"
         FontSize         =   12
         FontStrikethru   =   0   'False
         FontUnderline    =   0   'False
         ForeColor        =   &H0000FFFF&
         Height           =   315
         Left             =   60
         TabIndex         =   25
         Top              =   2400
         Width            =   4335
      End
      Begin Label Label5
         Alignment        =   2  'Center
         BackColor        =   &H00000000&
         Caption          =   "KNOXVILLE, TENNESSEE 37918"
         FontBold         =   -1  'True
         FontItalic       =   0   'False
         FontName         =   "Arial"
         FontSize         =   12
         FontStrikethru   =   0   'False
         FontUnderline    =   0   'False
         ForeColor        =   &H0000FFFF&
         Height           =   315
         Left             =   60
         TabIndex         =   24
         Top              =   2040
         Width            =   4335
      End
      Begin Image Image1
         BorderStyle      =   1  'Fixed Single
         Height           =   2025
         Left             =   0
         Picture          =   SOFTWARE.FRX:0000
         Top              =   0
         Width            =   4425
      End
   End
```

```
Begin SSCommand MechanicPassword
   BevelWidth      =   10
   Caption         =   "Change Mechanic Password"
   FontBold        =   -1  'True
   FontItalic      =   0   'False
   FontName        =   "Arial"
   FontSize        =   15.75
   FontStrikethru  =   0   'False
   FontUnderline   =   0   'False
   ForeColor       =   &H00FF0000&
   Height          =   855
   Left            =   120
   TabIndex        =   18
   Top             =   1680
   Width           =   4815
End
Begin SSCommand UserPassword
   BevelWidth      =   10
   Caption         =   "Change User Password"
   FontBold        =   -1  'True
   FontItalic      =   0   'False
   FontName        =   "Arial"
   FontSize        =   15.75
   FontStrikethru  =   0   'False
   FontUnderline   =   0   'False
   ForeColor       =   &H00FF0000&
   Height          =   855
   Left            =   120
   TabIndex        =   16
   Top             =   720
   Width           =   4815
End
Begin SSCommand AdminPassword
   BevelWidth      =   10
   Caption         =   "Change Admin. Password"
   FontBold        =   -1  'True
   FontItalic      =   0   'False
   FontName        =   "Arial"
   FontSize        =   13.5
   FontStrikethru  =   0   'False
   FontUnderline   =   0   'False
   ForeColor       =   &H00FF0000&
   Height          =   915
   Left            =   5160
   TabIndex        =   15
   Top             =   5040
   Width           =   4335
End
Begin PictureBox Picture1
   BackColor       =   &H00FFFF80&
   Height          =   4395
   Left            =   120
   ScaleHeight     =   4365
   ScaleWidth      =   4845
   TabIndex        =   1
   Top             =   2700
   Width           =   4875
   Begin SSCommand Command3D2
      BevelWidth      =   10
      Caption         =   "9"
      Enabled         =   0   'False
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H00C00000&
      Height          =   950
      Index           =   9
      Left            =   1320
      TabIndex        =   12
```

```
   Top              =   3240
   Width            =   1000
End
Begin SSCommand Command3D2
   BevelWidth       =   10
   Caption          =   "8"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   8
   Left             =   120
   TabIndex         =   11
   Top              =   3240
   Width            =   1000
End
Begin SSCommand Command3D2
   BevelWidth       =   10
   Caption          =   "7"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   7
   Left             =   3690
   TabIndex         =   10
   Top              =   2220
   Width            =   1000
End
Begin SSCommand Command3D2
   BevelWidth       =   10
   Caption          =   "6"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   6
   Left             =   2490
   TabIndex         =   9
   Top              =   2220
   Width            =   1000
End
Begin SSCommand Command3D2
   BevelWidth       =   10
   Caption          =   "5"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   5
   Left             =   1320
   TabIndex         =   8
```

```
   Top              =   2220
   Width            =   1000
End
Begin SSCommand Command3D2
   BevelWidth       =   10
   Caption          =   "4"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   4
   Left             =   120
   TabIndex         =   7
   Top              =   2220
   Width            =   1000
End
Begin SSCommand Command3D2
   BevelWidth       =   10
   Caption          =   "3"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   3
   Left             =   3690
   TabIndex         =   6
   Top              =   1200
   Width            =   1000
End
Begin SSCommand Command3D2
   BevelWidth       =   10
   Caption          =   "2"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   2
   Left             =   2490
   TabIndex         =   5
   Top              =   1200
   Width            =   1000
End
Begin SSCommand Command3D2
   BevelWidth       =   10
   Caption          =   "1"
   Enabled          =   0    'False
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H00C00000&
   Height           =   950
   Index            =   1
   Left             =   1320
   TabIndex         =   4
```

```
      Top              =   1200
      Width            =   1000
   End
   Begin SSCommand EnterButton
      BevelWidth       =   10
      Caption          =   "Enter"
      Enabled          =   0    'False
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00C00000&
      Height           =   950
      Left             =   2460
      TabIndex         =   3
      Top              =   3240
      Width            =   2295
   End
   Begin SSCommand Command3D2
      BevelWidth       =   10
      Caption          =   "0"
      Enabled          =   0    'False
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00C00000&
      Height           =   950
      Index            =   0
      Left             =   120
      TabIndex         =   2
      Top              =   1200
      Width            =   1000
   End
   Begin Label PWord
      BorderStyle      =   1   'Fixed Single
      FontBold         =   -1   'True
      FontItalic       =   0    'False
      FontName         =   "MS Sans Serif"
      FontSize         =   18
      FontStrikethru   =   0    'False
      FontUnderline    =   0    'False
      Height           =   585
      Left             =   150
      TabIndex         =   14
      Top              =   510
      Width            =   4425
   End
   Begin Label PTitle
      BackStyle        =   0   'Transparent
      Caption          =   "Enter Admin. Password:"
      FontBold         =   -1   'True
      FontItalic       =   0    'False
      FontName         =   "Arial"
      FontSize         =   18
      FontStrikethru   =   0    'False
      FontUnderline    =   0    'False
      Height           =   435
      Left             =   180
      TabIndex         =   13
      Top              =   60
      Width            =   4635
   End
End
Begin SSCommand ExitButton
   BevelWidth       =   10
   Caption          =   "EXIT"
   FontBold         =   -1   'True
```

```
   FontItalic       =   0   'False
   FontName         =   "Arial"
   FontSize         =   24
   FontStrikethru   =   0   'False
   FontUnderline    =   0   'False
   ForeColor        =   &H000000FF&
   Height           =   975
   Left             =   5160
   TabIndex         =   0
   Top              =   6120
   Width            =   4395
End
Begin Label Label4
   Alignment        =   2  'Center
   BackStyle        =   0  'Transparent
   Caption          =   "Copyright 1994/1995, Tice Engineering && Sales"
   FontBold         =   -1  'True
   FontItalic       =   0   'False
   FontName         =   "Arial"
   FontSize         =   9.75
   FontStrikethru   =   0   'False
   FontUnderline    =   0   'False
   ForeColor        =   &H00800000&
   Height           =   435
   Left             =   5100
   TabIndex         =   22
   Top              =   4500
   Width            =   4395
End
Begin Label Version
   Alignment        =   2  'Center
   BackStyle        =   0  'Transparent
   Caption          =   "Version"
   FontBold         =   -1  'True
   FontItalic       =   -1  'True
   FontName         =   "Arial"
   FontSize         =   15.75
   FontStrikethru   =   0   'False
   FontUnderline    =   0   'False
   ForeColor        =   &H00800000&
   Height           =   435
   Left             =   5100
   TabIndex         =   21
   Top              =   4080
   Width            =   4395
End
Begin Label Label3
   Alignment        =   2  'Center
   BackStyle        =   0  'Transparent
   Caption          =   "Interface"
   FontBold         =   -1  'True
   FontItalic       =   0   'False
   FontName         =   "Arial"
   FontSize         =   21
   FontStrikethru   =   0   'False
   FontUnderline    =   0   'False
   ForeColor        =   &H00800000&
   Height           =   435
   Left             =   5100
   TabIndex         =   20
   Top              =   3600
   Width            =   4395
End
Begin Label Title
   Alignment        =   2  'Center
   BackStyle        =   0  'Transparent
   Caption          =   "JL-5000 Software"
   FontBold         =   -1  'True
   FontItalic       =   0   'False
   FontName         =   "Arial"
   FontSize         =   21
   FontStrikethru   =   0   'False
```

```
      FontUnderline    =   0    'False
      ForeColor        =   &H00800000&
      Height           =   435
      Left             =   5160
      TabIndex         =   19
      Top              =   3180
      Width            =   4395
   End
   Begin Label Label2
      Alignment        =   2   'Center
      BackStyle        =   0   'Transparent
      Caption          =   "SOFTWARE SETUP"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00800000&
      Height           =   615
      Index            =   1
      Left             =   120
      TabIndex         =   17
      Top              =   120
      Width            =   4815
   End
End
Dim SoftWord As String
Dim PMode As Integer 'True = Admin; False = User
Dim PMatch As Integer

Sub AdminPassword_Click ()
'Disable Buttons
    Buttons False

'Clear any old Passwords
    SoftWord = ""

'Change PTitle
    PTitle.FontSize = 13.5
    PTitle = "Enter Current Admin. Password:"

'Wait for response
    PMatch = False
    Do Until PMatch = True
        DoEvents
    Loop

'Check Results
    P$ = ReadAdminPassword()
    If P$ <> SoftWord Then
        msg$ = "Incorrect Password." & Chr$(13)
        msg$ = msg$ & "This violation has been noted in the security log." &
Chr$(13)
         'Update Security Log
            FF% = FreeFile
            Open Path$ & "Security.log" For Append As FF%
            Print #FF%, Format$(Now - z, "yyyy/mm/dd hh:mmam/pm") & " = " &
"Administrative Password Incorrect during Administrative Change."
            Close FF%
        MsgBox msg$, 0, "Security Violation"
        SoftWord = ""
        Buttons True
        Exit Sub
        End If

'Change PTitle
    PTitle = "Enter New Admin. Password:"
    PWord = ""
    SoftWord = ""

'Wait for response
```

```
    PMatch = False
    Do Until PMatch <> False
        DoEvents
    Loop

'Confirm New Password
    NewAdmin$ = SoftWord

'Change PTitle
    PTitle = "Confirm New Admin. Password:"
    PWord = ""
    SoftWord = ""

'Wait for response
    PMatch = False
    Do Until PMatch <> False
        DoEvents
    Loop

'Write New Password
    If NewAdmin$ <> SoftWord Then
        msg$ = "Confirmation of Password did not match" & Chr$(13) & "the new
password as originally entered." & Chr$(13)
        msg$ = msg$ & "Please try again."
        MsgBox msg$, 0, "Password Confirmation Failure"
        SoftWord = ""
        PMatch = 1
        Buttons True
        Exit Sub
        End If

'Write New Password
    r% = WriteAdminPassword(SoftWord)
    PWord = ""
    If r% <> False Then
        MsgBox "Administrative Password successfully changed.", 0, "Change Admin.
Password"
        Else
        MsgBox "Computer error updating password.", 0, "Change Admin. Password"
        End If

'Reinstate Buttons
    SoftWord = ""
    Buttons True

End Sub

Sub Buttons (ByVal V As Integer)

AdminPassword.Enabled = V
UserPassword.Enabled = V
MechanicPassword.Enabled = V
ExitButton.Enabled = V

'Change Number Buttons and Enter Button
    For z = 0 To 9
        Command3D2(z).Enabled = Not V
    Next z
    EnterButton.Enabled = Not V

If V = True Then
    PTitle.Caption = ""
    PWord = ""
    End If



End Sub

Sub Command3D17_Click ()
```

```
End Sub

Sub Command3D18_Click ()

End Sub

Sub Command3D2_Click (Index As Integer)
SoftWord = SoftWord & Format$(Index)
PWord = String$(Len(SoftWord), "*")
End Sub

Sub EnterButton_Click ()

'Show that there was a match
    PMatch = True

End Sub

Sub ExitButton_Click ()
PMatch = 1
Software3.Show
Unload Me
End Sub

Sub Form_KeyDown (KeyCode As Integer, Shift As Integer)
GlobalKeyDown KeyCode, Shift
End Sub

Sub Form_Load ()
'Setup This Form
    SetUpWindow Me, "SoftwareSetup"

'CenterControls
    'CenterControl Command3D4, Me.Width, Me.Height

'Title
    SoftwareVersion W$, V!, D$
    Version = Trim$(Version) & " " & W$
    PTitle = ""

If UserIsHere% <> 1 Then AdminPassword.Visible = False
End Sub

Sub MechanicPassword_Click ()
'Disable Buttons
    Buttons False

'Clear any old Passwords
    SoftWord = ""

'Change PTitle
    PTitle.FontSize = 13.5
    If UserIsHere% <> 1 Then
        PTitle = "Enter Current Mech. Password:"
        Else
        PTitle = "Enter Current Admin. Password:"
        End If

'Wait for response
    PMatch = False
    Do Until PMatch = True
        DoEvents
    Loop

'Check Results
    If UserIsHere% <> 1 Then
        P$ = ReadMechPassword()
        Else
        P$ = ReadAdminPassword()
        End If

    If P$ <> SoftWord Then
```

```
        msg$ = "Incorrect Password." & Chr$(13)
        msg$ = msg$ & "This violation has been noted in the security log." &
Chr$(13)
        'Update Security Log
            FF% = FreeFile
            Open Path$ & "Security.log" For Append As FF%

            If UserIsHere% <> 1 Then
                Print #FF%, Format$(Now - z, "yyyy/mm/dd hh:mmam/pm") & " = " &
"Mech. Password Incorrect during User Password Change"
                Else
                Print #FF%, Format$(Now - z, "yyyy/mm/dd hh:mmam/pm") & " = " &
"Admin. Password Incorrect during User Password Change"
                End If

            Close FF%
        MsgBox msg$, 0, "Security Violation"
        SoftWord = ""
        Buttons True
        Exit Sub
        End If

'Change PTitle
    PTitle.FontSize = 13.5
    PTitle = "Enter New Mech. Password:"
    PWord = ""
    SoftWord = ""

'Wait for response
    PMatch = False
    Do Until PMatch <> False
        DoEvents
    Loop

'Confirm New Password
    NewAdmin$ = SoftWord

'Change PTitle
    PTitle = "Confirm New Mech. Password:"
    PWord = ""
    SoftWord = ""

'Wait for response
    PMatch = False
    Do Until PMatch <> False
        DoEvents
    Loop

'Write New Password
    If NewAdmin$ <> SoftWord Then
        msg$ = "Confirmation of Password did not match" & Chr$(13) & "the new
password as originally entered." & Chr$(13)
        msg$ = msg$ & "Please try again."
        MsgBox msg$, 0, "Password Confirmation Failure"
        SoftWord = ""
        PMatch = 1
        Buttons True
        Exit Sub
        End If

'Write New Password
    r% = WriteMechPassword(SoftWord)
    PWord = ""
    If r% <> False Then
        MsgBox "User Password successfully changed.", 0, "Change User Password"
        Else
        MsgBox "Computer error updating password.", 0, "Change User Password"
        End If

'Reinstate Buttons
    SoftWord = ""
    Buttons True
```

```
End Sub

Sub UserPassword_Click ()
'Disable Buttons
    Buttons False

'Clear any old Passwords
    SoftWord = ""

'Change PTitle
    PTitle.FontSize = 13.5
    If UserIsHere% <> 1 Then
        PTitle = "Enter Current Mech. Password:"
        Else
        PTitle = "Enter Current Admin. Password:"
        End If

'Wait for response
    PMatch = False
    Do Until PMatch = True
        DoEvents
    Loop

'Check Results
    If UserIsHere% <> 1 Then
        P$ = ReadMechPassword()
        Else
        P$ = ReadAdminPassword()
        End If

    If P$ <> SoftWord Then
        msg$ = "Incorrect Password." & Chr$(13)
        msg$ = msg$ & "This violation has been noted in the security log." &
Chr$(13)
        'Update Security Log
            FF% = FreeFile
            Open Path$ & "Security.log" For Append As FF%
            If UserIsHere% <> 1 Then
                Print #FF%, Format$(Now - z, "yyyy/mm/dd hh:mmam/pm") & " = " &
"Mech. Password Incorrect during User Password Change"
                Else
                Print #FF%, Format$(Now - z, "yyyy/mm/dd hh:mmam/pm") & " = " &
"Admin. Password Incorrect during User Password Change"
                End If
            Close FF%
        MsgBox msg$, 0, "Security Violation"
        SoftWord = ""
        Buttons True
        Exit Sub
        End If

'Change PTitle
    PTitle.FontSize = 13.5
    PTitle = "Enter New User Password:"
    PWord = ""
    SoftWord = ""

'Wait for response
    PMatch = False
    Do Until PMatch <> False
        DoEvents
    Loop

'Confirm New Password
    NewAdmin$ = SoftWord

'Change PTitle
    PTitle = "Confirm New User Password:"
    PWord = ""
    SoftWord = ""
```

```
'Wait for response
    PMatch = False
    Do Until PMatch <> False
        DoEvents
    Loop

'Write New Password
    If NewAdmin$ <> SoftWord Then
        msg$ = "Confirmation of Password did not match" & Chr$(13) & "the new
password as originally entered." & Chr$(13)
        msg$ = msg$ & "Please try again."
        MsgBox msg$, 0, "Password Confirmation Failure"
        SoftWord = ""
        PMatch = 1
        Buttons True
        Exit Sub
        End If

'Write New Password
    r% = WriteUserPassword(SoftWord)
    PWord = ""
    If r% <> False Then
        MsgBox "User Password successfully changed.", 0, "Change User Password"
        Else
        MsgBox "Computer error updating password.", 0, "Change User Password"
        End If

'Reinstate Buttons
    SoftWord = ""
    Buttons True

End Sub
```

```
VERSION 2.00
Begin Form SPattern
   BackColor        =   &H00FFFF00&
   BorderStyle      =   1  'Fixed Single
   Caption          =   "Stitch Pattern"
   ClientHeight     =   7545
   ClientLeft       =   30
   ClientTop        =   1545
   ClientWidth      =   10335
   ControlBox       =   0   'False
   Height           =   7950
   KeyPreview       =   -1  'True
   Left             =   -30
   LinkTopic        =   "Form7"
   MaxButton        =   0   'False
   MinButton        =   0   'False
   ScaleHeight      =   7545
   ScaleWidth       =   10335
   Top              =   1200
   Width            =   10455
   Begin SSCommand Command3D4
      BevelWidth       =   10
      Caption          =   "View Slow Motion"
      FontBold         =   -1  'True
      FontItalic       =   0   'False
      FontName         =   "Arial"
      FontSize         =   15.75
      FontStrikethru   =   0   'False
      FontUnderline    =   0   'False
      ForeColor        =   &H00FF0000&
      Height           =   1035
      Left             =   6480
      TabIndex         =   15
      Top              =   4560
      Width            =   3015
   End
   Begin SSCommand ScaleButton
      BevelWidth       =   10
      Caption          =   "+"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00FF0000&
      Height           =   975
      Index            =   3
      Left             =   4320
      TabIndex         =   14
      Top              =   5880
      Width            =   1575
   End
   Begin HScrollBar ScrollBar
      Height           =   375
      Index            =   1
      Left             =   1920
      Max              =   200
      Min              =   50
      TabIndex         =   13
      Top              =   6240
      Value            =   100
      Width            =   2295
   End
   Begin SSCommand ScaleButton
      BevelWidth       =   10
      Caption          =   "-"
      FontBold         =   -1  'True
      FontItalic       =   0   'False
      FontName         =   "Arial"
      FontSize         =   24
      FontStrikethru   =   0   'False
```

```
   FontUnderline    =   0   'False
   ForeColor        =   &H00FF0000&
   Height           =   975
   Index            =   2
   Left             =   240
   TabIndex         =   12
   Top              =   5880
   Width            =   1575
End
Begin SSCommand ScaleButton
   BevelWidth       =   10
   Caption          =   "-"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H00FF0000&
   Height           =   975
   Index            =   0
   Left             =   240
   TabIndex         =   10
   Top              =   4440
   Width            =   1575
End
Begin HScrollBar ScrollBar
   Height           =   375
   Index            =   0
   Left             =   1920
   Max              =   100
   Min              =   50
   TabIndex         =   9
   Top              =   4800
   Value            =   100
   Width            =   2295
End
Begin SSCommand ScaleButton
   BevelWidth       =   10
   Caption          =   "+"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H00FF0000&
   Height           =   975
   Index            =   1
   Left             =   4320
   TabIndex         =   8
   Top              =   4440
   Width            =   1575
End
Begin ListBox List1
   Height           =   225
   Left             =   1920
   TabIndex         =   7
   Top              =   6960
   Visible          =   0   'False
   Width            =   2055
End
Begin PictureBox P
   BorderStyle      =   0  'None
   DrawWidth        =   2
   FillStyle        =   0  'Solid
   ForeColor        =   &H000000FF&
   Height           =   2235
   Left             =   240
   ScaleHeight      =   9.386
   ScaleMode        =   0  'User
   ScaleWidth       =   11.463
```

```
   TabIndex          =   6
   Top               =   1800
   Width             =   5589
End
Begin SSCommand Command3D1
   BevelWidth        =   10
   Caption           =   "CREATE STITCH"
   FontBold          =   -1  'True
   FontItalic        =   0   'False
   FontName          =   "Arial"
   FontSize          =   15.75
   FontStrikethru    =   0   'False
   FontUnderline     =   0   'False
   ForeColor         =   &H00FF0000&
   Height            =   1335
   Left              =   6480
   TabIndex          =   5
   Top               =   3000
   Width             =   3015
End
Begin SSCommand Command3D3
   BevelWidth        =   10
   Caption           =   "SELECT STITCH"
   FontBold          =   -1  'True
   FontItalic        =   0   'False
   FontName          =   "Arial"
   FontSize          =   15.75
   FontStrikethru    =   0   'False
   FontUnderline     =   0   'False
   ForeColor         =   &H00FF0000&
   Height            =   1335
   Left              =   6480
   TabIndex          =   4
   Top               =   1440
   Width             =   3015
End
Begin SSCommand Command3D2
   BevelWidth        =   10
   Caption           =   "EXIT"
   FontBold          =   -1  'True
   FontItalic        =   0   'False
   FontName          =   "Arial"
   FontSize          =   24
   FontStrikethru    =   0   'False
   FontUnderline     =   0   'False
   ForeColor         =   &H000000FF&
   Height            =   1035
   Left              =   6480
   TabIndex          =   0
   Top               =   5820
   Width             =   3015
End
Begin Label Label3
   Alignment         =   2   'Center
   BackStyle         =   0   'Transparent
   Caption           =   "STITCH SCALE"
   FontBold          =   -1  'True
   FontItalic        =   0   'False
   FontName          =   "MS Sans Serif"
   FontSize          =   12
   FontStrikethru    =   0   'False
   FontUnderline     =   0   'False
   Height            =   255
   Left              =   1920
   TabIndex          =   3
   Top               =   5880
   Width             =   2295
End
Begin Label Label4
   Alignment         =   2   'Center
   BackStyle         =   0   'Transparent
   Caption           =   "STITCH SCALE"
```

```
      FontBold          =   -1  'True
      FontItalic        =   0   'False
      FontName          =   "MS Sans Serif"
      FontSize          =   12
      FontStrikethru    =   0   'False
      FontUnderline     =   0   'False
      Height            =   255
      Left              =   1920
      TabIndex          =   11
      Top               =   4440
      Width             =   2295
   End
   Begin Label Label1
      Alignment         =   2  'Center
      BackStyle         =   0  'Transparent
      Caption           =   "TICE ENGINEERING - JL-5000"
      FontBold          =   -1  'True
      FontItalic        =   0   'False
      FontName          =   "Arial"
      FontSize          =   24
      FontStrikethru    =   0   'False
      FontUnderline     =   0   'False
      ForeColor         =   &H00800000&
      Height            =   615
      Index             =   1
      Left              =   1320
      TabIndex          =   2
      Top               =   240
      Width             =   7095
   End
   Begin Label Label1
      BackColor         =   &H00FF0000&
      BackStyle         =   0  'Transparent
      Caption           =   "SELECTED STITCH"
      FontBold          =   -1  'True
      FontItalic        =   0   'False
      FontName          =   "Arial"
      FontSize          =   18
      FontStrikethru    =   0   'False
      FontUnderline     =   0   'False
      ForeColor         =   &H00FF0000&
      Height            =   375
      Index             =   0
      Left              =   360
      TabIndex          =   1
      Top               =   1320
      Width             =   3855
   End
End
Dim DownFlag%, OrgScaleX As Single, OrgScaleY As Single


Sub Command3D1_Click ()
CameFromSPattern% = True
StitchMaker.Show
Unload Me
End Sub

Sub Command3D2_Click ()
'Save Scale  Setting
    success% = WriteStitchScaleX(StitchScaleX)
    success% = WriteStitchScaleY(StitchScaleY)

'Ask if user wishes to make scale settings the default value for current stitch
    If OrgScaleX <> StitchScaleX Or OrgScaleY <> StitchScaleY Then
        m$ = "Do you wish to make the current stitch scale the default"
        m$ = m$ & Chr$(13) & Chr$(10) & "scale for the current stitch?"
        r% = YN(m$, "Stitch Scale")
        If r% = True Then
            ChangeStitchScaleInFile CurrentStitch$, StitchScaleX, StitchScaleY
            End If
        ResetGalia
```

```
        End If

If SPattern.Tag <> "Manual" Then SetupForm.Show
Unload Me

End Sub

Sub Command3D3_Click ()
Display "Loading Stitch Patterns...Please Wait."
PickStitch.Show
Display ""
Unload Me
End Sub

Sub Command3D4_Click ()

If Command3D4.Caption <> "STOP DRAWING" Then
    Command3D4.Caption = "STOP DRAWING"
    Tbuttons False
    DrawTime = .01
    DrawStitch P, List1, False, -1
    DrawTime = 0
    Else
    DrawTime = 0
    End If

Command3D4.Caption = "View Slow Motion"
Tbuttons True
End Sub

Sub Form_Activate ()
'Load Current Stitch coordinates into listbox
    LoadStitchIntoListBox List1, CurrentStitch$

End Sub

Sub Form_KeyDown (KeyCode As Integer, Shift As Integer)
GlobalKeyDown KeyCode, Shift
End Sub

Sub Form_Load ()
SetUpWindow Me, "SPattern"

'Setup P Window
    P.Height = 2235
    P.Width = 5589

'Get Original Scale Values
    OrgScaleX = StitchScaleX
    OrgScaleY = StitchScaleY

'Check User
    If UserIsHere% = True Then
        If ReadUser1() = False Then
            Command3D1.Visible = False
            Command3D4.Top = Command3D1.Top
            Command3D4.Height = Command3D1.Height
            Command3D2.Top = Command3D2.Top - Abs(Command3D2.Height -
Command3D1.Height)
            Command3D2.Height = Command3D1.Height
            End If
        End If

'Set Title
    Label1(1).Left = (Me.Width / 2) - (Label1(1).Width / 2)
    ScrollBar(0).Value = StitchScaleX
    ScrollBar(1).Value = StitchScaleY
    Me.Show
    DownFlag% = True
    ScrollBar_Change 0
```

```
    ScrollBar_Change 1
    DownFlag% = False


End Sub

Sub Form_Paint ()
DrawStitch P, List1, False, -1
End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub ScaleButton_MouseDown (Index As Integer, Button As Integer, Shift As Integer, X
As Single, Y As Single)
On Error Resume Next

'set downflag
    If DownFlag% = True Then Exit Sub
    DownFlag% = True

'Get Index Values
    Select Case Index
        Case 0
            SBar% = 0
            SB_Value = -1
        Case 1
            SBar% = 0
            SB_Value = 1
        Case 2
            SBar% = 1
            SB_Value = -1
        Case 3
            SBar% = 1
            SB_Value = 1
    End Select

'change first value
    ScrollBar(SBar%).Value = ScrollBar(SBar%).Value + SB_Value
    ScrollBar(SBar%).Refresh

'allow time for mouseup
    rsleep .5

'enter loop for continous value change
    Do Until DownFlag% = False
        ScrollBar(SBar%).Value = ScrollBar(SBar%).Value + SB_Value
        ScrollBar(SBar%).Refresh
        DoEvents
    Loop

'ReDraw Stitch with new scale value
    DrawStitch P, List1, False, -1

End Sub
```

```
Sub ScaleButton_MouseUp (Index As Integer, Button As Integer, Shift As Integer, X As
Single, Y As Single)
DownFlag% = False
End Sub

Sub ScrollBar_Change (Index As Integer)
MTop% = ScrollBar(Index).Top + (ScrollBar(Index).Height * 1.25)
MLeft% = ScrollBar(Index).Left
MWidth% = ScrollBar(Index).Width
FontSize = 12
FontBold = True

'Clear Old Value
    CurrentX = MLeft%
    CurrentY = MTop%
    tmpFC# = ForeColor
    ForeColor = BackColor
    Line (MLeft%, MTop%)-(MLeft% + MWidth%, MTop% + (TextHeight("Xj") * 1.5)), , BF
    ForeColor = tmpFC#

'Print New Value
    SB$ = Format$(ScrollBar(Index).Value, "0")
    If Index = 0 Then
        SB$ = SB$ & "% of width"
        Else
        SB$ = SB$ & "% of Height"
        End If
    CurrentX = MLeft% + (MWidth% / 2) - (TextWidth(SB$) / 2)
    CurrentY = MTop%
    Print SB$

'Update Global Variable
    If Index = 0 Then
        StitchScaleX = ScrollBar(Index)
        Else
        StitchScaleY = ScrollBar(Index)
        End If

'Update Stitch Drawing
    If DownFlag% = False Then DrawStitch P, List1, False, -1

End Sub

Sub Tbuttons (ByVal Toggle%)

For z = 0 To 3: ScaleButton(z).Enabled = Toggle%: Next z
ScrollBar(0).Enabled = Toggle%
ScrollBar(1).Enabled = Toggle%
Command3D3.Enabled = Toggle%
Command3D1.Enabled = Toggle%
Command3D2.Enabled = Toggle%

End Sub
```

```
VERSION 2.00
Begin Form PickStitch
   BackColor          =   &H0000FF00&
   BorderStyle        =   1  'Fixed Single
   Caption            =   "Pick Stitch"
   ClientHeight       =   7245
   ClientLeft         =   360
   ClientTop          =   915
   ClientWidth        =   9615
   ClipControls       =   0   'False
   ControlBox         =   0   'False
   ForeColor          =   &H00808080&
   Height             =   7650
   KeyPreview         =   -1  'True
   Left               =   300
   LinkTopic          =   "Form8"
   MaxButton          =   0   'False
   MinButton          =   0   'False
   ScaleHeight        =   7245
   ScaleWidth         =   9615
   Top                =   570
   Width              =   9735
   Begin SSCommand Command3D1
      BevelWidth      =   10
      Caption         =   "EXIT"
      FontBold        =   -1  'True
      FontItalic      =   0   'False
      FontName        =   "Arial"
      FontSize        =   18
      FontStrikethru  =   0   'False
      FontUnderline   =   0   'False
      ForeColor       =   &H000000FF&
      Height          =   1215
      Left            =   7680
      TabIndex        =   33
      Top             =   5640
      Width           =   1695
   End
   Begin SSCommand S
      BevelWidth      =   10
      Caption         =   "1"
      FontBold        =   -1  'True
      FontItalic      =   0   'False
      FontName        =   "Arial"
      FontSize        =   19.5
      FontStrikethru  =   0   'False
      FontUnderline   =   0   'False
      ForeColor       =   &H00FF0000&
      Height          =   975
      Index           =   0
      Left            =   120
      TabIndex        =   1
      Top             =   960
      Width           =   615
   End
   Begin SSRibbon GroupPush3D3
      AutoSize        =   0  'None
      GroupAllowAllUp =   0   'False
      Height          =   1215
      Left            =   3600
      PictureUp       =   PSTITCH.FRX:0000
      Top             =   5640
      Width           =   1695
   End
   Begin SSRibbon GroupPush3D2
      AutoSize        =   0  'None
      GroupAllowAllUp =   0   'False
      Height          =   1215
      Left            =   1920
      PictureUp       =   PSTITCH.FRX:052A
      Top             =   5640
      Width           =   1695
```

```
End
Begin SSRibbon GroupPush3D1
   AutoSize        =   0   'None
   GroupAllowAllUp =   0   'False
   Height          =   1215
   Left            =   210
   PictureUp       =   PSTITCH.FRX:0AB4
   Top             =   5640
   Width           =   1755
End
Begin SSCommand Command3D4
   BevelWidth      =   10
   Caption         =   "UP"
   FontBold        =   -1  'True
   FontItalic      =   0   'False
   FontName        =   "Arial"
   FontSize        =   18
   FontStrikethru  =   0   'False
   FontUnderline   =   0   'False
   ForeColor       =   &H00FF0000&
   Height          =   615
   Left            =   5640
   TabIndex        =   32
   Top             =   6240
   Width           =   1695
End
Begin SSCommand Command3D3
   BevelWidth      =   10
   Caption         =   "DOWN"
   FontBold        =   -1  'True
   FontItalic      =   0   'False
   FontName        =   "Arial"
   FontSize        =   18
   FontStrikethru  =   0   'False
   FontUnderline   =   0   'False
   ForeColor       =   &H00FF0000&
   Height          =   615
   Left            =   5640
   TabIndex        =   31
   Top             =   5640
   Width           =   1695
End
Begin ListBox List1
   Height          =   225
   Left            =   1950
   TabIndex        =   22
   Top             =   7440
   Visible         =   0   'False
   Width           =   975
End
Begin FileListBox File1
   Height          =   225
   Left            =   720
   TabIndex        =   21
   Top             =   7320
   Visible         =   0   'False
   Width           =   1095
End
Begin PictureBox P
   AutoRedraw      =   -1  'True
   FillStyle       =   0   'Solid
   ForeColor       =   &H000000FF&
   Height          =   975
   Index           =   8
   Left            =   6960
   ScaleHeight     =   9
   ScaleLeft       =   -1
   ScaleMode       =   0   'User
   ScaleTop        =   -1
   ScaleWidth      =   16
   TabIndex        =   20
   Top             =   4080
```

```
   Width            =   2438
End
Begin SSCommand S
   BevelWidth       =   10
   Caption          =   "9"
   FontBold         =   -1  'True
   FontItalic       =   0   'False
   FontName         =   "Arial"
   FontSize         =   19.5
   FontStrikethru   =   0   'False
   FontUnderline    =   0   'False
   ForeColor        =   &H00FF0000&
   Height           =   975
   Index            =   8
   Left             =   6360
   TabIndex         =   19
   Top              =   4080
   Width            =   615
End
Begin PictureBox P
   AutoRedraw       =   -1  'True
   FillStyle        =   0  'Solid
   ForeColor        =   &H000000FF&
   Height           =   975
   Index            =   7
   Left             =   6960
   ScaleHeight      =   9
   ScaleLeft        =   -1
   ScaleMode        =   0  'User
   ScaleTop         =   -1
   ScaleWidth       =   16
   TabIndex         =   18
   Top              =   2520
   Width            =   2438
End
Begin SSCommand S
   BevelWidth       =   10
   Caption          =   "8"
   FontBold         =   -1  'True
   FontItalic       =   0   'False
   FontName         =   "Arial"
   FontSize         =   19.5
   FontStrikethru   =   0   'False
   FontUnderline    =   0   'False
   ForeColor        =   &H00FF0000&
   Height           =   975
   Index            =   7
   Left             =   6360
   TabIndex         =   17
   Top              =   2520
   Width            =   615
End
Begin PictureBox P
   AutoRedraw       =   -1  'True
   FillStyle        =   0  'Solid
   ForeColor        =   &H000000FF&
   Height           =   975
   Index            =   6
   Left             =   6960
   ScaleHeight      =   9
   ScaleLeft        =   -1
   ScaleMode        =   0  'User
   ScaleTop         =   -1
   ScaleWidth       =   16
   TabIndex         =   16
   Top              =   960
   Width            =   2438
End
Begin SSCommand S
   BevelWidth       =   10
   Caption          =   "7"
   FontBold         =   -1  'True
```

```
   FontItalic        =   0   'False
   FontName          =   "Arial"
   FontSize          =   19.5
   FontStrikethru    =   0   'False
   FontUnderline     =   0   'False
   ForeColor         =   &H00FF0000&
   Height            =   975
   Index             =   6
   Left              =   6360
   TabIndex          =   15
   Top               =   960
   Width             =   615
End
Begin PictureBox P
   AutoRedraw        =   -1  'True
   FillStyle         =   0  'Solid
   ForeColor         =   &H000000FF&
   Height            =   975
   Index             =   5
   Left              =   3840
   ScaleHeight       =   9
   ScaleLeft         =   -1
   ScaleMode         =   0  'User
   ScaleTop          =   -1
   ScaleWidth        =   16
   TabIndex          =   14
   Top               =   4080
   Width             =   2438
End
Begin SSCommand S
   BevelWidth        =   10
   Caption           =   "6"
   FontBold          =   -1  'True
   FontItalic        =   0   'False
   FontName          =   "Arial"
   FontSize          =   19.5
   FontStrikethru    =   0   'False
   FontUnderline     =   0   'False
   ForeColor         =   &H00FF0000&
   Height            =   975
   Index             =   5
   Left              =   3240
   TabIndex          =   13
   Top               =   4080
   Width             =   615
End
Begin PictureBox P
   AutoRedraw        =   -1  'True
   FillStyle         =   0  'Solid
   ForeColor         =   &H000000FF&
   Height            =   975
   Index             =   4
   Left              =   3840
   ScaleHeight       =   9
   ScaleLeft         =   -1
   ScaleMode         =   0  'User
   ScaleTop          =   -1
   ScaleWidth        =   16
   TabIndex          =   12
   Top               =   2520
   Width             =   2438
End
Begin SSCommand S
   BevelWidth        =   10
   Caption           =   "5"
   FontBold          =   -1  'True
   FontItalic        =   0   'False
   FontName          =   "Arial"
   FontSize          =   19.5
   FontStrikethru    =   0   'False
   FontUnderline     =   0   'False
   ForeColor         =   &H00FF0000&
```

```
   Height          =   975
   Index           =   4
   Left            =   3240
   TabIndex        =   11
   Top             =   2520
   Width           =   615
End
Begin PictureBox P
   AutoRedraw      =   -1  'True
   FillStyle       =   0  'Solid
   ForeColor       =   &H000000FF&
   Height          =   975
   Index           =   3
   Left            =   3840
   ScaleHeight     =   9
   ScaleLeft       =   -1
   ScaleMode       =   0  'User
   ScaleTop        =   -1
   ScaleWidth      =   16
   TabIndex        =   10
   Top             =   960
   Width           =   2438
End
Begin SSCommand S
   BevelWidth      =   10
   Caption         =   "4"
   FontBold        =   -1  'True
   FontItalic      =   0   'False
   FontName        =   "Arial"
   FontSize        =   19.5
   FontStrikethru  =   0   'False
   FontUnderline   =   0   'False
   ForeColor       =   &H00FF0000&
   Height          =   975
   Index           =   3
   Left            =   3240
   TabIndex        =   9
   Top             =   960
   Width           =   615
End
Begin PictureBox P
   AutoRedraw      =   -1  'True
   FillStyle       =   0  'Solid
   ForeColor       =   &H000000FF&
   Height          =   975
   Index           =   2
   Left            =   720
   ScaleHeight     =   9
   ScaleLeft       =   -1
   ScaleMode       =   0  'User
   ScaleTop        =   -1
   ScaleWidth      =   16
   TabIndex        =   8
   Top             =   4080
   Width           =   2438
End
Begin SSCommand S
   BevelWidth      =   10
   Caption         =   "3"
   FontBold        =   -1  'True
   FontItalic      =   0   'False
   FontName        =   "Arial"
   FontSize        =   19.5
   FontStrikethru  =   0   'False
   FontUnderline   =   0   'False
   ForeColor       =   &H00FF0000&
   Height          =   975
   Index           =   2
   Left            =   120
   TabIndex        =   7
   Top             =   4080
   Width           =   615
```

```
End
Begin PictureBox P
   AutoRedraw       =   -1  'True
   FillStyle        =   0  'Solid
   ForeColor        =   &H000000FF&
   Height           =   975
   Index            =   1
   Left             =   720
   ScaleHeight      =   9
   ScaleLeft        =   -1
   ScaleMode        =   0  'User
   ScaleTop         =   -1
   ScaleWidth       =   16
   TabIndex         =   6
   Top              =   2520
   Width            =   2438
End
Begin SSCommand S
   BevelWidth       =   10
   Caption          =   "2"
   FontBold         =   -1  'True
   FontItalic       =   0   'False
   FontName         =   "Arial"
   FontSize         =   19.5
   FontStrikethru   =   0   'False
   FontUnderline    =   0   'False
   ForeColor        =   &H00FF0000&
   Height           =   975
   Index            =   1
   Left             =   120
   TabIndex         =   5
   Top              =   2520
   Width            =   615
End
Begin PictureBox P
   AutoRedraw       =   -1  'True
   FillStyle        =   0  'Solid
   ForeColor        =   &H000000FF&
   Height           =   975
   Index            =   0
   Left             =   720
   ScaleHeight      =   9
   ScaleLeft        =   -1
   ScaleMode        =   0  'User
   ScaleTop         =   -1
   ScaleWidth       =   16
   TabIndex         =   0
   Top              =   960
   Width            =   2438
End
Begin Label Label3
   Alignment        =   2  'Center
   BackStyle        =   0  'Transparent
   Caption          =   "Pattern"
   Height           =   255
   Index            =   8
   Left             =   6990
   TabIndex         =   4
   Top              =   5130
   Width            =   2415
End
Begin Label Label3
   Alignment        =   2  'Center
   BackStyle        =   0  'Transparent
   Caption          =   "Pattern"
   Height           =   255
   Index            =   7
   Left             =   6960
   TabIndex         =   30
   Top              =   3600
   Width            =   2415
End
```

```
Begin Label Label3
   Alignment        =   2  'Center
   BackStyle        =   0  'Transparent
   Caption          =   "Pattern"
   Height           =   255
   Index            =   6
   Left             =   6960
   TabIndex         =   29
   Top              =   2040
   Width            =   2415
End
Begin Label Label3
   Alignment        =   2  'Center
   BackStyle        =   0  'Transparent
   Caption          =   "Pattern"
   Height           =   255
   Index            =   5
   Left             =   3840
   TabIndex         =   28
   Top              =   5130
   Width            =   2415
End
Begin Label Label3
   Alignment        =   2  'Center
   BackStyle        =   0  'Transparent
   Caption          =   "Pattern"
   Height           =   255
   Index            =   4
   Left             =   3840
   TabIndex         =   27
   Top              =   3600
   Width            =   2415
End
Begin Label Label3
   Alignment        =   2  'Center
   BackStyle        =   0  'Transparent
   Caption          =   "Pattern"
   Height           =   255
   Index            =   3
   Left             =   3840
   TabIndex         =   26
   Top              =   2040
   Width            =   2415
End
Begin Label Label3
   Alignment        =   2  'Center
   BackStyle        =   0  'Transparent
   Caption          =   "Pattern"
   Height           =   255
   Index            =   2
   Left             =   720
   TabIndex         =   25
   Top              =   5160
   Width            =   2415
End
Begin Label Label3
   Alignment        =   2  'Center
   BackStyle        =   0  'Transparent
   Caption          =   "Pattern"
   Height           =   255
   Index            =   1
   Left             =   600
   TabIndex         =   24
   Top              =   3600
   Width            =   2535
End
Begin Label Label3
   Alignment        =   2  'Center
   BackStyle        =   0  'Transparent
   Caption          =   "Pattern"
   Height           =   255
   Index            =   0
```

```
      Left            =   720
      TabIndex        =   23
      Top             =   2040
      Width           =   2415
   End
   Begin Label Label2
      Alignment       =   2   'Center
      BackStyle       =   0   'Transparent
      Caption         =   "JL-5000"
      FontBold        =   -1   'True
      FontItalic      =   0    'False
      FontName        =   "Arial"
      FontSize        =   24
      FontStrikethru  =   0    'False
      FontUnderline   =   0    'False
      ForeColor       =   &H00800000&
      Height          =   615
      Index           =   1
      Left            =   6120
      TabIndex        =   3
      Top             =   120
      Width           =   2055
   End
   Begin Label Label1
      Alignment       =   2   'Center
      BackStyle       =   0   'Transparent
      Caption         =   "TICE ENGINEERING"
      FontBold        =   -1   'True
      FontItalic      =   0    'False
      FontName        =   "Arial"
      FontSize        =   24
      FontStrikethru  =   0    'False
      FontUnderline   =   0    'False
      ForeColor       =   &H00800000&
      Height          =   615
      Index           =   1
      Left            =   1320
      TabIndex        =   2
      Top             =   120
      Width           =   4695
   End
   Begin Image Image1
      Height          =   480
      Index           =   0
      Left            =   8280
      Picture         =   PSTITCH.FRX:11E2
      Top             =   120
      Width           =   480
   End
   Begin Image Image1
      Height          =   480
      Index           =   1
      Left            =   720
      Picture         =   PSTITCH.FRX:14E4
      Top             =   120
      Width           =   480
   End
End
Dim PickFile$

Dim FirstStitch%

Dim CurrentButton%


Sub Command3D1_Click ()
If Dir$(CurrentStitch$) = "" Then
    CurrentStitch$ = Path$ & File1.List(0)
    End If

SPattern.Show
Unload Me
```

```
End Sub

Sub Command3D3_Click ()
If FirstStitch% - 9 > -1 Then
    FirstStitch% = FirstStitch% - 9 'up one page
    LoadStitchesIntoBoxes
    If GroupPush3D2.Value Then GroupPush3D2_click True
    If GroupPush3D3.Value Then GroupPush3D3_click True
    End If

End Sub

Sub Command3D4_Click ()
If FirstStitch% + 9 <= File1.ListCount - 1 Then
    FirstStitch% = FirstStitch% + 9 'up one page
    LoadStitchesIntoBoxes
    If GroupPush3D2.Value Then GroupPush3D2_click True
    If GroupPush3D3.Value Then GroupPush3D3_click True

    End If


End Sub

Sub DeleteStitch ()
On Error Resume Next

If CurrentButton% + FirstStitch% < Presets Then
    MsgBox "Cannot delete factory preset patterns.", 0, "Delete Stitch Pattern"
    Exit Sub
    End If

Display "Deleting Stitch...Please Wait."

Kill PickFile$

File1.Refresh


If P(0).Tag = PickFile$ Then
    FirstStitch% = FirstStitch% - 9
    End If

LoadStitchesIntoBoxes
Display ""
End Sub

Sub EditStitch ()
Display "Loading Pattern to edit...Please Wait."
Load StitchMaker

LoadStitchIntoListBox StitchMaker.List1, PickFile$
StitchMaker.Tag = PickFile$


StitchMaker.Show
Display ""
Unload Me


End Sub

Sub Form_KeyDown (KeyCode As Integer, Shift As Integer)
GlobalKeyDown KeyCode, Shift
End Sub

Sub Form_Load ()
 SetUpWindow Me, "PickStitch"

GroupPush3D1.Value = True
```

```
'Refresh Files
    'Path = app.Path
    'If Right$(Path$, 1) <> "\" Then Path$ = Path$ & "\"
    File1.Path = Path$
    File1.Pattern = "*.sti"
    File1.Refresh

'Check User
    If UserIsHere% = True Then
        If ReadUser1() = False Then
            GroupPush3D1.Visible = False
            GroupPush3D2.Visible = False
            GroupPush3D3.Visible = False
            End If
        Else
        GroupPush3D1.Visible = True
        GroupPush3D2.Visible = True
        GroupPush3D3.Visible = True
        End If


'Load First Stitches
    LoadStitchesIntoBoxes

End Sub

Sub GroupPush3D1_Click (Value As Integer)
For z = 0 To 8
S(z).Caption = ""
Next

End Sub

Sub GroupPush3D2_click (Value As Integer)
For z = 0 To 8
If P(z).Tag <> "" Then S(z).Caption = "E" Else S(z).Caption = ""
Next


End Sub

Sub GroupPush3D3_click (Value As Integer)
For z = 0 To 8
If P(z).Tag <> "" Then S(z).Caption = "R" Else S(z).Caption = ""
Next

End Sub

Sub LoadStitch (file$, N%, PNum%)

LoadStitchIntoListBox List1, file$
DrawStitch P(N%), List1, 100, -1
Label3(N%) = "Pattern #" & Format$(PNum% + 1) & " - " & Format$(List1.ListCount - 1)
& " stitches"


End Sub

Sub LoadStitchesIntoBoxes ()
'Global FirstStitch%

Dim NumberOfStitchesOnCurrentPage%, LastStitch%

LastStitch% = File1.ListCount - 1

If FirstStitch% + 8 < LastStitch% Then
     'then there are a full 9 stitches to show
     NumberOfStitchesOnCurrentPage% = 9
     Command3D4.Enabled = True
     Else
     'There are less than 9 stitches on this page
     NumberOfStitchesOnCurrentPage% = LastStitch% - FirstStitch% + 1
```

```
    Command3D4.Enabled = False
    End If

Counter% = 0
For z% = FirstStitch% To FirstStitch% + NumberOfStitchesOnCurrentPage% - 1
    file$ = Path$ & File1.List(z%)
    'MsgBox file$
    P(Counter%).Tag = file$
    LoadStitch file$, Counter%, z%
    Counter% = Counter% + 1
Next z%

For z% = Counter% To 8
    P(z%).Tag = ""
    P(z%).Cls
    Label3(z%) = ""
    Next

If FirstStitch% = 0 Then
    Command3D3.Enabled = False
    Else
    Command3D3.Enabled = True
    End If


End Sub

Sub P_Click (Index As Integer)
If P(Index).Tag = "" Then Exit Sub
PickFile$ = P(Index).Tag
End Sub

Sub S_Click (Index As Integer)

If P(Index).Tag = "" Then Exit Sub

CurrentButton% = Index

PickFile$ = P(Index).Tag

Select Case S(Index).Caption
    Case "E"
        EditStitch
    Case ""
        SelectStitch
    Case "R"
        DeleteStitch
    Case Else
End Select
End Sub

Sub SelectStitch ()
'On Error Resume Next

Display "Loading Stitch...Please Wait."

CurrentStitch$ = PickFile$
x% = WriteCurrentStitch(CurrentStitch$)

LoadStitchIntoListBox List1, CurrentStitch$
StitchScaleX = DefaultScaleX
StitchScaleY = DefaultScaleY

ResetGalia
SPattern.Show
Display ""
Unload Me

End Sub
```

```
VERSION 2.00
Begin Form StitchMaker
   BackColor        =   &H00FFFF80&
   BorderStyle      =   1  'Fixed Single
   Caption          =   "Stitch Maker"
   ClientHeight     =   7935
   ClientLeft       =   480
   ClientTop        =   1590
   ClientWidth      =   10170
   ControlBox       =   0   'False
   Height           =   8340
   KeyPreview       =   -1  'True
   Left             =   420
   LinkTopic        =   "Form6"
   MaxButton        =   0   'False
   MinButton        =   0   'False
   ScaleHeight      =   7935
   ScaleWidth       =   10170
   Top              =   1245
   Width            =   10290
   Begin CommandButton Command3
      Caption          =   "DELETE"
      FontBold         =   -1  'True
      FontItalic       =   0   'False
      FontName         =   "Arial"
      FontSize         =   9.75
      FontStrikethru   =   0   'False
      FontUnderline    =   0   'False
      Height           =   795
      Left             =   4140
      TabIndex         =   4
      Top              =   6360
      Width            =   1455
   End
   Begin CommandButton Command2
      Caption          =   "INSERT"
      FontBold         =   -1  'True
      FontItalic       =   0   'False
      FontName         =   "Arial"
      FontSize         =   9.75
      FontStrikethru   =   0   'False
      FontUnderline    =   0   'False
      Height           =   795
      Left             =   2160
      TabIndex         =   12
      Top              =   6360
      Width            =   1455
   End
   Begin CommandButton Command1
      Caption          =   "NEW"
      FontBold         =   -1  'True
      FontItalic       =   0   'False
      FontName         =   "Arial"
      FontSize         =   9.75
      FontStrikethru   =   0   'False
      FontUnderline    =   0   'False
      Height           =   795
      Left             =   120
      TabIndex         =   11
      Top              =   6360
      Width            =   1455
   End
   Begin ListBox List2
      Height           =   1200
      Left             =   6600
      TabIndex         =   10
      Top              =   2280
      Visible          =   0   'False
      Width            =   2175
   End
   Begin SSCommand Command3D4
      BevelWidth       =   10
```

```
    Caption          =   "UP"
    FontBold         =   -1  'True
    FontItalic       =   0   'False
    FontName         =   "MS Sans Serif"
    FontSize         =   12
    FontStrikethru   =   0   'False
    FontUnderline    =   0   'False
    ForeColor        =   &H000000FF&
    Height           =   855
    Left             =   8160
    TabIndex         =   8
    Top              =   4020
    Width            =   1395
End
Begin SSCommand Command3D5
    BevelWidth       =   10
    Caption          =   "DN"
    FontBold         =   -1  'True
    FontItalic       =   0   'False
    FontName         =   "MS Sans Serif"
    FontSize         =   12
    FontStrikethru   =   0   'False
    FontUnderline    =   0   'False
    ForeColor        =   &H000000FF&
    Height           =   855
    Left             =   8160
    TabIndex         =   9
    Top              =   5340
    Width            =   1395
End
Begin FileListBox File1
    Height           =   1005
    Left             =   6540
    TabIndex         =   5
    Top              =   1140
    Visible          =   0   'False
    Width            =   2295
End
Begin PictureBox P
    BorderStyle      =   0  'None
    DrawWidth        =   2
    FillStyle        =   0  'Solid
    ForeColor        =   &H000000FF&
    Height           =   2115
    Left             =   120
    ScaleHeight      =   8.882
    ScaleMode        =   0  'User
    ScaleWidth       =   11.217
    TabIndex         =   7
    Top              =   4020
    Width            =   5475
End
Begin ListBox List1
    Height           =   2175
    Left             =   5820
    TabIndex         =   6
    Top              =   4020
    Width            =   2175
End
Begin CommandButton Command53
    Caption          =   "UNDO"
    FontBold         =   -1  'True
    FontItalic       =   0   'False
    FontName         =   "Arial"
    FontSize         =   9.75
    FontStrikethru   =   0   'False
    FontUnderline    =   0   'False
    Height           =   855
    Left             =   9960
    TabIndex         =   3
    Top              =   6420
    Width            =   1095
```

```
  End
  Begin CommandButton Command52
     Caption          =   "SAVE STITCH"
     FontBold         =   -1   'True
     FontItalic       =   0    'False
     FontName         =   "Arial"
     FontSize         =   9.75
     FontStrikethru   =   0    'False
     FontUnderline    =   0    'False
     Height           =   375
     Left             =   3300
     TabIndex         =   2
     Top              =   7440
     Visible          =   0    'False
     Width            =   2055
  End
  Begin CommandButton Command51
     Caption          =   "EXIT"
     FontBold         =   -1   'True
     FontItalic       =   0    'False
     FontName         =   "Arial"
     FontSize         =   9.75
     FontStrikethru   =   0    'False
     FontUnderline    =   0    'False
     Height           =   795
     Left             =   5820
     TabIndex         =   1
     Top              =   6360
     Width            =   3735
  End
  Begin CommandButton A
     BackColor        =   &H00C0C0C0&
     Caption          =   "0, 0"
     FontBold         =   0    'False
     FontItalic       =   0    'False
     FontName         =   "MS Sans Serif"
     FontSize         =   8.25
     FontStrikethru   =   0    'False
     FontUnderline    =   0    'False
     Height           =   375
     Index            =   0
     Left             =   120
     TabIndex         =   0
     Top              =   180
     Width            =   540
  End
  Begin Line Line1
     Visible          =   0    'False
     X1               =   9660
     X2               =   9660
     Y1               =   0
     Y2               =   7260
  End
  Begin Line Line2
     Visible          =   0    'False
     X1               =   9660
     X2               =   0
     Y1               =   7260
     Y2               =   7260
  End
End
Dim LastButtonPushed%

Sub A_Click (Index As Integer)
On Error Resume Next
If List1.ListIndex = -1 Then
    Command1_Click
    End If

'List1.AddItem A(Index).Caption
LastButtonPushed% = Index
```

```
List1.List(List1.ListIndex) = A(Index).Caption
If List1.ListIndex = List1.ListCount - 1 Then
    List1.AddItem "<New>"
    List1.ListIndex = List1.ListCount - 1
    End If

List1_Click
'DrawStitchOnP


End Sub

Sub Command1_Click ()

List1.AddItem "<New>"
List1.ListIndex = List1.NewIndex

End Sub

Sub Command2_Click ()
On Error Resume Next

r% = ListFindExact(List1, "<New>")
If r% > -1 Then List1.RemoveItem r%


List1.AddItem ""
For z = List1.ListCount - 2 To List1.ListIndex Step -1
    List1.List(z + 1) = List1.List(z)
Next z

List1.List(List1.ListIndex) = "<New>"

DrawStitchOnP

End Sub

Sub Command3_Click ()
On Error Resume Next
r% = List1.ListIndex
List1.RemoveItem r%
Err = 0
List1.ListIndex = r% - 1
If Err Or List1.ListIndex = -1 Then
    Command1_Click
    End If
DrawStitchOnP

End Sub

Sub Command3D4_Click ()
On Error Resume Next

If List1.ListIndex = 0 Then Exit Sub

List1.ListIndex = List1.ListIndex - 1
End Sub

Sub Command3D5_Click ()
On Error Resume Next

List1.ListIndex = List1.ListIndex + 1

End Sub

Sub Command51_Click ()
r% = YN("Save Current Stitch?", "Save?")
```

```
If r% = True Then
    r2% = SaveStitch()
    If r2% = False Then Exit Sub
    End If

If CameFromSPattern% = True Then
    CameFromSPattern% = False
    SPattern.Show
    Else
    PickStitch.Show
    End If

Unload Me
End Sub

Sub Command53_Click ()
If List1.ListCount = 0 Then Exit Sub
List1.RemoveItem List1.ListCount - 1
DrawStitchOnP
End Sub

Sub DrawStitchOnP ()
On Error Resume Next

If List1.ListCount = 0 And List1.List(0) <> "<New>" Then Exit Sub

List2.Clear
For z = 0 To List1.ListCount - 1
    If List1.List(z) <> "<New>" Then
        List2.AddItem List1.List(z)
        End If
Next z


If List1.ListIndex = -1 Then List1.ListIndex = List1.ListCount - 1
Err = 0
List2.ListIndex = List1.ListIndex
If Err Then List2.ListIndex = List2.ListCount - 1

DrawStitch P, List2, 100, List2.ListIndex
End Sub

Sub Form_KeyDown (KeyCode As Integer, Shift As Integer)
GlobalKeyDown KeyCode, Shift
End Sub

Sub Form_Load ()
SetUpWindow Me, "StitchMaker"

'Label1.Left = (Me.Width / 2) - (Label1.Width / 2)

L% = A(0).Left
T% = A(0).Top
I% = 0
For zz = 0 To 14
    I% = zz * 8
    For z = 0 To 7
        zI% = z + I%
        If zI% > 0 Then
            Load A(zI%)
            A(zI%).Top = T%
            A(zI%).Left = L%
            A(zI%).Caption = Format$(zz) & ", " & Format$(z)
            A(zI%).Visible = True
            End If
    T% = T% + A(0).Height + (A(0).Height / 4)
    Next z
    L% = L% + A(0).Width + (A(0).Width / 6)
    T% = A(0).Top
Next zz

P.Height = 2235
```

```
P.Width = 5589

End Sub

Sub Form_Paint ()
DrawStitchOnP
End Sub

Sub List1_Click ()
On Error Resume Next

If List1.Text = "<New>" Then
    tmp$ = List1.List(List1.ListIndex - 1)
    Else
    tmp$ = List1.Text
    End If
Index = (Val(tmp$) * 8) + Val(Mid$(tmp$, InStr(tmp$, ",")-+ 1))

Unit% = 50
x1! = A(Index).Left - Unit%
Y1! = A(Index).Top - Unit%
x2! = x1! + A(Index).Width + (Unit% * 2)
y2! = Y1! + A(Index).Height + (Unit% * 2)

Cls
Line (x1!, Y1!)-(x2!, y2!), RGB(255, 0, 0), BF

r% = ListFindExact(List1, "<New>")
If r% > -1 And r% <> List1.ListIndex Then List1.RemoveItem r%

DrawStitchOnP
End Sub

Function SaveStitch () As Integer
On Error Resume Next

r% = ListFindExact(List1, "<New>")
If r% > -1 Then List1.RemoveItem r%


If List1.ListCount <= 1 Then
    MsgBox "A Stitch Pattern must at least have two stitches.", 0, "Can Not Save
Stitch"
    SaveStitch = False
    Exit Function
    End If

If List1.List(0) <> List1.List(List1.ListCount - 1) Then
    msg$ = "For a Stitch Pattern to be complete, the" & Chr$(13) & Chr$(10)
    msg$ = msg$ & "beginning and end stitch must be the same."
    MsgBox msg$, 0, "Can Not Save Stitch"
    SaveStitch = False
    Exit Function
    End If

'See if Stitch is a preset that is being editeded
    r% = GetStitchNumber(StitchMaker.Tag) 'returns 0 if StichMaker.tag = ""
    If r% > 0 And r% <= Presets Then
        StitchMaker.Tag = ""
        msg$ = "The stitch you are editing is a Factory Preset Stitch." & nl$
        msg$ = msg$ & "The stitch will be saved as a new stitch."
        MsgBox msg$, 0, "Save Stitch"
        End If

If StitchMaker.Tag = "" Then
    File1.Path = app.Path
    File1.Pattern = "*.sti"
    If File1.ListCount > 0 Then
        tmp$ = File1.List(File1.ListCount - 1)
        D# = Val(Left$(tmp$, InStr(tmp$, ".") - 1))
        Else
        D# = 0
```

```
        End If
    'Path$ = app.Path
    'If Right$(Path$, 1) <> "\" Then Path$ = Path$ & "\"

    file$ = Path$ & Format$(D# + 1, "00000000") & ".sti"
    Else
    file$ = StitchMaker.Tag
    End If

FF% = FreeFile
Open file$ For Output As FF%
    Print #FF%, Trim$(List1.ListCount) 'number of stitches
    Print #FF%, "100,100"
    For z = 0 To List1.ListCount - 1
        Print #FF%, List1.List(z)
    Next z

Close FF%
CurrentStitch$ = file$
DefaultScaleX = 100
DefaultScaleY = 100
StitchScaleX = DefaultScaleX
StitchScaleY = DefaultScaleY

'The following line was remmed out because I couldn't remember
'what it was for
    'sleep (2)

SaveStitch = True


End Function
```

```
VERSION 2.00
Begin Form Manual
   BackColor        =   &H00FFFF00&
   BorderStyle      =   1  'Fixed Single
   Caption          =   "Manual Mode"
   ClientHeight     =   7650
   ClientLeft       =   300
   ClientTop        =   1860
   ClientWidth      =   10590
   ControlBox       =   0   'False
   FontBold         =   -1  'True
   FontItalic       =   0   'False
   FontName         =   "MS Sans Serif"
   FontSize         =   12
   FontStrikethru   =   0   'False
   FontUnderline    =   0   'False
   Height           =   8055
   KeyPreview       =   -1  'True
   Left             =   240
   LinkTopic        =   "Form1"
   MaxButton        =   0   'False
   MinButton        =   0   'False
   ScaleHeight      =   7650
   ScaleWidth       =   10590
   Tag              =   "1"
   Top              =   1515
   Width            =   10710
   Begin Timer Timer1
      Enabled          =   0   'False
      Interval         =   100
      Left             =   9960
      Top              =   4980
   End
   Begin SSCommand Command3D15
      BevelWidth       =   10
      Caption          =   "MECH."
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H000000FF&
      Height           =   915
      Left             =   240
      TabIndex         =   41
      Top              =   3000
      Width            =   1695
   End
   Begin SSCommand Command3D14
      BevelWidth       =   10
      Caption          =   "STITCH"
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H000000FF&
      Height           =   900
      Left             =   2160
      TabIndex         =   40
      Top              =   4080
      Width            =   1695
   End
   Begin SSCommand Command3D16
      BevelWidth       =   10
      Caption          =   "BELT"
      FontBold         =   -1  'True
      FontItalic       =   0   'False
      FontName         =   "Arial"
      FontSize         =   12
```

```
   FontStrikethru  =   0    'False
   FontUnderline   =   0    'False
   ForeColor       =   &H000000FF&
   Height          =   900
   Left            =   240
   TabIndex        =   39
   Top             =   4080
   Width           =   1695
End
Begin TextBox ResponseOutput
   BackColor       =   &H00FFFF00&
   FontBold        =   -1   'True
   FontItalic      =   0    'False
   FontName        =   "Arial"
   FontSize        =   12
   FontStrikethru  =   0    'False
   FontUnderline   =   0    'False
   Height          =   1215
   Left            =   10320
   TabIndex        =   38
   Top             =   2760
   Width           =   465
End
Begin SSCommand Command3D13
   BevelWidth      =   10
   Caption         =   "AUTO"
   FontBold        =   -1   'True
   FontItalic      =   0    'False
   FontName        =   "Arial"
   FontSize        =   12
   FontStrikethru  =   0    'False
   FontUnderline   =   0    'False
   ForeColor       =   &H000000FF&
   Height          =   915
   Left            =   4080
   TabIndex        =   3
   Top             =   5160
   Width           =   1695
End
Begin PictureBox Picture1
   BackColor       =   &H00FFFF00&
   Height          =   1995
   Left            =   240
   ScaleHeight     =   1965
   ScaleWidth      =   5505
   TabIndex        =   30
   Top             =   840
   Width           =   5535
   Begin TextBox ErrX
      Height       =   288
      Left         =   3780
      TabIndex     =   9
      Top          =   120
      Width        =   1332
   End
   Begin TextBox ErrY
      Height       =   288
      Left         =   3780
      TabIndex     =   10
      Top          =   480
      Width        =   1332
   End
   Begin TextBox PosX
      Height       =   288
      Left         =   1260
      TabIndex     =   11
      Top          =   120
      Width        =   1332
   End
   Begin TextBox PosY
      Height       =   288
      Left         =   1260
```

```
   TabIndex          =   37
   Top               =   480
   Width             =   1332
End
Begin TextBox ErrZ
   Height            =   288
   Left              =   3780
   TabIndex          =   36
   Top               =   840
   Width             =   1332
End
Begin TextBox PosZ
   Height            =   288
   Left              =   1260
   TabIndex          =   35
   Top               =   840
   Width             =   1332
End
Begin TextBox PosW
   Height            =   288
   Left              =   1260
   TabIndex          =   34
   Top               =   1200
   Width             =   1332
End
Begin TextBox ErrW
   Height            =   288
   Left              =   3780
   TabIndex          =   33
   Top               =   1200
   Width             =   1332
End
Begin TextBox PosE
   Height            =   288
   Left              =   1260
   TabIndex          =   32
   Top               =   1560
   Width             =   1332
End
Begin TextBox ErrE
   Height            =   288
   Left              =   3780
   TabIndex          =   31
   Top               =   1560
   Width             =   1332
End
Begin Label Label3
   BackStyle         =   0  'Transparent
   Caption           =   "ErrorX"
   Height            =   255
   Left              =   2970
   TabIndex          =   12
   Top               =   150
   Width             =   735
End
Begin Label Label4
   BackStyle         =   0  'Transparent
   Caption           =   "ErrorY"
   Height            =   255
   Left              =   2970
   TabIndex          =   13
   Top               =   510
   Width             =   735
End
Begin Label Label5
   BackStyle         =   0  'Transparent
   Caption           =   "PosX"
   Height            =   255
   Left              =   180
   TabIndex          =   14
   Top               =   120
   Width             =   615
```

```
    End
    Begin Label Label6
       BackStyle        =   0  'Transparent
       Caption          =   "PosY"
       Height           =   255
       Left             =   180
       TabIndex         =   15
       Top              =   480
       Width            =   495
    End
    Begin Label Label7
       BackStyle        =   0  'Transparent
       Caption          =   "ErrorZ"
       Height           =   255
       Left             =   2970
       TabIndex         =   16
       Top              =   870
       Width            =   735
    End
    Begin Label Label8
       BackStyle        =   0  'Transparent
       Caption          =   "ErrorW"
       Height           =   255
       Left             =   2970
       TabIndex         =   17
       Top              =   1230
       Width            =   735
    End
    Begin Label Label9
       BackStyle        =   0  'Transparent
       Caption          =   "ErrorE"
       Height           =   255
       Left             =   2970
       TabIndex         =   18
       Top              =   1590
       Width            =   735
    End
    Begin Label Label10
       BackStyle        =   0  'Transparent
       Caption          =   "Hook A"
       Height           =   255
       Left             =   180
       TabIndex         =   24
       Top              =   840
       Width            =   975
    End
    Begin Label Label11
       BackStyle        =   0  'Transparent
       Caption          =   "Needle:"
       Height           =   255
       Left             =   180
       TabIndex         =   27
       Top              =   1200
       Width            =   975
    End
    Begin Label Label12
       BackStyle        =   0  'Transparent
       Caption          =   "Hook B:"
       Height           =   255
       Left             =   180
       TabIndex         =   28
       Top              =   1560
       Width            =   975
    End
End
Begin SSCommand Command3D12
   BevelWidth       =   10
   Caption          =   "TRIMMER"
   FontBold         =   -1  'True
   FontItalic       =   0   'False
   FontName         =   "Arial"
   FontSize         =   12
```

```
   FontStrikethru  =   0    'False
   FontUnderline   =   0    'False
   ForeColor       =   &H000000FF&
   Height          =   915
   Left            =   240
   TabIndex        =   26
   Top             =   5160
   Width           =   1695
End
Begin SSCommand Command3D10
   BevelWidth      =   10
   Caption         =   "NEEDLE"
   FontBold        =   -1   'True
   FontItalic      =   0    'False
   FontName        =   "Arial"
   FontSize        =   12
   FontStrikethru  =   0    'False
   FontUnderline   =   0    'False
   ForeColor       =   &H000000FF&
   Height          =   915
   Left            =   240
   TabIndex        =   25
   Top             =   6240
   Width           =   1695
End
Begin SSCommand Command3D6
   BevelWidth      =   10
   Caption         =   "TORQUE"
   FontBold        =   -1   'True
   FontItalic      =   0    'False
   FontName        =   "Arial"
   FontSize        =   12
   FontStrikethru  =   0    'False
   FontUnderline   =   0    'False
   ForeColor       =   &H000000FF&
   Height          =   900
   Left            =   2160
   TabIndex        =   20
   Top             =   5160
   Width           =   1695
End
Begin SSCommand Command3D1
   BevelWidth      =   10
   Caption         =   "X,Y-HOME"
   FontBold        =   -1   'True
   FontItalic      =   0    'False
   FontName        =   "Arial"
   FontSize        =   12
   FontStrikethru  =   0    'False
   FontUnderline   =   0    'False
   ForeColor       =   &H000000FF&
   Height          =   900
   Left            =   2160
   TabIndex        =   19
   Top             =   6240
   Width           =   1695
End
Begin SSCommand Command3D11
   BevelWidth      =   10
   Caption         =   "OFF-DRIVE"
   FontBold        =   -1   'True
   FontItalic      =   0    'False
   FontName        =   "Arial"
   FontSize        =   12
   FontStrikethru  =   0    'False
   FontUnderline   =   0    'False
   ForeColor       =   &H000000FF&
   Height          =   915
   Left            =   2160
   TabIndex        =   8
   Top             =   3000
   Width           =   1695
```

```
End
Begin SSCommand Command3D2
   BevelWidth       =   10
   Caption          =   "RUN"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H000000FF&
   Height           =   1485
   Left             =   6540
   Picture          =   MANUAL.FRX:0000
   TabIndex         =   7
   Top              =   360
   Width            =   2475
End
Begin SSCommand Command3D9
   BevelWidth       =   10
   Caption          =   "STOP"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H000000FF&
   Height           =   1400
   Left             =   6540
   Picture          =   MANUAL.FRX:0302
   TabIndex         =   6
   Top              =   2160
   Width            =   2500
End
Begin SSCommand Command3D8
   BevelWidth       =   10
   Caption          =   "HOOKS"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H000000FF&
   Height           =   900
   Left             =   4080
   TabIndex         =   5
   Top              =   6240
   Width            =   1695
End
Begin SSCommand Command3D7
   BevelWidth       =   10
   Caption          =   "EXIT"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H000000FF&
   Height           =   1455
   Left             =   6540
   TabIndex         =   4
   Top              =   5640
   Width            =   2505
End
Begin SSCommand Command3D5
   BevelWidth       =   10
   Caption          =   "FOOT UP"
   FontBold         =   -1   'True
   FontItalic       =   0    'False
```

```
   FontName          =   "Arial"
   FontSize          =   12
   FontStrikethru    =   0    'False
   FontUnderline     =   0    'False
   ForeColor         =   &H000000FF&
   Height            =   900
   Left              =   4080
   TabIndex          =   2
   Top               =   3000
   Width             =   1695
End
Begin SSCommand Command3D4
   BevelWidth        =   10
   Caption           =   "FT. DOWN"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H000000FF&
   Height            =   900
   Left              =   4080
   TabIndex          =   1
   Top               =   4080
   Width             =   1695
End
Begin SSCommand Command3D3
   BevelWidth        =   10
   Caption           =   "JOG"
   FontBold          =   -1   'True
   FontItalic        =   0    'False
   FontName          =   "Arial"
   FontSize          =   24
   FontStrikethru    =   0    'False
   FontUnderline     =   0    'False
   ForeColor         =   &H000000FF&
   Height            =   1395
   Left              =   6540
   TabIndex          =   0
   Top               =   3840
   Width             =   2535
End
Begin Label Label17
   Alignment         =   2   'Center
   BackStyle         =   0   'Transparent
   Caption           =   "TICE ENGINEERING"
   FontBold          =   -1   'True
   FontItalic        =   0    'False
   FontName          =   "Arial"
   FontSize          =   24
   FontStrikethru    =   0    'False
   FontUnderline     =   0    'False
   ForeColor         =   &H00800000&
   Height            =   555
   Left              =   240
   TabIndex          =   29
   Top               =   180
   Width             =   5535
End
Begin Line Line2
   Visible           =   0    'False
   X1                =   9660
   X2                =   0
   Y1                =   7260
   Y2                =   7260
End
Begin Line Line1
   Visible           =   0    'False
   X1                =   9660
   X2                =   9660
   Y1                =   0
```

```
      Y2                =   7260
   End
   Begin Label Label16
      Alignment         =   2  'Center
      BackColor         =   &H00800000&
      BackStyle         =   0  'Transparent
      Caption           =   "JL-5000"
      FontBold          =   -1  'True
      FontItalic        =   -1  'True
      FontName          =   "Arial"
      FontSize          =   18
      FontStrikethru    =   0   'False
      FontUnderline     =   0   'False
      ForeColor         =   &H00800000&
      Height            =   375
      Left              =   10680
      TabIndex          =   21
      Top               =   3180
      Width             =   3615
   End
   Begin Label Label15
      Alignment         =   2  'Center
      BackStyle         =   0  'Transparent
      Caption           =   "TICE ENGINEERING"
      FontBold          =   -1  'True
      FontItalic        =   0   'False
      FontName          =   "Arial"
      FontSize          =   24
      FontStrikethru    =   0   'False
      FontUnderline     =   0   'False
      ForeColor         =   &H00800000&
      Height            =   495
      Left              =   10680
      TabIndex          =   23
      Top               =   2160
      Width             =   3615
   End
   Begin Label Label14
      Alignment         =   2  'Center
      BackStyle         =   0  'Transparent
      Caption           =   "ENGINEERING"
      FontBold          =   -1  'True
      FontItalic        =   0   'False
      FontName          =   "Arial"
      FontSize          =   24
      FontStrikethru    =   0   'False
      FontUnderline     =   0   'False
      ForeColor         =   &H00800000&
      Height            =   495
      Left              =   10680
      TabIndex          =   22
      Top               =   2640
      Width             =   3615
   End
End
Sub Command3D1_Click ()
G_Stop
G_FootDown
XYAdjust.Show



End Sub

Sub Command3D10_Click ()


If DMode = False Then
    'Unload Form
        ResetGalia
```

```
    'Wait till reset is done
        Ret$ = "0"
        Dim T2 As Double, T3 As Double
        T2 = Now
        N! = 10
        T3 = T2 + (TimeSerial(0, 0, 1) * N!)

        Do Until Val(Ret$) <> 0 Or T2 > T3
            Ret$ = Space$(255)
            r% = get_from_1000("HomeDone=?", Ret$)
            T2 = Now
        Loop
    End If

NeedleMotorHome.Show


End Sub

Sub Command3D11_Click ()
G_OffDrive

End Sub

Sub Command3D12_Click ()
Trimmer.Show
End Sub

Sub Command3D13_Click ()
G_Stop
Status = G_Command("XQ#START")
AutoRun.Show
AutoRun.Tag = "Manual"

End Sub

Sub Command3D14_Click ()
SPattern.Show
SPattern.Tag = "Manual"
End Sub

Sub Command3D15_Click ()
Mech.Show
End Sub

Sub Command3D16_Click ()
Display "Please wait..."
BeltLoopSetup.Show
BeltLoopSetup.Tag = "Manual"

End Sub

Sub Command3D2_Click ()
G_Run
End Sub

Sub Command3D3_Click ()


G_Stop
JogForm.Show

End Sub

Sub Command3D4_Click ()
G_FootDown
End Sub


Sub Command3D5_Click ()
G_FootUp
```

```
End Sub

Sub Command3D6_Click ()
Torque.Show
End Sub

Sub Command3D7_Click ()
SetupForm.Show
Unload Me
End Sub

Sub Command3D8_Click ()
G_HandWheel
G_FootDown

HandWheel.Show

End Sub

Sub Command3D9_Click ()
G_Stop
StopForm.Show
End Sub

Sub DMCShell1_DMCCommError (ErrorNumber As Integer)
    Dim Msg As String
    Msg = "Communications error. Return code = " + Format(ErrorNumber)
    MsgBox Msg, MB_EXCLAIM
End Sub

Sub Form_Activate ()
SetUpWindow Me, "Manual"
End Sub

Sub Form_KeyDown (KeyCode As Integer, Shift As Integer)
GlobalKeyDown KeyCode, Shift
End Sub

Sub Form_Load ()
SetUpWindow Me, "Manual"
If DMode Then Timer1.enabled = True
End Sub

Sub Timer1_Timer ()
PosX = Format$(Int((4000 - 10 + 1) * Rnd + 10), "00000000")
PosY = Format$(Int((4000 - 10 + 1) * Rnd + 10), "00000000")
PosZ = Format$(Int((4000 - 10 + 1) * Rnd + 10), "00000000")
PosW = Format$(Int((4000 - 10 + 1) * Rnd + 10), "00000000")
PosE = Format$(Int((4000 - 10 + 1) * Rnd + 10), "00000000")

ErrX = Format$(Int((10 - 1 + 1) * Rnd + 1), "00000000")
ErrY = Format$(Int((10 - 1 + 1) * Rnd + 1), "00000000")
ErrZ = Format$(Int((10 - 1 + 1) * Rnd + 1), "00000000")
ErrW = Format$(Int((10 - 1 + 1) * Rnd + 1), "00000000")
ErrE = Format$(Int((10 - 1 + 1) * Rnd + 1), "00000000")

End Sub
```

```
VERSION 2.00
Begin Form Mech
   BackColor        =   &H00FFFF00&
   BorderStyle      =   1  'Fixed Single
   Caption          =   "Mech. Screen"
   ClientHeight     =   7515
   ClientLeft       =   660
   ClientTop        =   2325
   ClientWidth      =   9885
   ControlBox       =   0   'False
   Height           =   7920
   KeyPreview       =   -1  'True
   Left             =   600
   LinkTopic        =   "Form1"
   MaxButton        =   0   'False
   MinButton        =   0   'False
   ScaleHeight      =   360
   ScaleWidth       =   2400
   Top              =   1980
   Width            =   10005
   Begin PictureBox Picture1
      Height          =   2535
      Left            =   4680
      ScaleHeight     =   2505
      ScaleWidth      =   4425
      TabIndex        =   9
      Top             =   1320
      Width           =   4455
      Begin CheckBox Check4
         Caption         =   "Display Stitches Average RPM"
         FontBold        =   -1  'True
         FontItalic      =   0   'False
         FontName        =   "MS Sans Serif"
         FontSize        =   9.75
         FontStrikethru  =   0   'False
         FontUnderline   =   0   'False
         Height          =   315
         Left            =   240
         TabIndex        =   13
         Top             =   1920
         Width           =   3675
      End
      Begin CheckBox Check3
         Caption         =   "Display Each Stitches RPM"
         FontBold        =   -1  'True
         FontItalic      =   0   'False
         FontName        =   "MS Sans Serif"
         FontSize        =   9.75
         FontStrikethru  =   0   'False
         FontUnderline   =   0   'False
         Height          =   315
         Left            =   240
         TabIndex        =   12
         Top             =   1440
         Width           =   3555
      End
      Begin CheckBox Check2
         Caption         =   "Display Sewing Cycle Time"
         FontBold        =   -1  'True
         FontItalic      =   0   'False
         FontName        =   "MS Sans Serif"
         FontSize        =   9.75
         FontStrikethru  =   0   'False
         FontUnderline   =   0   'False
         Height          =   315
         Left            =   240
         TabIndex        =   11
         Top             =   960
         Width           =   3615
      End
      Begin CheckBox Check1
         Caption         =   "Display Full Cycle Time"
```

```
      FontBold          =   -1   'True
      FontItalic        =   0    'False
      FontName          =   "MS Sans Serif"
      FontSize          =   9.75
      FontStrikethru    =   0    'False
      FontUnderline     =   0    'False
      Height            =   315
      Left              =   240
      TabIndex          =   10
      Top               =   480
      Width             =   3375
   End
   Begin Label Label2
      Caption           =   "AUTOMODE DISPLAY OPTIONS"
      FontBold          =   -1   'True
      FontItalic        =   0    'False
      FontName          =   "MS Sans Serif"
      FontSize          =   12
      FontStrikethru    =   0    'False
      FontUnderline     =   0    'False
      ForeColor         =   &H000000FF&
      Height            =   315
      Left              =   240
      TabIndex          =   14
      Top               =   60
      Width             =   4155
   End
End
Begin SSCommand Command3D7
   BevelWidth        =   10
   Caption           =   "+"
   FontBold          =   -1   'True
   FontItalic        =   0    'False
   FontName          =   "MS Sans Serif"
   FontSize          =   24
   FontStrikethru    =   0    'False
   FontUnderline     =   0    'False
   ForeColor         =   &H000000FF&
   Height            =   855
   Left              =   1020
   TabIndex          =   0
   Top               =   2880
   Width             =   1335
End
Begin ListBox List1
   Height            =   2955
   Left              =   1080
   Sorted            =   -1   'True
   TabIndex          =   8
   Top               =   3960
   Width             =   2835
End
Begin SSCommand Command3D2
   BevelWidth        =   10
   Caption           =   "SAVE"
   FontBold          =   -1   'True
   FontItalic        =   0    'False
   FontName          =   "MS Sans Serif"
   FontSize          =   12
   FontStrikethru    =   0    'False
   FontUnderline     =   0    'False
   ForeColor         =   &H000000FF&
   Height            =   855
   Left              =   2580
   TabIndex          =   7
   Top               =   2880
   Width             =   1335
End
Begin SSCommand Command3D1
   BevelWidth        =   10
   Caption           =   "LOAD"
   FontBold          =   -1   'True
```

```
   FontItalic        =   0    'False
   FontName          =   "MS Sans Serif"
   FontSize          =   12
   FontStrikethru    =   0    'False
   FontUnderline     =   0    'False
   ForeColor         =   &H000000FF&
   Height            =   855
   Left              =   2580
   TabIndex          =   6
   Top               =   1920
   Width             =   1335
End
Begin SSCommand Command3D3
   BevelWidth        =   10
   Caption           =   "EXIT"
   FontBold          =   -1   'True
   FontItalic        =   0    'False
   FontName          =   "Arial"
   FontSize          =   24
   FontStrikethru    =   0    'False
   FontUnderline     =   0    'False
   ForeColor         =   &H000000FF&
   Height            =   1815
   Left              =   7740
   Picture           =   MECH.FRX:0000
   TabIndex          =   3
   Top               =   5220
   Width             =   1560
End
Begin VScrollBar VScroll2
   Height            =   4995
   LargeChange       =   100
   Left              =   300
   Max               =   10
   Min               =   1
   TabIndex          =   2
   Top               =   1920
   Value             =   1
   Width             =   615
End
Begin SSCommand Command3D6
   BevelWidth        =   10
   Caption           =   "-"
   FontBold          =   -1   'True
   FontItalic        =   0    'False
   FontName          =   "MS Sans Serif"
   FontSize          =   36
   FontStrikethru    =   0    'False
   FontUnderline     =   0    'False
   ForeColor         =   &H000000FF&
   Height            =   855
   Left              =   1020
   TabIndex          =   1
   Top               =   1920
   Width             =   1335
End
Begin Line Line1
   Visible           =   0    'False
   X1                =   9660
   X2                =   9660
   Y1                =   0
   Y2                =   7260
End
Begin Line Line2
   Visible           =   0    'False
   X1                =   9660
   X2                =   0
   Y1                =   7260
   Y2                =   7260
End
Begin Label Label1
   Alignment         =   2    'Center
```

```
      BackStyle        =   0  'Transparent
      Caption          =   "TICE ENGINEERING - JL-5000"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   0
      TabIndex         =   4
      Top              =   180
      Width            =   9675
   End
   Begin Label Label5
      BackStyle        =   0  'Transparent
      Caption          =   "Settings Slot: # 00"
      FontBold         =   -1  'True
      FontItalic       =   0   'False
      FontName         =   "Arial"
      FontSize         =   19.5
      FontStrikethru   =   0   'False
      FontUnderline    =   -1  'True
      Height           =   615
      Left             =   240
      TabIndex         =   5
      Top              =   1260
      Width            =   3975
   End
End
Dim DownFlag%

Sub Command3D1_Click ()

On Error Resume Next

'Verify action
    M$ = "Loading these values will erase the current timing" & Chr$(13)
    M$ = M$ & "values that are currently on this machine." & Chr$(13)
    M$ = M$ & "" & Chr$(13)
    M$ = M$ & "Are you sure you want to continue?"
    r% = YN(ByVal M$, "Load Timing Values from Slot " & Format$(Vscroll2.Value,
"0"))
    If r% = False Then Exit Sub

If LoadTVFile(Vscroll2.Value) = False Then
    Exit Sub
    End If


'Tell that action completed
    VScroll2_Change
    MsgBox "Values have been loaded from slot " & Format$(Vscroll2.Value, "0") &
".", 0, "Load Timing Values"


End Sub

Sub Command3D2_Click ()
On Error Resume Next

'Get File Name
    FN$ = Path$ & Format$(Vscroll2.Value, "00") & ".TV"

'Get JL5000 Section
    Ret$ = Getini(Path$ & "TICE.ini", "JL5000", "", "")

'Delimit Values
    If Ret$ <> "" Then
        If Right$(Ret$, 1) <> Chr$(0) Then Ret$ = Ret$ & Chr$(0)
```

```
        Do Until Ret$ = ""
            X% = InStr(Ret$, Chr$(0))
            tmp$ = Left$(Ret$, X% - 1)
            Ret$ = Mid$(Ret$, X% + 1)
            Ret2$ = Getini(Path$ & "TICE.ini", "JL5000", tmp$, "")
            'MsgBox Ret2$, 0, tmp$
            success% = Writeini("JL5000", tmp$, Ret2$, FN$)
        Loop
        End If

'Tell that action completed
    VScroll2_Change
    MsgBox "Values have been saved in slot " & Format$(Vscroll2.Value, "0") & ".",
0, "Save Timing Values"


End Sub

Sub Command3D3_Click ()
'Write Displays
    Write_FullCycle Check1.Value
    Write_SewingCycle Check2.Value
    Write_EachCycle Check3.Value
    Write_AverageCycle Check4.Value

'Get Cycel time display messages
    If Read_FullCycle() Then Cycle1 = True Else Cycle1 = False
    If Read_SewingCycle() Then Cycle2 = True Else Cycle2 = False
    If Read_EachCycle() Then Cycle3 = True Else Cycle3 = False
    If Read_AverageCycle() Then Cycle4 = True Else Cycle4 = False


'Unload Form
    ResetGalia

'Wait till reset is done
    If DMode = True Then
        Unload Me
        Exit Sub
        End If
    Ret$ = "0"
    Dim T2 As Double, T3 As Double
    T2 = Now
    N! = 10
    T3 = T2 + (TimeSerial(0, 0, 1) * N!)

    Do Until Val(Ret$) <> 0 Or T2 > T3
        Ret$ = Space$(255)
        r% = get_from_1000("HomeDone=?", Ret$)
        T2 = Now
    Loop

Unload Me
End Sub

Sub Command3D6_MouseDown (Button As Integer, Shift As Integer, X As Single, Y As
Single)
On Error Resume Next

'set downflag
    If DownFlag% = True Then Exit Sub
    DownFlag% = True

'change first value
    Vscroll2.Value = Vscroll2.Value - Vscroll2.SmallChange
    Vscroll2.Refresh

'allow time for mouseup
    rsleep .5

'enter loop for continous value change
    Do Until DownFlag% = False
```

```
        Vscroll2.Value = Vscroll2.Value - Vscroll2.SmallChange
        If Err Then DownFlag% = False: Vscroll2.Value = Vscroll2.Min
        Vscroll2.Refresh
        DoEvents
    Loop

    DownFlag% = False

End Sub

Sub Command3D6_MouseUp (Button As Integer, Shift As Integer, X As Single, Y As
Single)
DownFlag% = False
End Sub

Sub Command3D7_MouseDown (Button As Integer, Shift As Integer, X As Single, Y As
Single)
On Error Resume Next

'set downflag
    If DownFlag% = True Then Exit Sub
    DownFlag% = True

'change first value
    Vscroll2.Value = Vscroll2.Value + Vscroll2.SmallChange
    Vscroll2.Refresh

'allow time for mouseup
    rsleep .5

'enter loop for continous value change
    Do Until DownFlag% = False
        Vscroll2.Value = Vscroll2.Value + Vscroll2.SmallChange
        If Err Then DownFlag% = False: Vscroll2.Value = Vscroll2.Max
        Vscroll2.Refresh
        DoEvents
    Loop

    DownFlag% = False


End Sub

Sub Command3D7_MouseUp (Button As Integer, Shift As Integer, X As Single, Y As
Single)
DownFlag% = False
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "Mech"

VScroll2_Change

Check1.Value = Read_FullCycle()
Check2.Value = Read_SewingCycle()
Check3.Value = Read_EachCycle()
Check4.Value = Read_AverageCycle()


End Sub

Sub List1_Click ()
On Error Resume Next
'Verify action
    M$ = "Erase these saved values from system?" & Chr$(13)
```

```
    r% = YN(ByVal M$, "Erase Timing Values from Slot " & Format$(Vscroll2.Value,
"0"))
    If r% = False Then Exit Sub

'Get File Name
    FN$ = Path$ & Format$(Vscroll2.Value, "00") & ".TV"

'Erase File
    Kill FN$
    VScroll2_Change

End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub Unit_Change ()
Unit2 = Format$(Val(Unit) * (4000 / 360), "0")
End Sub

Sub VScroll2_Change ()
On Error Resume Next

'Get File Name
    FN$ = Path$ & Format$(Vscroll2.Value, "00") & ".TV"

'Get JL5000 Section
    Ret$ = Getini(FN$, "JL5000", "", "")

'Delimit Values
    List1.Clear
    If Ret$ <> "" Then
        If Right$(Ret$, 1) <> Chr$(0) Then Ret$ = Ret$ & Chr$(0)
        Do Until Ret$ = ""
            X% = InStr(Ret$, Chr$(0))
            tmp$ = Left$(Ret$, X% - 1)
            Ret$ = Mid$(Ret$, X% + 1)
            Ret2$ = Getini(FN$, "JL5000", tmp$, "")
            If Ret2$ <> "" And UCase$(tmp$) <> "STITCH" Then List1.AddItem tmp$ &
"=" & Ret2$
        Loop
        End If

'TOut = M$
Label5 = "Settings Slot: # " & Format$(Vscroll2.Value, "0")


End Sub
```

```
VERSION 2.00
Begin Form Trimmer
   BackColor        =   &H00FFFF00&
   BorderStyle      =   1  'Fixed Single
   Caption          =   "Trimmer Setup"
   ClientHeight     =   7515
   ClientLeft       =   345
   ClientTop        =   2025
   ClientWidth      =   9885
   ControlBox       =   0   'False
   Height           =   7920
   KeyPreview       =   -1  'True
   Left             =   285
   LinkTopic        =   "Form1"
   MaxButton        =   0   'False
   MinButton        =   0   'False
   ScaleHeight      =   7515
   ScaleWidth       =   9885
   Top              =   1680
   Width            =   10005
   Begin TextBox CountBox
      Height           =   375
      Index            =   1
      Left             =   3600
      TabIndex         =   18
      Top              =   6360
      Width            =   1455
   End
   Begin TextBox Degrees
      Height           =   375
      Index            =   1
      Left             =   3600
      TabIndex         =   17
      Top              =   5880
      Width            =   1455
   End
   Begin VScrollBar VScroll
      Height           =   3495
      Index            =   1
      LargeChange      =   100
      Left             =   3600
      Max              =   360
      TabIndex         =   16
      Top              =   2280
      Value            =   25
      Width            =   615
   End
   Begin SSCommand Minus
      BevelWidth       =   10
      Caption          =   "-"
      FontBold         =   -1  'True
      FontItalic       =   0   'False
      FontName         =   "MS Sans Serif"
      FontSize         =   36
      FontStrikethru   =   0   'False
      FontUnderline    =   0   'False
      ForeColor        =   &H000000FF&
      Height           =   855
      Index            =   1
      Left             =   4320
      TabIndex         =   15
      Top              =   2280
      Width            =   1335
   End
   Begin SSCommand Plus
      BevelWidth       =   10
      Caption          =   "+"
      FontBold         =   -1  'True
      FontItalic       =   0   'False
      FontName         =   "MS Sans Serif"
      FontSize         =   24
      FontStrikethru   =   0   'False
```

```
   FontUnderline    =   0   'False
   ForeColor        =   &H000000FF&
   Height           =   855
   Index            =   1
   Left             =   4320
   TabIndex         =   14
   Top              =   3240
   Width            =   1335
End
Begin SSCommand Plus
   BevelWidth       =   10
   Caption          =   "+"
   FontBold         =   -1  'True
   FontItalic       =   0   'False
   FontName         =   "MS Sans Serif"
   FontSize         =   24
   FontStrikethru   =   0   'False
   FontUnderline    =   0   'False
   ForeColor        =   &H000000FF&
   Height           =   855
   Index            =   0
   Left             =   1200
   TabIndex         =   10
   Top              =   3180
   Width            =   1335
End
Begin SSCommand Minus
   BevelWidth       =   10
   Caption          =   "-"
   FontBold         =   -1  'True
   FontItalic       =   0   'False
   FontName         =   "MS Sans Serif"
   FontSize         =   36
   FontStrikethru   =   0   'False
   FontUnderline    =   0   'False
   ForeColor        =   &H000000FF&
   Height           =   855
   Index            =   0
   Left             =   1200
   TabIndex         =   9
   Top              =   2220
   Width            =   1335
End
Begin VScrollBar VScroll
   Height           =   3495
   Index            =   0
   LargeChange      =   100
   Left             =   480
   Max              =   360
   TabIndex         =   8
   Top              =   2220
   Value            =   25
   Width            =   615
End
Begin TextBox Degrees
   Height           =   375
   Index            =   0
   Left             =   480
   TabIndex         =   7
   Top              =   5820
   Width            =   1455
End
Begin TextBox CountBox
   Height           =   375
   Index            =   0
   Left             =   480
   TabIndex         =   6
   Top              =   6300
   Width            =   1455
End
Begin SSCommand Command3D3
   BevelWidth       =   10
```

```
   Caption          =   "EXIT"
   FontBold         =   -1  'True
   FontItalic       =   0   'False
   FontName         =   "Arial"
   FontSize         =   24
   FontStrikethru   =   0   'False
   FontUnderline    =   0   'False
   ForeColor        =   &H000000FF&
   Height           =   1815
   Left             =   7260
   Picture          =   TRIMMER.FRX:0000
   TabIndex         =   0
   Top              =   4920
   Width            =   1875
End
Begin Label Label3
   BackStyle        =   0  'Transparent
   Caption          =   "COUNT"
   Height           =   255
   Index            =   1
   Left             =   5160
   TabIndex         =   1
   Top              =   6480
   Width            =   975
End
Begin Label Label7
   BackStyle        =   0  'Transparent
   Caption          =   "DEGREES"
   Height           =   255
   Index            =   1
   Left             =   5160
   TabIndex         =   2
   Top              =   6000
   Width            =   1275
End
Begin Label Label4
   BackStyle        =   0  'Transparent
   Caption          =   "Back Trimmer Timing"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   315
   Index            =   1
   Left             =   3540
   TabIndex         =   5
   Top              =   1860
   Width            =   2715
End
Begin Label Label4
   BackStyle        =   0  'Transparent
   Caption          =   "Front Trimmer Timing"
   FontBold         =   -1  'True
   FontItalic       =   0   'False
   FontName         =   "Arial"
   FontSize         =   12
   FontStrikethru   =   0   'False
   FontUnderline    =   0   'False
   Height           =   315
   Index            =   0
   Left             =   420
   TabIndex         =   13
   Top              =   1800
   Width            =   2895
End
Begin Label Label7
   BackStyle        =   0  'Transparent
   Caption          =   "DEGREES"
   Height           =   255
   Index            =   0
```

```
      Left            =   2040
      TabIndex        =   12
      Top             =   5940
      Width           =   1275
   End
   Begin Label Label3
      BackStyle       =   0  'Transparent
      Caption         =   "COUNT"
      Height          =   255
      Index           =   0
      Left            =   2040
      TabIndex        =   11
      Top             =   6420
      Width           =   975
   End
   Begin Line Line1
      Visible         =   0   'False
      X1              =   9660
      X2              =   9660
      Y1              =   0
      Y2              =   7260
   End
   Begin Line Line2
      Visible         =   0   'False
      X1              =   9660
      X2              =   0
      Y1              =   7260
      Y2              =   7260
   End
   Begin Label Label1
      Alignment       =   2  'Center
      BackStyle       =   0  'Transparent
      Caption         =   "TICE ENGINEERING - JL-5000"
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H008000000&
      Height          =   615
      Left            =   0
      TabIndex        =   4
      Top             =   180
      Width           =   9675
   End
   Begin Label Label5
      BackStyle       =   0  'Transparent
      Caption         =   "Trimmer Setup "
      FontBold        =   -1  'True
      FontItalic      =   0   'False
      FontName        =   "Arial"
      FontSize        =   19.5
      FontStrikethru  =   0   'False
      FontUnderline   =   -1  'True
      Height          =   615
      Left            =   420
      TabIndex        =   3
      Top             =   1200
      Width           =   4455
   End
End
Dim DownFlag%

Sub Command3D3_Click ()
'Write Value to INI
    WriteKnife Val(CountBox(0))
    WriteKnifeBack Val(CountBox(1))

'Check if this is a factory setting
    If TechMode = True Or FactoryFlag% = True Then
        r% = WriteFacKnife(Val(CountBox(0)))
```

```
        r% = WriteFacKnifeBack(Val(CountBox(1)))
        End If


'Unload Form
    ResetGalia

'Wait till reset is done
    If DMode = True Then
        Unload Me
        Exit Sub
        End If
    Ret$ = "0"
    Dim T2 As Double, T3 As Double
    T2 = Now
    N! = 10
    T3 = T2 + (TimeSerial(0, 0, 1) * N!)

    Do Until Val(Ret$) <> 0 Or T2 > T3
        Ret$ = Space$(255)
        r% = get_from_1000("HomeDone=?", Ret$)
        T2 = Now
    Loop

Unload Me
End Sub

Sub Degrees_Change (Index As Integer)
CountBox(Index) = Format$(Val(Degrees(Index)) * (4000 / 360), "0")
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "Trimmer"

'Display Sew Speed in Pulse Count
    Degrees(0).Text = Format$(Val(ReadKnife()) / (4000 / 360), "0")
    VScroll(0).Value = Val(Degrees(0))

    Degrees(1).Text = Format$(Val(ReadKnifeBack()) / (4000 / 360), "0")
    VScroll(1).Value = Val(Degrees(1))


End Sub

Sub Minus_MouseDown (Index As Integer, Button As Integer, Shift As Integer, X As
Single, Y As Single)
On Error Resume Next

'set downflag
    If DownFlag% = True Then Exit Sub
    DownFlag% = True

'change first value
    VScroll(Index).Value = VScroll(Index).Value - VScroll(Index).SmallChange
    VScroll(Index).Refresh

'allow time for mouseup
    rsleep .5

'enter loop for continous value change
    Do Until DownFlag% = False
        VScroll(Index).Value = VScroll(Index).Value - VScroll(Index).SmallChange
        If Err Then DownFlag% = False: VScroll(Index).Value = VScroll(Index).Min
        VScroll(Index).Refresh
```

```
        DoEvents
    Loop

    DownFlag% = False

End Sub

Sub Minus_MouseUp (Index As Integer, Button As Integer, Shift As Integer, X As
Single, Y As Single)
DownFlag% = False
End Sub

Sub Plus_MouseDown (Index As Integer, Button As Integer, Shift As Integer, X As
Single, Y As Single)
On Error Resume Next

'set downflag
    If DownFlag% = True Then Exit Sub
    DownFlag% = True

'change first value
    VScroll(Index).Value = VScroll(Index).Value + VScroll(Index).SmallChange
    VScroll(Index).Refresh

'allow time for mouseup
    rsleep .5

'enter loop for continous value change
    Do Until DownFlag% = False
        VScroll(Index).Value = VScroll(Index).Value + VScroll(Index).SmallChange
        If Err Then DownFlag% = False: VScroll(Index).Value = VScroll(Index).Max
        VScroll(Index).Refresh
        DoEvents
    Loop

    DownFlag% = False


End Sub

Sub Plus_MouseUp (Index As Integer, Button As Integer, Shift As Integer, X As
Single, Y As Single)
DownFlag% = False
End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub VScroll_Change (Index As Integer)
    'Display Sew Speed in Pulse Count
        Degrees(Index).Text = Format$(VScroll(Index).Value)

End Sub
```

```
VERSION 2.00
Begin Form Torque
   AutoRedraw       =   -1  'True
   BackColor        =   &H00FFFF00&
   BorderStyle      =   1  'Fixed Single
   Caption          =   "Torque"
   ClientHeight     =   7965
   ClientLeft       =   285
   ClientTop        =   1695
   ClientWidth      =   10620
   ControlBox       =   0   'False
   DrawWidth        =   3
   Height           =   8370
   Icon             =   TORQUE.FRX:0000
   KeyPreview       =   -1  'True
   Left             =   225
   LinkTopic        =   "Form4"
   MaxButton        =   0   'False
   MinButton        =   0   'False
   ScaleHeight      =   7965
   ScaleWidth       =   10620
   Top              =   1350
   Width            =   10740
   Begin SSCommand Command3D7
      BevelWidth       =   10
      Caption          =   "+"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H000000FF&
      Height           =   855
      Left             =   6360
      TabIndex         =   1
      Top              =   3360
      Width            =   1335
   End
   Begin SSCommand Command3D6
      BevelWidth       =   10
      Caption          =   "-"
      FontBold         =   -1  'True
      FontItalic       =   0   'False
      FontName         =   "MS Sans Serif"
      FontSize         =   36
      FontStrikethru   =   0   'False
      FontUnderline    =   0   'False
      ForeColor        =   &H000000FF&
      Height           =   855
      Left             =   6360
      TabIndex         =   16
      Top              =   2400
      Width            =   1335
   End
   Begin SSCommand Command3D5
      BevelWidth       =   10
      Caption          =   "+"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H000000FF&
      Height           =   855
      Left             =   3720
      TabIndex         =   20
      Top              =   3360
      Width            =   1335
   End
   Begin SSCommand Command3D4
```

```
   BevelWidth       =   10
   Caption          =   "-"
   FontBold         =   -1   'True
   FontItalic       =   0    'False
   FontName         =   "MS Sans Serif"
   FontSize         =   36
   FontStrikethru   =   0    'False
   FontUnderline    =   0    'False
   ForeColor        =   &H000000FF&
   Height           =   855
   Left             =   3720
   TabIndex         =   19
   Top              =   2400
   Width            =   1335
End
Begin SSCommand Command3D2
   BevelWidth       =   10
   Caption          =   "-"
   FontBold         =   -1   'True
   FontItalic       =   0    'False
   FontName         =   "MS Sans Serif"
   FontSize         =   36
   FontStrikethru   =   0    'False
   FontUnderline    =   0    'False
   ForeColor        =   &H000000FF&
   Height           =   855
   Left             =   1320
   TabIndex         =   18
   Top              =   2400
   Width            =   1335
End
Begin SSCommand Command3D1
   BevelWidth       =   10
   Caption          =   "+"
   FontBold         =   -1   'True
   FontItalic       =   0    'False
   FontName         =   "MS Sans Serif"
   FontSize         =   24
   FontStrikethru   =   0    'False
   FontUnderline    =   0    'False
   ForeColor        =   &H000000FF&
   Height           =   855
   Left             =   1320
   TabIndex         =   17
   Top              =   3360
   Width            =   1335
End
Begin VScrollBar W_Bar
   Height           =   3495
   LargeChange      =   10
   Left             =   5640
   Max              =   100
   Min              =   1
   TabIndex         =   13
   Top              =   2400
   Value            =   50
   Width            =   615
End
Begin TextBox W_Label
   Height           =   375
   Left             =   5640
   TabIndex         =   12
   Top              =   6000
   Width            =   1455
End
Begin TextBox XY_Label
   Height           =   375
   Left             =   600
   TabIndex         =   8
   Top              =   6000
   Width            =   1215
End
```

```
Begin TextBox ZE_Label
   Height          =   375
   Left            =   3000
   TabIndex        =   9
   Top             =   6000
   Width           =   1575
End
Begin VScrollBar XY_Bar
   Height          =   3495
   LargeChange     =   10
   Left            =   600
   Max             =   100
   Min             =   1
   TabIndex        =   6
   Top             =   2400
   Value           =   50
   Width           =   645
End
Begin VScrollBar ZE_Bar
   DragIcon        =   TORQUE.FRX:0302
   Height          =   3495
   LargeChange     =   10
   Left            =   3000
   Max             =   100
   Min             =   1
   TabIndex        =   3
   Top             =   2400
   Value           =   50
   Width           =   615
End
Begin SSCommand Command3D3
   BevelWidth      =   10
   Caption         =   "EXIT"
   FontBold        =   -1   'True
   FontItalic      =   0    'False
   FontName        =   "Arial"
   FontSize        =   24
   FontStrikethru  =   0    'False
   FontUnderline   =   0    'False
   ForeColor       =   &H000000FF&
   Height          =   1815
   Left            =   7920
   Picture         =   TORQUE.FRX:0604
   TabIndex        =   0
   Top             =   2400
   Width           =   1560
End
Begin Label Label4
   BackStyle       =   0   'Transparent
   Caption         =   "Needle Limit"
   FontBold        =   -1   'True
   FontItalic      =   0    'False
   FontName        =   "Arial"
   FontSize        =   12
   FontStrikethru  =   0    'False
   FontUnderline   =   0    'False
   Height          =   255
   Index           =   2
   Left            =   5640
   TabIndex        =   14
   Top             =   2040
   Width           =   2295
End
Begin Label Label6
   BackStyle       =   0   'Transparent
   Caption         =   "%"
   FontBold        =   -1   'True
   FontItalic      =   0    'False
   FontName        =   "MS Sans Serif"
   FontSize        =   12
   FontStrikethru  =   0    'False
   FontUnderline   =   0    'False
```

```
    Height          =   255
    Left            =   7200
    TabIndex        =   15
    Top             =   6120
    Width           =   735
End
Begin Label Label3
    BackStyle       =   0   'Transparent
    Caption         =   "%"
    FontBold        =   -1  'True
    FontItalic      =   0   'False
    FontName        =   "Arial"
    FontSize        =   12
    FontStrikethru  =   0   'False
    FontUnderline   =   0   'False
    Height          =   255
    Left            =   1920
    TabIndex        =   11
    Top             =   6120
    Width           =   735
End
Begin Label Label5
    BackStyle       =   0   'Transparent
    Caption         =   "Torque Setup"
    FontBold        =   -1  'True
    FontItalic      =   0   'False
    FontName        =   "Arial"
    FontSize        =   19.5
    FontStrikethru  =   0   'False
    FontUnderline   =   -1  'True
    Height          =   615
    Left            =   600
    TabIndex        =   5
    Top             =   1320
    Width           =   3375
End
Begin Label Label4
    BackStyle       =   0   'Transparent
    Caption         =   "Bobbin Limit"
    FontBold        =   -1  'True
    FontItalic      =   0   'False
    FontName        =   "Arial"
    FontSize        =   12
    FontStrikethru  =   0   'False
    FontUnderline   =   0   'False
    Height          =   255
    Index           =   1
    Left            =   3000
    TabIndex        =   7
    Top             =   2040
    Width           =   2055
End
Begin Label Label4
    BackStyle       =   0   'Transparent
    Caption         =   "XY Limit"
    FontBold        =   -1  'True
    FontItalic      =   0   'False
    FontName        =   "Arial"
    FontSize        =   12
    FontStrikethru  =   0   'False
    FontUnderline   =   0   'False
    Height          =   315
    Index           =   0
    Left            =   600
    TabIndex        =   10
    Top             =   2040
    Width           =   2055
End
Begin Label Label14
    BackStyle       =   0   'Transparent
    Caption         =   "%"
    FontBold        =   -1  'True
```

```
      FontItalic       =   0    'False
      FontName         =   "Arial"
      FontSize         =   12
      FontStrikethru   =   0    'False
      FontUnderline    =   0    'False
      Height           =   615
      Left             =   4680
      TabIndex         =   4
      Top              =   6120
      Width            =   855
   End
   Begin Label Label1
      Alignment        =   2   'Center
      BackStyle        =   0   'Transparent
      Caption          =   "TICE ENGINEERING - JL-5000"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00800000&
      Height           =   615
      Left             =   0
      TabIndex         =   2
      Top              =   360
      Width            =   7935
   End
End
Dim DownFlag%

Sub Command3D1_Click ()
'On Error Resume Next

'XY_Bar.Value = XY_Bar.Value + XY_Bar.SmallChange
'If Err Then XY_Bar.Value = XY_Bar.Max

End Sub

Sub Command3D1_MouseDown (Button As Integer, Shift As Integer, X As Single, Y As
Single)
On Error Resume Next

'set downflag
    If DownFlag% = True Then Exit Sub
    DownFlag% = True

'change first value
    XY_Bar.Value = XY_Bar.Value + XY_Bar.SmallChange
    XY_Bar.Refresh

'allow time for mouseup
    rsleep .5

'enter loop for continous value change
    Do Until DownFlag% = False
        XY_Bar.Value = XY_Bar.Value + XY_Bar.SmallChange
        XY_Bar.Refresh
        DoEvents
    Loop

    DownFlag% = False

End Sub

Sub Command3D1_MouseUp (Button As Integer, Shift As Integer, X As Single, Y As
Single)
DownFlag% = False
End Sub

Sub Command3D2_Click ()
'On Error Resume Next
```

```
'XY_Bar.Value = XY_Bar.Value - XY_Bar.SmallChange

'If Err Then XY_Bar.Value = XY_Bar.Min

End Sub

Sub Command3D2_MouseDown (Button As Integer, Shift As Integer, X As Single, Y As
Single)
On Error Resume Next

'set downflag
    If DownFlag% = True Then Exit Sub
    DownFlag% = True

'change first value
    XY_Bar.Value = XY_Bar.Value - XY_Bar.SmallChange
    XY_Bar.Refresh

'allow time for mouseup
    rsleep .5

'enter loop for continous value change
    Do Until DownFlag% = False
        XY_Bar.Value = XY_Bar.Value - XY_Bar.SmallChange
        XY_Bar.Refresh
        DoEvents
    Loop

    DownFlag% = False

End Sub

Sub Command3D2_MouseUp (Button As Integer, Shift As Integer, X As Single, Y As
Single)
DownFlag% = False
End Sub

Sub Command3D3_Click ()

'Save Settings to INI File
    Write_XY_Limit XY_Bar.Value
    Write_ZE_Limit ZE_Bar.Value
    Write_W_Limit W_Bar.Value

'Create New Stitch File
    ResetGalia

'Show new form
    Unload Me
End Sub


Sub Command3D4_Click ()
'On Error Resume Next
'ZE_Bar.Value = ZE_Bar.Value - ZE_Bar.SmallChange

'If Err Then ZE_Bar.Value = ZE_Bar.Min
End Sub

Sub Command3D4_MouseDown (Button As Integer, Shift As Integer, X As Single, Y As
Single)
On Error Resume Next

'set downflag
    If DownFlag% = True Then Exit Sub
    DownFlag% = True

'change first value
    ZE_Bar.Value = ZE_Bar.Value - ZE_Bar.SmallChange
```

```
    ZE_Bar.Refresh

'allow time for mouseup
    rsleep .5

'enter loop for continous value change
    Do Until DownFlag% = False
        ZE_Bar.Value = ZE_Bar.Value - ZE_Bar.SmallChange
        ZE_Bar.Refresh
        DoEvents
    Loop

    DownFlag% = False

End Sub

Sub Command3D4_MouseUp (Button As Integer, Shift As Integer, X As Single, Y As
Single)
DownFlag% = False
End Sub

Sub Command3D5_Click ()
'On Error Resume Next
'ZE_Bar.Value = ZE_Bar.Value + ZE_Bar.SmallChange
'If Err Then ZE_Bar.Value = ZE_Bar.Max

End Sub

Sub Command3D5_MouseDown (Button As Integer, Shift As Integer, X As Single, Y As
Single)
On Error Resume Next

'set downflag
    If DownFlag% = True Then Exit Sub
    DownFlag% = True

'change first value
    ZE_Bar.Value = ZE_Bar.Value + ZE_Bar.SmallChange
    ZE_Bar.Refresh

'allow time for mouseup
    rsleep .5

'enter loop for continous value change
    Do Until DownFlag% = False
        ZE_Bar.Value = ZE_Bar.Value + ZE_Bar.SmallChange
        ZE_Bar.Refresh
        DoEvents
    Loop

    DownFlag% = False

End Sub

Sub Command3D5_MouseUp (Button As Integer, Shift As Integer, X As Single, Y As
Single)
DownFlag% = False
End Sub

Sub Command3D6_Click ()
'On Error Resume Next
'W_Bar.Value = W_Bar.Value - W_Bar.SmallChange
'If Err Then W_Bar.Value = W_Bar.Min
End Sub

Sub Command3D6_MouseDown (Button As Integer, Shift As Integer, X As Single, Y As
Single)
On Error Resume Next

'set downflag
    If DownFlag% = True Then Exit Sub
    DownFlag% = True
```

```
'change first value
    W_Bar.Value = W_Bar.Value - W_Bar.SmallChange
    W_Bar.Refresh

'allow time for mouseup
    rsleep .5

'enter loop for continous value change
    Do Until DownFlag% = False
        W_Bar.Value = W_Bar.Value - W_Bar.SmallChange
        W_Bar.Refresh
        DoEvents
    Loop

    DownFlag% = False

End Sub

Sub Command3D6_MouseUp (Button As Integer, Shift As Integer, X As Single, Y As
Single)
DownFlag% = False
End Sub

Sub Command3D7_Click ()
'On Error Resume Next
'W_Bar.Value = W_Bar.Value + W_Bar.SmallChange
'If Err Then W_Bar.Value = W_Bar.Max

End Sub

Sub Command3D7_MouseDown (Button As Integer, Shift As Integer, X As Single, Y As
Single)
On Error Resume Next

'set downflag
    If DownFlag% = True Then Exit Sub
    DownFlag% = True

'change first value
    W_Bar.Value = W_Bar.Value + W_Bar.SmallChange
    W_Bar.Refresh

'allow time for mouseup
    rsleep .5

'enter loop for continous value change
    Do Until DownFlag% = False
        W_Bar.Value = W_Bar.Value + W_Bar.SmallChange
        W_Bar.Refresh
        DoEvents
    Loop

    DownFlag% = False

End Sub

Sub Command3D7_MouseUp (Button As Integer, Shift As Integer, X As Single, Y As
Single)
DownFlag% = False
End Sub

Sub Form_KeyDown (KeyCode As Integer, Shift As Integer)
GlobalKeyDown KeyCode, Shift
End Sub

Sub Form_Load ()
On Error Resume Next

SetUpWindow Me, "Torque"

'Set Scroll Bar Values
```

```
    XY_Bar.Value = Read_XY_Limit()
    ZE_Bar.Value = Read_ZE_Limit()
    W_Bar.Value = Read_W_Limit()

'Update Display Boxes
    XY_Bar_Change
    ZE_Bar_Change
    W_Bar_Change

'Center Controls
    CenterControlW Label1, Me.Width

End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub W_Bar_Change ()
W_Label = Format$(W_Bar.Value)
End Sub

Sub XY_Bar_Change ()
XY_Label = Format$(XY_Bar.Value)
End Sub

Sub ZE_Bar_Change ()
ZE_Label = Format$(ZE_Bar.Value)
End Sub
```

```
VERSION 2.00
Begin Form NeedleMotorHome
   BackColor        =   &H00FFFF00&
   BorderStyle      =   0  'None
   Caption          =   "HOME-NEEDLE"
   ClientHeight     =   7485
   ClientLeft       =   120
   ClientTop        =   2295
   ClientWidth      =   10545
   ClipControls     =   0   'False
   ControlBox       =   0   'False
   ForeColor        =   &H000000FF&
   Height           =   7890
   KeyPreview       =   -1  'True
   Left             =   60
   LinkTopic        =   "Form1"
   MaxButton        =   0   'False
   MinButton        =   0   'False
   ScaleHeight      =   7485
   ScaleWidth       =   10545
   Top              =   1950
   Width            =   10665
   WindowState      =   2  'Maximized
   Begin PictureBox P
      BackColor        =   &H00FFFF00&
      BorderStyle      =   0  'None
      Height           =   3975
      Left             =   900
      ScaleHeight      =   3975
      ScaleWidth       =   4875
      TabIndex         =   8
      Top              =   2040
      Width            =   4875
      Begin SSCommand Command3D1
         BevelWidth       =   10
         Caption          =   "REVERSE"
         Enabled          =   0   'False
         FontBold         =   -1  'True
         FontItalic       =   0   'False
         FontName         =   "Arial"
         FontSize         =   15.75
         FontStrikethru   =   0   'False
         FontUnderline    =   0   'False
         ForeColor        =   &H000000FF&
         Height           =   1215
         Left             =   0
         TabIndex         =   11
         Top              =   540
         Width            =   2055
      End
      Begin SSCommand Command3D2
         BevelWidth       =   10
         Caption          =   "FORWARD"
         Enabled          =   0   'False
         FontBold         =   -1  'True
         FontItalic       =   0   'False
         FontName         =   "Arial"
         FontSize         =   15.75
         FontStrikethru   =   0   'False
         FontUnderline    =   0   'False
         ForeColor        =   &H000000FF&
         Height           =   1215
         Left             =   2760
         TabIndex         =   10
         Top              =   540
         Width            =   2055
      End
      Begin SSCommand Command3D4
         BevelWidth       =   10
         Caption          =   "EXIT"
         Enabled          =   0   'False
         FontBold         =   -1  'True
```

```
      FontItalic       =   0    'False
      FontName         =   "Arial"
      FontSize         =   18
      FontStrikethru   =   0    'False
      FontUnderline    =   0    'False
      ForeColor        =   &H000000FF&
      Height           =   1215
      Left             =   1380
      TabIndex         =   9
      Top              =   2700
      Width            =   2175
   End
   Begin Label Label3
      Alignment        =   2   'Center
      BackStyle        =   0   'Transparent
      Caption          =   "NEEDLE MOTOR HOME POSITION"
      FontBold         =   -1   'True
      FontItalic       =   0    'False
      FontName         =   "Arial"
      FontSize         =   13.5
      FontStrikethru   =   0    'False
      FontUnderline    =   0    'False
      Height           =   435
      Left             =   0
      TabIndex         =   2
      Top              =   0
      Width            =   4875
   End
   Begin Label FValue
      BackStyle        =   0   'Transparent
      Caption          =   "0000"
      FontBold         =   0    'False
      FontItalic       =   0    'False
      FontName         =   "MS Sans Serif"
      FontSize         =   13.5
      FontStrikethru   =   0    'False
      FontUnderline    =   0    'False
      Height           =   345
      Left             =   2520
      TabIndex         =   3
      Top              =   1980
      Width            =   855
   End
   Begin Label FValueT
      BackStyle        =   0   'Transparent
      Caption          =   "Value:"
      FontBold         =   0    'False
      FontItalic       =   0    'False
      FontName         =   "MS Sans Serif"
      FontSize         =   13.5
      FontStrikethru   =   0    'False
      FontUnderline    =   0    'False
      Height           =   345
      Left             =   1560
      TabIndex         =   5
      Top              =   1980
      Width            =   915
   End
End
Begin SSCommand HJog
   BevelWidth       =   10
   Caption          =   "OFF"
   FontBold         =   -1   'True
   FontItalic       =   0    'False
   FontName         =   "Arial"
   FontSize         =   18
   FontStrikethru   =   0    'False
   FontUnderline    =   0    'False
   ForeColor        =   &H000000FF&
   Height           =   1215
   Left             =   7380
   TabIndex         =   6
```

```
      Top              =   2340
      Width            =   1335
   End
   Begin Shape Shape1
      Height           =   1395
      Left             =   360
      Top              =   180
      Width            =   8955
   End
   Begin Label Label5
      Alignment        =   2   'Center
      BackStyle        =   0   'Transparent
      Caption          =   "Reverse Needle direction while traveling Home"
      FontBold         =   0    'False
      FontItalic       =   0    'False
      FontName         =   "MS Sans Serif"
      FontSize         =   13.5
      FontStrikethru   =   0    'False
      FontUnderline    =   0    'False
      Height           =   1275
      Left             =   7080
      TabIndex         =   7
      Top              =   3660
      Width            =   2055
   End
   Begin Line Line2
      Visible          =   0    'False
      X1               =   9660
      X2               =   0
      Y1               =   7260
      Y2               =   7260
   End
   Begin Line Line1
      Visible          =   0    'False
      X1               =   9660
      X2               =   9660
      Y1               =   0
      Y2               =   7260
   End
   Begin Label Label4
      Alignment        =   2   'Center
      BackStyle        =   0   'Transparent
      Caption          =   "WARNING: IF YOU DO NOT KNOW EXACTLY WHAT YOU ARE DOING ON
THIS SCREEN-DO NOT CHANGE ANYTHING. THE RESULTS OF AN INCORRECT VALUE COULD DISABLE
THIS MACHINE."
      FontBold         =   -1   'True
      FontItalic       =   0    'False
      FontName         =   "Arial"
      FontSize         =   13.5
      FontStrikethru   =   0    'False
      FontUnderline    =   0    'False
      ForeColor        =   &H00FF0000&
      Height           =   975
      Left             =   120
      TabIndex         =   4
      Top              =   6240
      Width            =   9315
   End
   Begin Label Label1
      Alignment        =   2   'Center
      BackStyle        =   0   'Transparent
      Caption          =   "TICE ENGINEERING"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00800000&
      Height           =   615
      Left             =   2700
      TabIndex         =   1
```

```
      Top              =   300
      Width            =   4695
   End
   Begin Label Label2
      Alignment        =   2   'Center
      BackStyle        =   0   'Transparent
      Caption          =   "JL-5000"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   4080
      TabIndex         =   0
      Top              =   900
      Width            =   2235
   End
   Begin Image Image1
      Height           =   480
      Left             =   6300
      Picture          =   NM_HOME.FRX:0000
      Top              =   900
      Width            =   480
   End
End
Dim DownFlag%

Sub Command3D1_MouseDown (Button As Integer, Shift As Integer, X As Single, Y As
Single)
On Error Resume Next

'set downflag
    If DownFlag% = True Then Exit Sub
    DownFlag% = True

'change first value
    status = G_Command("SP,,,1000")
    status = G_Command("PR,,,-10")
    status = G_Command("BGW")


'allow time for mouseup
    rsleep .5

'enter loop for continous value change
    Do Until DownFlag% = False
        status = G_Command("SP,,,1000")
        status = G_Command("PR,,,-10")
        status = G_Command("BGW")
        DoEvents
    Loop

    DownFlag% = False

End Sub

Sub Command3D1_MouseUp (Button As Integer, Shift As Integer, X As Single, Y As
Single)
DownFlag% = False
End Sub

Sub Command3D2_MouseDown (Button As Integer, Shift As Integer, X As Single, Y As
Single)
On Error Resume Next

'set downflag
    If DownFlag% = True Then Exit Sub
    DownFlag% = True
```

```
'change first value
    status = G_Command("SP,,,1000")
    status = G_Command("PR,,,10")
    status = G_Command("BGW")


'allow time for mouseup
    rsleep .5

'enter loop for continous value change
    Do Until DownFlag% = False
        status = G_Command("SP,,,1000")
        status = G_Command("PR,,,10")
        status = G_Command("BGW")
        DoEvents
    Loop

    DownFlag% = False

End Sub

Sub Command3D2_MouseUp (Button As Integer, Shift As Integer, X As Single, Y As
Single)
DownFlag% = False
End Sub

Sub Command3D4_Click ()
'Turn off Handwheel
    G_Stop
    CurrentWindow$ = "NeedleMotorHomeExit"


'Get FValue Value
    Ret$ = Space$(255)
    r% = get_from_1000("TPW", Ret$)
    V# = Val(Ret$)
    If DMode = True Then
        Ret$ = InputBox$("Enter Needle Home Value")
        V# = Val(Ret$)
        End If
    'Get Index under 4000
        V# = V# - (Fix(V# / 4000) * 4000)
    'Make to nearest 10
        V# = Fix(V# / 10) * 10


'Ask Input
    r% = YN("Use value of " & Format$(V#) & " for new Needle Home Adjustment?",
"Needle Home")
    If r% = False Then
        Unload Me
        Exit Sub
        End If


'Write Value to INI
    r% = WriteNeedleHome(V#)
    If HJog.Caption = "ON" Then
        r% = WriteNeedleHomeJog(True)
        Else
        r% = WriteNeedleHomeJog(False)
        End If

'Check if this is a factory setting
    If ReadFacNeedleHome() = "" Or TechMode = True Or FactoryFlag% = True Then
        r% = WriteFacNeedleHome(V#)
        If HJog.Caption = "ON" Then
            r% = WriteNeedleHomeJog(True)
            Else
            r% = WriteNeedleHomeJog(False)
            End If
        End If
```

```
'Unload Form
    ResetGalia

'Wait till reset is done
    If DMode = True Then
        Unload Me
        Exit Sub
        End If
    Ret$ = "0"
    Dim T2 As Double, T3 As Double
    T2 = Now
    N! = 10
    T3 = T2 + (TimeSerial(0, 0, 1) * N!)

    Do Until Val(Ret$) <> 0 Or T2 > T3
        Ret$ = Space$(255)
        r% = get_from_1000("HomeDone=?", Ret$)
        T2 = Now
    Loop

'unload form
    Unload Me

End Sub

Sub Form_KeyDown (KeyCode As Integer, Shift As Integer)
GlobalKeyDown KeyCode, Shift
End Sub

Sub Form_Load ()
SetUpWindow Me, "NeedleMotorHome"

'Center Controls
    CenterControlW Label1, Me.Width
    CenterControlW Label2, Me.Width
    Image1.Left = Label2.Left + Label2.Width
    CenterControlW Label3, P.Width
    Command3D1.Left = Label3.Left
    Command3D2.Left = Label3.Left + Label3.Width - Command3D2.Width
    'CenterControlW FValue, Me.Width
    CenterControlW Command3D4, P.Width
    CenterControlW Label4, Me.Width
    HJog.Top = P.Top + Command3D2.Top
    Label5.Top = HJog.Top + HJog.Height + 50


'Get Current Value from INI
    FValue = Format$(ReadNeedleHome())
    If ReadNeedleHomeJog() = True Then HJog.Caption = "ON"

'Show Form and start Handwheel
    G_Stop
    G_WHandWheel
    G_FootDown
    Me.Show

'Enable Controls
    Command3D1.Enabled = True
    Command3D2.Enabled = True
    Command3D4.Enabled = True
End Sub

Sub HJog_Click ()
If HJog.Caption = "OFF" Then
    HJog.Caption = "ON"
    Else
    HJog.Caption = "OFF"
    End If
End Sub

Sub rsleep (N As Single)
```

```
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub
```

```
VERSION 2.00
Begin Form XYAdjust
   BackColor        =   &H00FFFF00&
   BorderStyle      =   0  'None
   Caption          =   "XY ADJUSTMENTS"
   ClientHeight     =   8040
   ClientLeft       =   300
   ClientTop        =   1560
   ClientWidth      =   10110
   ClipControls     =   0   'False
   ControlBox       =   0   'False
   Height           =   8445
   KeyPreview       =   -1  'True
   Left             =   240
   LinkTopic        =   "Form2"
   MaxButton        =   0   'False
   MinButton        =   0   'False
   ScaleHeight      =   8040
   ScaleWidth       =   10110
   Top              =   1215
   Width            =   10230
   WindowState      =   2  'Maximized
   Begin PictureBox Picture2
      BackColor       =   &H00FFFFC0&
      Height          =   5355
      Left            =   180
      ScaleHeight     =   5325
      ScaleWidth      =   2445
      TabIndex        =   15
      Top             =   1620
      Width           =   2475
      Begin SSCommand Plus
         BevelWidth      =   10
         Caption         =   "+"
         FontBold        =   -1  'True
         FontItalic      =   0   'False
         FontName        =   "MS Sans Serif"
         FontSize        =   24
         FontStrikethru  =   0   'False
         FontUnderline   =   0   'False
         ForeColor       =   &H000000FF&
         Height          =   855
         Left            =   960
         TabIndex        =   18
         Top             =   1920
         Width           =   1335
      End
      Begin VScrollBar VScroll
         Height          =   4275
         LargeChange     =   100
         Left            =   180
         Max             =   4000
         Min             =   1
         TabIndex        =   17
         Top             =   780
         Value           =   1
         Width           =   615
      End
      Begin SSCommand Minus
         BevelWidth      =   10
         Caption         =   "-"
         FontBold        =   -1  'True
         FontItalic      =   0   'False
         FontName        =   "MS Sans Serif"
         FontSize        =   36
         FontStrikethru  =   0   'False
         FontUnderline   =   0   'False
         ForeColor       =   &H000000FF&
         Height          =   855
         Left            =   960
         TabIndex        =   16
         Top             =   780
```

```
      Width            =   1335
   End
   Begin Label Label5
      BackStyle        =   0  'Transparent
      Caption          =   "XY/NEEDLE MOTION RATIO"
      FontBold         =   -1  'True
      FontItalic       =   0   'False
      FontName         =   "Arial"
      FontSize         =   9.75
      FontStrikethru   =   0   'False
      FontUnderline    =   0   'False
      Height           =   555
      Left             =   180
      TabIndex         =   5
      Top              =   120
      Width            =   1635
   End
   Begin Label Unit
      BorderStyle      =   1  'Fixed Single
      Height           =   315
      Left             =   900
      TabIndex         =   6
      Top              =   4740
      Width            =   1395
   End
End
Begin PictureBox Picture1
   BackColor        =   &H00FFFFC0&
   Height           =   5355
   Left             =   2760
   ScaleHeight      =   5325
   ScaleWidth       =   4905
   TabIndex         =   7
   Top              =   1620
   Width            =   4935
   Begin SSCommand Command3D2
      BevelWidth       =   10
      Caption          =   "X"
      FontBold         =   -1  'True
      FontItalic       =   0   'False
      FontName         =   "Arial"
      FontSize         =   18
      FontStrikethru   =   0   'False
      FontUnderline    =   0   'False
      ForeColor        =   &H000000FF&
      Height           =   1320
      Left             =   180
      Picture          =   XYADJUST.FRX:0000
      TabIndex         =   11
      Top              =   1680
      Width            =   1455
   End
   Begin SSCommand Command3D1
      BevelWidth       =   10
      Caption          =   "Y"
      FontBold         =   -1  'True
      FontItalic       =   0   'False
      FontName         =   "Arial"
      FontSize         =   18
      FontStrikethru   =   0   'False
      FontUnderline    =   0   'False
      ForeColor        =   &H000000FF&
      Height           =   1335
      Left             =   1740
      Picture          =   XYADJUST.FRX:0302
      TabIndex         =   10
      Top              =   3120
      Width            =   1455
   End
   Begin SSCommand Command3D3
      BevelWidth       =   10
      Caption          =   "Y"
```

```
    FontBold          =   -1   'True
    FontItalic        =   0    'False
    FontName          =   "Arial"
    FontSize          =   18
    FontStrikethru    =   0    'False
    FontUnderline     =   0    'False
    ForeColor         =   &H000000FF&
    Height            =   1335
    Left              =   1740
    Picture           =   XYADJUST.FRX:0604
    TabIndex          =   9
    Top               =   240
    Width             =   1455
End
Begin SSCommand Command3D4
    BevelWidth        =   10
    Caption           =   "X"
    FontBold          =   -1   'True
    FontItalic        =   0    'False
    FontName          =   "Arial"
    FontSize          =   18
    FontStrikethru    =   0    'False
    FontUnderline     =   0    'False
    ForeColor         =   &H000000FF&
    Height            =   1335
    Left              =   3300
    Picture           =   XYADJUST.FRX:0906
    TabIndex          =   8
    Top               =   1680
    Width             =   1455
End
Begin Label Label3
    Alignment         =   2   'Center
    BackStyle         =   0   'Transparent
    Caption           =   "SET XY POSITIONS"
    FontBold          =   -1   'True
    FontItalic        =   0    'False
    FontName          =   "MS Sans Serif"
    FontSize          =   13.5
    FontStrikethru    =   0    'False
    FontUnderline     =   0    'False
    Height            =   375
    Left              =   60
    TabIndex          =   14
    Top               =   4740
    Width             =   4755
End
Begin Label FXValue
    Alignment         =   2   'Center
    BorderStyle       =   1   'Fixed Single
    Caption           =   "ValueX: 0000"
    FontBold          =   0    'False
    FontItalic        =   0    'False
    FontName          =   "MS Sans Serif"
    FontSize          =   9.75
    FontStrikethru    =   0    'False
    FontUnderline     =   0    'False
    Height            =   345
    Left              =   1860
    TabIndex          =   13
    Top               =   1920
    Width             =   1215
End
Begin Label FYValue
    Alignment         =   2   'Center
    BorderStyle       =   1   'Fixed Single
    Caption           =   "ValueY: 0000"
    FontBold          =   0    'False
    FontItalic        =   0    'False
    FontName          =   "MS Sans Serif"
    FontSize          =   9.75
    FontStrikethru    =   0    'False
```

```
      FontUnderline    =   0    'False
      Height           =   345
      Left             =   1860
      TabIndex         =   12
      Top              =   2400
      Width            =   1215
   End
End
Begin SSCommand Command3D7
   BevelWidth       =   10
   Caption          =   "FT. DOWN"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H000000FF&
   Height           =   900
   Left             =   7920
   TabIndex         =   4
   Top              =   2700
   Width            =   1575
End
Begin SSCommand Command3D6
   BevelWidth       =   10
   Caption          =   "FOOT UP"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H000000FF&
   Height           =   900
   Left             =   7920
   TabIndex         =   3
   Top              =   1620
   Width            =   1575
End
Begin SSCommand Command3D5
   BevelWidth       =   10
   Caption          =   "EXIT"
   FontBold         =   -1   'True
   FontItalic       =   0    'False
   FontName         =   "Arial"
   FontSize         =   24
   FontStrikethru   =   0    'False
   FontUnderline    =   0    'False
   ForeColor        =   &H000000FF&
   Height           =   1815
   Left             =   7920
   Picture          =   XYADJUST.FRX:0C08
   TabIndex         =   0
   Top              =   5160
   Width            =   1620
End
Begin Line Line2
   Visible          =   0    'False
   X1               =   9660
   X2               =   0
   Y1               =   7260
   Y2               =   7260
End
Begin Line Line1
   Visible          =   0    'False
   X1               =   9660
   X2               =   9660
   Y1               =   0
   Y2               =   7260
End
Begin Image Image1
```

```
      Height          =   480
      Left            =   6210
      Picture         =   XYADJUST.FRX:0F0A
      Top             =   720
      Width           =   480
   End
   Begin Label Label1
      Alignment       =   2  'Center
      BackStyle       =   0  'Transparent
      Caption         =   "TICE ENGINEERING"
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H000000FF&
      Height          =   615
      Index           =   1
      Left            =   0
      TabIndex        =   2
      Top             =   180
      Width           =   9675
   End
   Begin Label Label2
      Alignment       =   2  'Center
      BackColor       =   &H00800000&
      BackStyle       =   0  'Transparent
      Caption         =   "JL-5000"
      FontBold        =   -1  'True
      FontItalic      =   0   'False
      FontName        =   "Arial"
      FontSize        =   24
      FontStrikethru  =   0   'False
      FontUnderline   =   0   'False
      ForeColor       =   &H000000FF&
      Height          =   615
      Left            =   60
      TabIndex        =   1
      Top             =   660
      Width           =   9645
   End
End
Const XYConst = 25
Dim DownFlag%


Sub Command3D1_Click ()

'XYMoveY 1
End Sub

Sub Command3D1_MouseDown (Button As Integer, Shift As Integer, X As Single, Y As
Single)
On Error Resume Next

'set downflag
    If DownFlag% = True Then Exit Sub
    DownFlag% = True

'change first value
    XYMoveY 1

'allow time for mouseup
    rsleep .5

'enter loop for continous value change
    Do Until DownFlag% = False
        XYMoveY 1
        DoEvents
    Loop
```

```
    DownFlag% = False

End Sub

Sub Command3D1_MouseUp (Button As Integer, Shift As Integer, X As Single, Y As
Single)
DownFlag% = False
End Sub

Sub Command3D2_MouseDown (Button As Integer, Shift As Integer, X As Single, Y As
Single)
On Error Resume Next

'set downflag
    If DownFlag% = True Then Exit Sub
    DownFlag% = True

'change first value
    XYMoveX -1

'allow time for mouseup
    rsleep .5

'enter loop for continous value change
    Do Until DownFlag% = False
        XYMoveX -1
        DoEvents
    Loop

    DownFlag% = False

End Sub

Sub Command3D2_MouseUp (Button As Integer, Shift As Integer, X As Single, Y As
Single)
DownFlag% = False
End Sub

Sub Command3D3_MouseDown (Button As Integer, Shift As Integer, X As Single, Y As
Single)
On Error Resume Next

'set downflag
    If DownFlag% = True Then Exit Sub
    DownFlag% = True

'change first value
    XYMoveY -1

'allow time for mouseup
    rsleep .5

'enter loop for continous value change
    Do Until DownFlag% = False
        XYMoveY -1
        DoEvents
    Loop

    DownFlag% = False

End Sub

Sub Command3D3_MouseUp (Button As Integer, Shift As Integer, X As Single, Y As
Single)
DownFlag% = False
End Sub

Sub Command3D4_Click ()
'XYMoveX 1
End Sub
```

```
Sub Command3D4_MouseDown (Button As Integer, Shift As Integer, X As Single, Y As
Single)
On Error Resume Next

'set downflag
    If DownFlag% = True Then Exit Sub
    DownFlag% = True

'change first value
    XYMoveX 1

'allow time for mouseup
    rsleep .5

'enter loop for continous value change
    Do Until DownFlag% = False
        XYMoveX 1
        DoEvents
    Loop

    DownFlag% = False

End Sub

Sub Command3D4_MouseUp (Button As Integer, Shift As Integer, X As Single, Y As
Single)
DownFlag% = False
End Sub

Sub Command3D5_Click ()
G_Stop
status = G_Command("DP0,0")
status = G_Command("SB16")
G_Wait 50

'Check if this is a factory setting
    If ReadFacHomeX() = "" Or ReadFacHomeY() = "" Or TechMode = True Or FactoryFlag%
= True Then
        r% = WriteFacHomeX(ReadHomeX())
        r% = WriteFacHomeY(ReadHomeY())
        If TechMode = True Then
            'ResetGalia
            Else
            'ResetGaliaWithoutHome
            End If
        Else
        'ResetGalia
        End If


'XYW RATIO
    If VScroll.Value <> Read_XYW_Ratio() Then
        Write_XYW_Ratio VScroll.Value
        If ReadFacHomeXYW() = "" Or TechMode = True Or FactoryFlag% = True Then
            Success% = WriteFacHomeXYW(VScroll.Value)
            End If
        End If

'Reset
    ResetGalia

If DMode = False Then
    'Wait till reset is done
        Ret$ = "0"
        Dim T2 As Double, T3 As Double
        T2 = Now
        N! = 10
        T3 = T2 + (TimeSerial(0, 0, 1) * N!)

        Do Until Val(Ret$) <> 0 Or T2 > T3
            Ret$ = Space$(255)
            r% = get_from_1000("HomeDone=?", Ret$)
```

```
            T2 = Now
        Loop
    End If

Unload Me

End Sub

Sub Command3D6_Click ()
G_FootUp
End Sub

Sub Command3D7_Click ()
G_FootDown
End Sub

Sub Form_KeyDown (KeyCode As Integer, Shift As Integer)
GlobalKeyDown KeyCode, Shift
End Sub

Sub Form_Load ()
On Error Resume Next
SetUpWindow Me, "XYAdjust"

'Load X,Y
    FXValue = "Value: " & Format$(ReadHomeX())
    FYVALUE = "Value: " & Format$(ReadHomeY())

VScroll.Value = Read_XYW_Ratio()
VScroll_Change
End Sub

Sub Minus_MouseDown (Button As Integer, Shift As Integer, X As Single, Y As Single)
On Error Resume Next

'set downflag
    If DownFlag% = True Then Exit Sub
    DownFlag% = True

'change first value
    VScroll.Value = VScroll.Value - VScroll.SmallChange
    VScroll.Refresh

'allow time for mouseup
    rsleep .5

'enter loop for continous value change
    Do Until DownFlag% = False
        VScroll.Value = VScroll.Value - VScroll.SmallChange
        If Err Then DownFlag% = False: VScroll.Value = VScroll.Min
        VScroll.Refresh
        DoEvents
    Loop

    DownFlag% = False

End Sub

Sub Minus_MouseUp (Button As Integer, Shift As Integer, X As Single, Y As Single)
DownFlag% = False
End Sub

Sub Plus_MouseDown (Button As Integer, Shift As Integer, X As Single, Y As Single)
On Error Resume Next

'set downflag
    If DownFlag% = True Then Exit Sub
    DownFlag% = True

'change first value
    VScroll.Value = VScroll.Value + VScroll.SmallChange
    VScroll.Refresh
```

```
'allow time for mouseup
    rsleep .5

'enter loop for continous value change
    Do Until DownFlag% = False
        VScroll.Value = VScroll.Value + VScroll.SmallChange
        If Err Then DownFlag% = False: VScroll.Value = VScroll.Max
        VScroll.Refresh
        DoEvents
    Loop

    DownFlag% = False

End Sub

Sub Plus_MouseUp (Button As Integer, Shift As Integer, X As Single, Y As Single)
DownFlag% = False
End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub VScroll_Change ()
On Error Resume Next
Unit = Format$(VScroll.Value, "0")

End Sub

Sub XYMoveX (ByVal M%)
'Dim M% 'value of -1 or +1

If M% <> -1 And M% <> 1 Then M% = 1

'Set new values
    tmpXYConst% = XYConst * M%

'Get Value
    MaxValue% = 3000 - (14 * 80)
    V% = ReadHomeX() + tmpXYConst%
    If V% < 0 Then V% = 0
    If V% > MaxValue% Then V% = MaxValue%
    r% = WriteHomeX(V%)
    FXValue = "Value: " & Format$(V%)
    If V% + tmpXYConst% >= 0 And V% + tmpXYConst% <= MaxValue% Then
        XYMove tmpXYConst%, 0
        End If

End Sub

Sub XYMoveY (ByVal M%)
'Dim M% 'value of -1 or +1

If M% <> -1 And M% <> 1 Then M% = 1

'Set new values
    tmpXYConst% = XYConst * M%
```

```
'Get Value
    MaxValue% = 3000 - (7 * 50)
    V% = ReadHomeY() + tmpXYConst%
    If V% < 0 Then V% = 0
    If V% > MaxValue% Then V% = MaxValue%
    r% = WriteHomeY(V%)
    FYVALUE = "Value: " & Format$(V%)
    If V% + tmpXYConst% >= 0 And V% + tmpXYConst% <= MaxValue% Then
        XYMove 0, tmpXYConst%
        End If

End Sub
```

```
VERSION 2.00
Begin Form HandWheel
   BackColor        =   &H00FFFF00&
   BorderStyle      =   1  'Fixed Single
   Caption          =   "Hand Wheel"
   ClientHeight     =   8385
   ClientLeft       =   -225
   ClientTop        =   1905
   ClientWidth      =   11550
   ControlBox       =   0   'False
   Height           =   8790
   KeyPreview       =   -1  'True
   Left             =   -285
   LinkTopic        =   "Form2"
   MaxButton        =   0   'False
   MinButton        =   0   'False
   ScaleHeight      =   8385
   ScaleWidth       =   11550
   Top              =   1560
   Width            =   11670
   Begin Timer Timer1
      Enabled          =   0   'False
      Interval         =   100
      Left             =   10020
      Top              =   5220
   End
   Begin PictureBox Picture5
      BackColor        =   &H00C0C0C0&
      Height           =   615
      Left             =   9960
      Picture          =   HWHEEL.FRX:0000
      ScaleHeight      =   585
      ScaleWidth       =   765
      TabIndex         =   40
      Top              =   2160
      Width            =   795
   End
   Begin PictureBox Picture4
      BackColor        =   &H00C0C0C0&
      Height           =   615
      Left             =   9960
      Picture          =   HWHEEL.FRX:08AE
      ScaleHeight      =   585
      ScaleWidth       =   765
      TabIndex         =   39
      Top              =   1380
      Width            =   795
   End
   Begin SSCommand Command3D10
      BevelWidth       =   10
      Caption          =   "Gain On"
      FontBold         =   -1  'True
      FontItalic       =   0   'False
      FontName         =   "Arial"
      FontSize         =   15
      FontStrikethru   =   0   'False
      FontUnderline    =   0   'False
      ForeColor        =   &H000000FF&
      Height           =   975
      Left             =   5340
      TabIndex         =   38
      Top              =   4860
      Width            =   1695
   End
   Begin SSCommand Command3D9
      BevelWidth       =   10
      Caption          =   "Micro Advance / Needle Up"
      FontBold         =   -1  'True
      FontItalic       =   0   'False
      FontName         =   "Arial"
      FontSize         =   15
      FontStrikethru   =   0   'False
```

```
   FontUnderline    =   0   'False
   ForeColor        =   &H000000FF&
   Height           =   975
   Left             =   2520
   TabIndex         =   2
   Top              =   6000
   Width            =   4515
End
Begin PictureBox Picture3
   BackColor        =   &H00FFFF00&
   Height           =   1815
   Left             =   120
   ScaleHeight      =   1785
   ScaleWidth       =   4065
   TabIndex         =   36
   Top              =   2820
   Width            =   4095
   Begin SSCommand Command3D8
      BevelWidth       =   10
      Caption          =   "-"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   975
      Left             =   120
      TabIndex         =   3
      Top              =   450
      Width            =   1575
   End
   Begin SSCommand Command3D7
      BevelWidth       =   10
      Caption          =   "+"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   975
      Left             =   2190
      TabIndex         =   37
      Top              =   450
      Width            =   1575
   End
   Begin Label RValue
      Alignment        =   2  'Center
      BackStyle        =   0  'Transparent
      Caption          =   "Value: 0000"
      FontBold         =   0   'False
      FontItalic       =   0   'False
      FontName         =   "MS Sans Serif"
      FontSize         =   9.75
      FontStrikethru   =   0   'False
      FontUnderline    =   0   'False
      Height           =   345
      Left             =   0
      TabIndex         =   8
      Top              =   1530
      Width            =   4065
   End
   Begin Label Label4
      Alignment        =   2  'Center
      BackStyle        =   0  'Transparent
      Caption          =   "Rear Hook Timing Adjustment"
      FontBold         =   -1  'True
      FontItalic       =   0   'False
      FontName         =   "MS Sans Serif"
```

```
      FontSize          =   9.75
      FontStrikethru    =   0    'False
      FontUnderline     =   0    'False
      Height            =   315
      Left              =   0
      TabIndex          =   35
      Top               =   120
      Width             =   4005
   End
End
Begin PictureBox Picture2
   BackColor         =   &H00FFFF00&
   Height            =   3735
   Left              =   4320
   ScaleHeight       =   3705
   ScaleWidth        =   5175
   TabIndex          =   12
   Top               =   900
   Width             =   5205
   Begin TextBox ResponseOutput
      BackColor         =   &H00FFFF00&
      FontBold          =   -1   'True
      FontItalic        =   0    'False
      FontName          =   "Arial"
      FontSize          =   12
      FontStrikethru    =   0    'False
      FontUnderline     =   0    'False
      Height            =   1755
      Left              =   90
      TabIndex          =   23
      Top               =   60
      Width             =   5025
   End
   Begin TextBox ErrX
      Height            =   288
      Left              =   3750
      TabIndex          =   22
      Top               =   1950
      Width             =   1332
   End
   Begin TextBox ErrY
      Height            =   288
      Left              =   3750
      TabIndex          =   21
      Top               =   2310
      Width             =   1332
   End
   Begin TextBox PosX
      Height            =   288
      Left              =   1200
      TabIndex          =   20
      Top               =   1920
      Width             =   1332
   End
   Begin TextBox PosY
      Height            =   288
      Left              =   1200
      TabIndex          =   19
      Top               =   2280
      Width             =   1332
   End
   Begin TextBox ErrZ
      Height            =   288
      Left              =   3750
      TabIndex          =   18
      Top               =   2670
      Width             =   1332
   End
   Begin TextBox PosZ
      Height            =   288
      Left              =   1200
      TabIndex          =   17
```

```
   Top              =   2640
   Width            =   1332
End
Begin TextBox PosW
   Height           =   288
   Left             =   1200
   TabIndex         =   16
   Top              =   3000
   Width            =   1332
End
Begin TextBox ErrW
   Height           =   288
   Left             =   3750
   TabIndex         =   15
   Top              =   3030
   Width            =   1332
End
Begin TextBox PosE
   Height           =   288
   Left             =   1200
   TabIndex         =   14
   Top              =   3360
   Width            =   1332
End
Begin TextBox ErrE
   Height           =   288
   Left             =   3750
   TabIndex         =   13
   Top              =   3390
   Width            =   1332
End
Begin Label Label14
   BackStyle        =   0  'Transparent
   Caption          =   "ErrorX"
   Height           =   255
   Left             =   2910
   TabIndex         =   33
   Top              =   1950
   Width            =   735
End
Begin Label Label13
   BackStyle        =   0  'Transparent
   Caption          =   "ErrorY"
   Height           =   255
   Left             =   2910
   TabIndex         =   32
   Top              =   2310
   Width            =   735
End
Begin Label Label5
   BackStyle        =   0  'Transparent
   Caption          =   "PosX"
   Height           =   255
   Left             =   120
   TabIndex         =   31
   Top              =   1920
   Width            =   615
End
Begin Label Label6
   BackStyle        =   0  'Transparent
   Caption          =   "PosY"
   Height           =   255
   Left             =   120
   TabIndex         =   30
   Top              =   2280
   Width            =   495
End
Begin Label Label7
   BackStyle        =   0  'Transparent
   Caption          =   "ErrorZ"
   Height           =   255
   Left             =   2910
```

```
      TabIndex          =   29
      Top               =   2670
      Width             =   735
   End
   Begin Label Label8
      BackStyle         =   0  'Transparent
      Caption           =   "ErrorW"
      Height            =   255
      Left              =   2910
      TabIndex          =   28
      Top               =   3030
      Width             =   735
   End
   Begin Label Label9
      BackStyle         =   0  'Transparent
      Caption           =   "ErrorE"
      Height            =   255
      Left              =   2910
      TabIndex          =   27
      Top               =   3390
      Width             =   735
   End
   Begin Label Label10
      BackStyle         =   0  'Transparent
      Caption           =   "Hook A"
      Height            =   255
      Left              =   120
      TabIndex          =   26
      Top               =   2640
      Width             =   975
   End
   Begin Label Label11
      BackStyle         =   0  'Transparent
      Caption           =   "Needle:"
      Height            =   255
      Left              =   120
      TabIndex          =   25
      Top               =   3000
      Width             =   975
   End
   Begin Label Label12
      BackStyle         =   0  'Transparent
      Caption           =   "Hook B:"
      Height            =   255
      Left              =   120
      TabIndex          =   24
      Top               =   3360
      Width             =   975
   End
End
Begin PictureBox Picture1
   BackColor         =   &H00FFFF00&
   Height            =   1905
   Left              =   120
   ScaleHeight       =   1875
   ScaleWidth        =   4065
   TabIndex          =   9
   Top               =   930
   Width             =   4095
   Begin SSCommand Command3D5
      BevelWidth        =   10
      Caption           =   "-"
      FontBold          =   -1  'True
      FontItalic        =   0   'False
      FontName          =   "Arial"
      FontSize          =   24
      FontStrikethru    =   0   'False
      FontUnderline     =   0   'False
      ForeColor         =   &H000000FF&
      Height            =   975
      Left              =   120
      TabIndex          =   11
```

```
      Top              =   480
      Width            =   1575
   End
   Begin SSCommand Command3D6
      BevelWidth       =   10
      Caption          =   "+"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   975
      Left             =   2160
      TabIndex         =   10
      Top              =   480
      Width            =   1575
   End
   Begin Label FValue
      Alignment        =   2  'Center
      BackStyle        =   0  'Transparent
      Caption          =   "Value: 0000"
      FontBold         =   0   'False
      FontItalic       =   0   'False
      FontName         =   "MS Sans Serif"
      FontSize         =   9.75
      FontStrikethru   =   0   'False
      FontUnderline    =   0   'False
      Height           =   345
      Left             =   0
      TabIndex         =   34
      Top              =   1500
      Width            =   4095
   End
   Begin Label Label3
      Alignment        =   2  'Center
      BackStyle        =   0  'Transparent
      Caption          =   "Front Hook Timing Adjustment"
      FontBold         =   -1  'True
      FontItalic       =   0   'False
      FontName         =   "MS Sans Serif"
      FontSize         =   9.75
      FontStrikethru   =   0   'False
      FontUnderline    =   0   'False
      Height           =   345
      Left             =   0
      TabIndex         =   7
      Top              =   120
      Width            =   4095
   End
End
Begin SSCommand Command3D4
   BevelWidth       =   10
   Caption          =   "XY Drivers Off"
   FontBold         =   -1  'True
   FontItalic       =   0   'False
   FontName         =   "Arial"
   FontSize         =   15
   FontStrikethru   =   0   'False
   FontUnderline    =   0   'False
   ForeColor        =   &H000000FF&
   Height           =   975
   Left             =   2520
   TabIndex         =   6
   Top              =   4860
   Width            =   2595
End
Begin SSCommand Command3D3
   BevelWidth       =   10
   Caption          =   "FT. DOWN"
   FontBold         =   -1  'True
```

```
   FontItalic        =   0   'False
   FontName          =   "Arial"
   FontSize          =   15
   FontStrikethru    =   0   'False
   FontUnderline     =   0   'False
   ForeColor         =   &H000000FF&
   Height            =   975
   Left              =   180
   TabIndex          =   5
   Top               =   6000
   Width             =   2145
End
Begin SSCommand Command3D2
   BevelWidth        =   10
   Caption           =   "FOOT UP"
   FontBold          =   -1  'True
   FontItalic        =   0   'False
   FontName          =   "Arial"
   FontSize          =   15
   FontStrikethru    =   0   'False
   FontUnderline     =   0   'False
   ForeColor         =   &H000000FF&
   Height            =   975
   Left              =   150
   TabIndex          =   4
   Top               =   4860
   Width             =   2145
End
Begin SSCommand Command3D1
   BevelWidth        =   10
   Caption           =   "EXIT"
   FontBold          =   -1  'True
   FontItalic        =   0   'False
   FontName          =   "Arial"
   FontSize          =   24
   FontStrikethru    =   0   'False
   FontUnderline     =   0   'False
   ForeColor         =   &H000000FF&
   Height            =   2115
   Left              =   7320
   Picture           =   HWHEEL.FRX:115C
   TabIndex          =   0
   Top               =   4830
   Width             =   2175
End
Begin Line Line1
   Visible           =   0   'False
   X1                =   9660
   X2                =   9660
   Y1                =   0
   Y2                =   7260
End
Begin Line Line2
   Visible           =   0   'False
   X1                =   9660
   X2                =   0
   Y1                =   7260
   Y2                =   7260
End
Begin Label Label1
   Alignment         =   2  'Center
   BackStyle         =   0  'Transparent
   Caption           =   "HOOK TIMING ADJUSTMENT"
   FontBold          =   -1  'True
   FontItalic        =   0   'False
   FontName          =   "Arial"
   FontSize          =   24
   FontStrikethru    =   0   'False
   FontUnderline     =   0   'False
   ForeColor         =   &H000000FF&
   Height            =   585
   Index             =   0
```

```
      Left            =   60
      TabIndex        =   1
      Top             =   180
      Width           =   9495
   End
End
Dim DownFlag%

Sub Command3D1_Click ()
G_Stop
Status = G_Command("DP0,0")
Status = G_Command("SB16")
G_Wait 50

'Check if this is a factory setting
    If ReadFacRearBobbin() = "" Or ReadFacFrontBobbin() = "" Or TechMode = True Or
FactoryFlag% = True Then
        r% = WriteFacFrontBobbin(ReadFrontBobbin())
        r% = WriteFacRearBobbin(ReadRearBobbin())
        If TechMode = True Then
            'ResetGalia
            Else
            'ResetGaliaWithoutHome
            End If
        Else
        'ResetGalia
        End If

ResetGalia

If DMode = False Then
    'Wait till reset is done
        Ret$ = "0"
        Dim T2 As Double, T3 As Double
        T2 = Now
        N! = 10
        T3 = T2 + (TimeSerial(0, 0, 1) * N!)

        Do Until Val(Ret$) <> 0 Or T2 > T3
            Ret$ = Space$(255)
            r% = get_from_1000("HomeDone=?", Ret$)
            T2 = Now
        Loop
    End If

Unload Me

End Sub

Sub Command3D10_Click ()
Command3D10.Enabled = False
If DMode = True Then Exit Sub
Status = command_1000("GNZ=70")
Status = command_1000("GNE=70")
Status = command_1000("KIZ=0")
Status = command_1000("KIE=0")


End Sub

Sub Command3D2_Click ()
G_FootUp


End Sub

Sub Command3D3_Click ()
G_FootDown


End Sub
```

```
Sub Command3D4_Click ()
Status = G_Command("CB16")

End Sub

Sub Command3D5_MouseDown (Button As Integer, Shift As Integer, X As Single, Y As
Single)
On Error Resume Next

'set downflag
    If DownFlag% = True Then Exit Sub
    DownFlag% = True

'change first value
    FB_minus

'allow time for mouseup
    rsleep .5

'enter loop for continous value change
    Do Until DownFlag% = False
        FB_minus
        DoEvents
    Loop

    DownFlag% = False

End Sub

Sub Command3D5_MouseUp (Button As Integer, Shift As Integer, X As Single, Y As
Single)
DownFlag% = False
End Sub

Sub Command3D6_MouseDown (Button As Integer, Shift As Integer, X As Single, Y As
Single)
On Error Resume Next

'set downflag
    If DownFlag% = True Then Exit Sub
    DownFlag% = True

'change first value
    FB_Plus

'allow time for mouseup
    rsleep .5

'enter loop for continous value change
    Do Until DownFlag% = False
        FB_Plus
        DoEvents
    Loop

    DownFlag% = False
End Sub

Sub Command3D6_MouseUp (Button As Integer, Shift As Integer, X As Single, Y As
Single)
DownFlag% = False
End Sub

Sub Command3D7_MouseDown (Button As Integer, Shift As Integer, X As Single, Y As
Single)
On Error Resume Next

'set downflag
    If DownFlag% = True Then Exit Sub
    DownFlag% = True

'change first value
    RB_Plus
```

```
'allow time for mouseup
    rsleep .5

'enter loop for continous value change
    Do Until DownFlag% = False
        RB_Plus
        DoEvents
    Loop

    DownFlag% = False

End Sub

Sub Command3D7_MouseUp (Button As Integer, Shift As Integer, X As Single, Y As
Single)
DownFlag% = False
End Sub

Sub Command3D8_MouseDown (Button As Integer, Shift As Integer, X As Single, Y As
Single)
On Error Resume Next

'set downflag
    If DownFlag% = True Then Exit Sub
    DownFlag% = True

'change first value
    RB_Minus

'allow time for mouseup
    rsleep .5

'enter loop for continous value change
    Do Until DownFlag% = False
        RB_Minus
        DoEvents
    Loop

    DownFlag% = False

End Sub

Sub Command3D8_MouseUp (Button As Integer, Shift As Integer, X As Single, Y As
Single)
DownFlag% = False
End Sub

Sub Command3D9_Click ()
G_NeedleMicroAdvance Command3D9
End Sub

Sub FB_minus ()
Status = G_Command("SP,,1000")
Status = G_Command("PR,,-10")
Status = G_Command("BGZ")
V# = Val(Mid$(FValue, InStr(FValue, ": ") + 2)) - 10
X% = WriteFrontBobbin(V#)
FValue = "Value: " & Format$(V#)

End Sub

Sub FB_Plus ()
Status = G_Command("SP,,1000")
Status = G_Command("PR,,10")
Status = G_Command("BGZ")

V# = Val(Mid$(FValue, InStr(FValue, ": ") + 2)) + 10
X% = WriteFrontBobbin(V#)
FValue = "Value: " & Format$(V#)

End Sub
```

```
Sub Form_KeyDown (KeyCode As Integer, Shift As Integer)
GlobalKeyDown KeyCode, Shift
End Sub

Sub Form_Load ()
SetUpWindow Me, "HandWheel"

'Load Bobbin Values
     FValue = "Value: " & Format$(ReadFrontBobbin())
     RValue = "Value: " & Format$(ReadRearBobbin())

Command3D5.Caption = ""
Command3D5.Picture = Picture4.Image
Command3D6.Caption = ""
Command3D6.Picture = Picture5.Image

Command3D8.Caption = ""
Command3D8.Picture = Picture4.Image
Command3D7.Caption = ""
Command3D7.Picture = Picture5.Image

If DMode Then Timer1.Enabled = True


End Sub

Sub RB_Minus ()
Status = G_Command("SP,,,,1000")
Status = G_Command("PR,,,,-10")
Status = G_Command("BGE")

V# = Val(Mid$(RValue, InStr(RValue, ": ") + 2)) - 10
X% = WriteRearBobbin(V#)
RValue = "Value: " & Format$(V#)

End Sub

Sub RB_Plus ()
Status = G_Command("SP,,,,1000")
Status = G_Command("PR,,,,10")
Status = G_Command("BGE")

V# = Val(Mid$(RValue, InStr(RValue, ": ") + 2)) + 10
X% = WriteRearBobbin(V#)
RValue = "Value: " & Format$(V#)

End Sub

Sub rsleep (N As Single)
'Pauses computer for N seconds
On Error Resume Next

Dim T2 As Double, T3 As Double
T2 = Now
T3 = T2 + (TimeSerial(0, 0, 1) * N)


Do Until T2 > T3
    T2 = Now
    DoEvents  'optional
    If DownFlag% = False Then Exit Sub
    Loop

End Sub

Sub Timer1_Timer ()

PosX = Format$(Int((4000 - 10 + 1) * Rnd + 10), "00000000")
PosY = Format$(Int((4000 - 10 + 1) * Rnd + 10), "00000000")
PosZ = Format$(Int((4000 - 10 + 1) * Rnd + 10), "00000000")
PosW = Format$(Int((4000 - 10 + 1) * Rnd + 10), "00000000")
```

```
PosE = Format$(Int((4000 - 10 + 1) * Rnd + 10), "00000000")

ErrX = Format$(Int((10 - 1 + 1) * Rnd + 1), "00000000")
ErrY = Format$(Int((10 - 1 + 1) * Rnd + 1), "00000000")
ErrZ = Format$(Int((10 - 1 + 1) * Rnd + 1), "00000000")
ErrW = Format$(Int((10 - 1 + 1) * Rnd + 1), "00000000")
ErrE = Format$(Int((10 - 1 + 1) * Rnd + 1), "00000000")


End Sub
```

```
VERSION 2.00
Begin Form StopForm2
   BackColor          =   &H0000FF00&
   BorderStyle        =   1   'Fixed Single
   Caption            =   "StopForm2"
   ClientHeight       =   8295
   ClientLeft         =   885
   ClientTop          =   1410
   ClientWidth        =   10200
   ClipControls       =   0    'False
   ControlBox         =   0    'False
   Height             =   8700
   KeyPreview         =   -1   'True
   Left               =   825
   LinkTopic          =   "Form3"
   MaxButton          =   0    'False
   MinButton          =   0    'False
   ScaleHeight        =   8295
   ScaleWidth         =   10200
   Top                =   1065
   Width              =   10320
   Begin SSCommand Command3D3
      BevelWidth      =   10
      Caption         =   "FT. UP"
      FontBold        =   -1   'True
      FontItalic      =   0    'False
      FontName        =   "Arial"
      FontSize        =   12
      FontStrikethru  =   0    'False
      FontUnderline   =   0    'False
      ForeColor       =   &H000000FF&
      Height          =   1200
      Left            =   3000
      TabIndex        =   2
      Top             =   1650
      Width           =   1600
   End
   Begin SSCommand Command3D2
      BevelWidth      =   10
      Caption         =   "RESET"
      FontBold        =   -1   'True
      FontItalic      =   0    'False
      FontName        =   "Arial"
      FontSize        =   24
      FontStrikethru  =   0    'False
      FontUnderline   =   0    'False
      ForeColor       =   &H000000FF&
      Height          =   1400
      Left            =   3900
      TabIndex        =   1
      Top             =   4800
      Width           =   2400
   End
   Begin SSCommand Command3D1
      BevelWidth      =   10
      Caption         =   "FT. DOWN"
      FontBold        =   -1   'True
      FontItalic      =   0    'False
      FontName        =   "Arial"
      FontSize        =   12
      FontStrikethru  =   0    'False
      FontUnderline   =   0    'False
      ForeColor       =   &H000000FF&
      Height          =   1200
      Left            =   5640
      TabIndex        =   0
      Top             =   1650
      Width           =   1600
   End
   Begin Label Label5
      BackStyle       =   0   'Transparent
      Caption         =   "THEN PRESS RESET"
```

```
   FontBold          =   -1   'True
   FontItalic        =   0    'False
   FontName          =   "Arial"
   FontSize          =   15.75
   FontStrikethru    =   0    'False
   FontUnderline     =   0    'False
   Height            =   375
   Left              =   3570
   TabIndex          =   7
   Top               =   4200
   Width             =   3495
End
Begin Label Label4
   BackStyle         =   0   'Transparent
   Caption           =   "UP  POSITION"
   FontBold          =   -1   'True
   FontItalic        =   0    'False
   FontName          =   "Arial"
   FontSize          =   24
   FontStrikethru    =   0    'False
   FontUnderline     =   0    'False
   ForeColor         =   &H000000FF&
   Height            =   615
   Left              =   3570
   TabIndex          =   6
   Top               =   3480
   Width             =   3495
End
Begin Label Label3
   BackStyle         =   0   'Transparent
   Caption           =   "STOP MODE!!  MOVE NEEDLE TO"
   FontBold          =   -1   'True
   FontItalic        =   0    'False
   FontName          =   "Arial"
   FontSize          =   15.75
   FontStrikethru    =   0    'False
   FontUnderline     =   0    'False
   Height            =   405
   Left              =   2850
   TabIndex          =   5
   Top               =   3000
   Width             =   31995
End
Begin Image Image1
   Height            =   480
   Left              =   5880
   Picture           =   SFORM2.FRX:0000
   Top               =   600
   Width             =   480
End
Begin Label Label1
   Alignment         =   2   'Center
   BackStyle         =   0   'Transparent
   Caption           =   "TICE ENGINEERING"
   FontBold          =   -1   'True
   FontItalic        =   0    'False
   FontName          =   "Arial"
   FontSize          =   24
   FontStrikethru    =   0    'False
   FontUnderline     =   0    'False
   ForeColor         =   &H00800000&
   Height            =   615
   Index             =   1
   Left              =   2640
   TabIndex          =   4
   Top               =   120
   Width             =   4695
End
Begin Label Label2
   Alignment         =   2   'Center
   BackColor         =   &H00800000&
   BackStyle         =   0   'Transparent
```

```
      Caption          =   "JL-5000"
      FontBold         =   -1   'True
      FontItalic       =   0    'False
      FontName         =   "Arial"
      FontSize         =   24
      FontStrikethru   =   0    'False
      FontUnderline    =   0    'False
      ForeColor        =   &H00800000&
      Height           =   615
      Left             =   3240
      TabIndex         =   3
      Top              =   600
      Width            =   2895
   End
End
Sub Command3D1_Click ()
G_FootDown


End Sub

Sub Command3D2_Click ()
G_Stop
ResetGalia

'Wait till reset is done
    If DMode = True Then
        Unload Me
        Exit Sub
        End If
    Ret$ = "0"
    Dim T2 As Double, T3 As Double
    T2 = Now
    N! = 10
    T3 = T2 + (TimeSerial(0, 0, 1) * N!)

    Do Until Val(Ret$) <> 0 Or T2 > T3
        Ret$ = Space$(255)
        r% = get_from_1000("HomeDone=?", Ret$)
        T2 = Now
    Loop

Unload Me


End Sub

Sub Command3D3_Click ()
G_FootUp


End Sub

Sub Form_KeyDown (KeyCode As Integer, Shift As Integer)
GlobalKeyDown KeyCode, Shift
End Sub

Sub Form_Load ()
SetUpWindow Me, "StopForm2"

If DMode = True Then Exit Sub
Status = command_1000("WT500")
Status = command_1000("CB1")
Status = command_1000("CB16")
Status = command_1000("CB14")


End Sub
```

```
VERSION 2.00
Begin Form JogForm
   BackColor        =   &H00FFFF00&
   BorderStyle      =   1  'Fixed Single
   Caption          =   "Jog Form"
   ClientHeight     =   6690
   ClientLeft       =   210
   ClientTop        =   1305
   ClientWidth      =   9600
   ControlBox       =   0   'False
   Height           =   7095
   KeyPreview       =   -1  'True
   Left             =   150
   MaxButton        =   0   'False
   MinButton        =   0   'False
   ScaleHeight      =   6690
   ScaleWidth       =   9600
   Top              =   960
   Visible          =   0   'False
   Width            =   9720
   Begin SSCommand Command3D2
      BevelWidth       =   10
      Caption          =   " REVERSE-JOG"
      FontBold         =   -1  'True
      FontItalic       =   0   'False
      FontName         =   "Arial"
      FontSize         =   18
      FontStrikethru   =   0   'False
      FontUnderline    =   0   'False
      ForeColor        =   &H000000FF&
      Height           =   1575
      Left             =   3240
      Picture          =   JOG.FRX:0000
      TabIndex         =   4
      Top              =   3480
      Width            =   3015
   End
   Begin SSCommand Command3D3
      BevelWidth       =   10
      Caption          =   "JOG"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   1575
      Left             =   3240
      Picture          =   JOG.FRX:0302
      TabIndex         =   3
      Top              =   1680
      Width            =   3015
   End
   Begin SSCommand Command3D1
      BevelWidth       =   10
      Caption          =   "EXIT"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   1590
      Left             =   3240
      Picture          =   JOG.FRX:0604
      TabIndex         =   2
      Top              =   5280
      Width            =   2985
   End
   Begin Label Label1
```

```
      Alignment        =   2  'Center
      BackStyle        =   0  'Transparent
      Caption          =   "TICE ENGINEERING"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   2280
      TabIndex         =   1
      Top              =   240
      Width            =   4695
   End
   Begin Label Label2
      Alignment        =   2  'Center
      BackStyle        =   0  'Transparent
      Caption          =   "JL-5000"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   3120
      TabIndex         =   0
      Top              =   840
      Width            =   2895
   End
End
Dim FormNumber As Integer, ASCNum As Integer

Sub Command3D1_Click ()
G_Stop
status = G_Command("XQ#JOGJ")
Unload Me
End Sub

Sub Command3D2_Click ()
'1  status = G_Command("XQ#JOGA,3")
'2  status = G_Command("XQ#JOGB,3")
'3  status = G_Command("XQ#JOGC")
'4  status = G_Command("XQ#JOGD")
'5 G_Stop
'  status = G_Command("XQ#JOGE")
'6 G_Stop
'  status = G_Command("XQ#JOGF")
'7 G_Stop
'  status = G_Command("XQ#JOGG")
'8 G_Stop
'  status = G_Command("XQ#JOGH")
'9 G_Stop
'  status = G_Command("XQ#JOGI")

'4r status = G_Command("XQ#JOGBC")  NOTE: Formnumber -1
'5r G_Stop
'   status = G_Command("XQ#JOGBD")
'6r G_Stop
'   status = G_Command("XQ#JOGBE")
'7r G_Stop
'   status = G_Command("XQ#JOGBF")
'8r G_Stop
'   status = G_Command("XQ#JOGBG")
'9r G_Stop  NOTE: Goto last jog form
'   status = G_Command("XQ#JOGBH")

'Get Forward Command
    TMP$ = "XQ#JOGB" & Chr$(ASCNum + FormNumber - 1)
```

```
'Update FormNumber
    FormNumber = FormNumber - 1
    Command3D3.Caption = "Jog-" & Chr$(ASCNum + FormNumber)

'Send Command
    If FormNumber >= 5 Then G_Stop
    status = G_Command(TMP$)

'Reset Buttons then update them
    If FormNumber = 3 Then
        Command3D3.Top = Command3D3.Top + (Command3D3.Height / 2)
        Command3D1.Top = Command3D1.Top - (Command3D1.Height / 2)
        Command3D2.Visible = False
        End If

End Sub

Sub Command3D3_Click ()
'1  status = G_Command("XQ#JOGA,3")
'2  status = G_Command("XQ#JOGB,3")
'3  status = G_Command("XQ#JOGC")
'4  status = G_Command("XQ#JOGD")
'5 G_Stop
'  status = G_Command("XQ#JOGE")
'6 G_Stop
'  status = G_Command("XQ#JOGF")
'7 G_Stop
'  status = G_Command("XQ#JOGG")
'8 G_Stop
'  status = G_Command("XQ#JOGH")
'9 G_Stop
'  status = G_Command("XQ#JOGI")

'Get Forward Command
    TMP$ = "XQ#JOG" & Chr$(ASCNum + FormNumber)
    If FormNumber <= 2 Then TMP$ = TMP$ & ",3"

'Update FormNumber
    FormNumber = FormNumber + 1
    If FormNumber = 1 Then
        Command3D3.Caption = "Jog"
        Else
        If FormNumber <= 9 Then
            Command3D3.Caption = "Jog-" & Chr$(ASCNum + FormNumber)
            End If
        End If

'Send Command
    If FormNumber >= 5 Then G_Stop
    status = G_Command(TMP$)

'Check if current form is next to last form
    If FormNumber > 9 Then
        'goto last form
        JogForm10.Show
        Unload Me
        Exit Sub
        End If


'Reset Buttons then update them
    If FormNumber = 4 Then
        Command3D3.Top = Command3D3.Top - (Command3D3.Height / 2)
        Command3D1.Top = Command3D1.Top + (Command3D1.Height / 2)
        Command3D2.Visible = True
        End If

End Sub

Sub Form_KeyDown (KeyCode As Integer, Shift As Integer)
```

```
GlobalKeyDown KeyCode, Shift
End Sub

Sub Form_Load ()
SetUpWindow Me, "JogForm"

'Center Controls
    CenterControlW Label1, Me.Width
    CenterControlW Label2, Me.Width
    CenterControlW Command3D3, Me.Width
    CenterControlW Command3D2, Me.Width
    CenterControlW Command3D1, Me.Width

'Set JogFormNumber
    FormNumber = 1
    ASCNum = Asc("A") - 1

'Update Buttons
    Command3D2.Visible = False
    Command3D3.Top = Command3D3.Top + (Command3D3.Height / 2)
    Command3D1.Top = Command3D1.Top - (Command3D3.Height / 2)


End Sub
```

```
VERSION 2.00
Begin Form JogForm10
   BackColor        =   &H00FFFF00&
   BorderStyle      =   1  'Fixed Single
   Caption          =   "Jog Form 10"
   ClientHeight     =   6915
   ClientLeft       =   450
   ClientTop        =   1530
   ClientWidth      =   9210
   ControlBox       =   0   'False
   FontBold         =   -1  'True
   FontItalic       =   0   'False
   FontName         =   "MS Sans Serif"
   FontSize         =   24
   FontStrikethru   =   0   'False
   FontUnderline    =   0   'False
   Height           =   7320
   KeyPreview       =   -1  'True
   Left             =   390
   LinkTopic        =   "Form10"
   MaxButton        =   0   'False
   MinButton        =   0   'False
   ScaleHeight      =   6915
   ScaleWidth       =   9210
   Top              =   1185
   Width            =   9330
   Begin SSCommand Command3D2
      BevelWidth       =   10
      Caption          =   "RUN"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   1695
      Left             =   6120
      Picture          =   JOG10.FRX:0000
      TabIndex         =   4
      Top              =   1920
      Width            =   2655
   End
   Begin TextBox Text1
      BackColor        =   &H00FFFF00&
      BorderStyle      =   0  'None
      FontBold         =   -1  'True
      FontItalic       =   0   'False
      FontName         =   "Arial"
      FontSize         =   12.75
      FontStrikethru   =   0   'False
      FontUnderline    =   0   'False
      ForeColor        =   &H000000C0&
      Height           =   735
      Left             =   120
      TabIndex         =   3
      Text             =   "JOG MODE IS OVER PRESS RESET TO EXIT"
      Top              =   3840
      Width            =   5295
   End
   Begin SSCommand Command3D1
      BevelWidth       =   10
      Caption          =   "RESET"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H000000FF&
      Height           =   1695
      Left             =   960
```

```
      Picture          =   JOG10.FRX:0302
      TabIndex         =   0
      Top              =   1920
      Width            =   2655
   End
   Begin Image Image1
      Height           =   480
      Left             =   5280
      Picture          =   JOG10.FRX:0604
      Top              =   600
      Width            =   480
   End
   Begin Label Label1
      Alignment        =   2  'Center
      BackStyle        =   0  'Transparent
      Caption          =   "TICE ENGINEERING"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   1800
      TabIndex         =   2
      Top              =   0
      Width            =   4695
   End
   Begin Label Label2
      Alignment        =   2  'Center
      BackStyle        =   0  'Transparent
      Caption          =   "JL-5000"
      FontBold         =   -1  'True
      FontItalic       =   0   'False
      FontName         =   "Arial"
      FontSize         =   24
      FontStrikethru   =   0   'False
      FontUnderline    =   0   'False
      ForeColor        =   &H00800000&
      Height           =   615
      Left             =   2640
      TabIndex         =   1
      Top              =   480
      Width            =   2535
   End
End
Sub Command3D1_Click ()
G_Stop
status = G_Command("XQ#JOGJ")
Unload Me

End Sub

Sub Command3D2_Click ()
G_Run
status = G_Command("XQ#JOGR,1")
Unload Me
End Sub

Sub Command3D3_Click ()
'status = G_Command("XQ#JOGJ")


End Sub

Sub Form_KeyDown (KeyCode As Integer, Shift As Integer)
GlobalKeyDown KeyCode, Shift
End Sub

Sub Form_Load ()
SetUpWindow Me, "JogForm10"
```

```
End Sub
```

```
VERSION 2.00
Begin Form TechForm
   BackColor        =   &H00FFFF00&
   BorderStyle      =   1  'Fixed Single
   Caption          =   "Technician Screen"
   ClientHeight     =   7620
   ClientLeft       =   585
   ClientTop        =   2130
   ClientWidth      =   10170
   ControlBox       =   0   'False
   Height           =   8025
   KeyPreview       =   -1  'True
   Left             =   525
   LinkTopic        =   "Form1"
   MaxButton        =   0   'False
   MinButton        =   0   'False
   ScaleHeight      =   7620
   ScaleWidth       =   10170
   Tag              =   "3"
   Top              =   1785
   Width            =   10290
   Begin SSCommand Command3D4
      BevelWidth       =   10
      Caption          =   "michal"
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H00FF0000&
      Height           =   705
      Left             =   5760
      TabIndex         =   46
      Top              =   6240
      Width            =   1755
   End
   Begin SSCommand Command3D18
      BevelWidth       =   10
      Caption          =   "Home"
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H00FF0000&
      Height           =   705
      Left             =   7860
      TabIndex         =   45
      Top              =   4560
      Width            =   1725
   End
   Begin SSCommand Command3D17
      BevelWidth       =   10
      Caption          =   "tice.ini"
      FontBold         =   -1  'True
      FontItalic       =   0   'False
      FontName         =   "Arial"
      FontSize         =   12
      FontStrikethru   =   0   'False
      FontUnderline    =   0   'False
      ForeColor        =   &H00FF0000&
      Height           =   705
      Left             =   5760
      TabIndex         =   44
      Top              =   5400
      Width            =   1755
   End
   Begin SSCommand Command3D20
      BevelWidth       =   10
      Caption          =   "Reset"
```

```
   FontBold          =   -1   'True
   FontItalic        =   0    'False
   FontName          =   "MS Sans Serif"
   FontSize          =   12
   FontStrikethru    =   0    'False
   FontUnderline     =   0    'False
   ForeColor         =   &H00FF0000&
   Height            =   705
   Left              =   7860
   TabIndex          =   43
   Top               =   3660
   Width             =   1725
End
Begin SSCommand Command3D16
   BevelWidth        =   10
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   5760
   TabIndex          =   41
   Top               =   4500
   Width             =   1755
End
Begin SSCommand Command3D15
   BevelWidth        =   10
   Caption           =   "Close Comm"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   5760
   TabIndex          =   40
   Top               =   1020
   Width             =   1785
End
Begin SSCommand Command3D14
   BevelWidth        =   10
   Caption           =   "Reset Prog"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   7860
   TabIndex          =   39
   Top               =   5400
   Width             =   1755
End
Begin SSCommand Command3D13
   BevelWidth        =   10
   Caption           =   "Dev. Mode"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   7860
```

```
   TabIndex          =   38
   Top               =   6240
   Width             =   1755
End
Begin SSCommand Command3D12
   BevelWidth        =   10
   Caption           =   "Off-Drive"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   7860
   TabIndex          =   37
   Top               =   2760
   Width             =   1725
End
Begin SSCommand Command3D11
   BevelWidth        =   10
   Caption           =   "Foot Down"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   7830
   TabIndex          =   36
   Top               =   1890
   Width             =   1755
End
Begin SSCommand Command3D10
   BevelWidth        =   10
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   5790
   TabIndex          =   35
   Top               =   2730
   Width             =   1785
End
Begin SSCommand Command3D9
   BevelWidth        =   10
   Caption           =   "Foot Up"
   FontBold          =   -1   'True
   FontItalic        =   0    'False
   FontName          =   "Arial"
   FontSize          =   12
   FontStrikethru    =   0    'False
   FontUnderline     =   0    'False
   ForeColor         =   &H00FF0000&
   Height            =   705
   Left              =   7860
   TabIndex          =   34
   Top               =   1020
   Width             =   1755
End
Begin SSCommand Command3D8
   BevelWidth        =   10
   FontBold          =   -1   'True
   FontItalic        =   0    'False
   FontName          =   "Arial"
```

```
   FontSize          =   12
   FontStrikethru    =   0   'False
   FontUnderline     =   0   'False
   ForeColor         =   &H00FF0000&
   Height            =   705
   Left              =   5790
   TabIndex          =   33
   Top               =   1860
   Width             =   1785
End
Begin SSCommand Command3D7
   BevelWidth        =   10
   Caption           =   "Manual"
   FontBold          =   -1  'True
   FontItalic        =   0   'False
   FontName          =   "Arial"
   FontSize          =   12
   FontStrikethru    =   0   'False
   FontUnderline     =   0   'False
   ForeColor         =   &H00FF0000&
   Height            =   705
   Left              =   7830
   TabIndex          =   32
   Top               =   180
   Width             =   1755
End
Begin SSCommand Command3D6
   BevelWidth        =   10
   Caption           =   "CONTINUE PROGRAM"
   FontBold          =   -1  'True
   FontItalic        =   0   'False
   FontName          =   "Arial"
   FontSize          =   12
   FontStrikethru    =   0   'False
   FontUnderline     =   0   'False
   ForeColor         =   &H000000FF&
   Height            =   765
   Left              =   120
   TabIndex          =   15
   Top               =   6480
   Width             =   5385
End
Begin SSCommand Command3D5
   BevelWidth        =   10
   Caption           =   "Program Manager"
   FontBold          =   -1  'True
   FontItalic        =   0   'False
   FontName          =   "Arial"
   FontSize          =   12
   FontStrikethru    =   0   'False
   FontUnderline     =   0   'False
   ForeColor         =   &H000000FF&
   Height            =   825
   Left              =   120
   TabIndex          =   0
   Top               =   5580
   Width             =   2475
End
Begin SSCommand Command3D2
   BevelWidth        =   10
   Caption           =   "Open Comm"
   FontBold          =   -1  'True
   FontItalic        =   0   'False
   FontName          =   "Arial"
   FontSize          =   12
   FontStrikethru    =   0   'False
   FontUnderline     =   0   'False
   ForeColor         =   &H00FF0000&
   Height            =   705
   Left              =   5760
   TabIndex          =   1
   Top               =   180
```

```
   Width           =   1755
End
Begin PictureBox Picture1
   Height          =   4455
   Left            =   90
   ScaleHeight     =   4425
   ScaleWidth      =   5355
   TabIndex        =   18
   Top             =   1050
   Width           =   5385
   Begin SSCommand Command3D19
      BevelWidth       =   10
      Caption          =   "CL"
      FontBold         =   -1   'True
      FontItalic       =   0    'False
      FontName         =   "Arial"
      FontSize         =   12
      FontStrikethru   =   0    'False
      FontUnderline    =   0    'False
      ForeColor        =   &H00FF0000&
      Height           =   615
      Left             =   4320
      TabIndex         =   42
      Top              =   120
      Width            =   765
   End
   Begin TextBox CommandInput
      BackColor        =   &H00FFFFFF&
      Height           =   375
      Left             =   150
      MaxLength        =   128
      TabIndex         =   31
      Top              =   390
      Width            =   2025
   End
   Begin TextBox ResponseOutput
      BackColor        =   &H00FFFFFF&
      Height           =   1635
      Left             =   120
      MultiLine        =   -1   'True
      ScrollBars       =   2   'Vertical
      TabIndex         =   30
      TabStop          =   0    'False
      Top              =   840
      Width            =   5025
   End
   Begin TextBox ErrX
      Height           =   288
      Left             =   3780
      TabIndex         =   29
      Top              =   2610
      Width            =   1332
   End
   Begin TextBox ErrY
      Height           =   288
      Left             =   3780
      TabIndex         =   28
      Top              =   2970
      Width            =   1332
   End
   Begin TextBox PosX
      Height           =   288
      Left             =   1230
      TabIndex         =   27
      Top              =   2580
      Width            =   1332
   End
   Begin TextBox PosY
      Height           =   288
      Left             =   1230
      TabIndex         =   26
      Top              =   2940
```

```
   Width            =   1332
End
Begin TextBox ErrZ
   Height           =   288
   Left             =   3780
   TabIndex         =   25
   Top              =   3330
   Width            =   1332
End
Begin TextBox PosZ
   Height           =   288
   Left             =   1230
   TabIndex         =   24
   Top              =   3300
   Width            =   1332
End
Begin TextBox PosW
   Height           =   288
   Left             =   1230
   TabIndex         =   23
   Top              =   3660
   Width            =   1332
End
Begin TextBox ErrW
   Height           =   288
   Left             =   3780
   TabIndex         =   22
   Top              =   3690
   Width            =   1332
End
Begin TextBox PosE
   Height           =   288
   Left             =   1230
   TabIndex         =   21
   Top              =   4020
   Width            =   1332
End
Begin TextBox ErrE
   Height           =   288
   Left             =   3780
   TabIndex         =   20
   Top              =   4050
   Width            =   1332
End
Begin SSCommand commandbutton
   BevelWidth       =   10
   Caption          =   "Send Cmd"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H00FF0000&
   Height           =   705
   Left             =   2400
   TabIndex         =   19
   Top              =   60
   Width            =   1815
End
Begin Label Label2
   BackStyle        =   0   'Transparent
   Caption          =   "Response Command:"
   Height           =   225
   Index            =   0
   Left             =   180
   TabIndex         =   2
   Top              =   90
   Width            =   1905
End
Begin Label Label3
   BackStyle        =   0   'Transparent
```

```
   Caption          =   "ErrorX"
   Height           =   255
   Left             =   2940
   TabIndex         =   3
   Top              =   2610
   Width            =   735
End
Begin Label Label4
   BackStyle        =   0  'Transparent
   Caption          =   "ErrorY"
   Height           =   255
   Left             =   2940
   TabIndex         =   4
   Top              =   2970
   Width            =   735
End
Begin Label Label5
   BackStyle        =   0  'Transparent
   Caption          =   "PosX"
   Height           =   255
   Left             =   150
   TabIndex         =   5
   Top              =   2580
   Width            =   615
End
Begin Label Label6
   BackStyle        =   0  'Transparent
   Caption          =   "PosY"
   Height           =   255
   Left             =   150
   TabIndex         =   6
   Top              =   2940
   Width            =   495
End
Begin Label Label7
   BackStyle        =   0  'Transparent
   Caption          =   "ErrorZ"
   Height           =   255
   Left             =   2940
   TabIndex         =   7
   Top              =   3330
   Width            =   735
End
Begin Label Label8
   BackStyle        =   0  'Transparent
   Caption          =   "ErrorW"
   Height           =   255
   Left             =   2940
   TabIndex         =   8
   Top              =   3690
   Width            =   735
End
Begin Label Label9
   BackStyle        =   0  'Transparent
   Caption          =   "ErrorE"
   Height           =   255
   Left             =   2940
   TabIndex         =   9
   Top              =   4050
   Width            =   735
End
Begin Label Label10
   BackStyle        =   0  'Transparent
   Caption          =   "Bobbin A"
   Height           =   255
   Left             =   150
   TabIndex         =   10
   Top              =   3300
   Width            =   975
End
Begin Label Label11
   BackStyle        =   0  'Transparent
```

```
      Caption          =   "Needle:"
      Height           =   255
      Left             =   150
      TabIndex         =   11
      Top              =   3660
      Width            =   975
   End
   Begin Label Label12
      BackStyle        =   0   'Transparent
      Caption          =   "Bobbin B:"
      Height           =   255
      Left             =   150
      TabIndex         =   12
      Top              =   4020
      Width            =   975
   End
End
Begin SSCommand Command3D3
   BevelWidth       =   10
   Caption          =   "E&xit Program"
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H000000FF&
   Height           =   825
   Left             =   2700
   TabIndex         =   14
   Top              =   5580
   Width            =   2805
End
Begin SSCommand Command3D1
   BevelWidth       =   10
   FontBold         =   -1   'True
   FontItalic       =   0    'False
   FontName         =   "Arial"
   FontSize         =   12
   FontStrikethru   =   0    'False
   FontUnderline    =   0    'False
   ForeColor        =   &H00FF0000&
   Height           =   705
   Left             =   5760
   TabIndex         =   13
   Top              =   3600
   Width            =   1785
End
Begin Line Line1
   BorderWidth      =   2
   X1               =   5640
   X2               =   5640
   Y1               =   240
   Y2               =   7230
End
Begin Label Label2
   Alignment        =   2   'Center
   BackStyle        =   0   'Transparent
   Caption          =   "JL-5000 Technician Screen"
   FontBold         =   -1   'True
   FontItalic       =   0    'False
   FontName         =   "Arial"
   FontSize         =   15
   FontStrikethru   =   0    'False
   FontUnderline    =   0    'False
   ForeColor        =   &H00800000&
   Height           =   405
   Index            =   2
   Left             =   0
   TabIndex         =   17
   Top              =   600
   Width            =   5385
```

```
    End
    Begin Label Label1
        Alignment       =   2   'Center
        BackStyle       =   0   'Transparent
        Caption         =   "TICE ENGINEERING"
        FontBold        =   -1  'True
        FontItalic      =   0   'False
        FontName        =   "Arial"
        FontSize        =   24
        FontStrikethru  =   0   'False
        FontUnderline   =   0   'False
        ForeColor       =   &H00800000&
        Height          =   615
        Index           =   1
        Left            =   0
        TabIndex        =   16
        Top             =   120
        Width           =   5385
    End
End

Sub Command3D11_Click ()
G_FootDown
End Sub

Sub Command3D12_Click ()
G_OffDrive

End Sub

Sub Command3D13_Click ()
If DMode = True Then
    DMode = False
    TechMode = False
    HideMouse
    MsgBox "Developer Mode is off.", 0, "Dev. Mode"
    Else
    DMode = True
    TechMode = True
    ShowMouse
    MsgBox "Developer Mode is on.", 0, "Dev. Mode"
    End If
End Sub

Sub Command3D14_Click ()
ResetProgram Me
End Sub

Sub Command3D15_Click ()
CloseCommWithVBX
End Sub

Sub Command3D17_Click ()
On Error Resume Next

r% = Shell("notepad.exe tice.ini", 1)

End Sub

Sub Command3D18_Click ()
G_Home
End Sub

Sub Command3D19_Click ()
ResponseOutput = ""
End Sub

Sub Command3D2_Click ()
OpenCommWithVBX

End Sub
```

```
Sub Command3D20_Click ()
ResetGalia
End Sub

Sub Command3D3_Click ()
quit
End Sub

Sub Command3D4_Click ()
On Error Resume Next

downloadstitch

r% = Shell("notepad.exe michal.dl", 1)

sleep 3
Kill Path$ & "Michal.dl"

End Sub

Sub Command3D5_Click ()
On Error Resume Next

success% = Shell("progman.exe", 1)

End Sub

Sub Command3D6_Click ()
Unload Me
End Sub

Sub Command3D7_Click ()
Manual.Show
Unload Me
End Sub

Sub Command3D9_Click ()
G_FootUp
End Sub

Sub CommandButton_Click ()
    If CommandInput.Text <> "" Then
        Screen.MousePointer = 11
        GForm.DMCShell1.DMCCommand = CommandInput.Text
        ResponseOutput.Text = ResponseOutput.Text + CommandInput.Text + Chr$(13) +
Chr$(10) + GForm.DMCShell1.DMCResponse
        ResponseOutput.SelStart = Len(ResponseOutput.Text)
        ResponseOutput.SelLength = 0
        CommandInput.Text = ""
        CommandInput.SetFocus
        Screen.MousePointer = 0
    End If
End Sub

Sub CommandInput_KeyPress (Keyascii As Integer)
On Error Resume Next

If Keyascii = 13 Then
    Keyascii = 0
    CommandButton_Click
    Exit Sub
    End If

Keyascii = Asc(UCase$(Chr$(Keyascii)))
End Sub

Sub Form_Activate ()
SetUpWindow Me, "TechForm"
End Sub

Sub Form_KeyDown (KeyCode As Integer, Shift As Integer)
GlobalKeyDown KeyCode, Shift
```

```
End Sub

Sub Form_Load ()
SetUpWindow Me, "TechForm"

End Sub

Sub ResponseOutput_DblClick ()
    ResponseOutput.Text = ""
End Sub
```

```
VERSION 2.00
Begin Form TShot
   BackColor        =   &H00FFFF00&
   BorderStyle      =   1  'Fixed Single
   Caption          =   "Troubleshooting"
   ClientHeight     =   4965
   ClientLeft       =   465
   ClientTop        =   2415
   ClientWidth      =   9450
   ControlBox       =   0    'False
   Height           =   5370
   KeyPreview       =   -1   'True
   Left             =   405
   LinkTopic        =   "Form6"
   MaxButton        =   0    'False
   MinButton        =   0    'False
   ScaleHeight      =   4965
   ScaleWidth       =   9450
   Top              =   2070
   Width            =   9570
   Begin SSCommand Command3D2
      BevelWidth       =   10
      Caption          =   "Setup Screen"
      FontBold         =   -1   'True
      FontItalic       =   0    'False
      FontName         =   "MS Sans Serif"
      FontSize         =   13.5
      FontStrikethru   =   0    'False
      FontUnderline    =   0    'False
      ForeColor        =   &H000000FF&
      Height           =   735
      Left             =   3900
      TabIndex         =   6
      Top              =   120
      Width            =   2625
   End
   Begin CommandButton Command1
      Caption          =   "Do Not Delete Me"
      Height           =   525
      Left             =   6360
      TabIndex         =   4
      Top              =   1560
      Width            =   2535
   End
   Begin SSCommand Command3D1
      BevelWidth       =   10
      Caption          =   "Reset Program"
      FontBold         =   -1   'True
      FontItalic       =   0    'False
      FontName         =   "MS Sans Serif"
      FontSize         =   13.5
      FontStrikethru   =   0    'False
      FontUnderline    =   0    'False
      ForeColor        =   &H000000FF&
      Height           =   735
      Left             =   6600
      TabIndex         =   2
      Top              =   120
      Width            =   2625
   End
   Begin TextBox Text1
      FontBold         =   -1   'True
      FontItalic       =   0    'False
      FontName         =   "MS Sans Serif"
      FontSize         =   12
      FontStrikethru   =   0    'False
      FontUnderline    =   0    'False
      Height           =   3615
      Left             =   150
      MultiLine        =   -1   'True
      ScrollBars       =   2  'Vertical
      TabIndex         =   0
```

```
      Top              =   1000
      Width            =   5775
   End
   Begin Label Label3
      Caption          =   "Note: This Form Loads the file ""TSHOT.TXT"" from the
Applications Directory."
      Height           =   945
      Left             =   6450
      TabIndex         =   5
      Top              =   2130
      Visible          =   0   'False
      Width            =   2565
   End
   Begin Label Label2
      BackStyle        =   0  'Transparent
      Caption          =   "JL-5000"
      FontBold         =   -1  'True
      FontItalic       =   0   'False
      FontName         =   "MS Sans Serif"
      FontSize         =   24
      FontStrikethru   =   0   'False
      FontUnderline    =   0   'False
      ForeColor        =   &H000000FF&
      Height           =   495
      Left             =   150
      TabIndex         =   3
      Top              =   30
      Width            =   3825
   End
   Begin Label Label1
      BackStyle        =   0  'Transparent
      Caption          =   "TROUBLE SHOOTING"
      FontBold         =   -1  'True
      FontItalic       =   0   'False
      FontName         =   "MS Sans Serif"
      FontSize         =   13.5
      FontStrikethru   =   0   'False
      FontUnderline    =   0   'False
      ForeColor        =   &H000000FF&
      Height           =   405
      Left             =   150
      TabIndex         =   1
      Top              =   510
      Width            =   3825
   End
End
Sub Command3D1_Click ()
'Change Defualts
    'ResetToFactoryDefaults Me
    ResetProgram Me
End Sub

Sub Command3D2_Click ()
'Check if Password is null and take action
    Password.Show
    Unload Me

End Sub

Sub Form_KeyDown (KeyCode As Integer, Shift As Integer)
GlobalKeyDown KeyCode, Shift
End Sub

Sub Form_Load ()
SetUpWindow Me, "TShot"

'Load Help File
    FF% = FreeFile
    Open path$ & "TShot.txt" For Input As FF%
        Do Until EOF(FF%)
        Line Input #FF%, a$
        B$ = B$ & a$ & Chr$(13) & Chr$(10)
```

```
        Loop
    Close FF%

'Load Help File Into TextBox
    Text1.Top = 1000
    Text1.Height = Me.Height - 1250
    Text1.Left = 100
    Text1.Width = Me.Width - 400
    Text1 = B$

'Place Factory Default Button
Command3D1.Left = Text1.Left + Text1.Width - Command3D1.Width
Command1.Left = Me.Width * 2

End Sub

Sub Text1_GotFocus ()
Command1.SetFocus
End Sub
```

```
VERSION 2.00
Begin Form DisplayForm
   BackColor        =   &H00FFFFFF&
   BorderStyle      =   3  'Fixed Double
   Caption          =   "Display"
   ClientHeight     =   2970
   ClientLeft       =   2370
   ClientTop        =   2040
   ClientWidth      =   6945
   ControlBox       =   0   'False
   FontBold         =   -1  'True
   FontItalic       =   0   'False
   FontName         =   "MS Sans Serif"
   FontSize         =   12
   FontStrikethru   =   0   'False
   FontUnderline    =   0   'False
   Height           =   3375
   Left             =   2310
   LinkTopic        =   "Form6"
   MaxButton        =   0   'False
   MinButton        =   0   'False
   ScaleHeight      =   2970
   ScaleWidth       =   6945
   Top              =   1695
   Width            =   7065
   Begin Label Message
      Alignment        =   2  'Center
      BackStyle        =   0  'Transparent
      Caption          =   "Message"
      FontBold         =   -1  'True
      FontItalic       =   0   'False
      FontName         =   "MS Sans Serif"
      FontSize         =   12
      FontStrikethru   =   0   'False
      FontUnderline    =   0   'False
      ForeColor        =   &H00FF0000&
      Height           =   2295
      Left             =   180
      TabIndex         =   0
      Top              =   270
      Width            =   6615
   End
End
```

```
VERSION 2.00
Begin Form GForm
   Caption          =   "Global Form (GForm)"
   ClientHeight     =   1425
   ClientLeft       =   8175
   ClientTop        =   7305
   ClientWidth      =   2550
   Height           =   1830
   Left             =   8115
   LinkTopic        =   "Form2"
   ScaleHeight      =   1425
   ScaleWidth       =   2550
   Top              =   6960
   Width            =   2670
   Begin FXCOMM FX
      Left             =   900
      Retries          =   6
      Top              =   300
   End
   Begin DMCShell DMCShell1
      DMCAddress       =   1000
      DMCInterrupt     =   0  ' 0 - No Interrupt
      DMCPollInterval  =   100
      DMCTimeout       =   0.5
      Height           =   420
      Left             =   180
      Top              =   120
      Width            =   420
   End
End
Sub DMCShell1_DMCError (ErrorNumber As Integer, ErrorMessage As String)

MsgBox ErrorMessage, 0, "G_Error"

End Sub

Sub DMCShell1_DMCInterrogate (Index As Integer, Response As String)
    VBX_DMCInterrogate Index, Response
End Sub

Sub DMCShell1_DMCInterrupt (StatusByte As Integer)
MsgBox "Interrupt Message #" & Format$(StatusByte), 0, "G_Interrupt"
End Sub

Sub DMCShell1_DMCResponse (Response As String)
    VBX_DisplayMessage Response
End Sub

Sub Form_Unload (Cancel As Integer)
CloseCommWithVBX
End Sub
```

Tice.ini

```
[Info]
AdminPassword=8901
User1=0
User2=0
User3=0
Password=0123

[Fac]
FacNeedleHome=-300
FacX=1225
FacY=300
FacFrontBobbin=200
FacRearBobbin=1650
FacKnife=900
XYW_Ratio=2200

[Options]
Presets=6
FullCycle=1
SewingCycle=0
EachCycle=0
AverageCycle=1

[JL5000]
SewSpeed=100035
BeltLoopSpeed=500
BeltLoopLength=98
RearBobbin=1610
FrontBobbin=1605
Y=875
X=500
StitchScaleX=100
StitchScaleY=100
Presets=6
XY_Limit=90
ZE_Limit=100
W_Limit=100
NeedleHome=1230
FacNeedleHome=-1180
FacX=505
FacY=625
FacFrontBobbin=55
FacRearBobbin=-1330
Knife=556
NeedleHomeJog=-1
Stitch=C:\PROGRA~2\JL5000\00000001.sti
Start_1st=0
AC_1st=890000
Speed_1st=97875
AC_2nd=350000
Start_3rd=0
Speed_3rd=100575
DC_3rd=900000
DC_2nd=0
KnifeBack=556
Options=6
```

01.tv

```
[JL5000]
SewSpeed=124875
BeltLoopSpeed=414
BeltLoopLength=118
RearBobbin=1680
FrontBobbin=1605
Y=850
X=500
StitchScaleX=80
StitchScaleY=94
Presets=6
XY_Limit=90
ZE_Limit=100
W_Limit=100
NeedleHome=1230
FacNeedleHome=-1180
FacX=505
FacY=625
FacFrontBobbin=55
FacRearBobbin=-1330
Knife=556
NeedleHomeJog=-1
Stitch=C:\JL5000\00000010.sti
Start_1st=0
AC_1st=50000
Speed_1st=50625
AC_2nd=0
Start_3rd=0
Speed_3rd=100575
DC_3rd=900000
DC_2nd=0
KnifeBack=556
```

00000001.fac

```
29
100,100
1, 2
5, 2
9, 2
13, 2
9, 3
5, 4
1, 5
5, 5
9, 5
13, 5
14, 7
14, 0
13, 7
12, 0
11, 7
10, 0
9, 7
8, 0
7, 7
6, 0
5, 7
4, 0
3, 7
2, 0
1, 7
0, 0
0, 7
1, 0
1, 2
```

00000001.sti

```
29
99,76
1, 2
5, 2
9, 2
13, 2
9, 3
5, 4
1, 5
5, 5
9, 5
13, 5
14, 7
14, 0
13, 7
12, 0
11, 7
10, 0
9, 7
8, 0
7, 7
6, 0
5, 7
4, 0
3, 7
2, 0
1, 7
0, 0
0, 7
1, 0
1, 2
```

We claim:

1. An apparatus for forming a pattern of continuous stitches in a material in which the movements of a plurality of operating parts are coordinated to form the pattern of stitches, said apparatus comprising:

an operating head comprising a plurality of operating parts, each part being movable through a range of positions to form continuous stitches in a material;

closed loop drive systems connected to each of said operating parts for driving said operating parts through their ranges of positions; and monitors for producing monitor signals substantially continuously corresponding to the positions of said operating parts;

a data acquisition and control system connected to each of said closed loop drive systems for receiving said monitor signals and for electronically gearing the movements of the operating parts so that the operating parts move in concert with each other to form the pattern of continuous stitches;

said data acquisition and control system including at least one motion controller having multiple control axes for receiving monitor signals from said monitors and for responding to said monitor signals to produce motion commands for each closed loop drive system; and a user interface connected to said data acquisition and control system for inputting commands to control the operation of the apparatus.

2. The apparatus of claim 1, wherein said data acquisition and control system electronically adjusts the position of an operating part relative to the position of another operating part in response to commands from the user interface.

3. The apparatus of claim 1, wherein said data acquisition and control system includes electronic memory for storing at least one stitch pattern.

4. The apparatus of claim 1, wherein said data acquisition and control system generates a stitch pattern in response to commands from the user interface.

5. The apparatus of claim 1, wherein said data acquisition and control system is further operable to electronically gear the movement of the operating parts during formation of a stitch pattern in accordance with a predetermined speed and acceleration profile.

6. The apparatus of claim 5, wherein said data acquisition and control system is further operable to produce a speed and acceleration profile in response to commands from the user interface.

7. The apparatus of claim 1, wherein the range of positions of said operating parts include positions for forming one or more backtack stitches at the end of a stitch pattern.

8. The apparatus of claim 1, wherein said data acquisition and control system is further operable to define values for a plurality of sewing parameters for optimizing the operation of the apparatus for particular sewing applications in response to commands from the user interface, and to store the defined values as a group for later retrieval.

9. The apparatus of claim 1, wherein said plurality of operating parts include at least a needle and a bobbin.

10. The apparatus of claim 1, wherein each of said closed loop drive systems comprises:

a servo motor connected to an operating part for driving said operating part in a sewing motion;

a servo drive interconnected with said servo motor and said motion controller for receiving motion commands from said controller and supplying power to said servo motor in response to said motion command.

11. The apparatus of claim 10, wherein each of said monitors comprises an encoder attached to a servo motor.

12. The apparatus of claim 1, further comprising a plurality of operating heads connected to and controlled by said data acquisition and control system.

13. The apparatus of claim 12, wherein said operating heads are electronically geared to each other by said data acquisition and control means so that all operating heads operate in substantial synchronicity.

14. A method for forming a pattern of continuous stitches in a material in which the movements of a plurality of operating parts are coordinated to form the pattern of stitches, comprising the steps of:

producing monitor signals corresponding to the positions of each of the operating parts;

monitoring the monitor signals to determine the positions of each of the operating parts;

directing the monitor signals to a controller having multiple control axes;

generating motion commands in the controller in accordance with a stitch pattern for coordinated movement of said plurality of operating parts; and directing said motion commands to mechanisms associated with each of said operating parts so that said operating parts move in concert with each other to form the pattern of continuous stitches.

15. The method of claim 14, further comprising the step of electronically adjusting the position of an operating part relative to the position of another operating part.

16. The method of claim 14, further comprising the step of generating motion commands in accordance with a predetermined speed and acceleration profile.

17. The method of claim 14, further comprising the step of identifying an alarm condition when the position of an operating part meets defined alarm criteria.

18. The method of claim 17, further comprising the step of electronically adjusting the alarm criteria.

19. The method of claim 17, further comprising the step of taking corrective action when an alarm condition is identified.

20. The method of claim 19, wherein the step of taking corrective action comprises terminating movement of the operating parts.

21. The method of claim 19, wherein the step of taking corrective action comprises re-executing the movement of at least one of the operating parts.

22. The method of claim 14, further comprising the steps of:

defining values for a plurality of operating parameters for optimizing movement of operating parts; and storing the defined values for later retrieval.

23. The method of claim 14, further comprising the step of backtacking a continuous stitching pattern at or near the end of said stitching pattern.

24. The method of claim 14, further comprising the steps of:

defining a stitch pattern; and inputting the defined stitch pattern to the controller, said controller generating motion commands in accordance with the defined stitch pattern.

25. An apparatus for forming holes in a textile sewing material in which the movement of a plurality of operating parts is coordinated to form stitches adjacent each of the holes, said apparatus comprising:

a plurality of operating parts, each part being movable through a range of positions to form holes in a textile sewing material and sew stitches adjacent each hole;

a plurality of closed loop drive systems connected to said operating parts for driving said operating parts;

monitors for producing monitor signals substantially continuously corresponding to the positions of said operating parts;

a data acquisition and control system:

connected to each of said closed loop drive systems;

for receiving said monitor signals; and for electronically gearing movement of multiple ones of the operating parts so that the operating parts move in concert with each other;

said data acquisition and control system for receiving monitor signals and for responding to said monitor signals to produce motion commands for multiple ones of said closed loop drive systems; and a user interface connected to said data acquisition and control system for inputting commands to control the operation of the apparatus.

26. A method of substantially simultaneously forming a plurality of bound holes in a material, comprising the steps of:

creating relative movement in a controlled fashion between the material and a plurality of sewing heads, each of which includes two or more cooperative operating parts;

monitoring the position of the operating parts in each head;

substantially continuously producing monitor signals corresponding to the positions of each of the operating parts;

directing the monitor signals to a controller;

generating commands in the controller for coordinated movement of said plurality of operating parts; and directing said commands to mechanisms associated with each of said operating parts in each head to control the movement of the operating parts in concert with each other to form the bound holes.

27. A method for simultaneously forming a plurality of button holes and thereafter attaching a plurality of corresponding buttons on a sewing material, comprising the steps of:

creating relative movement in a controlled fashion between the sewing material and a plurality of sewing heads, each of which includes two or more cooperative operating parts;

monitoring the position of the operating parts in each head;

substantially continuously producing monitor signals indicative of the positions of each of the operating parts in each head;

directing the monitor signals to a controller for receiving monitor signals from a plurality of monitors;

generating commands in the controller for coordinated movement of said plurality of operating parts; and directing said commands to mechanisms associated with each of said operating parts in each head to control the movement of the operating parts in concert with each other to allow substantially simultaneous cutting and sewing of a plurality of button holes, and thereafter the feeding and sewing of corresponding buttons for each button hole.

28. A method for detecting faults in a sewing operation, comprising the steps of:

acquiring data corresponding to the positions of two or more sewing parts which are moving in concert to form continuous stitches;

monitoring the acquired data to determine the position of said sewing parts relative to a reference position for each part; and identifying an alarm condition when the position of a sewing part is not within a predetermined tolerance of the reference position of the sewing part.

29. The method of claim 28, further comprising the step of taking corrective action when an alarm condition is identified.

30. The method of claim 29, wherein the step of taking corrective action comprises terminating the operation of the sewing machine.

31. The method of claim 29, wherein the step of taking corrective action comprises re-executing the operation of at least the out-of-tolerance sewing part.

32. The method of claim 28, further comprising the step of electronically adjusting the predetermined tolerance.

33. A method for detecting faults in a sewing operation, comprising the steps of:

acquiring data corresponding to the positions of two or more sewing parts which are moving in concert to form continuous stitches;

monitoring the acquired data to determine the position of said sewing parts relative to a predetermined position for each part; and identifying an alarm condition when a sewing part does not arrive at its predetermined position at a predetermined time.

34. The method of claim 33, further comprising the step of taking corrective action when an alarm condition is identified.

35. The method of claim 34, wherein the step of taking corrective action comprises terminating the operation of the sewing machine.

36. The method of claim 34, wherein the step of taking corrective action comprises re-executing the operation of at least the out-of-tolerance sewing part.

37. The method of claim 33, further comprising the step of adjusting the predetermined time.

38. A method for detecting a skipped stitch during operation of a sewing machine, comprising the steps of:

monitoring the positions of two or more sewing parts which are moving in concert to form continuous stitches;

comparing the monitored position of one sewing part to the monitored position of another sewing part to determine a positional difference between the parts; and detecting the presence of a skipped stitch when the positional difference meets a predetermined threshold.

39. The method of claim 38, further comprising the step of taking corrective action when a skipped stitch is detected.

40. The method of claim 39, wherein the step of taking corrective action comprises terminating the operation of the sewing machine.

41. The method of claim 39, wherein the step of taking corrective action comprises re-executing the operation of at least one of the compared sewing parts.

42. The method of claim 38, further comprising the step of electronically adjusting the predetermined threshold.

43. An apparatus for forming a pattern of continuous stitches in a material in which the movements of a plurality of operating parts are coordinated to form the pattern of stitches, said apparatus comprising:

a plurality of operating parts, each part being movable through a range of positions to form continuous stitches in a material;

a plurality of closed loop drive systems connected to said operating parts for driving said operating parts through their ranges of positions;

monitors for producing monitor signals substantially continuously corresponding to the positions of said operating parts;

said operating parts, drive systems, and monitors comprising a first operating head;

a data acquisition and control system;

connected to each of said closed loop drive systems;

for receiving said monitor signals; and for electronically gearing the movements of the operating parts so that the operating parts move in concert with each other to form the pattern of continuous stitches; and a user interface connected to said data acquisition and control system for inputting commands to control the operation of the apparatus;

wherein the timing of the operating parts, one relative to the other, is electronically adjustable in response to commands received from the user interface.

44. A method for detecting a skipped stitch during operation of a sewing machine having a needle and a sewing part, the sewing part operating in a sewing cycle in concert with the needle to act upon a thread carried by the needle and form a stitch, comprising the steps of:

monitoring the position of the sewing part during the sewing cycle;

determining the position of the sewing part at a selected position in the sewing cycle which is defined as the sampled position;

comparing the sampled position of the sewing part to a reference position to determine a positional difference between the sample position and the reference position; and detecting the presence of a skipped stitch when the positional difference meets a threshold.

45. A multi-head sewing apparatus for performing multiple sewing operations, the apparatus comprising:

a first sewing head having a plurality of sewing parts, each part being movable through a range of positions to form continuous stitches in a material;

closed loop drive systems connected to each of said sewing parts for driving said sewing parts through their ranges of positions; and monitors for producing monitor signals substantially continuously corresponding to the positions of said sewing parts;

a second sewing head having a plurality of sewing parts, each part being movable through a range of positions to form continuous stitches in a material;

closed loop drive systems connected to each of said sewing parts for driving said sewing parts through their ranges of positions; and monitors for producing monitor signals substantially continuously corresponding to the positions of said sewing parts;

a data acquisition and control system:

connected to each closed loop drive system of each of said first and second sewing heads;

for receiving monitor signals from each of said first and second sewing heads; and for electronically gearing movements of multiple ones of the sewing parts for each sewing head so that said sewing parts move in concert with each other; and a user interface connected to said data acquisition and control system for inputting commands to control the operation of the apparatus.

46. The apparatus of claim 45, wherein said data acquisition and control system further comprises means for electronically gearing the movements of sewing parts in one head with the movements of sewing parts in another head.

* * * * *